US010948250B2

(12) United States Patent
Sharkov et al.

(10) Patent No.: US 10,948,250 B2
(45) Date of Patent: Mar. 16, 2021

(54) CASELESS WEAPON (VARIANTS)

(71) Applicants: Oleksii Oleksandrovych Sharkov, m. Kyiv (UA); Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA)

(72) Inventors: Oleksii Oleksandrovych Sharkov, m. Kyiv (UA); Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA)

( * ) Notice: Subject to any disclaimer, the term of this patent is extended or adjusted under 35 U.S.C. 154(b) by 0 days.

(21) Appl. No.: 16/648,125

(22) PCT Filed: Sep. 28, 2017

(86) PCT No.: PCT/UA2017/000093
§ 371 (c)(1),
(2) Date: Mar. 17, 2020

(87) PCT Pub. No.: WO2019/054975
PCT Pub. Date: Mar. 21, 2019

(65) Prior Publication Data

US 2020/0232731 A1 Jul. 23, 2020

(30) Foreign Application Priority Data

Sep. 18, 2017 (UA) ..... 201709150

(51) Int. Cl.
*F41A 3/66* (2006.01)
*F41A 15/16* (2006.01)
(Continued)

(52) U.S. Cl.
CPC ..... *F41A 3/66* (2013.01); *F41A 15/16* (2013.01); *F41A 17/46* (2013.01); *F41A 19/16* (2013.01);
(Continued)

(58) Field of Classification Search
CPC ..... F41A 3/66; F41A 15/16; F41A 17/46
(Continued)

(56) References Cited

U.S. PATENT DOCUMENTS 3,474,560 A * 10/1969 Ramsay ..... F41A 15/20 42/17
3,722,123 A * 3/1973 Parisi ..... F41A 3/74 42/16
(Continued)

FOREIGN PATENT DOCUMENTS

RU 2122170 C1 11/1998
RU 2 499 214 C2 7/2012
RU 2 478 177 C2 3/2013

*Primary Examiner* — Samir Abdosh
(74) *Attorney, Agent, or Firm* — Westerman, Hattori, Daniels & Adrian, LLP

(57) ABSTRACT

The disclosure relates to firearms, and more particularly to a caseless weapon for magazine, semi-automatic and automatic shot. The disclosed weapon includes: a removable adjustable front sight, a removable adjustable dioptrical sight, a forward grip, a gunstock, a magazine, a receiver cover, a cocking lever, a bolt carrier, a rod, a percussion piston, a shutter housing, a safety catch of the firing percussion, a balancing gear, a barrel, a barrel latch, a multifunctional cartridge, a conical bushing of receiver, an extractor, a receiver, a big front nut, a front swivel, a magazine latch, a magazine latch pusher, a safety latch, a safety catch,
(Continued)

a trigger bar, a bracket of the percussion mechanism, a cocking piece, a multifunction latch lever, a stop of the multifunction latch, a lock pin splint, a latch of the ramrod, a spring of the latch of ramrod, a ramrod, a caseless ammunition.

26 Claims, 127 Drawing Sheets

(51) Int. Cl.

| | |
|---|---|
| ***F41A 17/46*** | (2006.01) |
| ***F41A 19/16*** | (2006.01) |
| ***F41C 7/00*** | (2006.01) |
| ***F41C 23/14*** | (2006.01) |
| ***F41G 1/30*** | (2006.01) |
| ***F42B 5/18*** | (2006.01) |

(52) U.S. Cl.
CPC ..... *F41C 7/00* (2013.01); *F41C 23/14* (2013.01); *F41G 1/30* (2013.01); *F42B 5/18* (2013.01)

(58) Field of Classification Search
USPC ..... 89/128; 102/431
See application file for complete search history.

(56) References Cited

U.S. PATENT DOCUMENTS

| | | | | |
|---|---|---|---|---|
| 4,123,963 | A * | 11/1978 | Junker | F41A 3/26 89/152 |
| 8,863,421 | B1 * | 10/2014 | Farage | F41A 19/58 42/6 |
| 2020/0232731 | A1 * | 7/2020 | Sharkov | F41A 11/00 |
| 2020/0292282 | A1 * | 9/2020 | Makarov | F41A 15/16 |

* cited by examiner 3-3

CASELESS WEAPON (VARIANTS)

Claimed invention relates to firearms, and more particularly to caseless weapons for magazine, semi-automatic, and automatic shot, and can be used to create the designs for shooting with caseless ammunition.

Some functions of the claimed invention were used in previous firearms designs, more particularly, for example, weapons of Garand and Tokarev with a piston striker and a movable capsule.

With the advent of modern materials and propellants, it became possible to increase the energy of a shot, while the weight and dimensions of the weapon are reducing. In traditional designs, the weapon is divided into the next types: a pistol, a machine gun, an assault rifle, a light machine gun, an average machine gun, each with its ammunition, and each type of weapon has its optimal principles of automation, design of assemblies and mechanisms. Further reduction of the size and weight, an increase of the weapon power, the acquisition of new properties are possible only with the use of a new designs.

There are different designs of caseless ammunition, in which a bullet disposed inside the headspace of the propellant charge developed in Austria (1983-1994), France (1980-1986), Germany (1974-1987), the USA (1969-1975). The disadvantage of ammunition when a bullet is inside the headspace is the complicated designs of the weapons.

In the weapon complex G-11 Germany (watch materials on the website: https://ru.wikipedia.org/wiki/HK_G11), or in the LSAT the USA (watch materials on the website: https://ru.wikipedia.org/wiki/LSAT_%28%D0%BF%D1%83%D0%BB%D0%B5%D0%BC%D1%91% D1%82%29), which are known in the prior art, there is also a possibility of self-ignition of ammunition in the weapon chamber and magazines during the long shooting, wherein said weapons have next disadvantages: the insecurity of ammunition during transportation, loss of its features during long storage.

Designs where the propellant charge disposed in the bullet, were developed in the USA for the weapon Volkanik 1860, Gyroyjet 1965, their disadvantages are the low power of the ammunition, which is no more than 250 J, and the lack of precision of the weapon. In the claimed invention, the propellant disposed within the ammunition. Due to this and to the embodiment features of the weapon and of the ammunition ensured a high power of ammunition up to 3500 J. This allows to develop the necessary energy for specific types of weapons and allows to have different types of weapons on one type of ammunition and one embodiment.

From the prior art, the automatic caseless weapon system is known (Patent RU No 2122170, IPC F41A 9/28, F41A 5/00, F41C 3/14, publ. 20 Nov. 1998), which comprises: a barrel, a bolt, a lock frame with a gas piston, recoil mechanism and a receiver. The specific feature of the system is the provision of a cylinder with several chambers and blades on its surface and an exhaust tube of nonburning particles of the ammunition ejection charge. A barrel chamber disposed of in the upper position having a cartridge chamber function. The exhaust tube of non-burnt particles of ammunition ejection charge is positioned in the front part of the receiver for alignment with the front part of the cylinder chamber at a feed of ammunition to this chamber. The rod of the gas piston having a function of the axis of the cylinder. In this invention, for eliminating the danger of self-ignition of ammunition in the chamber, it is essential to use from four to six bullet chambers, one of which participates in the shot, while others cool, which leads to a sharp weighting and growth of the transverse dimensions of the caseless weapon, wherein the blades on the surface of the bullet chamber at a rate of up to 500 shots per minute will rotate at a speed of 80-90 rpm, which is not enough for intensive cooling (intensive cooling from 300 rpm and above), while the size of the weapon will increase even more. Also, the disadvantages of this invention are:

- high friction in the units, which, at shooting can cause incomplete movement of the drum by the front part of the upper chamber to the obturating protrusion of the barrel, and incomplete movement of the obturating protrusion of the bolt to the rear part of the upper chamber;
- the complexity of the embodiment, which consists of a large number of components of complex configuration.

From the prior art, weapon system with caseless ammunition is known (Patent RU No 2499214, IPC F41A 9/37, F41A 9/46, publ. 10 Jul. 2012), which comprises: a barrel having separate chambers for propellants and magazine having separate chambers for powder charges. Said magazines composed of separate chambers for propellants and magazine composed of separate chambers for powder charges are arranged coaxially to an axis of the barrel channel with the possibillity to displace. The disadvantages of this invention are:

- at the shot, the weapon system has three joints: The joint between the barrel and the front end of the chamber (for propellants); joint between the rear end of the chamber (for propellants) and the front end of the chamber (for powder charges); joint between the front end of the chamber (for powder charges) and percussion device, in which a breakthrough powder gases can form. This reduces the power of the shot and the reliability of the system. Extremely low survivability of the joints with the obturation of powder gases is known;
- the unhandiness, the complexity of the embodiment with the abundance of rotating and moving parts, which consists of a large number of complex-shaped parts. All this reduces the survivability and reduces the reliability of the weapon. Such weapons can be used in artillery, but in small arms such is unacceptable.

From the prior art, the automatic firearm is known (Patent RU No 2478177, IPC F41A 19/03, F41A 3/78, publ. 27 Mar. 2013), which comprises a receiver with barrel secured therein, lock frame with bolt and return spring, smooth gunstock plate, buffer fear with fire selector, pistol grip and magazine. In which the buffer fear is located in the inner cavity of the pistol grip, it contains a two-arm buffer lever, one arm of which is located on the displacement of the lock frame, and the second has the possibility to interact with a spring-loaded buffer installed in the body; the switch knob is a rod, ledges are made on the rod with the possibility of selective interaction with the response slots of different depths made in housing buffer, and in the lower part of the bolt is fixed on the axis of the spring-loaded rammer with the ability to rotate its working part, in the direction towards the cartridge in the store. The disadvantages of this invention are: the unhandiness, complexity of the embodiment with the abundance of rotating and moving parts, which consists of a large number of complex-shaped parts. Wherein, the rate of fire is 1000 shots per minute while the buffer position is on will increase the shaking of the weapon. Such a rate of fire is not sufficient to increase the accuracy of shooting in short bursts of 2-3 rounds per minute. The effect of increasing accuracy is shown at a rate of 1800 and higher shots per minute, which allows three bullets to leave the barrel before the weapon is removed from the aiming line, and an additional cut-off mechanism is required for three times ammunition per turn.

The object of the claimed invention is to improve the design of caseless weapons (variants) that provides next improvement of performance: increase the reliability of the weapon in difficult conditions, reduce the weapons cocking force, provide ease of removing light delays and facilitate loading and unloading, ensure the reliability of weapons in combat conditions with the forced supply of ammunition, including polluted ones, will improve the stability of the projectile trajectory and provide improved accuracy of shots in the arms with a stable position and impromptu shooting.

The second object of the invention is creating a new embodiment that provides to remove recoil in the magazine weapon and to reduce the effects of vibration during firing in automatic and semi-automatic weapons, increase the effectiveness of the shot, reduce heat loss, reduce the barrel heat and increase the safety of weapons and shooters.

It is desirable to remove the recoil from the magazine weapon and to reduce the recoil and vibration in small arms when the automatic is working in automatic and semi-automatic weapons. Increase the efficiency of the shot, reduce heat loss and reduce the heating of the barrel, reduce weight and reduce the size of the weapon, improve the safety of the weapon and the shooter, improve the stability of flight projectile on the entire trajectory, to ensure the repair and replacement of parts in field conditions in case of weapon destruction.

Commonly, it is necessary to cock the weapon, thereby overcoming the force of the mainspring and recoil spring when loading small arms, which can reach five kilograms and more, which is tedious for a fighter. It is advisable to reduce the cocking force.

During conduct of the battle, it is often necessary to eliminate light delays and facilitate loading and unloading on site. Commonly, this occurs due to juggling of the lock frame, the lock frame is returned by a return spring. Wherein, if there is a delay due to the skew of the cartridge in the chamber and its jamming, then the elimination of the delay by juggling the slide frame will not help. The withdrawal of a fighter under the fire or partial disassembly of weapons under enemy fire is required. The weapon should be configured with the possibility to eliminate these kind of delays without disassembling the weapon.

In combat conditions, a fighter with a weapon is often being situated in mud, dust, water, sand, which leads to contamination of ammunition, and if there is no forced supply of ammunition, there is a delay in shooting, which threatens the death of a fighter. The weapon should be configured with a forced supply of ammunition.

It is advisable to have a reliable fixation, convenience, simplicity and speed in installing and removing the slide stop, the magazine latch, the ramrod, the latch on the receiver cover while using all types of small arms.

The most frequent delays in shooting in difficult conditions arise due to dirt, water, dust and sand getting inside the weapon through all sorts of holes and slots. It is advisable to minimize the places through which dirt, water, dust, and sand can get into the weapon.

As a result of the long-term operation of a folding adjustable gunstock, play appears in the gunstock fastening unit on the weapon, which reduces the accuracy of shooting. It is advisable to configure the gunstock with the self-removing play. Fighters with different anthropological characteristics use a weapon in a different position: standing, sitting, lying down with a knee. Each position requires its own optimal gunstock length and the ability to quickly mount it. The gunstock should be convenient in operation, folding and adjustable.

To improve the accuracy of the sniper and hunting weapons shooting from stable positions and impromptu shooting, a gunstock should have a side branch. At the same time, the inconvenience of shooting from the left shoulder appears, which is eliminated by folding the gunstock and using sights with image stabilization.

It is advisable to have a quick and convenient assembly and disassembly of the forward grip in the weapon, which has a firing forward grip.

In traditional weapons systems, such as the M-16 system, AK-74, the modular system (Steyr) AUG, the newly developed LSAT system, it is advisable to have specialized weapons workshops in military, police and sportive departments with qualified personnel for complete disassembly and repair of weapons, which increases the cost of the weapon and eliminates disassembly and assembly of the weapon and repair of weapons by the shooter right in the field. Therefore, the weapon system should provide disassembly and assembly of the weapon without the special tools in the field.

The tasks are solved by the fact that according to the first variant of the invention a caseless magazine weapon (1A), which contains a receiver cover (7), and interacts with a receiver (30), and a bolt carrier (12A) which is configured to reciprocate in a channel guide (178), in which a bolt is mounted (61), which is configured to reciprocate and rotate about an axis, wherein said receiver (30) mounted in a trigger housing (31A) and fixed by multifunction latch (64), a magazine (6) is mounted in the trigger housing (31A) and interacting with the magazine latch (34), and a conical bushing of the receiver (27) is mounted in the receiver (30) and a multifunctional cartridge (26) is mounted on said conical bushing of the receiver (27);

a barrel (24), at the front end of which spring-loaded washer of the balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacting with the bolt carrier (12A);

fixed forepart in the trigger housing (31A) a big front nut (32), with the front swivel (33) mounted on it, a ramrod (58), fixed in the trigger housing (31A) and in the receiver (30), and interacting with the latch of the ramrod (56), which is spring-loaded by spring of the latch of the ramrod (57) and mounted in the trigger housing (31A);

a safety catch (38), spring-loaded through safety latch (37) by the safety latch spring (36), which is located in the trigger housing (31A), and configured to reciprocate;

a trigger bar for a semi-automatic weapon (39A), configured together with a sear (40) and affected by the spring of the trigger bar (41) has the possibility to reciprocate in the trigger housing (31A), wherein said spring of the trigger bar (41) is configured to compress and expand in the trigger housing (31A);

a percussion mechanism (221) for magazine shot is fixed in the trigger housing (31A), and comprising a bracket of the percussion mechanism (46), a cocking piece (49A) with a cocking indicator mounted on the axis of the cocking piece (47), and a spiral mainspring (48), wherein said cocking piece (49A) is spring-loaded with the spiral mainspring (48), and interacting with enlargement (84) of the bolt carrier (12A) and the sear (40);

a removable adjustable front sight (2), a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with a stock (13), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12A) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12A), mounted on the axis of the cocking lever (9), which fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12A);

magazine latch (34) configured to rotate and spring-loaded through magazine latch pusher (35) by safety spring retaining pin (36);

the bolt carrier (12A) comprises the bar, the lower part of which has the form of a trapezoidal section (83), and enlargement (84), which configured to interact with the cocking piece (49A) and disposed in the rear part of a trapezoidal section (83);

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) and blind hole (93) disposed within upper part of the bar (82), and said blind hole (93) configured to interaction between the operating rod spring (14) and the rod (13);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12A) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102), and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (d120) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) has a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in junction point between the cylindrical section (125) and the thickened cylindrical section (126) the stepped protrusion is disposed therein, which comprising the base (131) and the leading protrusion (132), configured to interact with cam slot (97) of the bolt carrier (12A), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7), and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of the lower part of the receiver (181);

a stop (185) with a rear swivel (189) and the cross through hole (186), which configured to interact with the multifunction latch (64) and two vertical threaded holes, wherein said stop is mounted on the rear part of the receiver (181) below via screws (188);

the lower part of the bracket (190) containing threaded holes (191) for fastening the bracket (190) to the lower part of the receiver (181) with the screws (192) and a longitudinal hole (193), which configured to interact with a ramrod (58);

a threaded hole disposed (194) on top of the bracket (190), for fastening the rear sight rail (196) with the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) with screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12A) and the shutter housing (19), and in said consoles (215) in which the cross threaded holes (179) for cap screws (184) to connecting with the barrel chamber (173) with the lower part of the receiver (181), wherein the upper grooves (216) disposed on the external surface of the cylindrical part (204), configured to interact with the receiver cover (7);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31A) to press the front swivel (33) to the trigger box (31A), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31A) comprising the right half of the trigger box (260A) and left half of the trigger box (261A), which are connected to each other by the cap screws (263) with threaded bushings (264) and a threaded bushing with a splineway (265), and lower ventilation bushings (262) disposed on the sides of said trigger box (31A) in the lower part, wherein the right half of the trigger box (260A) and the left half of the trigger box (261A) form the pistol grip (268) of the trigger box (31A), and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) by cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allow the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on another side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

The tasks are solved by the fact that according to the second variant of the invention a caseless magazine weapon (1B), which contains a receiver cover (7), and interacts with a receiver (30), and a bolt carrier (12A) which is configured to reciprocate in a channel guide (178) of the receiver (30), in which a bolt is mounted (61), which is configured to reciprocate and rotate about an axis, wherein said receiver (30) mounted in a trigger housing (31B) and fixed by multifunction latch (64), a magazine (6) is mounted in the trigger housing (31B) and interacting with the magazine latch (34), and a conical bushing of the receiver (27) is mounted in the receiver (30) and a multifunctional cartridge (26) is mounted on said conical bushing of the receiver (27);

a barrel (24), at the front end of it spring-loaded washer of a balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacts with the bolt carrier (12A);

fixed forepart in the trigger housing (31A) a big front screw (32), with the front swivel (33) mounted on it, a ramrod (58), fixed in the trigger housing (31B) and in the receiver (30), and interacting with the latch of the ramrod (56), which is spring-loaded by spring of the latch of the ramrod (57) and mounted in the trigger housing (31B);

a safety catch (38), spring-loaded through safety latch (37) by the safety latch spring (36), which is located in the trigger housing (31B), and configured to reciprocate;

a trigger bar for a semi-automatic weapon (39A), configured together with a sear (40) and affected by the spring of the trigger bar (41) has the possibility to reciprocate in the trigger housing (31B), in which a single-shot sear (42) is disposed within, which is spring-loaded by trigger bar spring (45);

wherein said spring of the trigger bar (41) is configured to compress and expand in the trigger housing (31B);

a percussion mechanism (222) for semi-automatic and automatic shot is fixed in the trigger housing (31B), and comprising a bracket of the percussion mechanism (46), a cocking piece (49B) with a cocking indicator mounted on the axis of the cocking piece (47), and a spiral mainspring (48), wherein said cocking piece (49B) is spring-loaded with the spiral mainspring (48), and interacts with enlargement (84) of the bolt carrier (12A) the sear (40) and single-shot sear (42);

spring-loaded with spring of a slide stop (51), a slide stop (50), which is mounted in the trigger housing (31B), and has the possibility of angular bias, and interacting with locking lug (129) and the shutter housing (19);

a removable adjustable front sight (2), a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with the guide rod of a returnable spring (15), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12A) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12A), mounted on the axis of the cocking lever (9), which fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12A);

magazine latch (34) configured to rotate and spring-loaded through magazine latch pusher (35) by safety spring retaining pin (36);

the bolt carrier (12A) comprises the bar, the lower part of which has the form of a trapezoidal section (83), and enlargement (84), which configured to interact with the cocking piece (49B) and disposed in the rear part of a trapezoidal section (83);

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) configured for the guide rod of a returnable spring (15) reciprocation and blind hole (93) disposed within upper part of the bar (82), and said blind hole (93) configured to interaction between the returnable spring (16) and guide rod of a returnable spring (15);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12A) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102) and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (dl 20) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the percussion piston (17) is configured with a gap (443), which is made between cylindrical piston (123) of the percussion piston (17) and internal surface of stout wall (116) and conical bushing of the bolt (18);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) configured with a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in the junction point between the cylindrical section (125) and the thickened cylindrical section (126) the stepped protrusion is disposed therein, which comprising the base (131) and the leading protrusion (132), configured to interact with cam slot (97) of the bolt carrier (12A), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7);

and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of lower part of the receiver (181);

a stop (185) with a rear swivel (189) and the cross through hole (186), which configured to interact with the multifunction latch (64) and with two vertical threaded holes, wherein said stop is mounted on the rear part of the receiver (181) below via screws (188);

the lower part of the bracket (190) containing threaded holes (191) for fastening the bracket (190) to the lower part of the receiver (181) via the screws (192) and a longitudinal hole (193), which configured to interact with a ramrod (58);

a threaded hole disposed (194) on top of the bracket (190), for fastening the rear sight rail (196) via the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) via screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12A) and the shutter housing (19), and in said consoles (215) in which the cross threaded holes (179) for cap screws (184) to connecting the barrel chamber (173) with the lower part of the receiver (181), wherein the upper grooves (216) disposed on the external surface of the cylindrical part (204), configured to interact with the receiver cover (7);

the slide stop (50) configured in the form of a plate (241), in front upper part of which protrusion (242) with a hinge (243) in the form of the washer, is disposed therein, a "T" shaped protrusion (244) disposed on the external side of said plate (241), two protrusions upper protrusion (245) and lower protrusion (246) disposed at the end of said plate (241), and protrusion is disposed (247) on the internal side of said plate (241), wherein a hook (248) disposed on the internal side of lever (242);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) is disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31B) to press the front swivel (33) to the trigger box (31B), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31B) comprising the right half of the trigger box (260A) and left half of the trigger box (261B), which are connected to each other by the cap screws (263) with threaded bushings (264) and a threaded bushing with a splineway (265), and lower ventilation bushings (262) disposed on the sides of said trigger box (31B) in the lower part, wherein the right half of the trigger box (260A) and the left half of the trigger box (261B) form the pistol grip (268) of the trigger box (31B), in which a "T" shaped hole is made (271) for interaction with the slide stop (50) and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) via the cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allows the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots disposed at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on another side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

The tasks are solved by the fact that according to the third variant of the invention a caseless magazine weapon (1C), which contains a receiver cover (7), and interacts with a receiver (30), and a bolt carrier (12B) which is configured to reciprocate in a channel guide (178) of the receiver (30), in which a bolt is mounted (61), which is configured to reciprocate and rotate about an axis, wherein said receiver (30) mounted in a trigger housing (31C) and fixed by multifunction latch (64), a magazine (6) is mounted in the trigger housing (31C) and interacting with the magazine latch (34), and a conical bushing of the receiver (27) is mounted in the receiver (30) and a multifunctional cartridge (26) is mounted on said conical bushing of the receiver (27);

a barrel (24), at the front end of it spring-loaded washer of the balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacts with the bolt carrier (12B);

fixed forepart in the trigger housing (31C) a big front nut (32), with the front swivel (33) mounted on it, a ramrod (58), fixed in the trigger housing (31C) and in the receiver (30), and interacting with the latch of the ramrod (56), which is spring-loaded by spring of the latch of the ramrod (57) and mounted in the trigger housing (31C);

a safety catch (38), spring-loaded through safety latch (37) by the safety latch spring (36), which is located in the trigger housing (31C), and configured to reciprocate;

a trigger bar for a semi-automatic weapon (39B), configured together with a sear (40) and affected by the spring of the trigger bar (41) has the possibility to reciprocate in the trigger housing (31C), in which the multifunction switch (43) is disposed within, which is spring-loaded through the multifunction switch axis (44) by the trigger spring (45);

wherein said spring of the trigger bar (41) is configured to compress and expand in the trigger housing (31C);

a percussion mechanism (222) for semi-automatic and automatic shot is fixed in the trigger housing (31C), and comprising a bracket of the percussion mechanism (46), a cocking piece (49B) with a cocking indicator mounted on the axis of the cocking piece (47), and a spiral mainspring (48), wherein said cocking piece (49B) is spring-loaded with the spiral mainspring (48), and interacts with enlargement (84) of the bolt carrier (12B), the sear (40) and the multifunction switch (43);

spring-loaded with spring of a slide stop (51), a slide stop (50), which is mounted in the trigger housing (31C), and has the possibility of angular bias and interacting with locking lug (129) and the shutter housing (19);

a removable adjustable front sight (2) a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with the guide rod of a returnable spring (15), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12B) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12B), mounted on the axis of the cocking lever (9), which fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12B);

magazine latch (34) configured to rotate and spring-loaded through magazine latch pusher (35) by safety spring retaining pin (36);

the bolt carrier (12B) comprises the bar, the lower part of which has the form of a trapezoidal section (83), and in the rear part of a trapezoidal section (83), in which the enlargement (84), which configured to interact with the cocking piece (49B) and a hook-shaped protrusion (85), which interacts with the multifunction switch (43) in the "automatic fire" mode are disposed therein;

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) configured for the guide rod of a returnable spring (15) reciprocation and blind hole (93) disposed within upper part of the bar (82), and said blind hole (93) configured to interaction between the returnable spring (16) and guide rod of a returnable spring (15);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12B) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102) and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (d120) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the percussion piston (17) is configured with a gap (443), which is made between cylindrical piston (123) of the percussion piston (17) and internal surface of stout wall (116) and conical bushing of the bolt (18);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) has a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in the junction point between the cylindrical section (125) and the thickened cylindrical section (126) the stepped protrusion is disposed therein, which comprising the base (131) and the leading protrusion (132), configured to interact with cam slot (97) of the bolt carrier (12B), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7);

and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of lower part of the receiver (181);

a stop (185) with a rear swivel (189) and the cross through hole (186), which configured to interact with the multifunction latch (64) and with two vertical threaded holes, wherein said stop is mounted on the rear part of the receiver (181) below via screws (188);

the lower part of the bracket (190) containing threaded holes (191) for fastening the bracket (190) to the lower part of the receiver (181) via the screws (192) and a longitudinal hole (193), which configured to interact with a ramrod (58);

a threaded hole disposed (194) on top of the bracket (190), for fastening the rear sight rail (196) via the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) via screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12B) and the shutter housing (19), and in said consoles (215) in which the cross threaded holes (179) for cap screws (184) to connecting the barrel chamber (173) with the lower part of the receiver (181), wherein the upper grooves (216) disposed on the external surface of the cylindrical part (204), configured to interact with the receiver cover (7);

the slide stop (50) configured in the form of a plate (241), in front upper part of which protrusion (242) with a hinge (243) in the form of the washer, is disposed therein, a "T" shaped protrusion (244) disposed on the external side of said plate (241), two protrusions upper protrusion (245) and lower protrusion (246) disposed at the end of said plate (241), and protrusion is disposed (247) on the internal side of said plate (241), wherein a hook (248) disposed on the internal side of lever (242);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) is disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31C) to press the front swivel (33) to the trigger box (31C), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31C) comprising the right half of the trigger box (260C) and left half of the trigger box (261B), which are connected to each other via the cap screws (263) with threaded bushings (264) and a threaded bushing with a splineway (265), and lower ventilation bushings (262) disposed on the sides of said trigger box (31C) in the lower part, wherein the right half of the trigger box (260B) and the left half of the trigger box (261C) form the pistol grip (268) of the trigger box (31C), in which a "T" shaped hole is made (271) for interaction with the slide stop (50) and a through slot (307), which is made for interaction with the multifunction switch (43), and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) via the cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allows the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots disposed at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on the other side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

Besides, the rod (13) is configured with the washer with the radial chamfer (107), which passes into cylindrical part (108), which passes into the washer with the radial chamfer (107).

Besides, the guide rod (15) is configured with the spherical head (109), which passes into cylindrical part (110), which via a conical transition (111) passes into cylindrical part (112) with bigger diameter, which passes into the washer with radial chamfer (107).

Besides, the balancing gear (22) is configured in the form of a cylinder (143), inside of which a smooth cylindrical section (144) is disposed, which passes into a conical section (145), which passes into a cylindrical groove with threaded section (146), and in the front of the cylinder (143) there inclined holes (147) are disposed with an acute angle (148) to the longitudinal axis, and slots (150) are disposed behind the inclined holes (147) on the outer part of the cylinder (143), wherein said inclined holes (147) in the cross-section between them formed an angle (149).

Besides, the ramrod (58) is configured in the form of a rod (228), at the front end of which a slotted groove (229) is disposed, which passes into the flat end (230), a groove (232) is disposed in front of the rear end of the rod (228) which is configured in the form of a conical head (231).

Besides, the front sight (311) has a cylindrical section with a thread (331), which passes into a prismatic section (332), which passes into a cylindrical section (333), and a through slot (334) is disposed in the cylindrical section with thread (331).

Besides, the forward grip (4) comprising a body (351) in which a threaded cover (352) and a retainer spring-loaded with a spring of a locking pin (356) are mounted, and configured in the form of a locking pin (353), which is mounted in the body (351), and at the end of the locking pin (353) coming out of the body (351), a locking pin head (354) is mounted, which is fixed with a splint pin of the locking pin (355).

Besides, the body (351) is configured with a plate (357), in front of which there are holes (358), (359), wherein the rear end of the plate (357) connected to the conical cylindrical part (360), in which a cavity (361) is formed with a thread (362) at the exit, and on the upper surface in the middle of the plate (357) there are two "L" protrusions (363) and (364) with a slot (365).

Preferably, the threaded bushing (165) and the inner smooth bushing (166) are made of carbide and refractory material.

Besides, the caseless magazine weapon (1A) is additionally equipped with a knife-bayonet (427), which contains a front stop with a ring (428), a handle (431) with a slot (430) and a back stop with a hook-shaped protrusion (429).

Besides, the caseless semi-automatic weapon (1B) is additionally equipped with a bayonet-knife (427), which contains a front stop with a ring (428), a handle (431) with a slot (430) and a back stop with hook-shaped protrusion (429).

Besides, the caseless automatic weapon (1C) is additionally equipped with a bayonet-knife (427), which contains a front stop with a ring (428), a handle (431) with a slot (430) and a back stop with hook-shaped protrusion (429).

Improving the reliability of the weapon's operation in difficult conditions (dirt, water, dust, sand) is achieved by the fact that: when the automatic equipment of the proposed weapon is working, the receiver cover is fixed in the closed state, has no open windows. The only open window for the cocking lever of the receiver cover is securely closed by the cocking lever itself.

A reduction in the cocking force of the weapons, the convenience of eliminating light delays and facilitating loading and unloading in the claimed weapon is achieved by the fact that: when you manually rollback, the ledge of the receiver stays in place, wherein the cover of the receiver, the slide frame with the bolt and return mechanism are rolling back. At the same time, the recoil spring having a static position and does not participate in the rollback, which allows stopping the receiver cover over the entire length of the rollback. This provides convenient access to eliminate light delays in combat conditions. The recoil spring is not involved in reloading the weapon, thus reducing the cocking effort, and facilitates the loading and the unloading of the weapon.

Ensuring the reliability of weapons with the forced supply of ammunition, including contaminated in combat conditions is achieved by the fact that: when manually feeding in front of the receiver cover, the cocking lever should be in the closed position. Wherein the cocking lever with its inclined ledge under the action of a spring descends and rests against the shoulder of the lock frame. The inclined ledge resting on the ledge of the lock frame leads forcibly to the lock frame, which ensures the forced supply of ammunition, including contaminated, from the magazine to the multifunctional cartridge. This increases the reliability of weapons in combat conditions.

Ensuring ease of operation and firing accuracy when using the multifunction switch is achieved by the fact that: at the time of switching fire modes, the shooter does not lead the away from the aiming line, does not take his eyes off the aiming devices, and the switch is made with the thumb of any hand thus, the multifunction switch increases the efficiency and accuracy of shooting.

In the claimed weapon the slide stop plate tightly closes the cavity with a hole and prevents getting dirt, sand and water inside of the weapon, which ensures reliable operation of the slide stop in difficult conditions.

A distinctive feature of the proposed invention is the ammunition, which has surrounded by a large mass of metal (multilayer and multifunction cartridge, receiver, and bolt) when fired. The projectile has a wall thickness of 1.5-2 times more than the case wall in traditional weapons, which gives greater thermal inertia, and the free gap between the walls of the multifunctional cartridge and the walls of the projectile reduces the contact zone of heat transfer from the heated multifunctional cartridge to the projectile. Thus, the moment of spontaneous self-ignition of the projectile inside of the heated weapon is significantly distancing.

Also in the claimed weapon, the ramrod is removed when pressing inside the ramrod latch. One end of the spring of the ramrod latch will press down on the receiver. The semi-circular slot of the ramrod latch will come out of the ramrod's circular groove, which with the conical head will slide into the ramrod latch through the semi-circular hole and can be completely removed from the weapon. It is necessary to press the ramrod latch by the conical head of the ramrod and fixed it in site when putting the ramrod back on the weapon. This simplifies and speeds up the attachment of the ramrod to the weapon in field conditions and provides a reliable fixation of the ramrod and ease of installation and removal of the ramrod.

Another feature of the present invention is ensuring the reliability and ease of use of multifunctional latches. This is achieved by the fact that when the multifunction latch rotates counterclockwise approximately at 45 degrees and moves along the inclined surface of the trigger box, the ledge of the multifunction latch lever is removed from the blind hole of the bracket of the folding adjustable gunstock. At this point, the receiver cover and folding adjustable gunstock removed from the weapon. Attaching the folding adjustable gunstock back to the arms can be done by pressing on the ledge of the multifunctional latch with an inclined slot on the gunstock bracket.

The use of the present invention provides adjustment and elimination of play, as well as easy operation of the folding adjustable gunstock. This is achieved by the fact that: due to the presence of the inclined area of the gunstock base and the inclined side edge of the gunstock bracket in combination with the constant spring pressure of the gunstock axis on the bracket of the gunstock and the gunstock base, there is an automatic selection of the gap between these areas, which appears as a result of long-term operation, which eliminates play unit and improves shooting accuracy. Rapid folding and unfolding of the adjustable gunstock allow resizing weapons following the need to solve various problems. You need to press down on the bottom rounded ledge of the gunstock base to fold or to unfold the adjustable gunstock. Then, without slackening the pressure on the gunstock base, turn the gunstock body through 180° and release the base. The ability to lengthen and shorten the length of the adjustable gunstock gives ease of use of the weapon when shooting while standing, sitting and lying, as well as using weapons by a shooter with different anthropological characteristics. It is necessary to press the gunstock adjustment lever and push the gunstock body to the desired length and to release the lever when adjustment of the gunstock base is completed. The gunstock with a side branch provided improving the accuracy of weapons shooting from stable positions and from impromptu shooting.

Another feature of the present invention is to provide quick and easy assembly and disassembly of the front handle. This is achieved through the following actions: for installation, it is necessary to combine the front ledge and the rear ledge of the body with the lower ventilation holes on the trigger box with the handle and handguard. Next, push on the case to the full, and move the case in the direction of the trigger guard to the full. To disassembly, pull the head of the locking pin with the transverse hole on the handle, and move the handle forward to remove it.

In claimed weapon, a container is arranged in the front handle, and the front handle body having two L-shaped ledges with a triangular groove for the wrench for removing or installing the flame arrester compensator and the barrel in field conditions, which has bigger functionality by having the front handle. Another claimed feature of the proposed weapon is the possibility to disassemble the magazine, semiautomatic and automatic caseless weapons to pieces to the factory level and then assemble it without any special tools in any conditions.

THE BRIEF DESCRIPTION OF THE DRAWINGS

Figure 84:
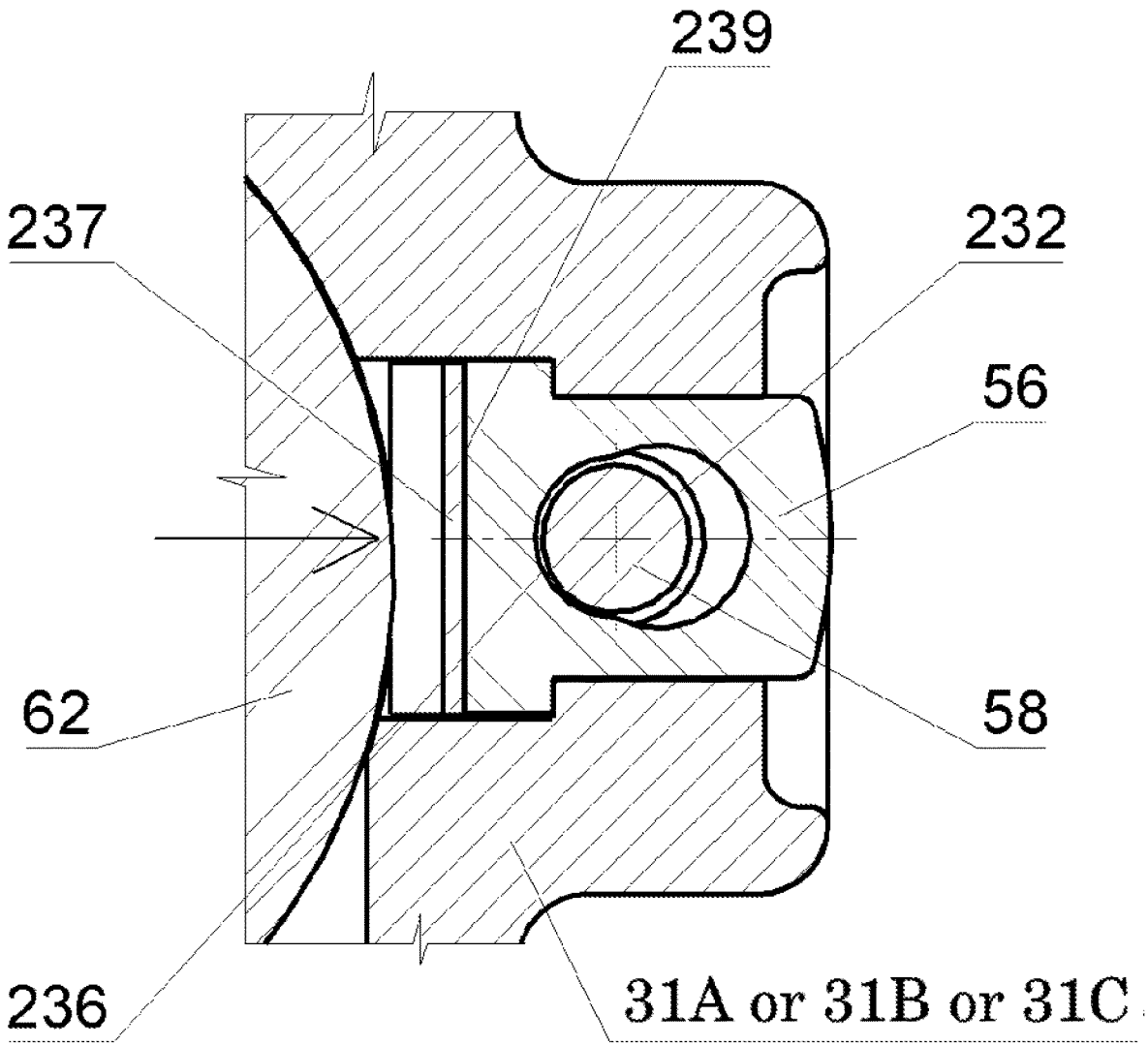
Figure 85:
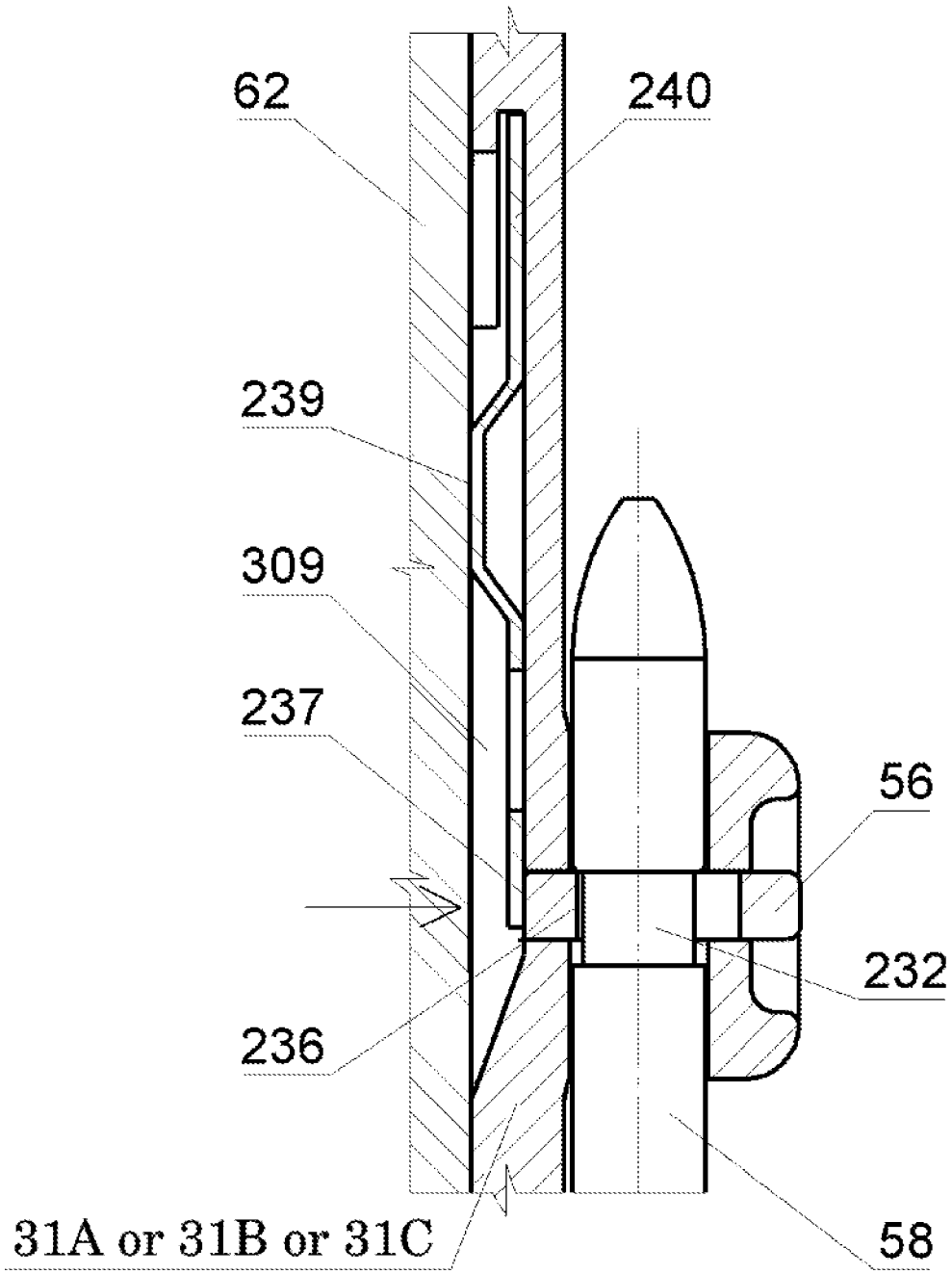

FIG. 84, FIG. 85 showing operation of the latch of the ramrod 56 in the off position.

FIG. 84 is a fragment of a cross section of the latch of the ramrod 56.

FIG. 85 is a fragment of a longitudinal section of the latch of the ramrod 56.

Figure 86:
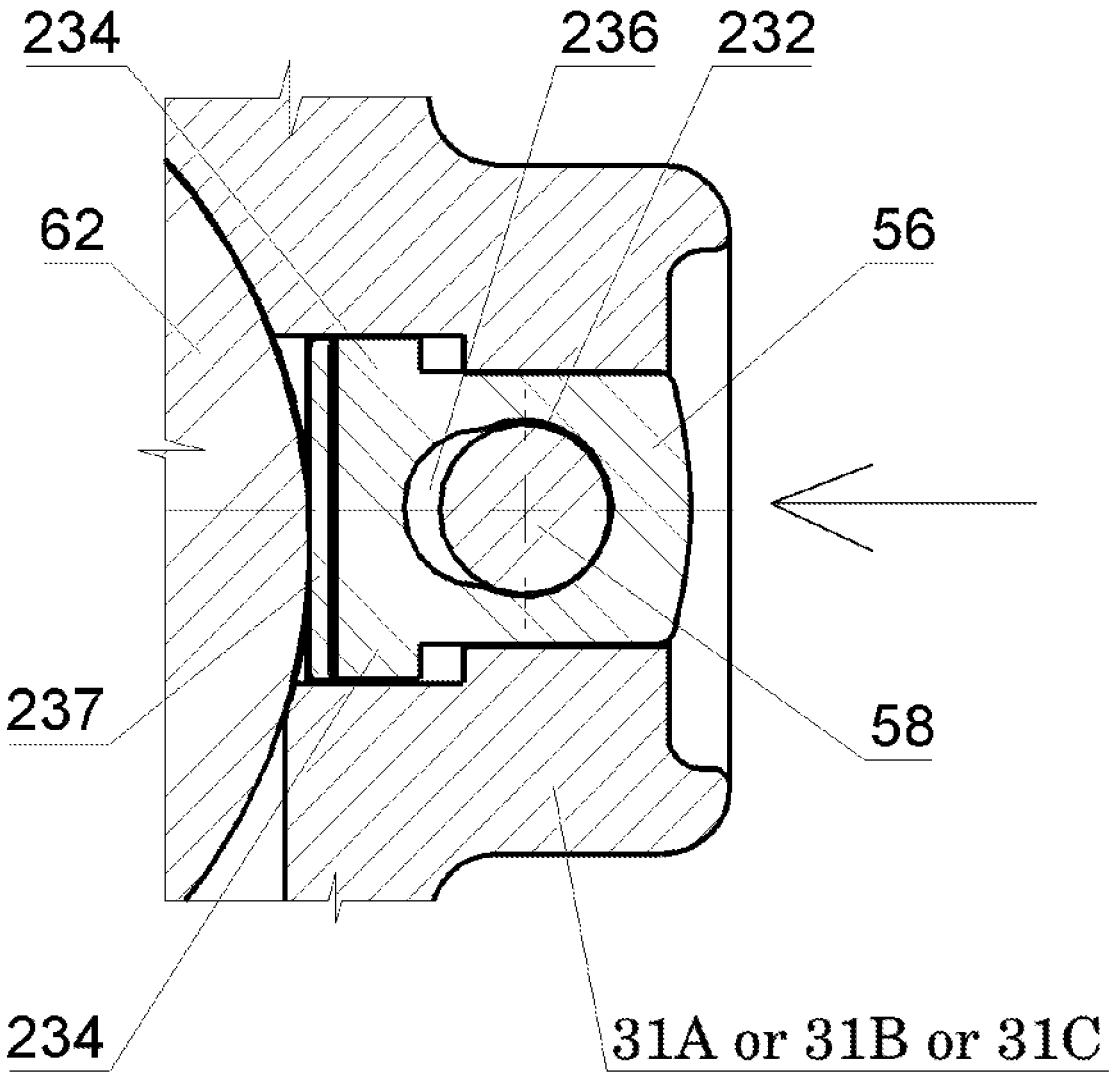
Figure 87:
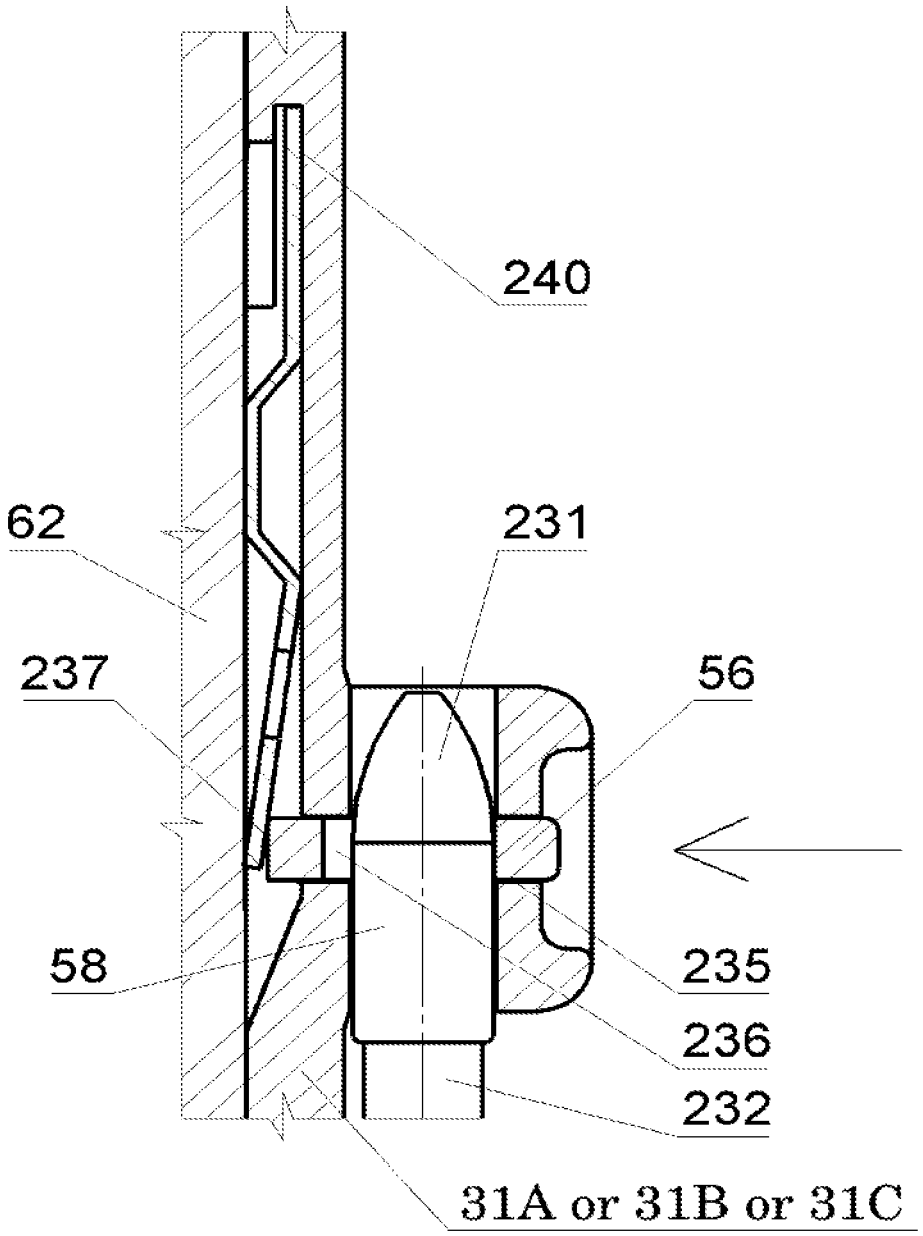

FIG. 86, FIG. 87 showing operation of the latch of the ramrod 56 in the on position.

FIG. 86 is a fragment of a cross section of the latch of the ramrod 56.

FIG. 87 is a fragment of a longitudinal section of the latch of the ramrod 56.

Figure 88:
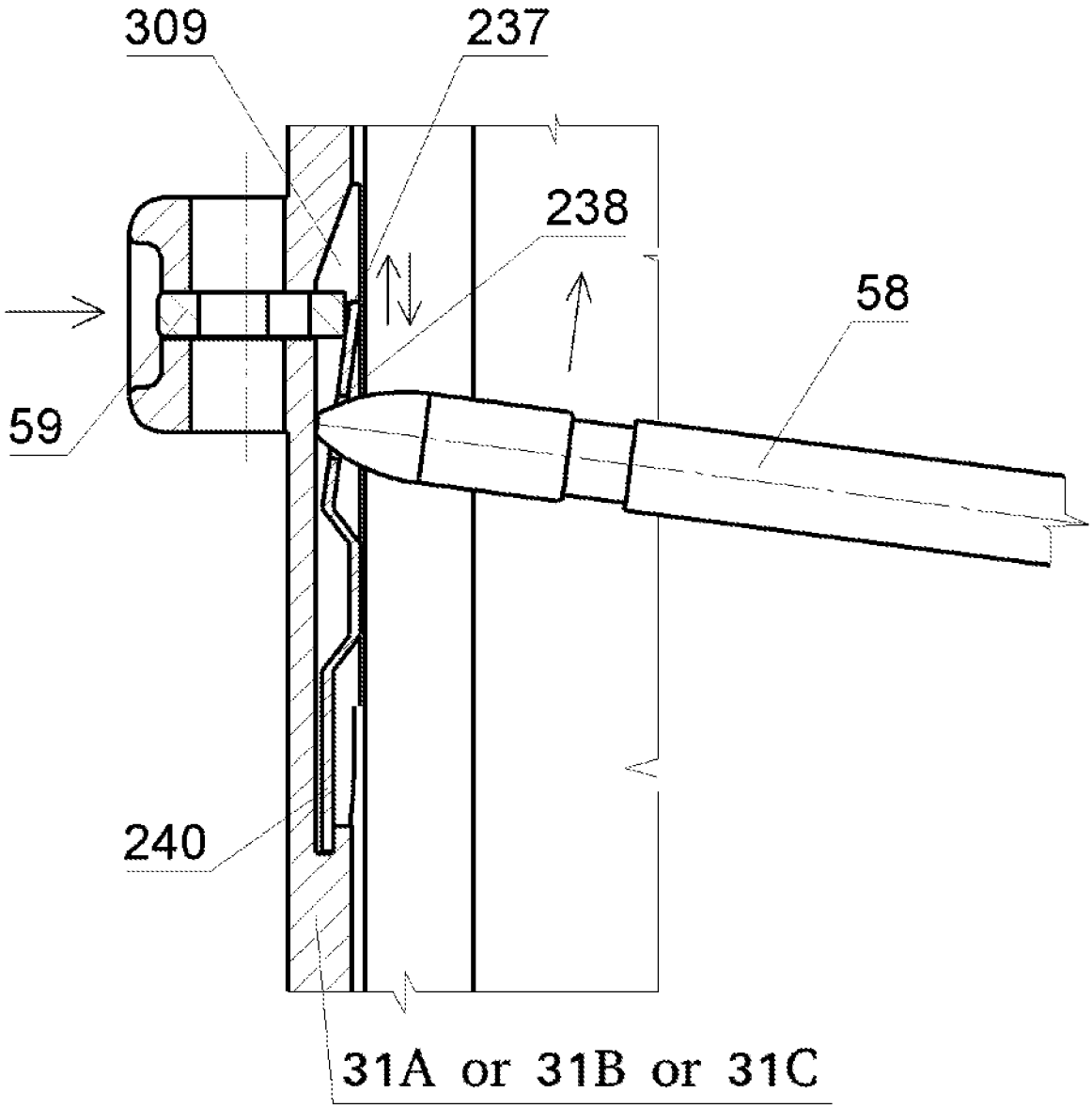

FIG. 88 is disassembly and assembly of the ramrod 56.

Figure 89:
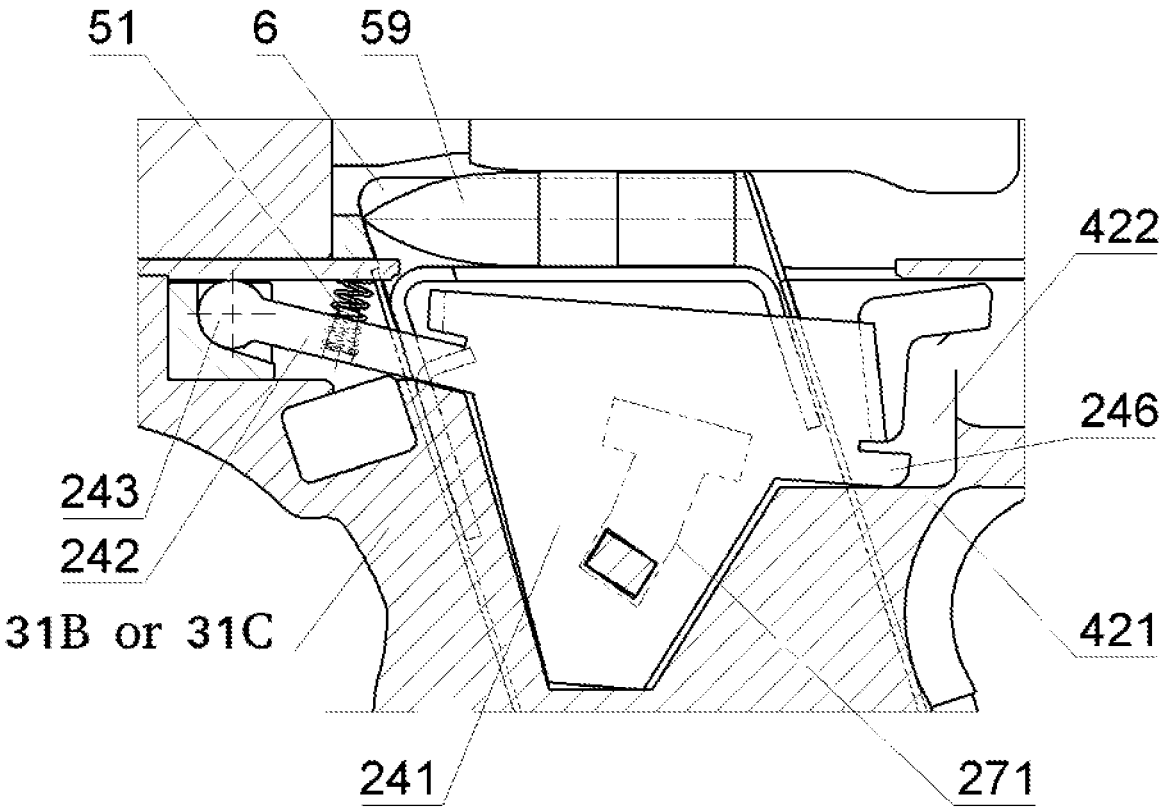

FIG. 89 showing an operation of the slide stop 50 in the off position (side view).

Figure 90:
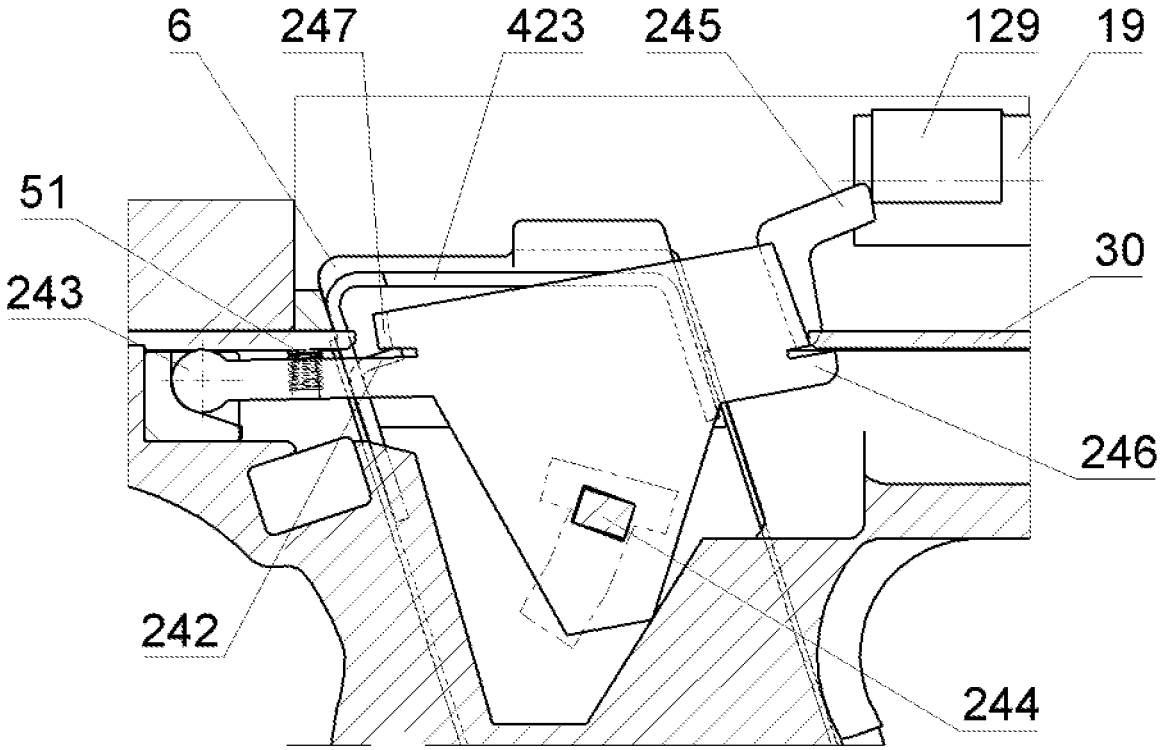

FIG. 90 showing an operation of the slide stop 50 in the on position (side view).

Figure 91:
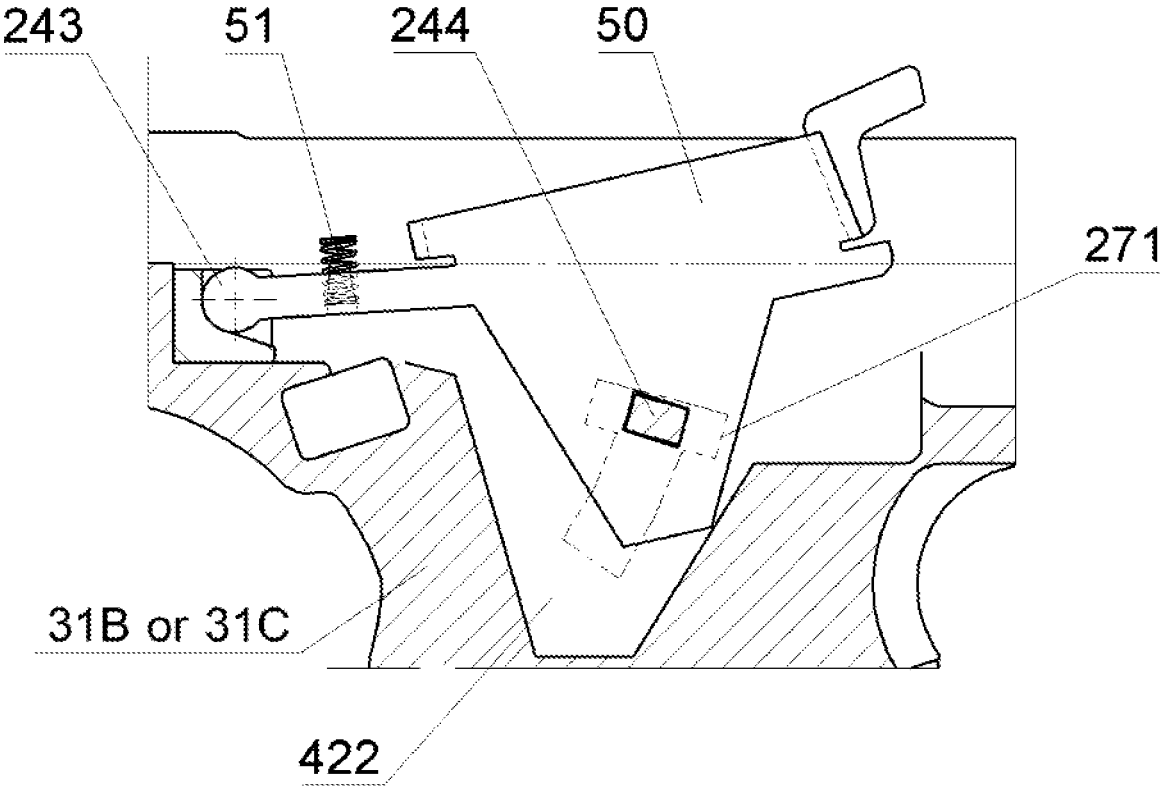

FIG. 91 is disassembly of the slide stop 50 (side view).

Figure 92:
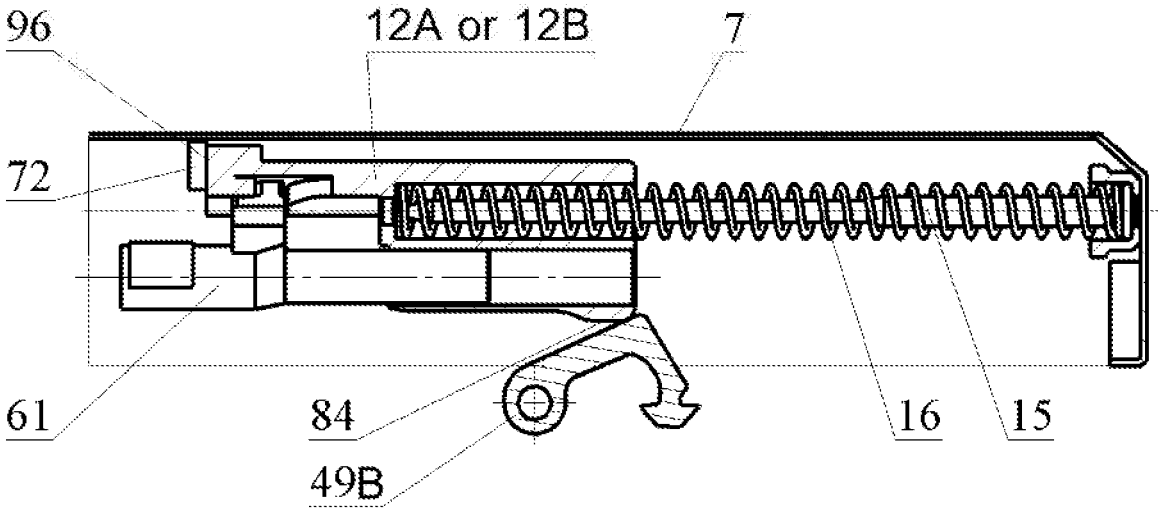

FIG. 92 showing an operation of the receiver cover 7 for the manual rearward movement.

Figure 93:
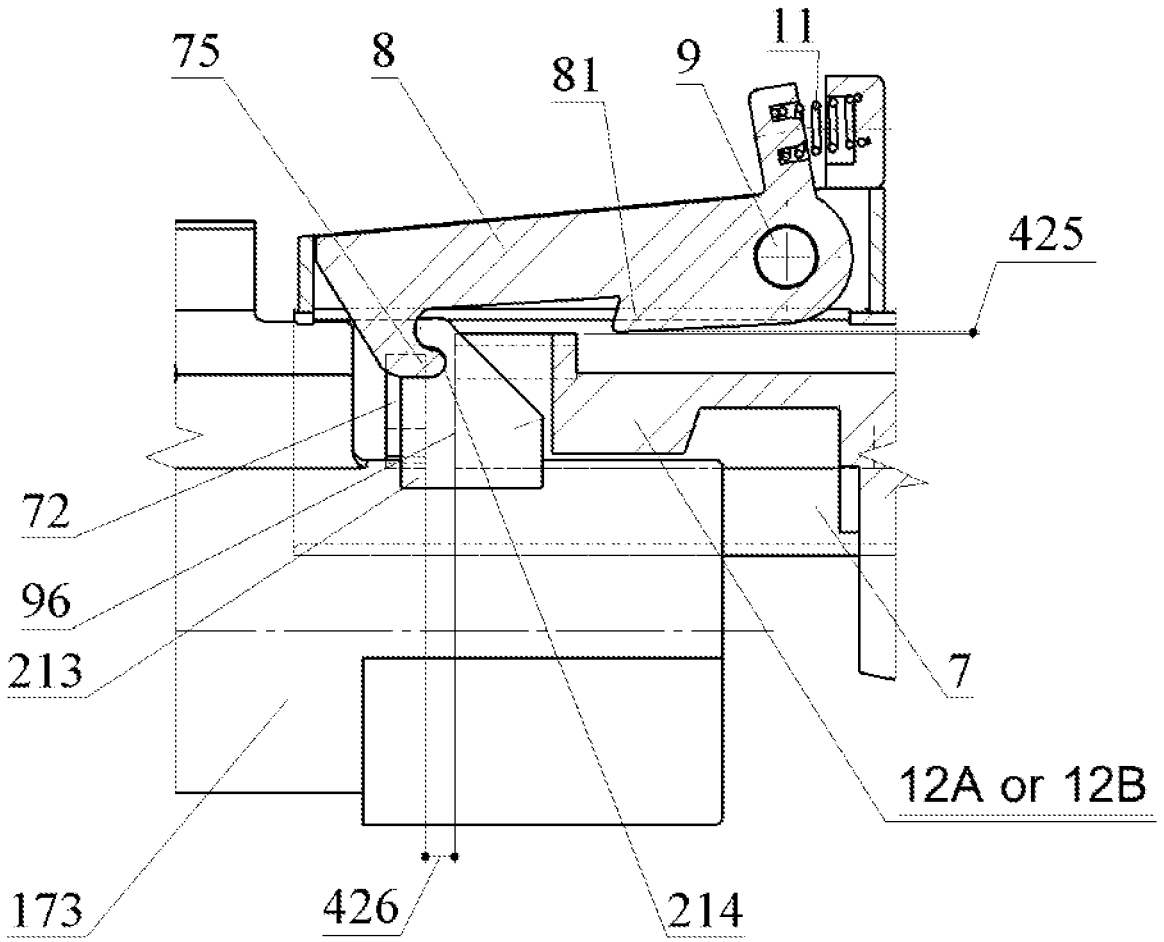

FIG. 93 showing an operation of the cocking lever 8 in the off position.

Figure 94:
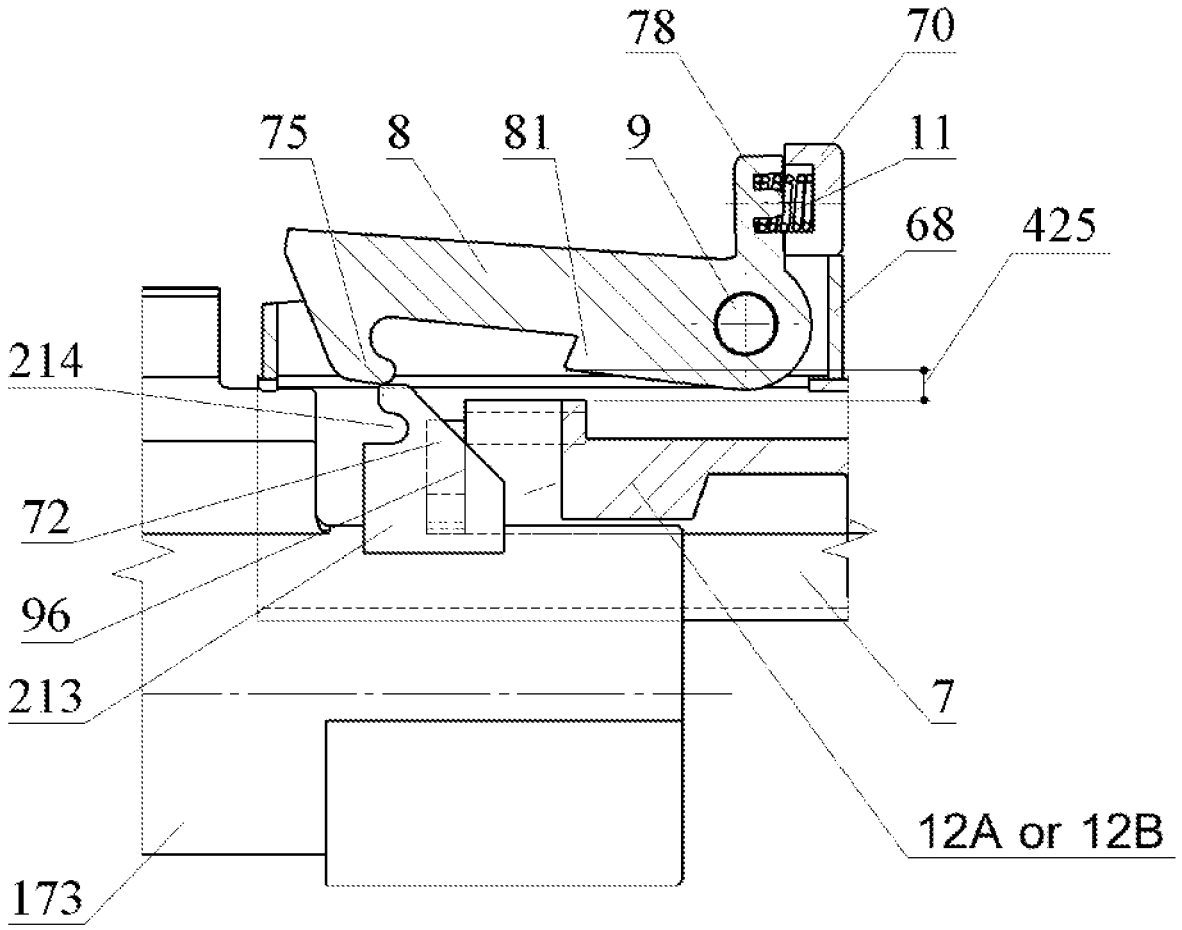

FIG. 94 showing an operation of the cocking lever 8 in the on position.

Figure 95:
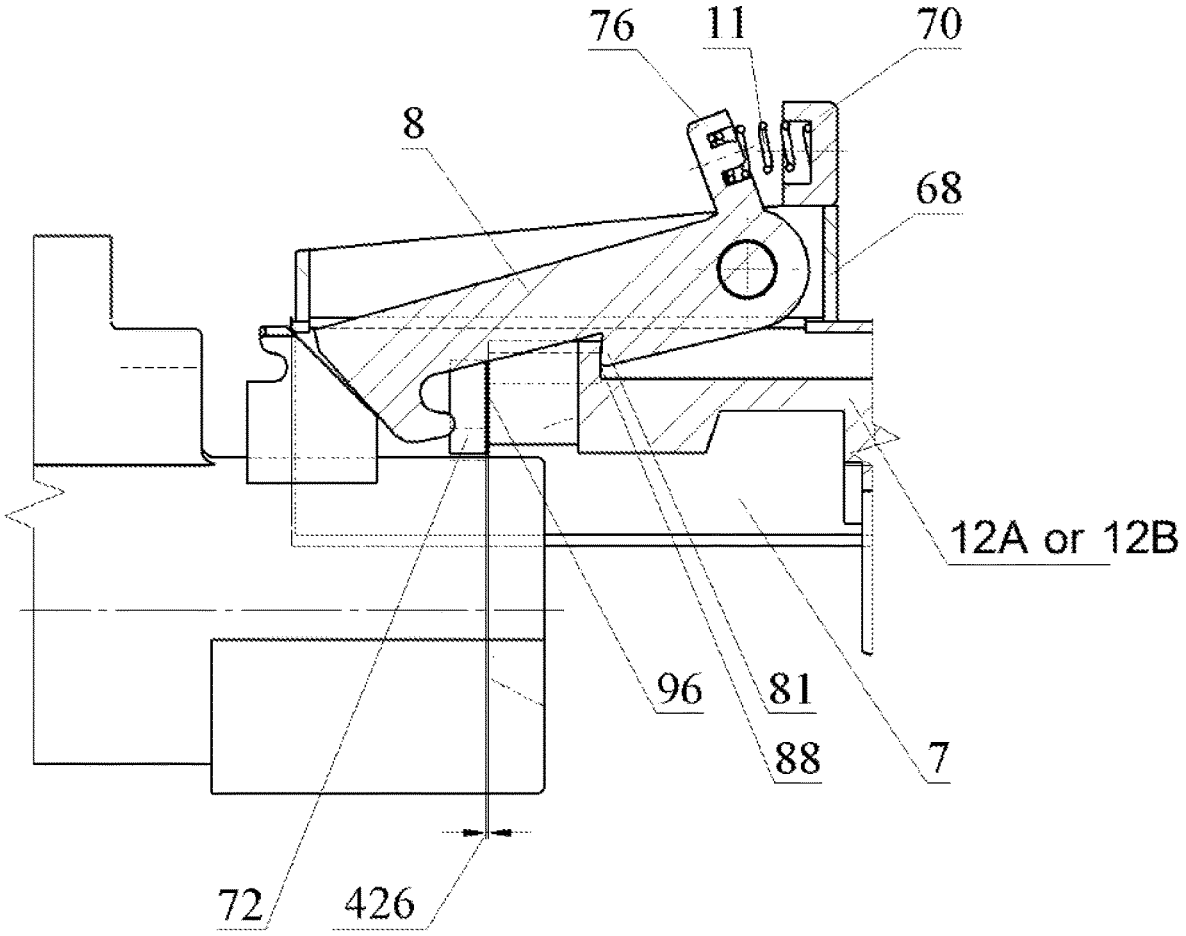

FIG. 95 showing an operation of the cocking lever 8 for the forward movement.

Figure 96:
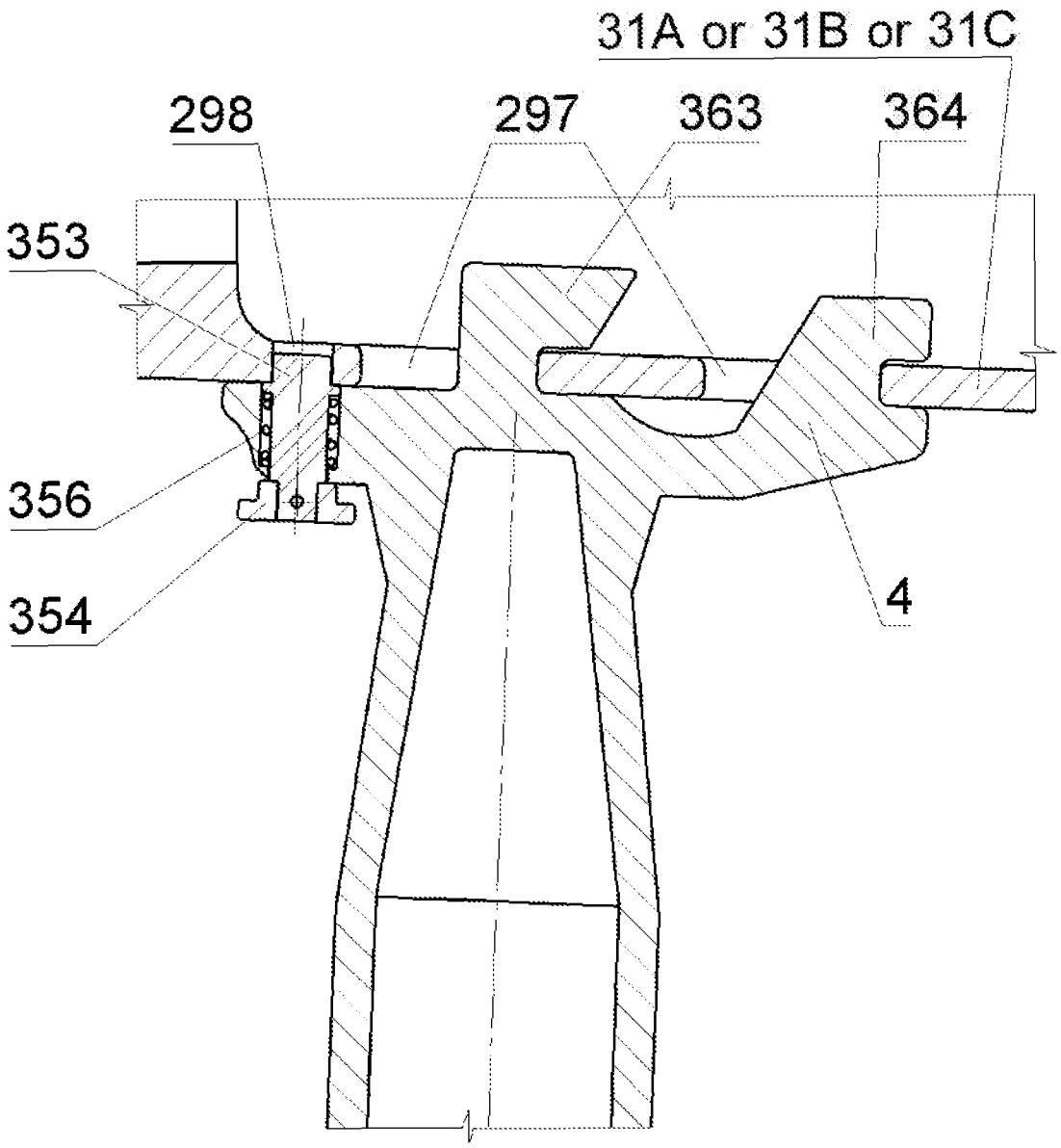
Figure 97:
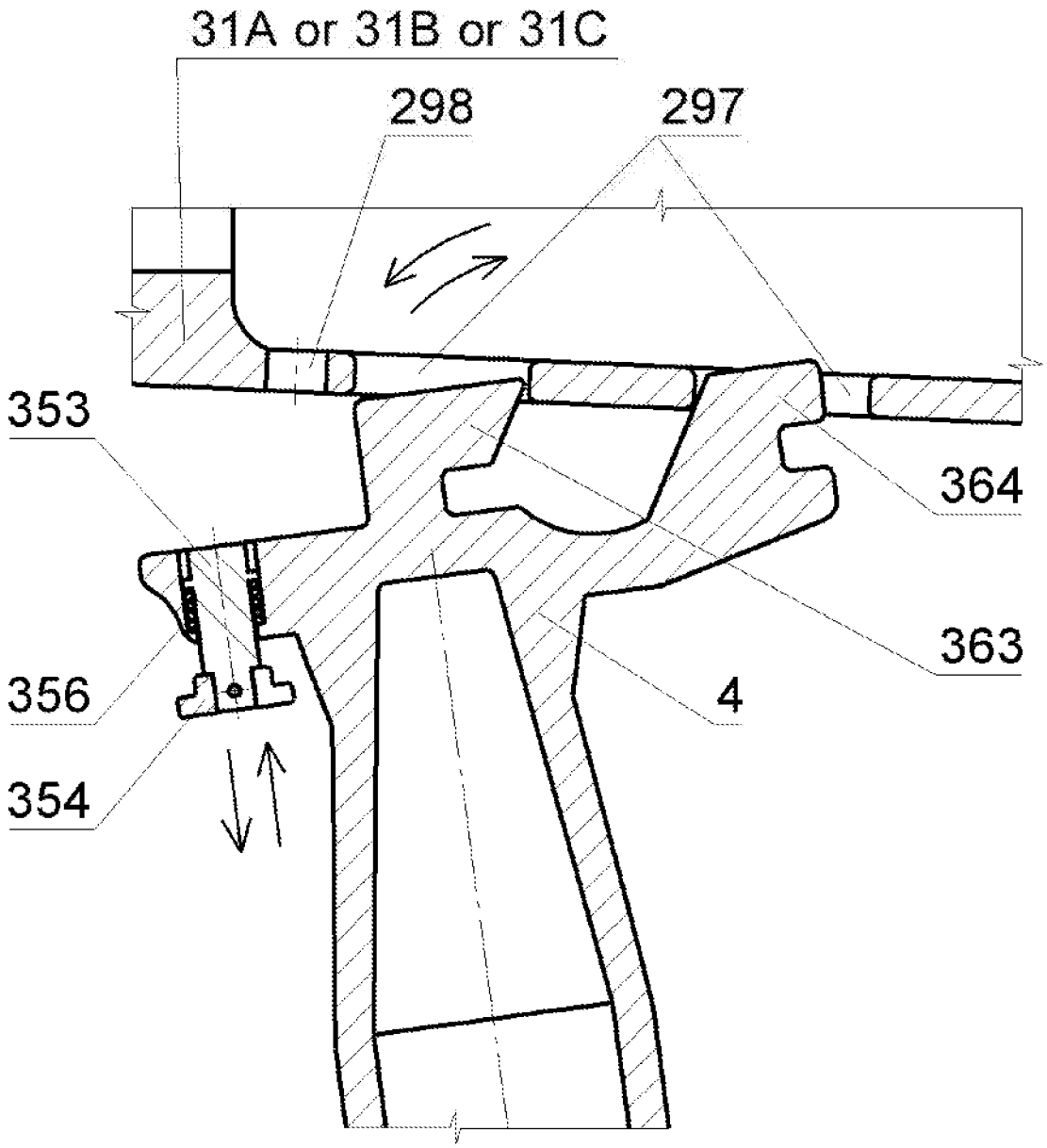

FIG. 96, FIG. 97 showing assembly and disassembly of the forward grip 4 for the weapon 1A or 1B or 1C.

Figure 98:
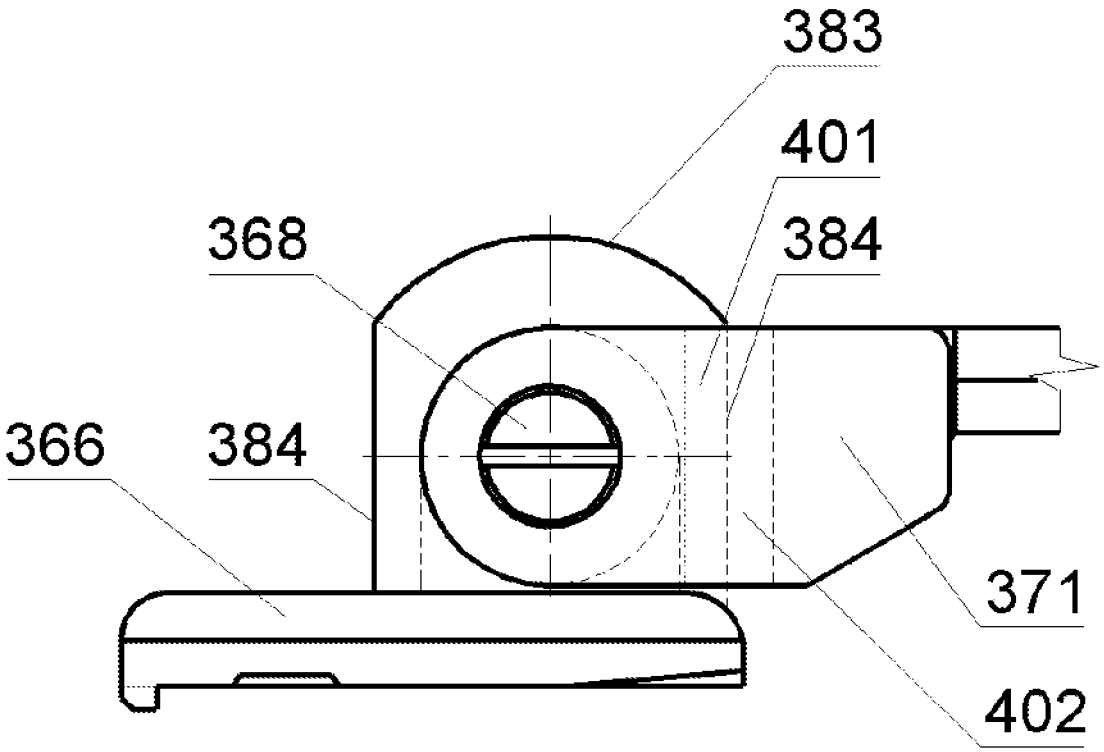
Figure 99:
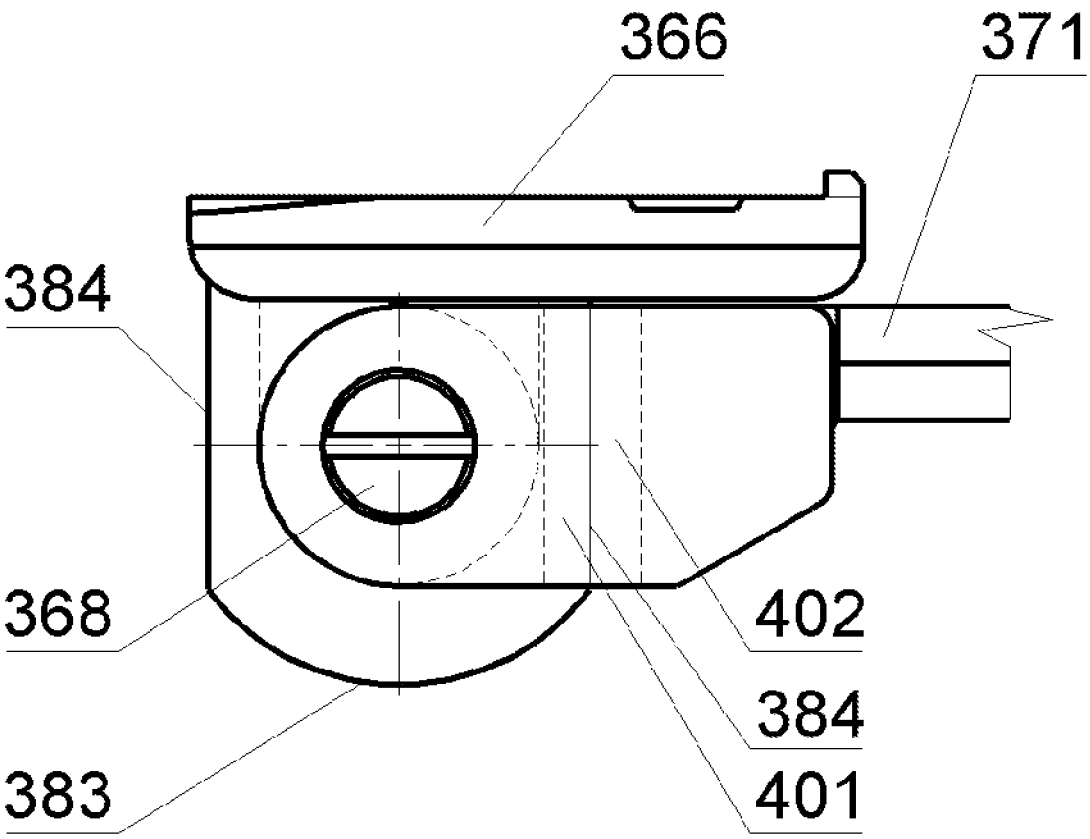

FIG. 98, FIG. 99 showing an folding and unfolding of the gunstock 5 for the weapon 1A or 1B or 1C.

Figure 100:
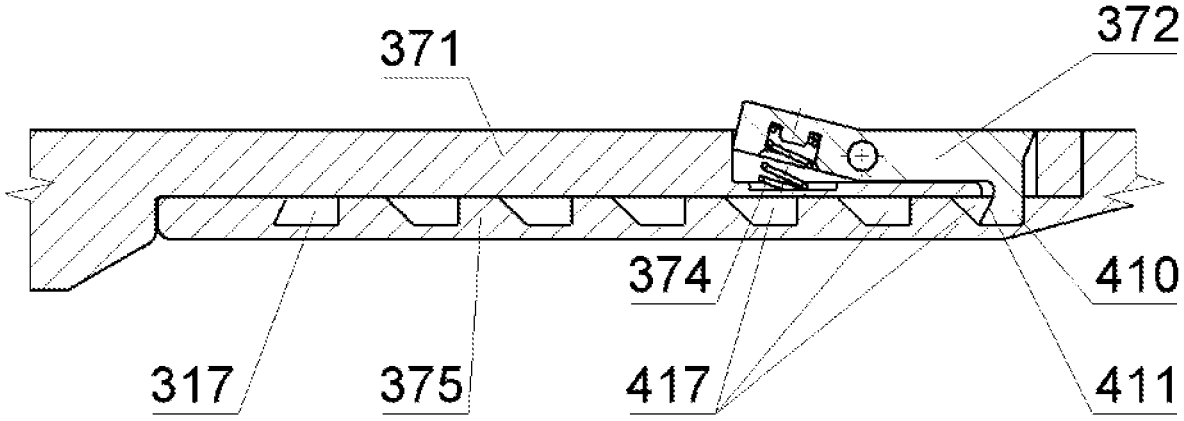
Figure 101:
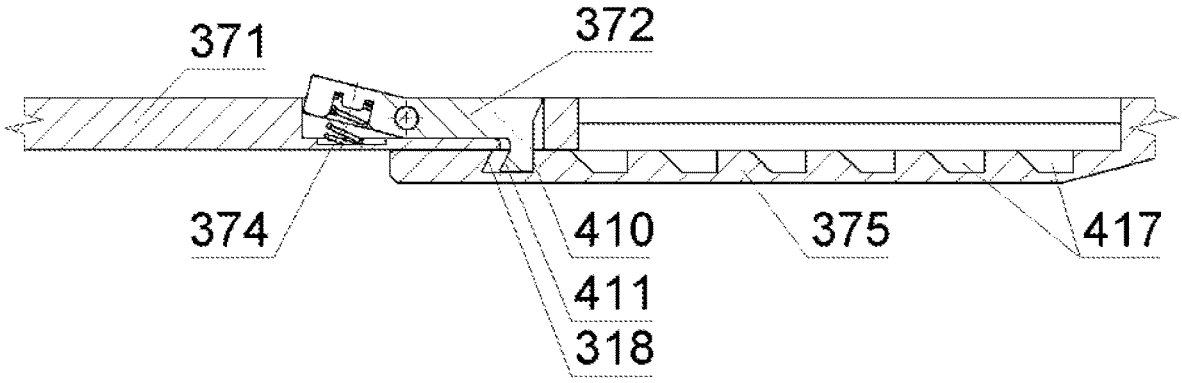

FIG. 100, FIG. 101 showing an alteration to the length of the gunstock 5 for the weapon 1A or 1B or 1C.

Figure 102:
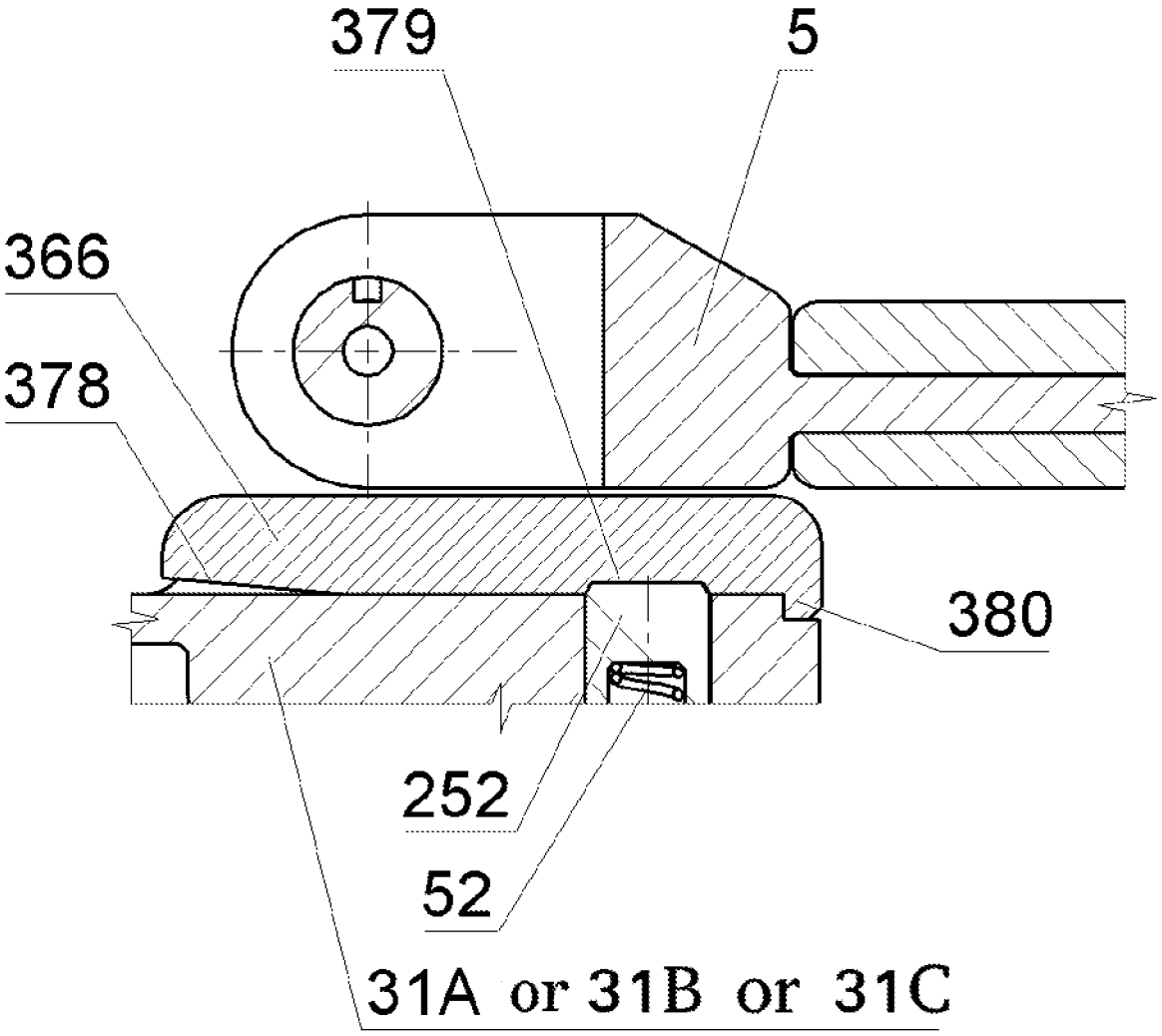
Figure 103:
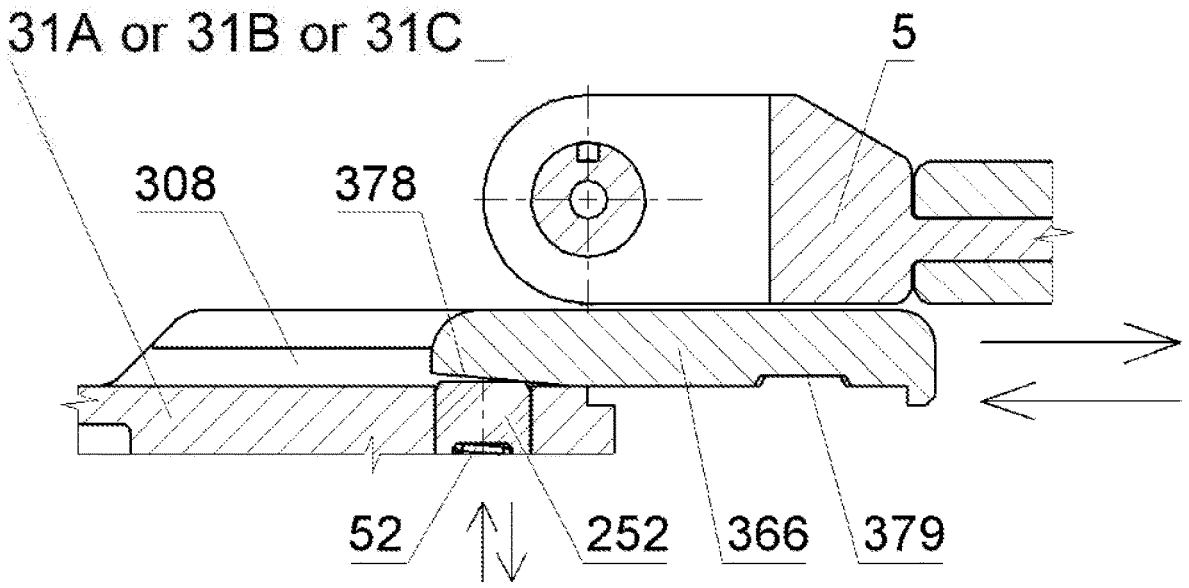

FIG. 102, FIG. 103 showing assembly and disassembly of the gunstock 5 for the weapon 1A or 1B or 1C.

Figure 104:
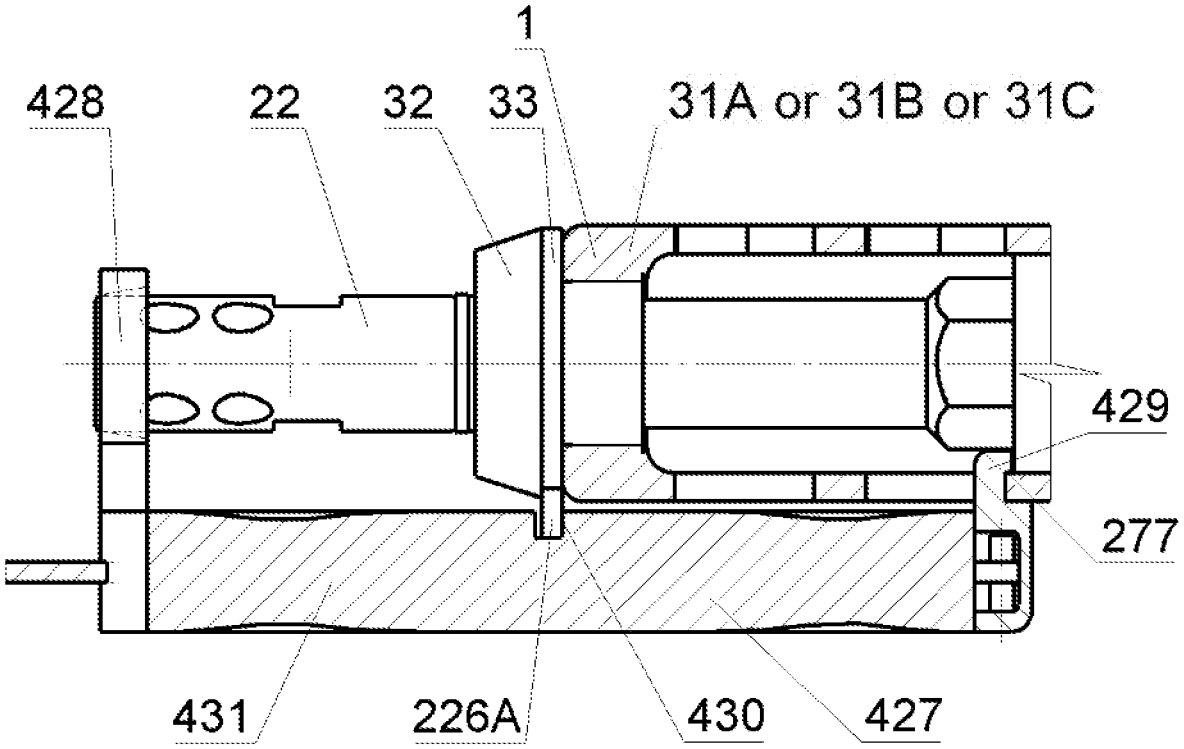
Figure 105:
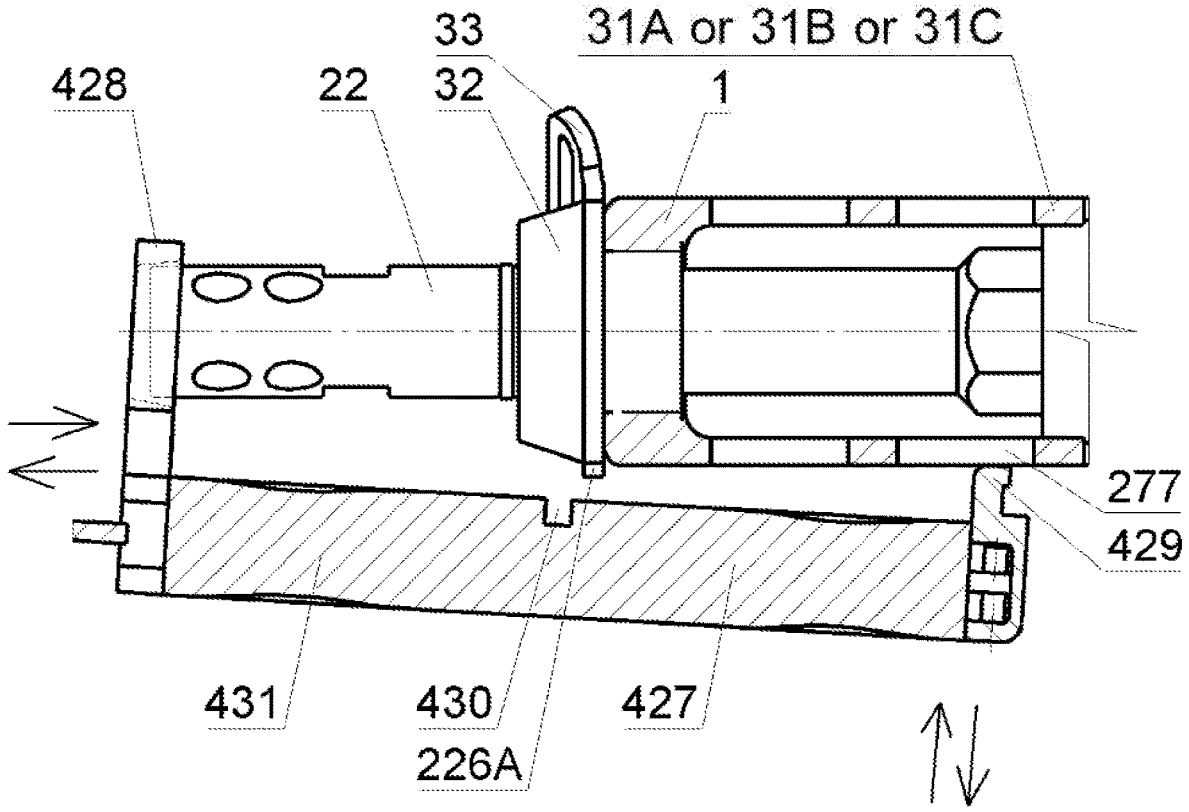

FIG. 104, FIG. 105 showing a mounting unit of the knife-bayonet 427 on the weapon 1A or 1B or 1C (upper side view).

Figure 106:
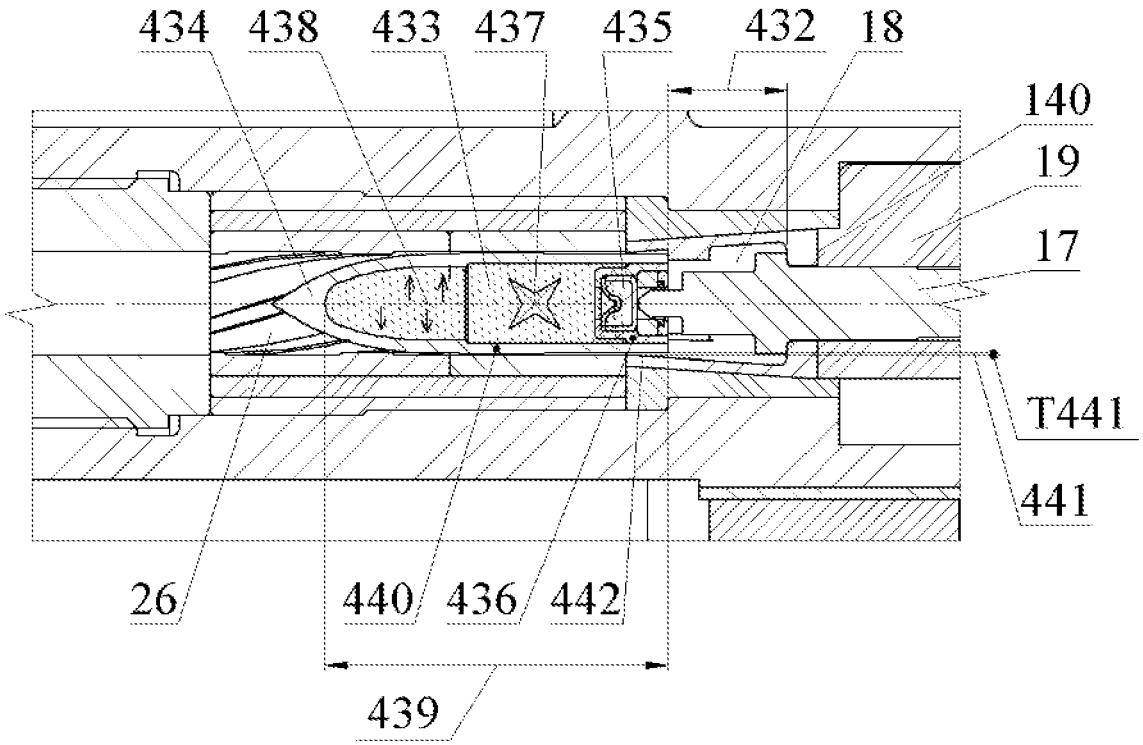

FIG. 106 showing an operation of weapon 1A in the lock time for the magazine shot.

Figure 107:
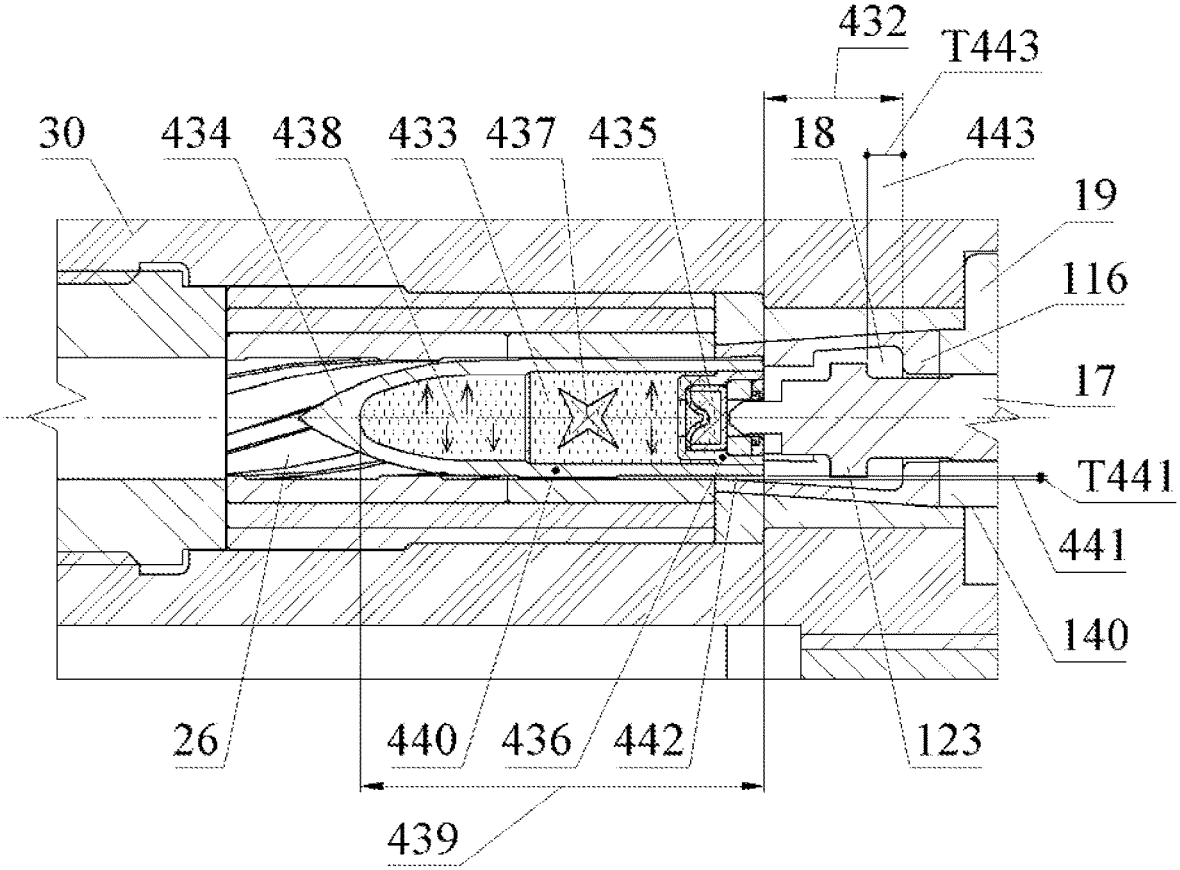

FIG. 107 showing an operation of the weapon 1B and 1C in the lock time for semi-automatic shot and automatic shot.

Figure 108:
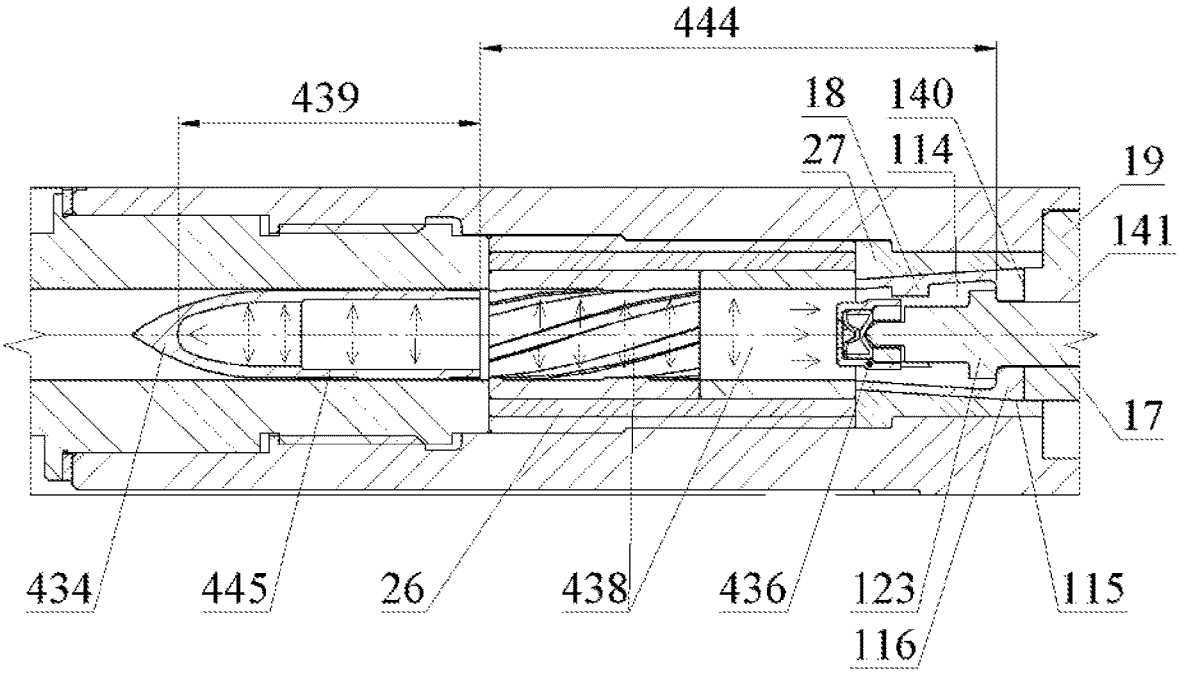

FIG. 108 showing an operation of the weapon 1A and 1B or 1C in the ignition time 444.

Figure 109:
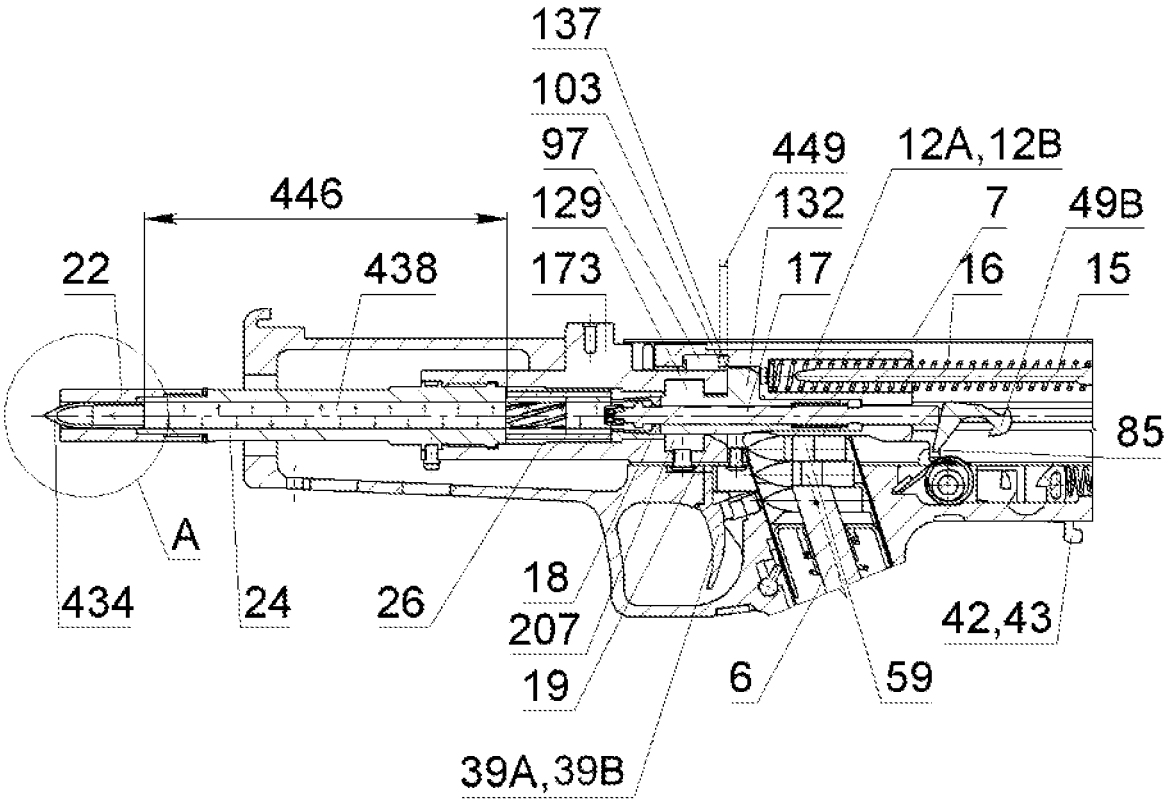
Figure 110:
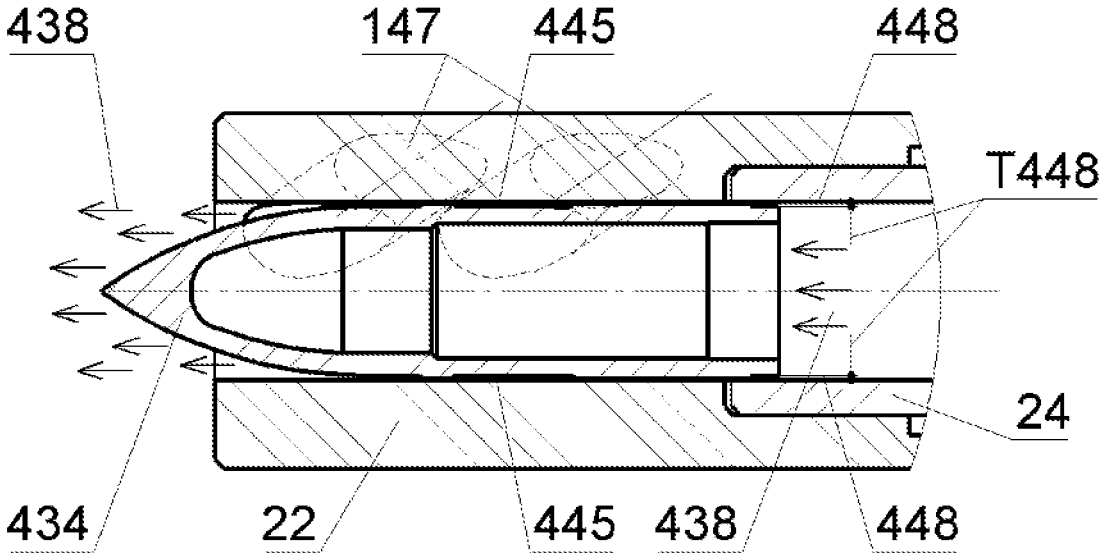

FIG. 20, FIG. 109, FIG. 110 (where unit A is shown in FIG. 109) showing operation of the weapon in the barrel time 446.

Figure 111:
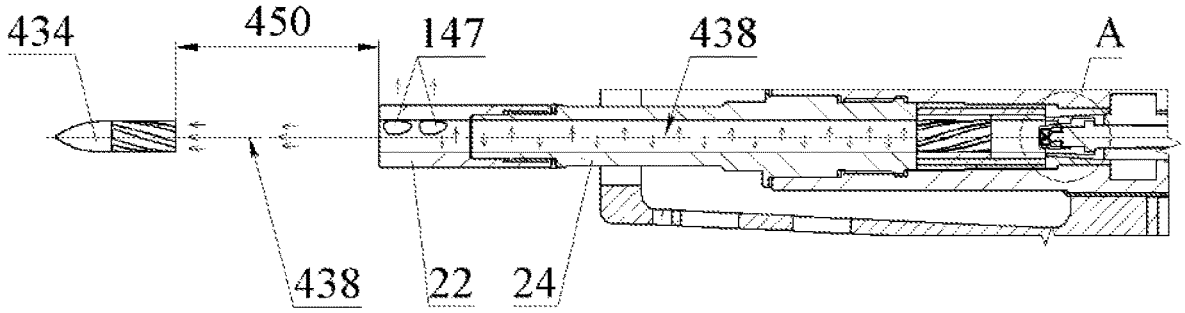
Figure 112:
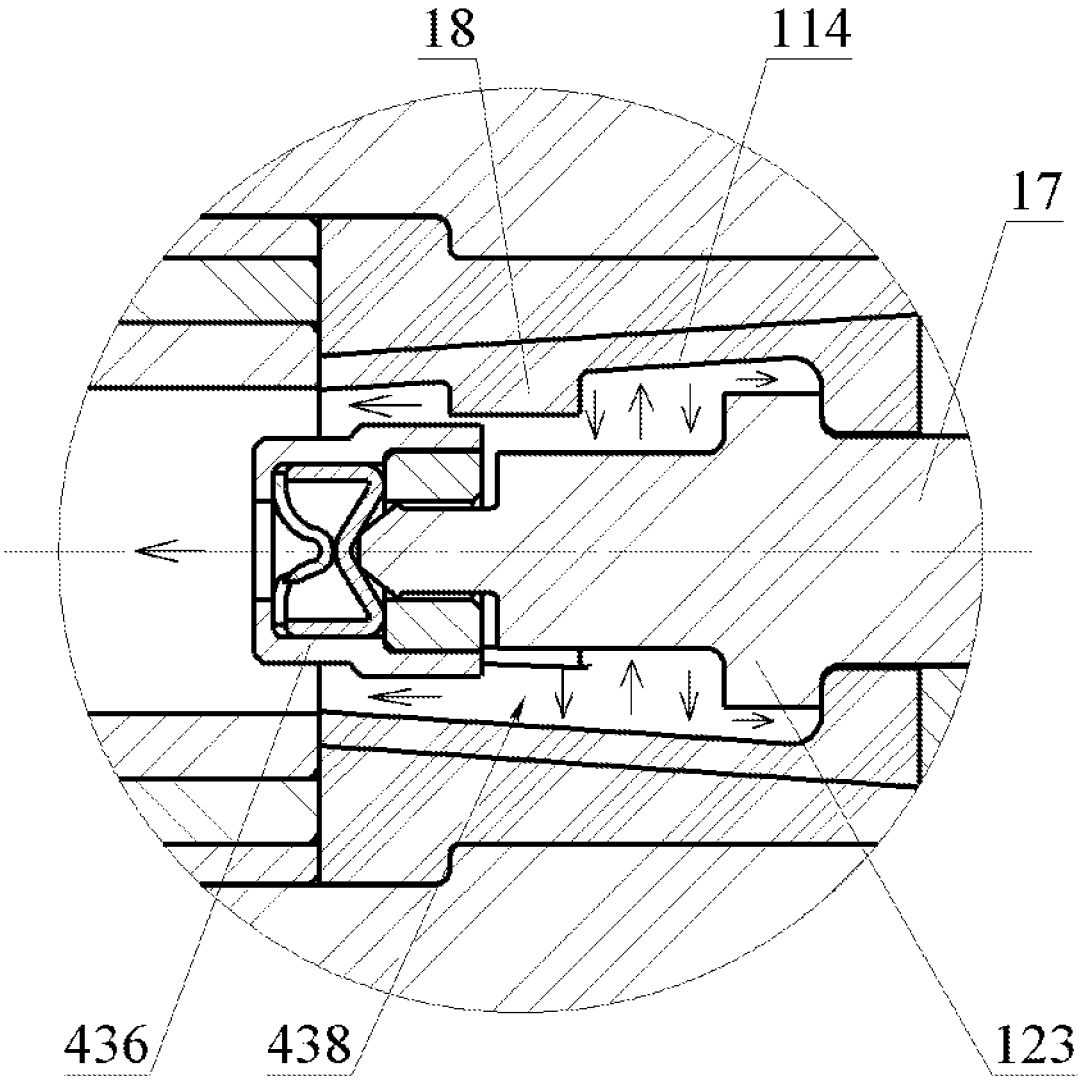
Figure 113:
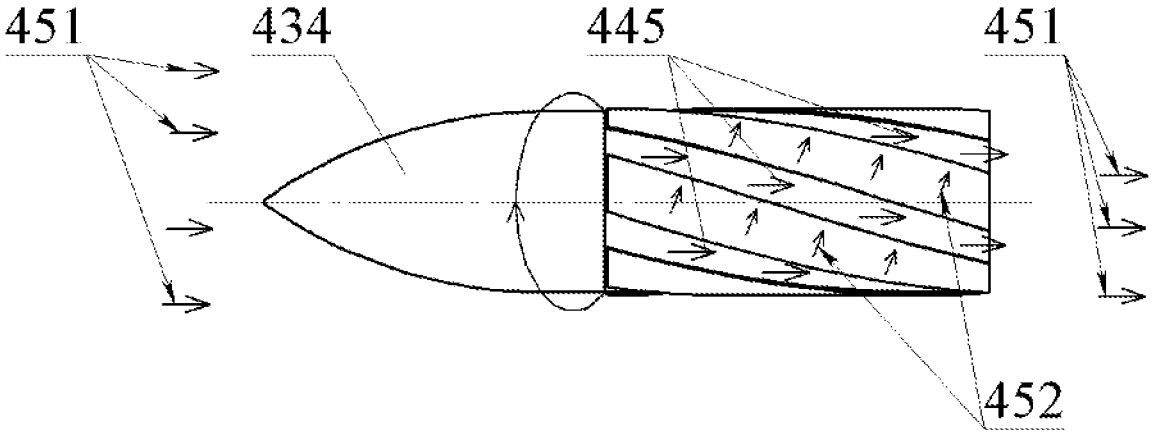

FIG. 111, FIG. 112, FIG. 113 showing an operation of the weapon in transitional period 450.

FIG. 20A, FIG. 20B, FIG. 106, FIG. 107, FIG. 108, FIG. 109, FIG. 110, FIG. 111, FIG. 112, FIG. 113 showing an operation of the caseless weapon when firing.

DESIGNATIONS USED IN THE CLAIMED INVENTION

1A—caseless magazine weapon;
1B—caseless semi-automatic weapon;
1C—caseless automatic weapon;
2—removable adjustable front sight;
3—removable adjustable dioptrical sight;
4—forward grip;
5—unfolded gunstock;
6—magazine;
7—receiver cover;
8—cocking lever;
9—cocking lever 8 axis;
10—lock washer of the cocking lever 9 axis;
11—spring of the cocking lever 8;
12A—bolt carrier for magazine and semi-automatic weapon;
12B—bolt carrier for automatic weapon;
13—rod;
14—spring of the rod 13;
15—guide rod of a returnable spring 16;
16—returnable spring;
17—percussion piston;
18—conical bushing of the bolt 61;
19—shutter housing 61;
20—safety catch of the firing percussion 17;
21—spring of the firing percussion 17;
22—balancing gear;
23—spring washer of the balancing gear 22;
24—barrel;
25—latch of the barrel 24;
26—multifunctional cartridge;
27—conical bushing of receiver 30;
28—extractor;
29—lock washer of the extractor 28;
30—receiver;
31A—trigger housing for magazine weapon 1A;
31B—trigger housing for semi-automatic weapon 1B;
31C—trigger housing for automatic weapon 1C;
32—big front nut on trigger housing 31A or 31B or 31C;
33—front swivel, which based on the big front nut 32;
34—latch of the magazine 6;
35—magazine 34 latch pusher;
36—safety spring retaining pin;
37—safety latch;
38—safety catch of the trigger housing with mechanisms 63A or 63B or 63C;
39A—trigger bar for semi-automatic shot;
39B—trigger bar for automatic shot;
40—sear;
41—trigger bar spring of the trigger housing with mechanisms 63A or 63B or 63C;
42—single—shot sear;
43—multifunction switch;
44—multifunction switch 43 axis;
45—trigger bar spring;
46—bracket of the percussion mechanism;
47—axis of the cocking piece 49A or 49B;
48—spiral mainspring;
49A, 49B—cocking piece;
50—slide stop;
51—spring of the slide stop 50;
52—lever of the multifunction latch 64;
53—stop of the multifunction latch 64;
54—lock pin splint;
55—spring of the lock pin splint 54;
56—latch of the ramrod of the trigger housing with mechanisms 63A or 63B or 63C;
57—spring of the ramrod latch of the trigger housing with mechanisms 63A or 63B or 63C;
59—caseless ammunition;
60—cover of the receiver with mechanisms;
61—bolt;
62—receiver with barrel and mechanisms;
63A—trigger housing with mechanisms for magazine weapon 1A;
63B—trigger housing with mechanisms for semi-automatic weapon 1B;
63C—trigger housing with mechanisms for automatic weapon 1C;
64—multifunction latch of the trigger housing with mechanisms 63A or 63B or
65—body of the receiver cover 30;
66—rear plate of body 65;
67—bushing of the rear plate 66;
68—bracket of the body 65;
69—through hole in bracket 68;
70—button on the bracket 68;
71—blind hole on the button 70;
72—front stop on the body 65;
73—protrusion with interior chamfer on body 65;
74—cocking lever 8;
75—hook of the lever 74;
76—rounded end of the hook 75;

77—through hole in lever 74;
78—protrusion on the form of the button in the front part of lever 74;
79—blind hole on the protrusion 78;
80—cylindrical protrusion on the protrusion 78;
81—inclined protrusion on the lever 74;
82—the bar of the bolt carrier 12A and 12B;
83—trapezoidal section on the bar 82;
84—enlargement in the rear part of trapezoidal section 83;
85—hook shaped protrusion in the rear part of trapezoidal section 83;
86—guided protrusions on the side surface of the bar 82;
87—console of front part of the bar 82;
88—protrusion on the console 87;
89—slot in the front part of console 87;
90—blind hole inside the lower part of bar 82;
91—through hole on the bottom of blind hole 90;
92—through hole in the upper part of the bar 82;
93—blind hole in the upper part of the bar 82;
94—inlet chamfer on the trapezoidal section 83;
95—support platform in the beginning of console 87;
95—support platform in the front part of console 87;
97—cam slot on the lower surface of console 87;
98—inlet slot on the cam slot 97;
99—leading edge on the cam slot 97;
100—edge on the cam slot 97;
101—free-running internal edge on the cam slot 97;
102—support platform on the cam slot 97;
103—internal leading edge on the cam slot 97;
104—acute angles of edge 100 and internal leading edge 103;
d104—measure of an acute angle;
105—bolt axis 61;
106—straight angle between the leading edge 99 and the bolt axis 105;
d106—measure of a straight angle;
107—washer with radial chamfer of the rod 13;
108—cylindrical part of rod 13;
109—spherical head on the guide rod 15;
110—cylindrical part on the guide rod 15;
111—conical transition on the guide rod 15;
112—cylindrical section on the guide rod 15;
113—truncated cone on the conical bushing of the bolt 18;
114—blind conical hole on the conical bushing of the bolt 18;
115—through conical hole on the conical bushing of the bolt 18;
116—stout wall on the big base output of truncated cone 113;
117—protrusions on entrance in blind conical hole 114;
118—conical section in front of percussion piston 17;
119—cylindrical section with smaller diameter of percussion piston 17;
120—inclined protrusion of percussion piston 17;
d120—angle of incline protrusion 120;
121—axis of the percussion piston 17;
122—cylindrical section of percussion piston 17 with bigger diameter;
123—cylindrical piston of percussion piston 17;
124—rod section with grooves of percussion piston 17;
125—cylindrical section of body of the bolt 19;
126—thickened cylindrical section of body of the bolt 19;
127—cylindrical head of body of the bolt 19;
128—chamfer on the body of the bolt 19;
129—locking lug of body of the bolt 19;
130—radius surfaces on a locking lug 129;
131—base of step-shaped protrusion on the bolt body 19;
132—leading protrusion of corbelling protrusion on the body of the bolt 19;
133—rear leading edge on the leading protrusion 132;
134—side edge of free running on the leading protrusion 132;
135—side edge of free running on the leading protrusion 132;
136—rear radius chamfer on the leading protrusion 132;
137—external sideway forepart scarf on the leading protrusion 132;
138—external radius section on the leading protrusion 132;
139—two cylindrical grooving with inclined sides on the base 131;
140—glazed area on the end of cylindrical head 127;
141—central cylinder channel inside the bolt body 19;
142—blind cylindrical hole in the central cylinder channel 141;
143—cylinder of balancing gear 22;
144—smooth cylindrical section inside the cylinder 143;
145—conical section inside the cylinder 143;
146—cylindrical groove with thread section inside the cylinder 143;
147—inclined holes in front part of cylinder 143;
148—acute angle of inclined holes 147;
149—angle formed by inclined holes 147 in cross-section;
150—slots on external part of cylinder 143;
151—split ring of spring washer of the balancing gear 23;
152—three-sided flange of spring washer of the balancing gear 23;
153—displacement of the ends of the split ring 151;
T153—measure of the displacement 153;
154—smooth conical section on the barrel 24;
155—threaded section on the barrel 24;
156—slot on the barrel 24;
157—cylindrical section with a splineway for a wrench on the barrel 24;
158—cylindrical section on the barrel 24;
159—multifaceted area for a key on the barrel 24;
160—smooth cylindrical section with groove on the barrel 24;
161—circular groove on the barrel 24;
162—threaded section with buttress thread on the barrel 24;
163—plain cylindrical section on the barrel 24;
164—internal channel of the barrel 24;
165—threaded bushing of the multifunctional cartridge 26 made of carbide and
refractory material;
166—inner smooth bushing of the multifunctional cartridge 26 made of carbide
and refractory material;
167—middle bushing of the multifunctional cartridge 26;
168—external bushing of multifunctional cartridge 26 with variable diameter;
169—big diameter of the external bushing with variable diameter 168;
170—cylindrical section of the conical bushing of the receiver 27;
171—smaller cylindrical section of the conical bushing of the receiver 27;
172—conical hole inside conical bushing of the receiver 27;
173—barrel chamber of the receiver 30;

174—locking screw of the gun chamber 174;
175—feed ramp of the receiver 30;
176—plate with threaded hole of the feed ramp 175;
177—cap screw of the feed ramp of receiver 30;
178—channel guide of the receiver 30;
179—threaded holes of the channel guide 178;
180—upper grooves on external surface of the channel guide 178;
181—lower part of the receiver for receiver 30;
182—holes on side walls of the lower part of the receiver 181;
183—cam hole on the bottom of the lower part of the receiver 181;
184—cap screw made for joining the channel guide 178 with the lower part of receiver 30;
185—stop on the rear part of the lower part of receiver 181;
186—cross through hole stop 185;
187—two vertical threaded holes of the stop 185;
188—screws of the stop 185;
189—rear stock swivel on the stop 185;
190—bracket of the receiver 30;
191—threaded holes in the lower part of the bracket 190;
192—screws in the lower part of the bracket 190;
193—longitudinal hole in the lower part of the bracket 190;
194—threaded hole on the top of the bracket 190;
195—screws on the top of the bracket 190;
196—rear sight rail of the receiver 30;
197—slot of the rear sight rail 196 and the front sight rail 199;
198—hole inside of the slot 197;
199—front sight rail of the receiver 30;
200—plate of the receiver 30;
201—hole in plate 200;
202—two threaded holes along the edges of the plate 200;
203—screws for fastening the plate 200;
204—cylindrical part of barrel chamber 173;
205—multi-layered cylindrical hole with threaded section of cylindrical part 204;
206—cross threaded hole in the lower part on entry of multi-layered cylindrical
hole with threaded section 205;
207—cylindrical groove of the cylindrical part 204;
208—threaded hole of the cylindrical groove 207;
209—complex-shaped section of the cylindrical part 204;
210—two cylindrical guiding chamfer on inlet in complicated shaped section 209;
211—base with protrusion type dovetail inside the upper part of cylindrical part 204;
212—threaded hole of base with dovetail type protrusion 211 for screw 195;
213—inclined protrusion in the end of cylindrical part 204;
214—cylindrical slot on inclined protrusion 213;
215—consoles in the rear end of the cylindrical part 204;
216—upper grooves on external surface of the cylindrical part 204;
217—retainer mechanism of the trigger housing with mechanisms 63A or 63B or 63C;
218—firing mechanism for magazine shot receiver with the mechanism 63A;
219—firing mechanism for semi-automatic shot receiver with mechanism 63B;
220—firing mechanism for automatic shot receiver with mechanism 63C;
221—percussion mechanism of the receiver with mechanism 63A for magazine shot weapon;
222—percussion mechanism of the receiver with mechanisms 63B or 63C for weapon with semi-automatic shot and automatic shot;
223—truncated cone of the big front nut 32;
224—cylindrical section with external thread of the big front nut 32;
225—cross hole of the big front nut 32;
226—ring of the front sling swivel 33;
226A—protrusion on the ring 226;
227—sling swivel besides the ring 226;
228—rod of washer 58;
229—slotted slot at the front end of the rod 228;
230—flat end of the ramrod 58;
231—conical head of the rear end of the rod 228;
232—groove in front of the conical head 231;
233—plate of the latch of the ramrod 56;
234—rounded protrusions of the plate 223;
235—cross semicircular hole in centre of the plate 233;
236—semicircular slot in the lower part of the cross hole 235;
237—flat spring of the locking ramrod spring 57;
238—cross hole on the front end of the flat spring 237;
239—bulge in the middle of the flat spring 237;
240—rear part of the flat spring 237;
241—slide stop 50 plate;
242—lever in the upper part of the plate 241;
243—hinge of the lever 242;
244—"T" shaped lever on the external side of the plate 241;
245—upper protrusion on the end of the plate 241;
246—lower protrusion on the end of the plate 241;
247—protrusion on the internal part of the plate 241;
248—hook on the internal part of the plate 242;
249—through cross hole of the multifunctional latch stop 53;
250—spherical ends of the lock pin splint 54;
251—groove in the middle of the lock pin splint 54;
252—rod of the multifunction latch lever 52;
253—lever on the front part of the rod 252;
254—inclined area of the lever 253;
255—enlargement on the end of the lever 253;
256—rear protrusion on enlargement 255;
257—front protrusion on enlargement 255;
258—blind hole in the rod 252;
259—through slot in the rod 252;
260A—right half of the trigger housing 31A;
260C—right half of the trigger housing 31C;
261A—left half of the trigger housing 31A;
261B—left half of the trigger housing 31B or 31C;
262—bottom ventilative bushing of the trigger housing 31A or 31B or 31C;
263—locking screw of the trigger housing 31A or 31B or 31C;
264—threaded bushings for the cap screw 263;
265—threaded bushing with splineway for the cap screw 263;
266—threaded hole on the left half of the trigger housing 261A or 261B;
267—handguard of the left half of the trigger housing 261A or 261B;
268—pistol grip on the left half of the trigger housing 261 or 261B;
269—rectangular hole for the safety catch 38 in pistol grip 268;
270—hole for magazine latch in pistol grip 268;

271—"T" shaped hole on pistol grip 268;
272—rear part of the left half of the trigger housing 261A or 261B;
273—slot in the rear part 272;
274—slot in the rear part 272;
275—inclined area with slot 273 or 274;
276—complex-shaped hole in the rear part 272;
277—ventilative holes on the upper, front part of the left half of the trigger housing 261A or 261B;
278—hook on the upper front part of the left half of the trigger housing 261A or 261B;
279—trigger guard under pistol grip 268;
280—trigger guard, which fastening pistol grip 268 and handguard 267;
281—protrusions of the trigger guard 280;
282—protrusion in the upper part of the handguard 267;
283—cross hole on the left half of the trigger housing 261A or 261B;
284—holes in side walls of the handguard 267;
285—channel inside the left half of the trigger housing 261A or 261B;
286—cavity inside the left half of the trigger housing 261A or 261B;
287—slot inside the left half of the trigger housing 261A or 261B;
288—cavity for magazine latch 34;
289—cavity for trigger bar with hook 39A or 39B;
290—cavity for trigger bar spring 41;
291—cavity inside the beginning of the cavity 290 for cocking piece 49A or 49B;
292—cavity for the stop 185;
293—rectangular hole inside the left half of the trigger housing 261A or 261B;
294—inlet conical hole inside the left half of the trigger housing 261A or 261B;
295—grooves inside the left half of the trigger housing 261A or 261B;
296—hole inside the left half of the trigger housing 261A or 261B;
297—lower rectangular hole inside the left half of the trigger housing 261A or 261B;
298—cylindrical hole inside the left half of the trigger housing 261A or 261B for fastening forward grip 4:
299—complex-shaped hole in pistol grip 268 for magazine latch 34;
300—rear part of the right half of the trigger housing 260A or 260B;
301—hole in rear part 300 for multifunctional latch 64;
302—through threaded holes of the right half of the trigger housing 260A or 260B;
303—assembly hole upper in pistol grip 268;
304—protrusion outside on the handguard 267 near with the trigger guard 280;
305—cross hole on the protrusion 304;
306—longitudinal hole on the protrusion 304;
307—through slot for multifunction switch 43 for the right half of the trigger housing 260C;
308—"T" shaped slot in the rear part 300 of the right half of the trigger housing 260A or 260C for mounting gunstock 5;
309—slot in the cavity 286 beginning for spring of the locking ramrod 57;
310—bracket of the removable front sight 2;
311—front sight;
312—cap screw of front sight 2 and dioptrical sight 3;
313—cylindrical nut of the front sight 2 and dioptrical sight 3;
314—bracket of the removable adjustable diopter sight 3;
315—adjustment screw of the diopter sight 3;
316—impeller with diopter holes of the diopter sight 3;
317—conical spring of the diopter sight 3;
318—retainer screw of the diopter sight 3;
319—plate of the front sight bracket 310;
320—clamp of the front sight bracket 310;
321—complex-shaped through slot in plates 319, 340;
322—hole in the middle of the top of the clamp 320;
323—light holes on the side walls of the clamp 320 at the junction with the plate 319;
324—threaded hole on top in the middle of the plate 319 for front sight 311;
325—cross hole at the back on the side surface of the plate 319 for cap screw 312;
326—through longitudinal slot behind the threaded hole 324 in front of the wall of the clamp 320 for the entire thickness of the wall plate 319;
327—blades of the impeller 316;
328—dioptrical holes on the blades 327;
329—through axial hole of the impeller blade 316;
330—retainer pin on one of the blades of the impeller 327;
331—cylindrical section with the thread of the front sight 311;
332—prismatic section of the front sight 311;
333—cylindrical section of the front sight 311;
334—through hole in the cylindrical section with the thread 331;
335—cylindrical section with the tread of the adjustment screw 315;
336—cylindrical section of adjustment screw 315;
337—slot on the perimeter of the cylindrical section 336;
338—washer of the adjustment screw 315;
339—slot in the washer 338 and in the cylindrical section 336;
340—plate of the bracket 314;
341—clamp of the bracket 314;
342—hole in the center of the top of the clamp 341;
343—cylindrical protrusions on the side walls of the clamp 341;
344—cylindrical protrusions on the side walls of the clamp 341;
345—smooth hole of the protrusion 343;
346—threaded hole of the protrusion 344;
347—threaded hole on the side surface of the cylindrical protrusion 343;
348—holes on the side surface of the clamp 341 from smooth hole side 343;
349—front cross hole on the side surface of the plate 340 for cap screw 312;
350—through longitudinal slot in front of the clamp wall 341 on the entire wall thickness of the plate 340;
351—body of the forward grip 4;
352—cover with thread of the forward grip 4;
353—lock pin of the forward grip 4;
354—lock pin head of the forward grip 4;
355—splint pin of locking pin of the forward grip 4;
356—spring of the splint pin of the locking pin of the forward grip 4;
357—plate of the body 351;
358—holes in the forepart of the plate 357;
359—holes in forepart of the plate 357;
360—conical-cylindrical part connected with the rear end of the plate 357;
361—cavity inside the conical-cylindrical part 360;
362—thread of the cavity 361;

363—«L» edge in the middle of the upper surface of plate 357;
364—«L» protrusion in the middle of the upper surface of plate 357;
365—slot on «L» protrusions 363, 364;
366—bracket of the gunstock 366;
367—bushing of the gunstock axis 5;
368—gunstock 5 axis;
369—pin of the gunstock axis 5;
370—spring of gunstock axis 5;
371—gunstock base 5;
372—adjustment lever of the gunstock 5;
373—axis of the adjustment lever of the gunstock 5;
374—spring of the adjustment lever of the gunstock 5;
375—body of the gunstock 5;
376—smooth gunstock plate 5;
377—"T" shaped section of the gunstock bracket 366;
378—inclined slot of "T" shaped section 377;
379—blind hole of "T" shaped section 377;
380—locking protrusion of "T" shaped section 377;
381—protrusion on another side of "T" shaped section 377;
382—cylinder in the upper part of the protrusion 381;
383—protrusion in the lower part of the protrusion 381;
384—inclined sides on the protrusion 381;
385—horizontal area on protrusion 381;
385—radial side on protrusion 381;
387—through hole on protrusion 381 at gunstock axis 368;
388—rod of gunstock axis 368;
389—rod with the smaller diameter of gunstock axis 368;
390—circular groove in the rod 388;
391—longitudinal slot in the rod 388 after circular groove 390;
392—blind slot in the rod 388 after circular groove 390;
393—splineway at the beginning of the rod 388;
394—bracket of the gunstock base 371;
395—"T" shaped protrusion of the base of gunstock base 371;
396—slots in "T" shaped protrusion 395;
397—rectangular slot behind "T" shaped protrusion 395;
398—through hole on rectangular slot 397;
399—blind hole on rectangular slot 397;
400—cross through hole inside of the rectangular slot 397;
401—inclined platform at the beginning of the bracket 394;
402—rectangular slot at the beginning of the bracket 394;
403—upper protrusion at the beginning of the bracket 394;
404—lower protrusion at the beginning of the bracket 394;
405—through hole in upper protrusion 403 and lower protrusion 404 for the gunstock axis 368;
406—through hole in upper protrusion 403 and lower protrusion 404 for the gunstock axis 368;
407—through hole on lower protrusion side 404 for the pin of the gunstock axis 369;
408—lever of the adjustment lever of the gunstock 372;
409—blind hole on one side of the lever 408 for the spring of adjustment lever 374;
410—protrusion on another side of the lever 408;
411—incline plane of the protrusion 410;
412—through hole inside the lever 408;
413—plate of the gunstock body 375;
414—protrusion of the plate 413;
415—complex-shaped hole in the rear part of plate 413, in front of protrusion 414;
416—guide "T" shaped, blind slot in front of plate 413;
417—cross grooves in "T" shaped, guide, blind slot 416;
418—chamfer of the first cross groove at the beginning of "T" shaped, blind slot 416;
419—negative incline of chamfer 418;
420—rectangular hole in protrusion 414;
421—section in the cavity 422;
422—cavity of the trigger housing 31B or 31C;
423—magazine platform of the slide stop 50;
424—protrusion of the magazine platform 423;
425—gap between the inclined protrusion 81 of the cocking lever 8 and bolt carrier 12A or 12B;
426—gap between support platform 96 of bolt carrier 12A or 12B and front stop 72 of the receiver cover 7;
427—knife-bayonet, which mounted on weapon 1;
428—front stop with knife-bayonet 427;
429—back stop with the hook-shaped protrusion of the knife-bayonet 427;
430—slot of the handle 431;
431—handle of the knife-bayonet 427;
432—lock time;
433—propellant;
434—shell;
435—primer with anvil;
436—igniter block;
437—fors flame, which makes igniter block 433 burnt;
438—gases, which released when igniter block 433 is being burnt;
439—projectile chamber;
440—leading cylindrical part of the projectile 344;
441—gap between cylindrical rear part 442 of the projectile 434 and internal surface of the multifunctional cartridge 26;
T441—thickness of the gap 441;
442—rear cylindrical part of the projectile 434;
443—gap between cylindrical piston 123 of the percussion piston 17 and the internal surface of the stout wall 116 of the conical bushing of the bolt 18;
T443—thickness of the gap 443;
444—ignition time;
445—screw-type bore on the projectile 434;
446—barrel time;
447—gas blanket, created by the gases 434 via the gap 448;
448—gap configured by rifling on the projectile 445;
T448—thickness of the gap 448;
449—free running gap disposed between external leading edge 103 of the cam slot 97 of the bolt carrier 12A or 12B and external sideway front scarf 137 on the leading protrusion 132 of the bolt body 19;
T449—thickness of the gap 449;
450—transitional period;
451—incoming airflow from the projectile 434 which fly out of the barrel 24;
452—reaction made by incoming airflow 451.

The following is a detailed description of the drawings of the present invention.

Figure 1A:
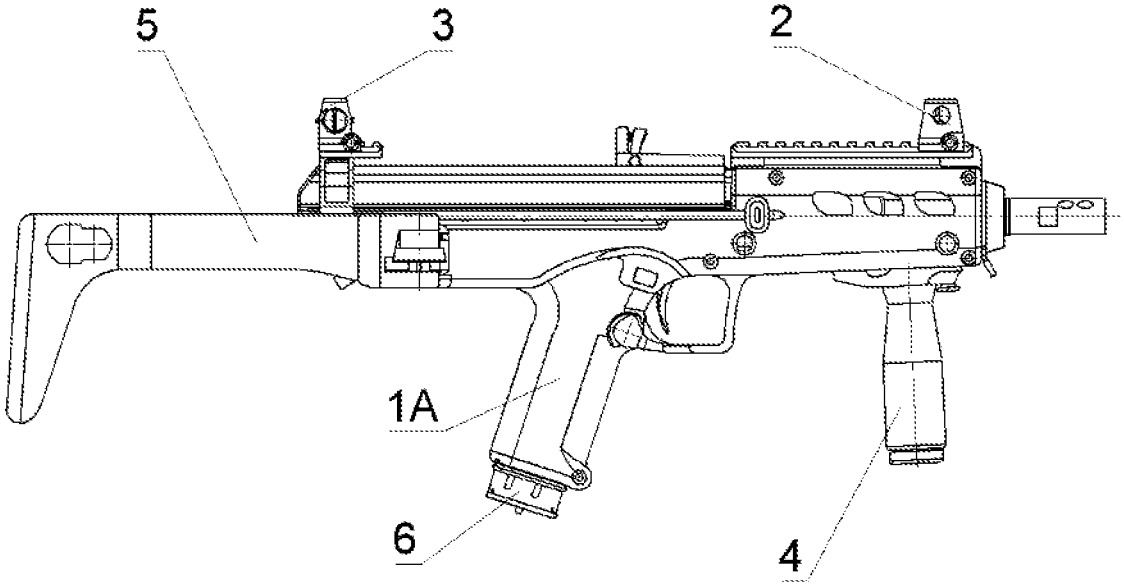
FIG. 1A is a schematic side view of the weapon 1A.
Figure 2A:
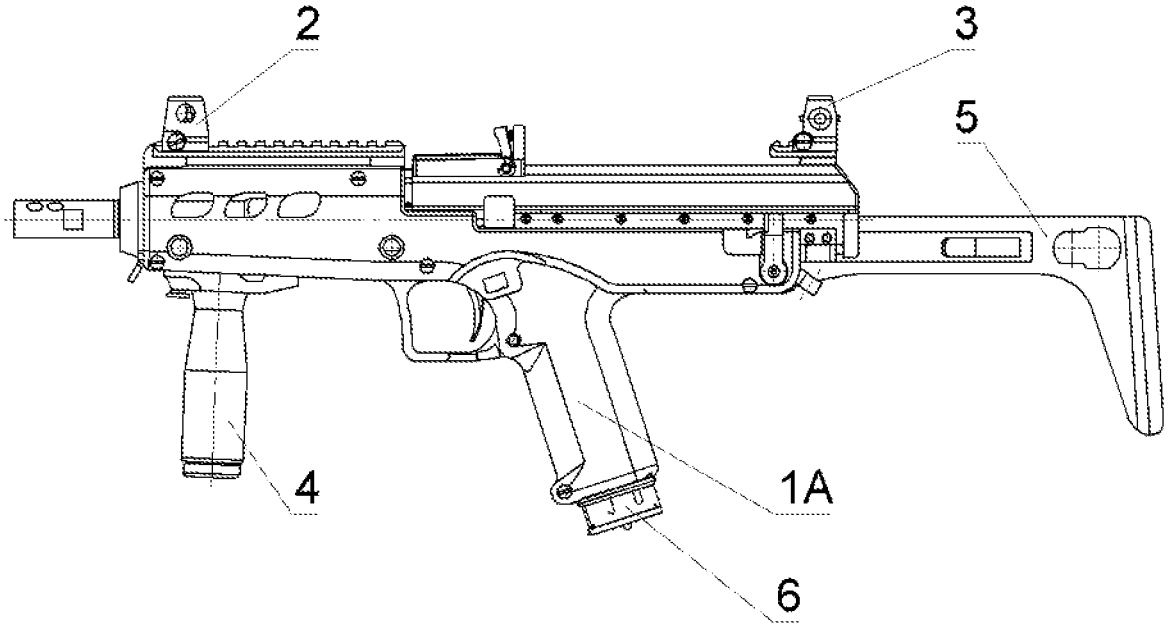
FIG. 2A is a schematic side view of the weapon 1A.
Figure 3A:
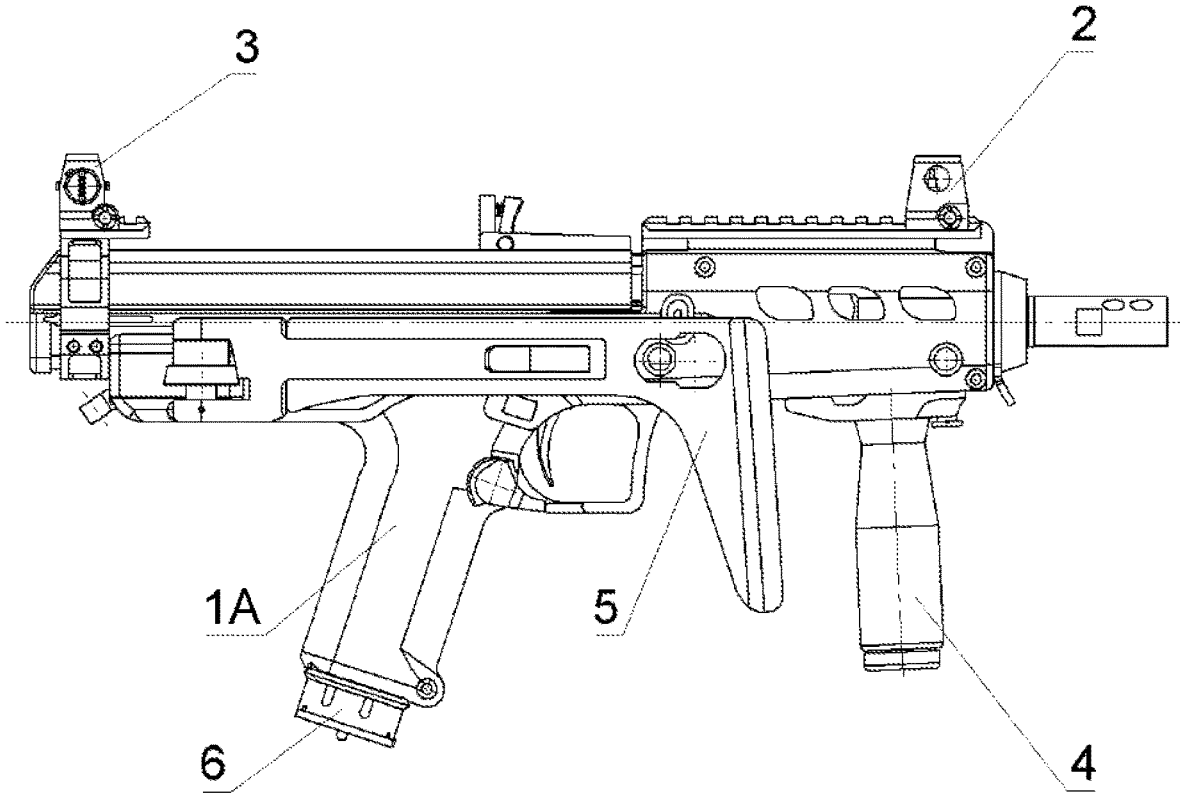
FIG. 3A is a schematic side view of the weapon 1A with folded gunstock.

FIG. 1A, FIG. 2A, FIG. 3A show a side view of the caseless weapon 1A. This configuration comprising: the weapon 1A, the removable front sight 2, the removable dioptrical sight 3, the forward grip 4, the gunstock 5 and the magazine 6.

Figure 1B:
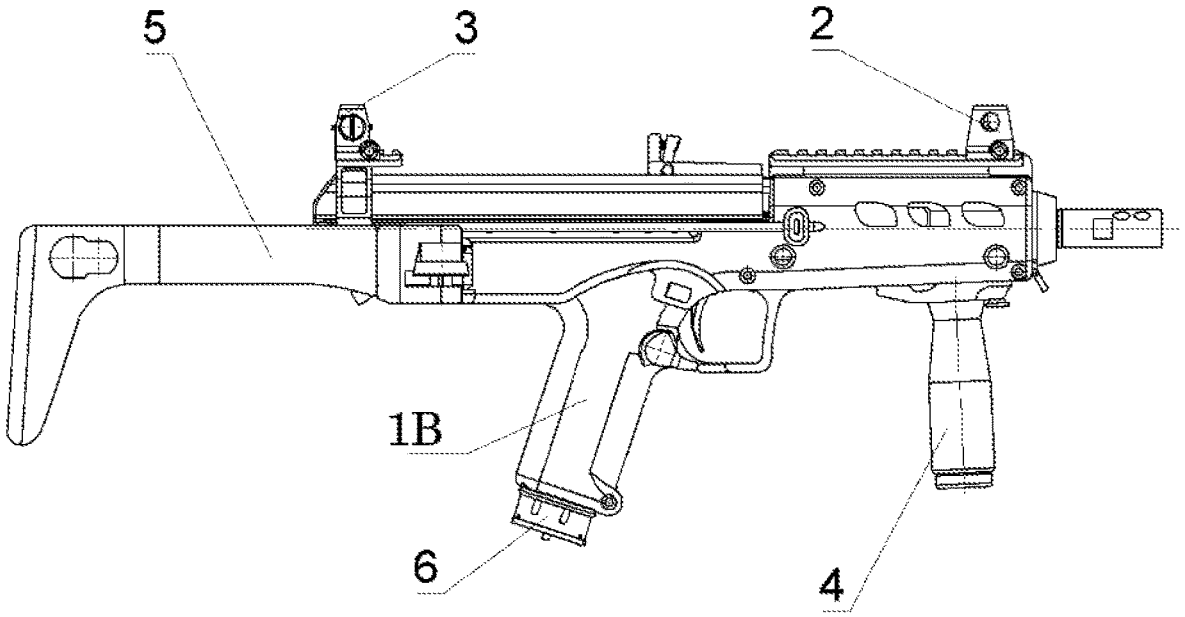
FIG. 1B is a schematic side view of the weapon 1B.
Figure 2B:
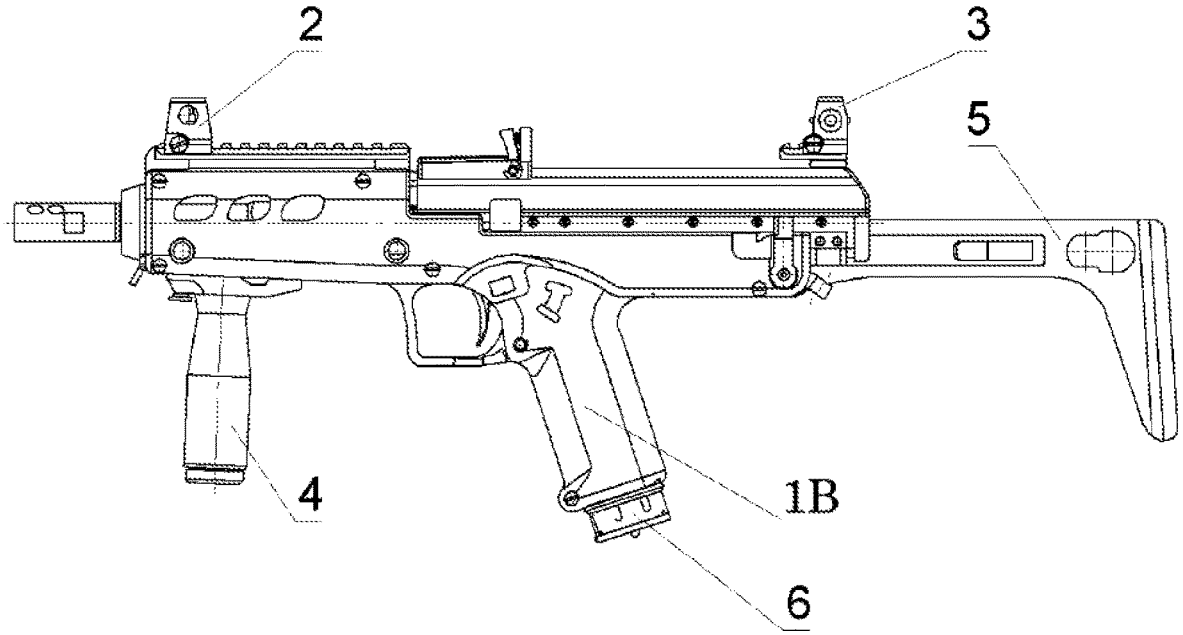
FIG. 2B is a schematic side view of the weapon 1B.
Figure 3B:
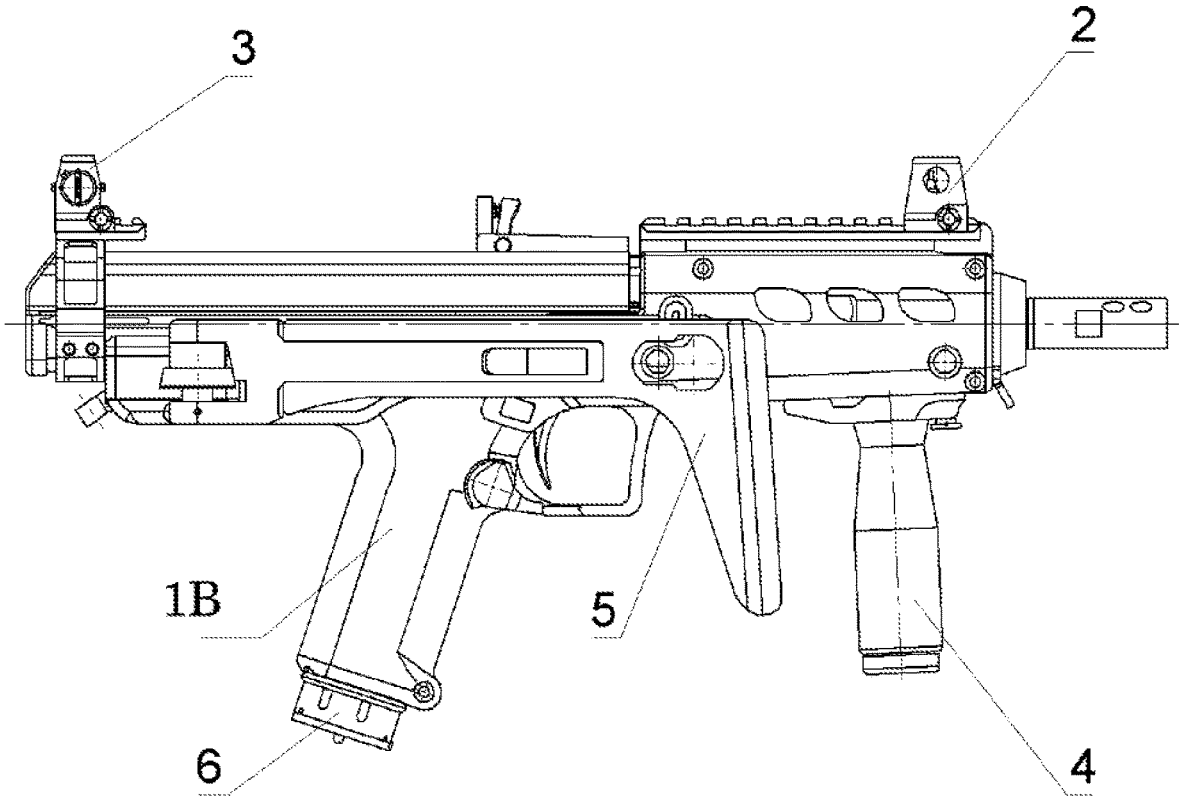
FIG. 3B is a schematic side view of the weapon 3B with folded gunstock.

FIG. 1B, FIG. 2B, FIG. 3B show a side view of the weapon 1B for the semi-automatic shot. This configuration comprising: the weapon 1B, the removable front sight 2, the removable dioptrical sight 3, the forward grip 4, the gunstock 5 and the magazine 6.

Figure 1C:
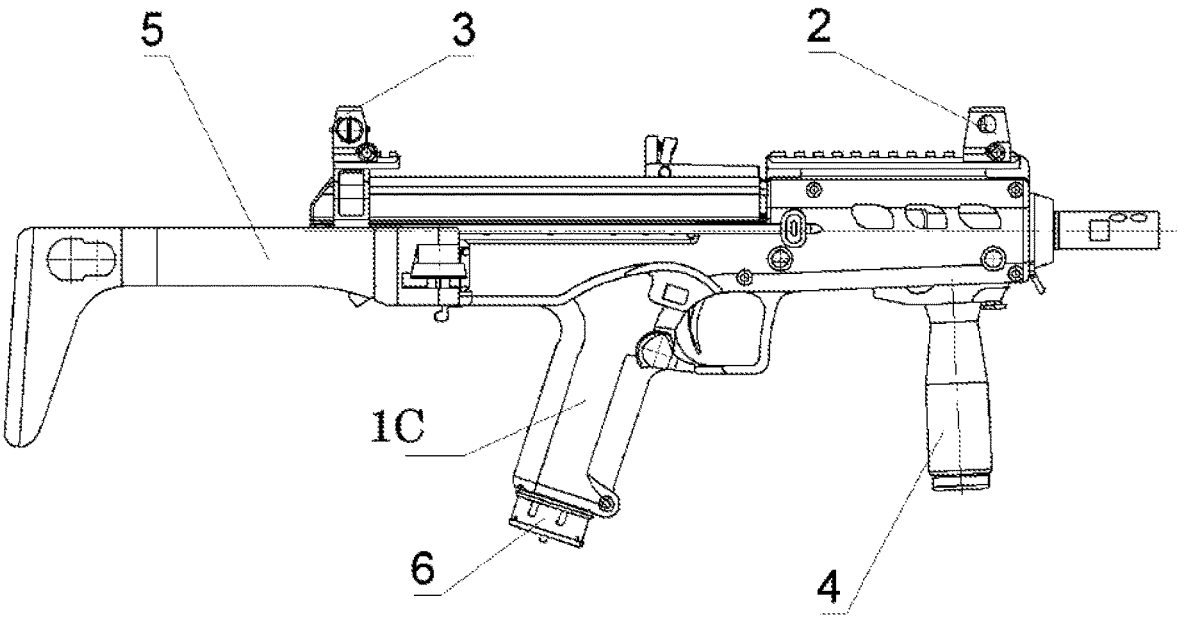
FIG. 1C is a schematic side view of the weapon 1C.
Figure 2C:
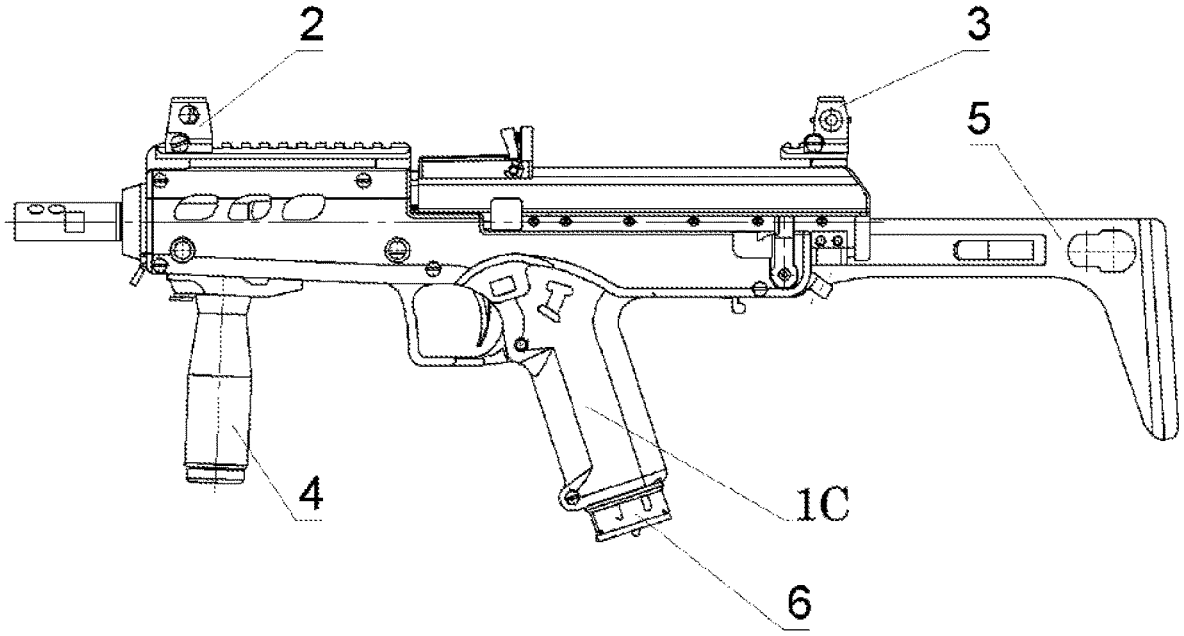
FIG. 2C is a schematic side view of the weapon 1C.
Figure 3C:
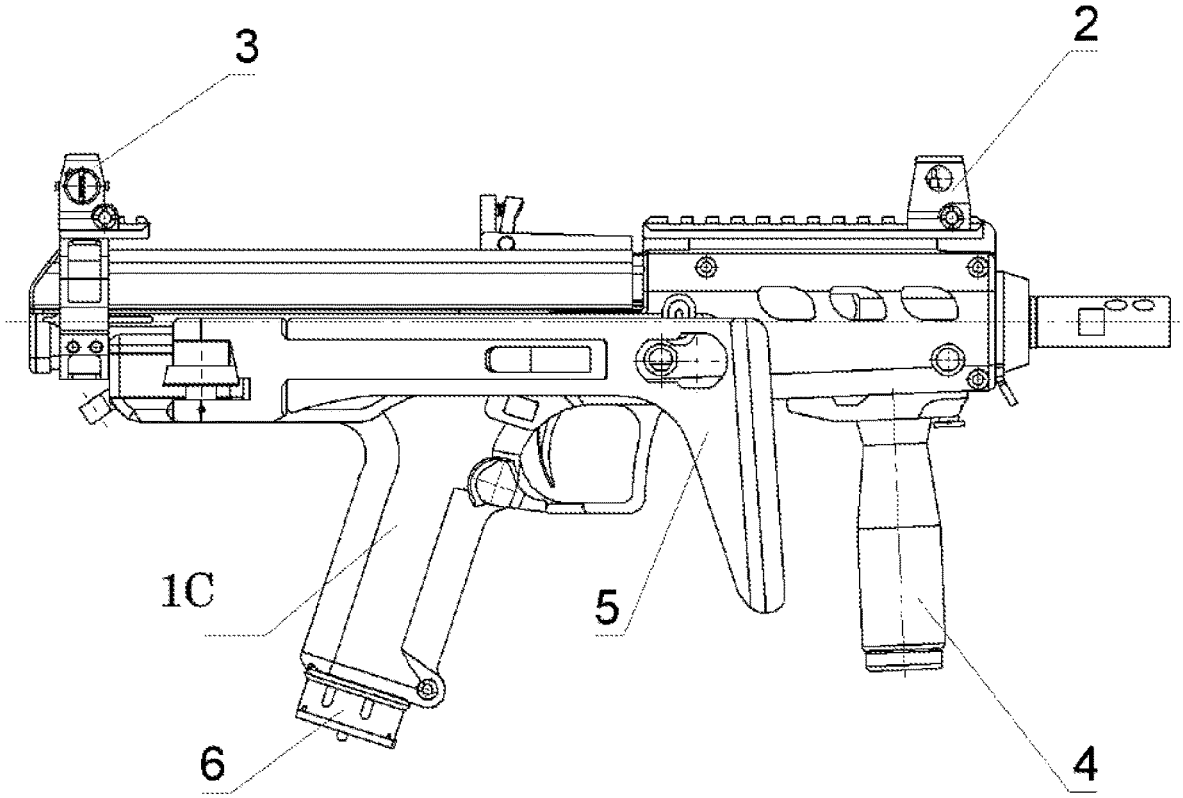
FIG. 3C is a schematic side view of the weapon 3C with folded gunstock.

FIG. 1C, FIG. 2C, FIG. 3C show a side view of the weapon 1C for automatic shot. This configuration comprising: the weapon 1C, the removable front sight 2, the removable dioptrical sight 3, the forward grip 4, the gunstock 5 and the magazine 6.

Figure 4:
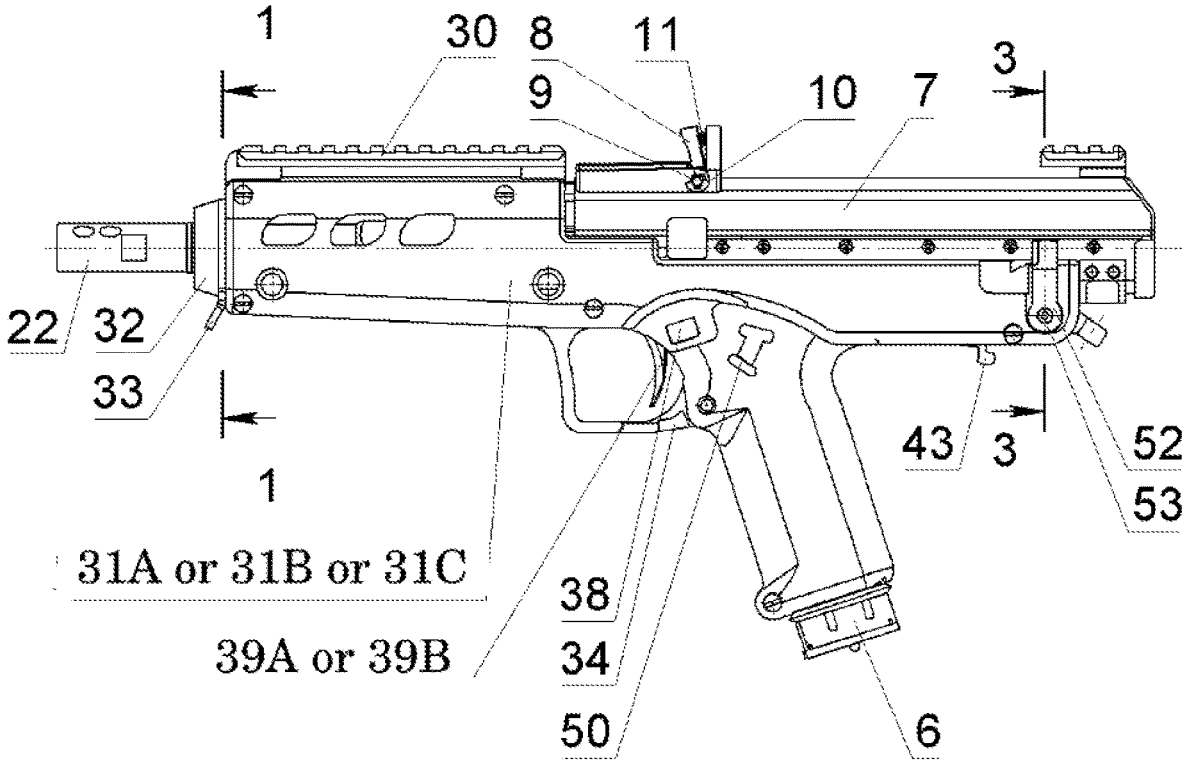
FIG. 4 is a side view of the weapon 1A or 1B or 1C.
Figure 5:
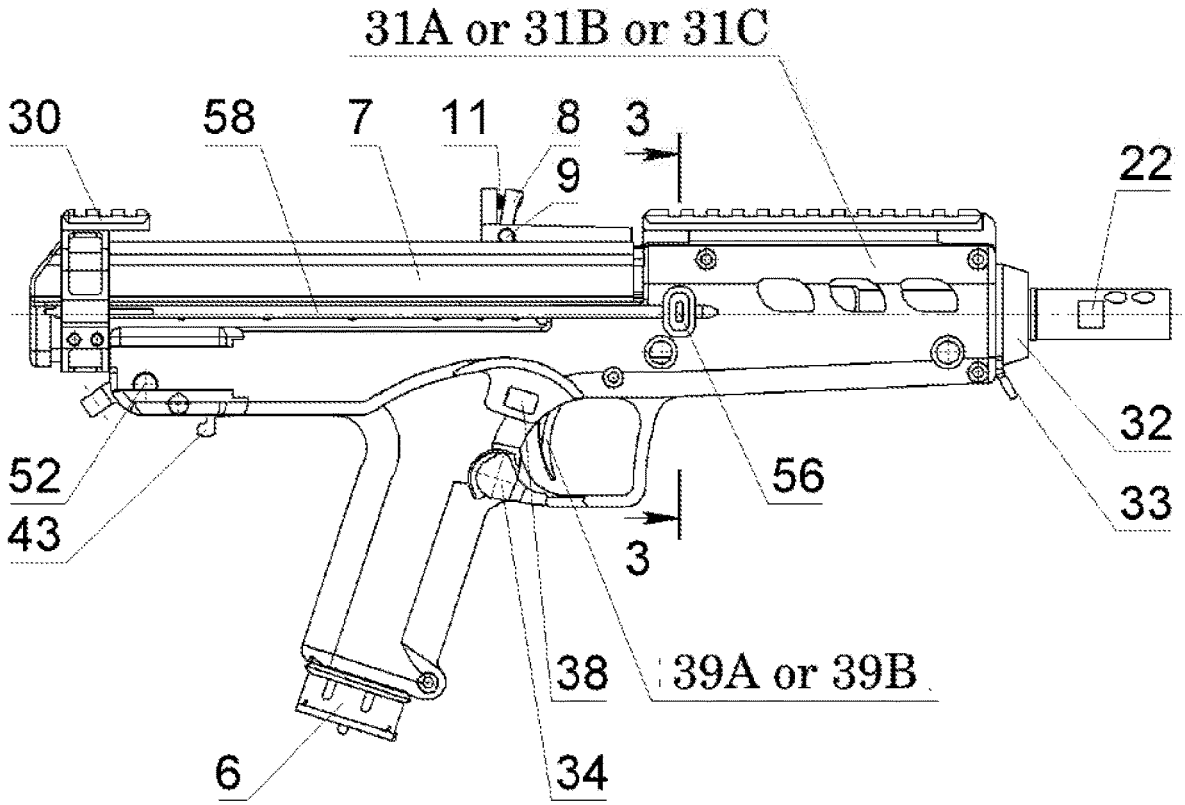
FIG. 5 is a side view of the 1A or 1B or 1C.
Figure 6A:
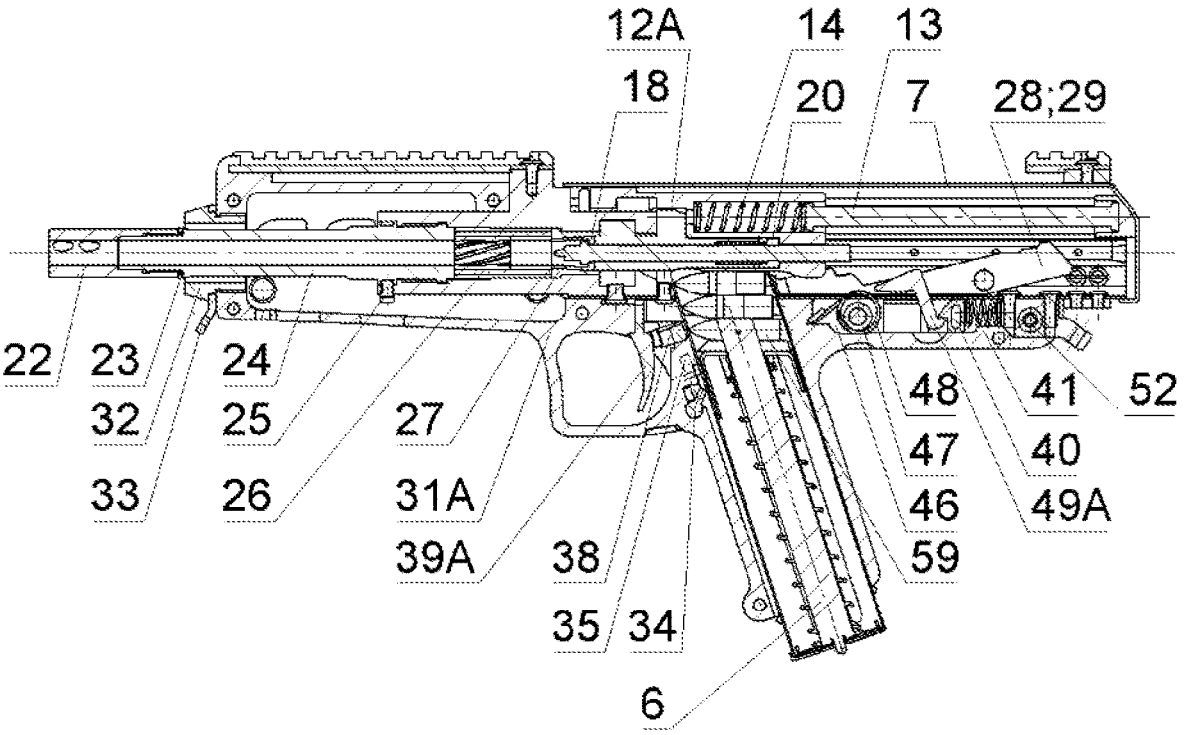
FIG. 6A is a longitudinal section of the weapon 1A in magazine embodiment.
Figure 7:
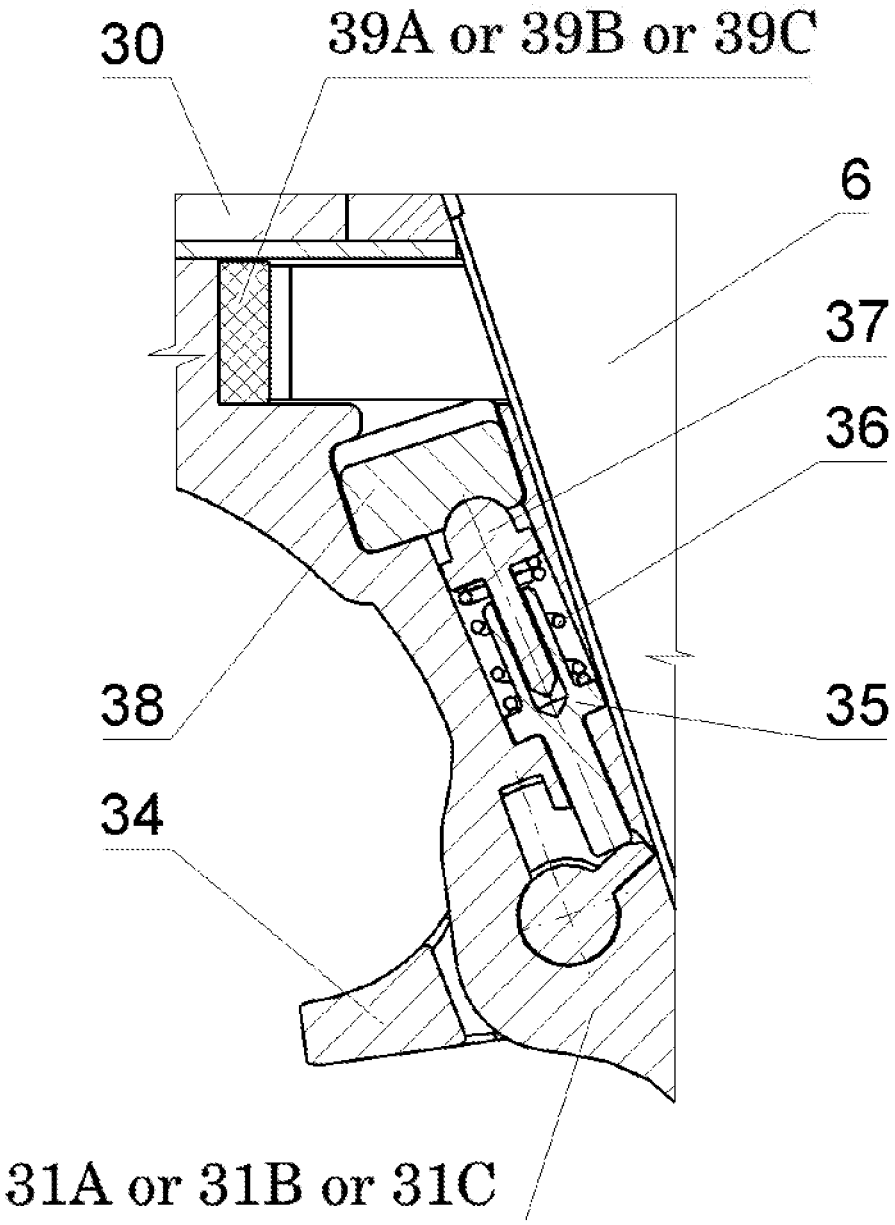
FIG. 7 is a fragment of a longitudinal section of the weapon 1A or 1B or 1C on the pusher 6 of the magazine latch 35.
Figure 8:
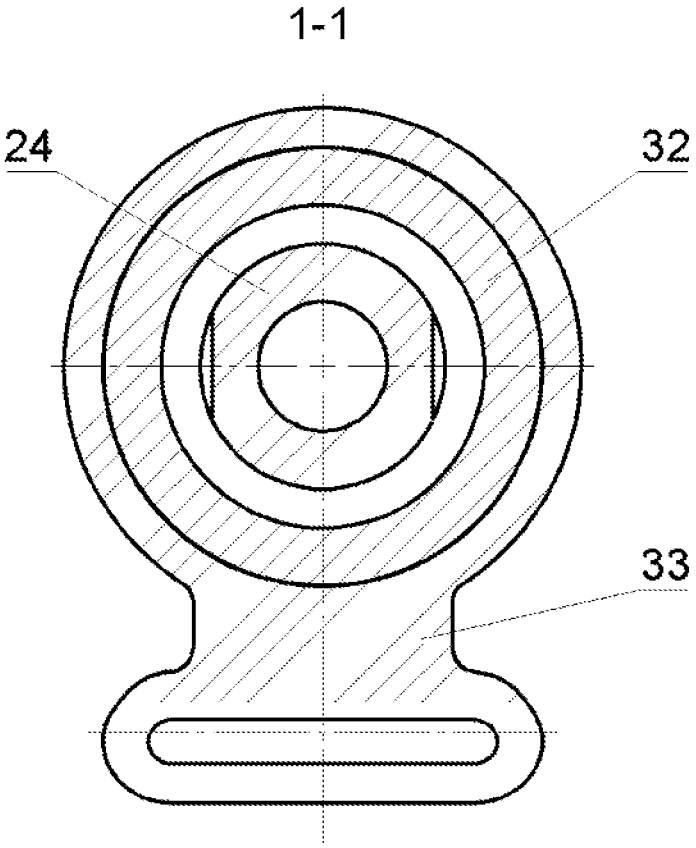
FIG. 8 is a cross-section 1-1 on FIG. 4.
Figure 9:
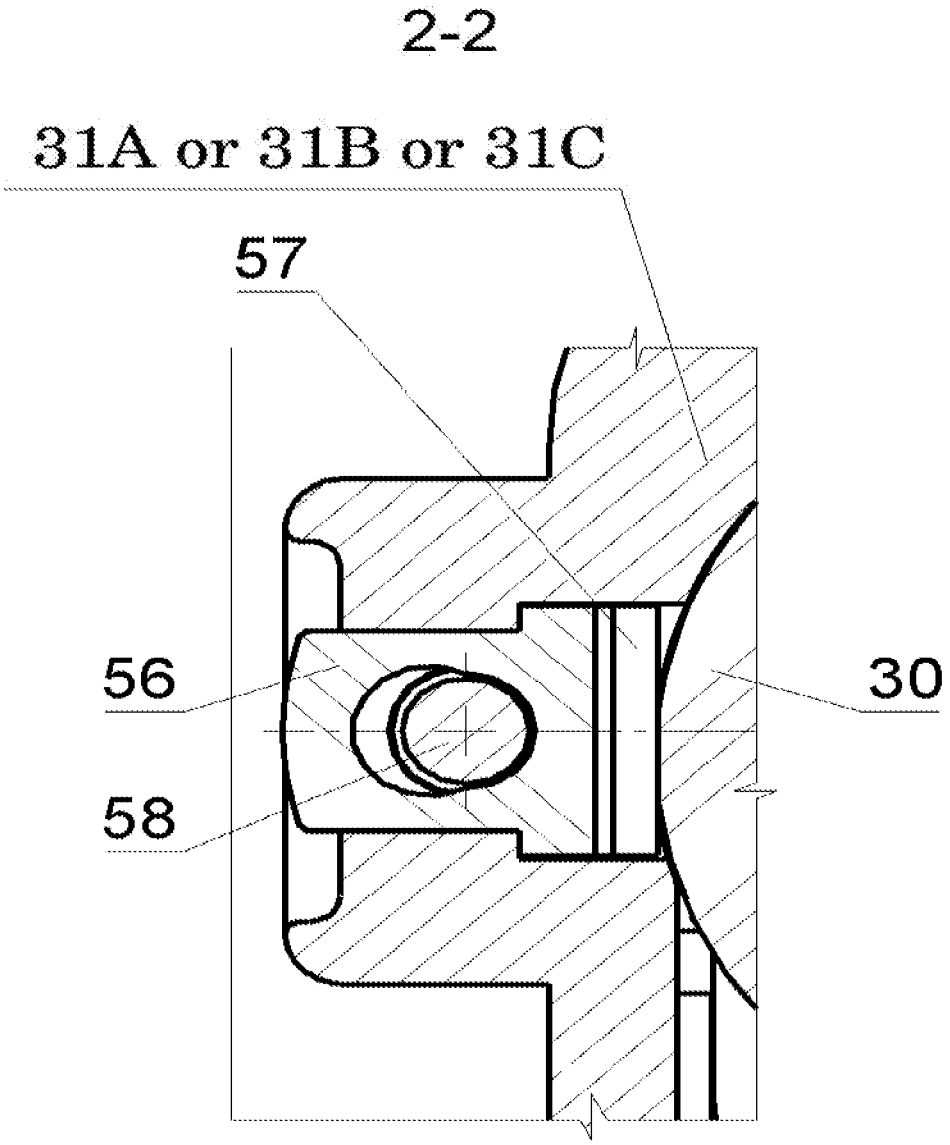
FIG. 9 is a cross-section 2-2 on FIG. 5.
Figure 13:
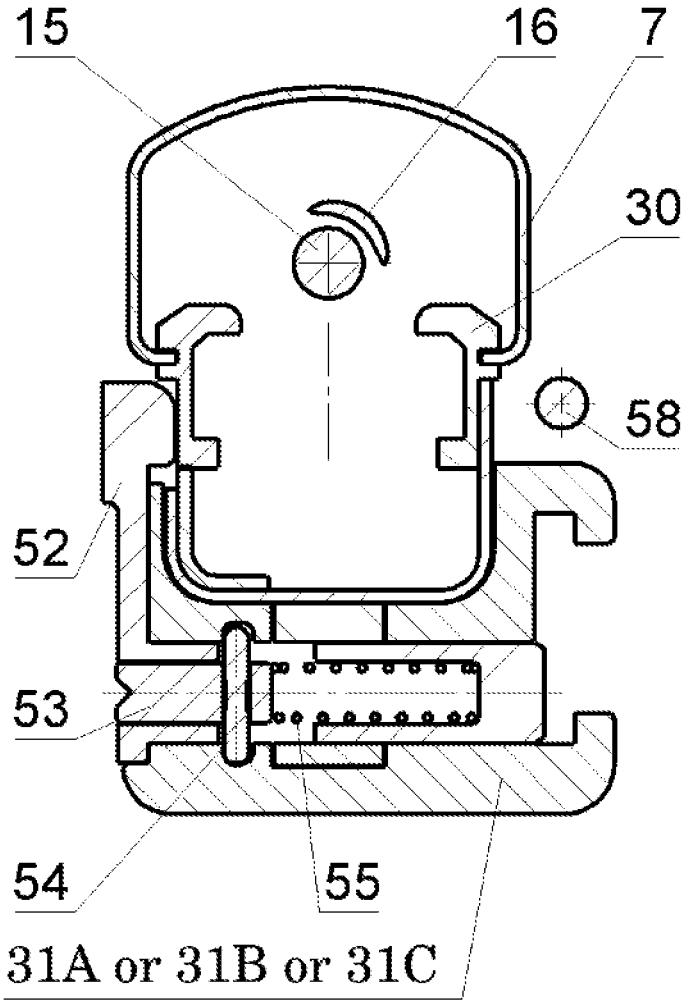
FIG. 13 is a cross-section 3-3 on FIG. 4 of the weapon 1A or 1B or 1C.

FIG. 4, FIG. 5 show a side view of the weapon for magazine shot 1A, FIG. 6A is a longitudinal section of the weapon 1A, FIG. 7 is a fragment of a longitudinal section of the weapon 1A on the pusher of the magazine latch 35, FIG. 8 is a cross-section 1-1 on FIG. 4, FIG. 9 is a cross-section 2-2 on FIG. 5, and FIG. 13 is a cross-section 3-3 on FIG. 4 of the weapon 1A. Weapon 1A comprising: the magazine 6, the receiver cover 7, the cocking lever 8, the cocking lever axis 9, the lock washer of the cocking lever axis 10, the spring of the cocking lever 11, the bolt carrier 12A, the rod 13, the spring of the rod 14, the percussion piston 17, the conical bushing of the bolt 18, the shutter housing 19, the safety catch of the firing percussion 20, the spring of the firing percussion 21, the balancing gear 22, the spring washer of the balancing gear 23, the barrel 24 with smooth channel, the barrel latch 25, multifunctional cartridge 26, the conical bushing of receiver 27, the extractor 28, the lock washer of the extractor 29, the receiver 30, the trigger housing 31A, the big front nut 32, the front swivel 33, the magazine latch 34, the magazine latch pusher 35, the safety latch spring 36, the safety latch 37, the safety catch 38, the trigger bar for semi-automatic shot 39A, the sear 40, the trigger bar spring 41, the bracket of the percussion mechanism 46, the axis of the cocking piece 47, the spiral mainspring 48, the cocking piece 49A, the multifunction latch lever 52, the stop of the multifunction latch 53, the lock pin splint 54, the spring of the lock pin splint 55, the latch of ramrod 56, the spring of the latch of ramrod 57, the ramrod 58, the caseless ammunition 59.

Figure 6B:
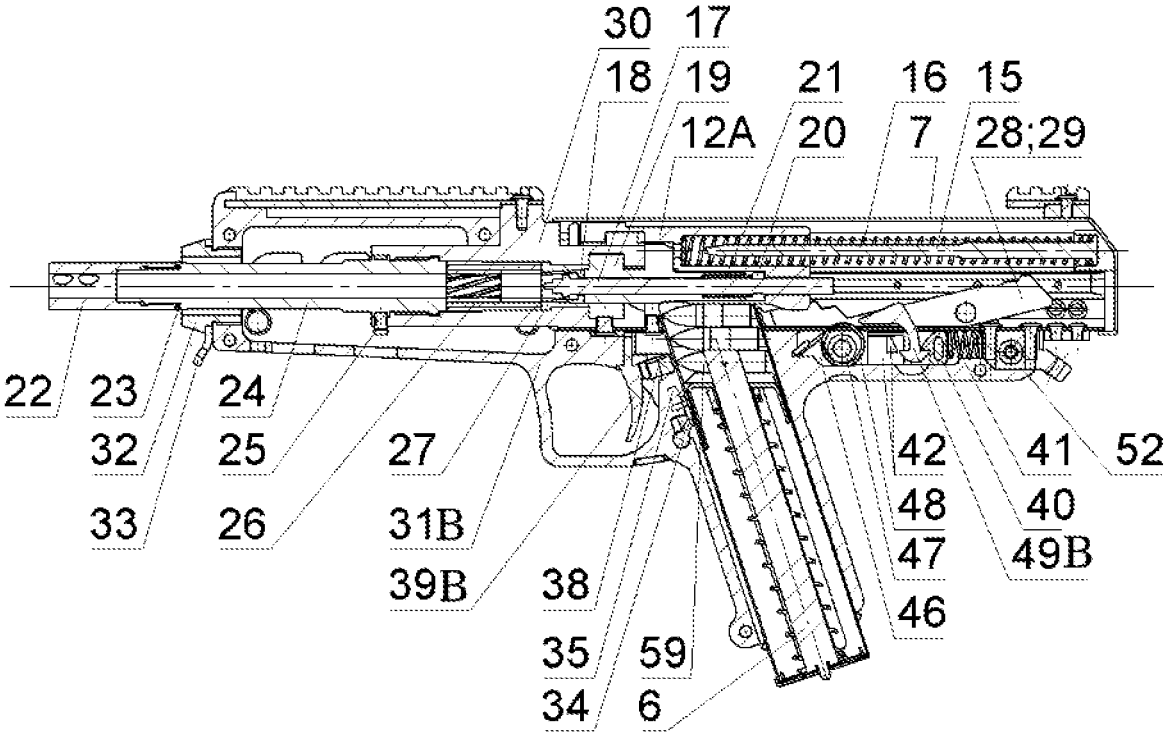
FIG. 6B is a longitudinal section of the weapon 1B in semi-automatic embodiment.
Figure 10:
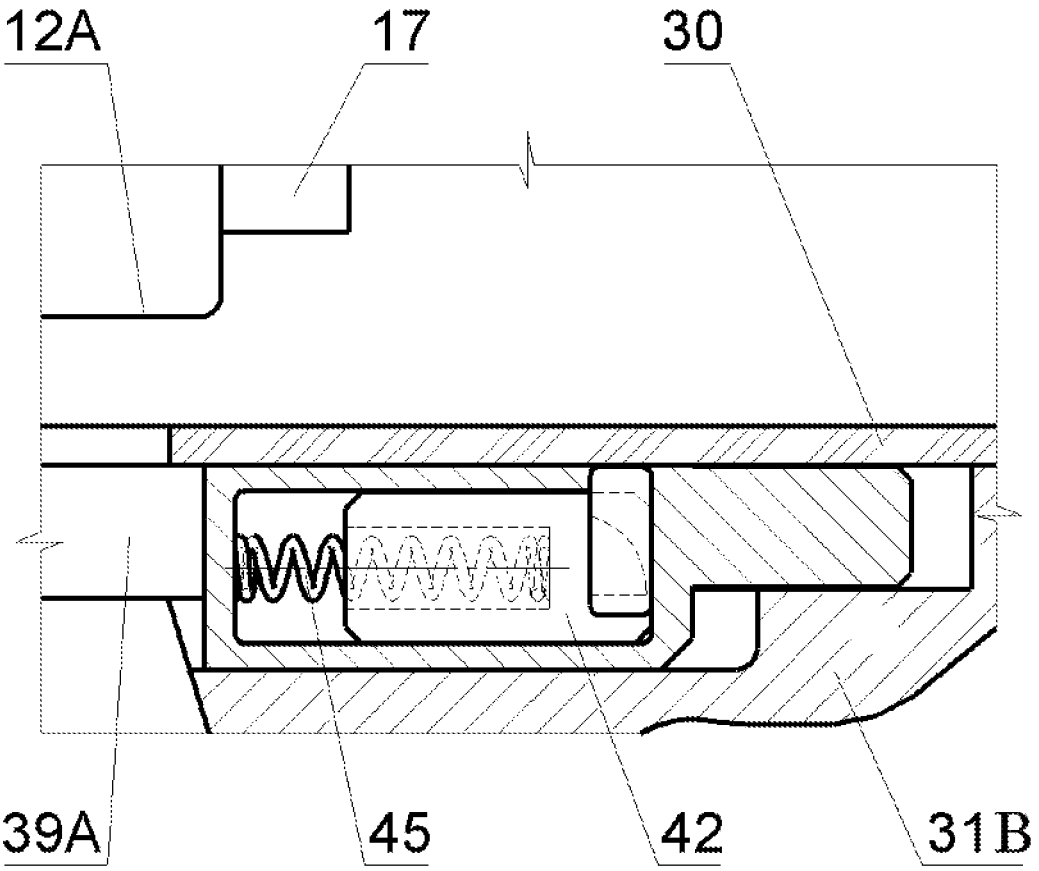
FIG. 10 is a fragment of a longitudinal section of the weapon 1B on the single-shot sear 42.
Figure 12:
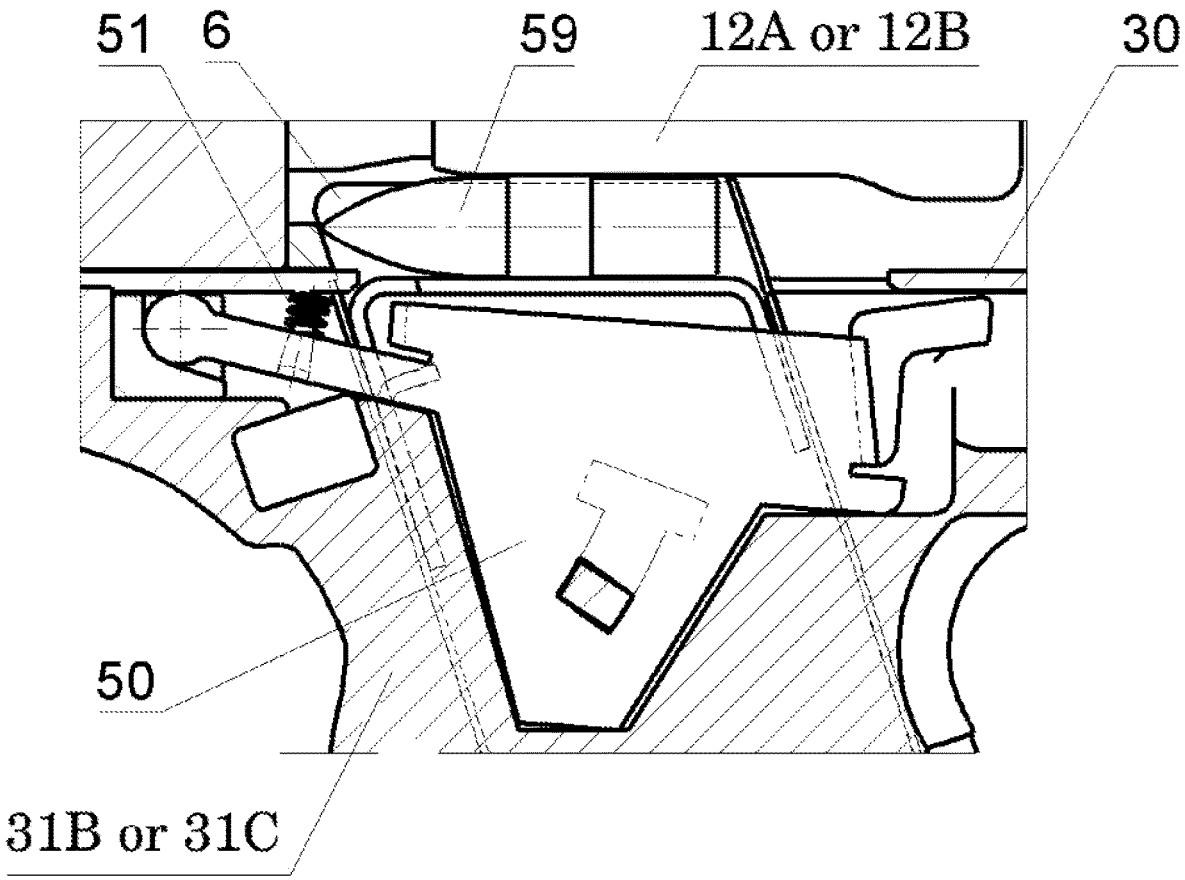
FIG. 12 is a fragment of a longitudinal section of the weapon 1B or 1C on the slide stop 50.

FIG. 4, FIG. 5 show a side view of the weapon for semi-automatic shot 1B, FIG. 6B is longitudinal section of the weapon 1B in semi-automatic embodiment, FIG. 7 is fragment of a longitudinal section of the weapon 1B on the pusher of the magazine latch 35, FIG. 8 is cross-section 1-1 on FIG. 4, FIG. 9 is cross-section 2-2 on FIG. 5, FIG. 10 is fragment of longitudinal section of the weapon 1B on the single-shot sear 42, FIG. 12 is fragment of longitudinal section of the weapon 1B on the slide stop 50, and FIG. 13 is cross-section 3-3 on FIG. 4 of the weapon 1B. Weapon 1B comprising: the magazine 6, the receiver cover 7, the cocking lever 8, the cocking lever axis 9, the lock washer of the cocking lever axis 10, the spring of cocking lever 11, the bolt carrier 12A, the guide rod of the returnable spring 15, the returnable spring 16, the percussion piston 17, the conical bushing of the bolt 18, the shutter housing 19, the safety catch of the firing percussion 20, the spring of the firing percussion 21, the balancing gear 22, the spring washer of the balancing gear 23, the barrel 24 with smooth channel, the barrel latch 25, the multifunctional cartridge 26, the conical bushing of receiver 27, the extractor 28, the lock washer of the extractor 29, the receiver 30, the trigger housing 31B, the big front nut 32, the front swivel 33, the magazine latch 34, the magazine latch pusher 35, the safety latch spring 36, the safety latch 37, the safety catch 38, the trigger bar for semi-automatic shot 39A, the sear 40, the trigger bar spring 41, the single-shot sear 42, the trigger bar spring 45, bracket of the percussion mechanism 46, the axis of the cocking piece 47, the spiral mainspring 48, the cocking piece 49B, the slide stop 50, the slide stop spring 51, the multifunction latch lever 52, the stop of the multifunction latch 53, the lock pin splint 54, the spring of the lock pin splint 55, the latch of ramrod 56, the spring of the latch of ramrod 57, the ramrod 58, the caseless ammunition 59.

Figure 6C:
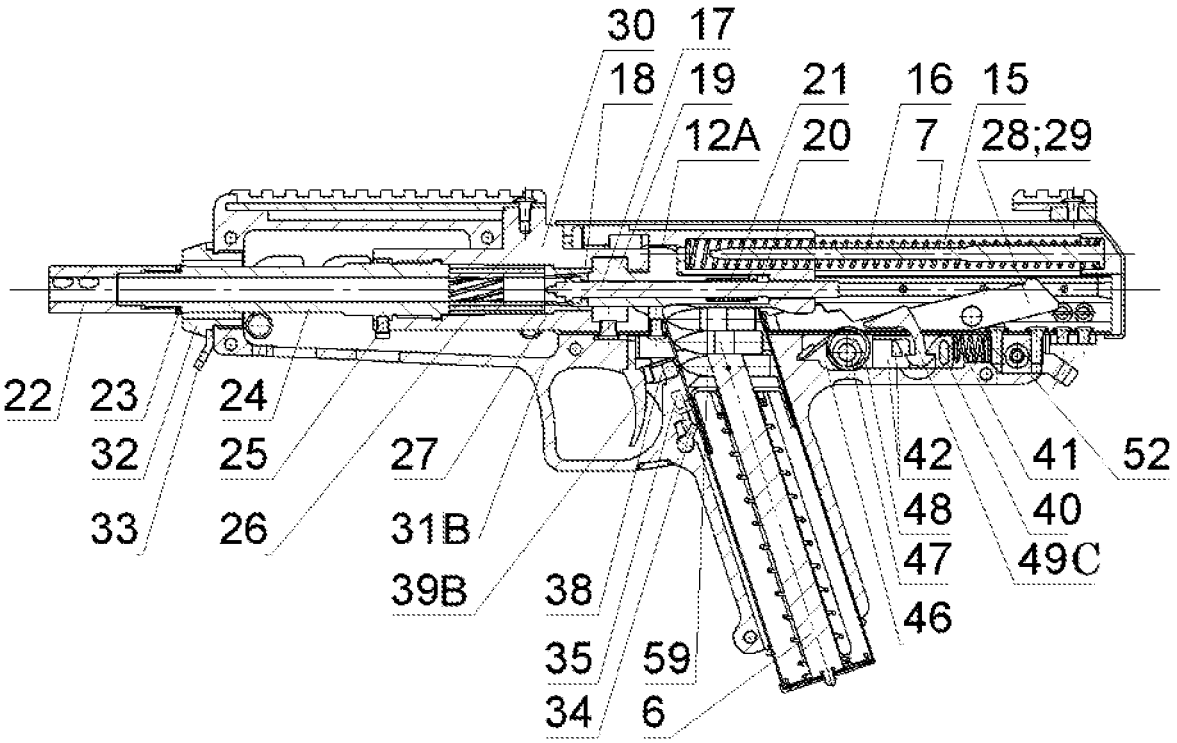
FIG. 6C is a longitudinal section of the weapon 1C in automatic embodiment.
Figure 11:
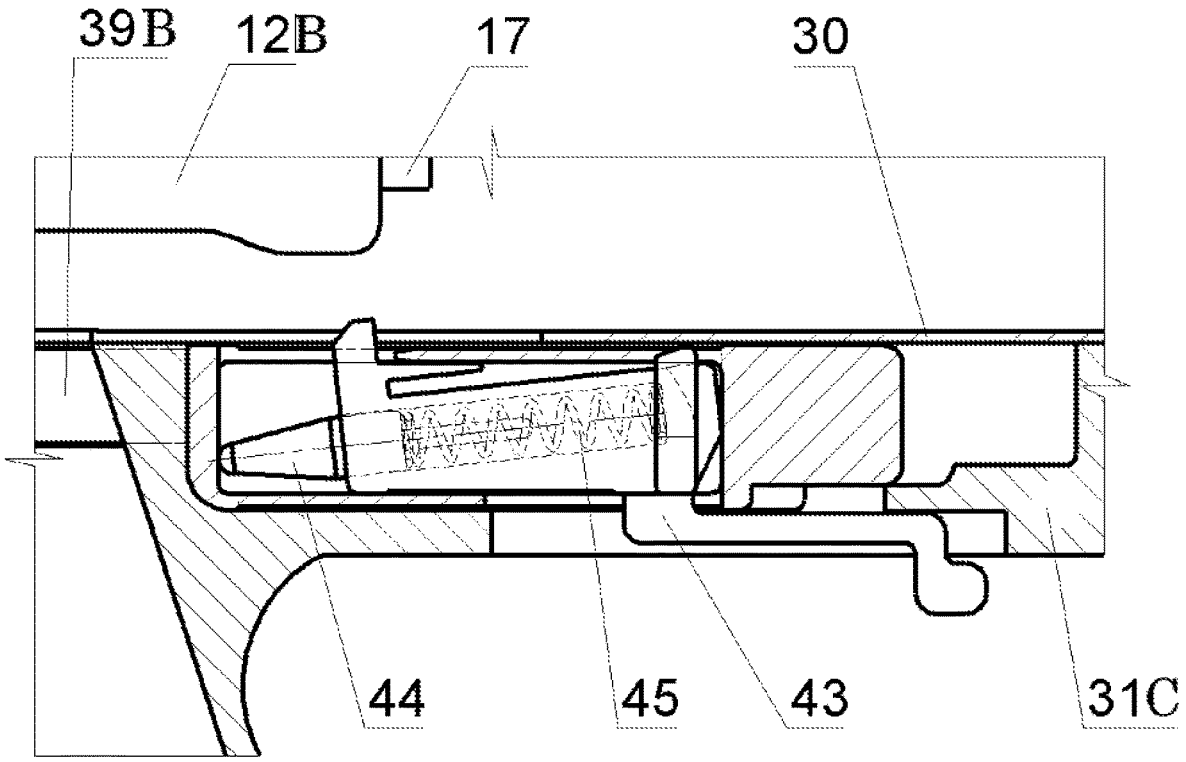
FIG. 11 is a fragment of a longitudinal section of the weapon 1C on the the multifunction switch 43.

FIG. 4, FIG. 5 show side view of the weapon for automatic shot 1C, FIG. 6C is longitudinal section of the weapon 1C, FIG. 7 is fragment of a longitudinal section of the weapon 1C on the pusher of the magazine latch 35, FIG. 8 is cross-section 1-1 on FIG. 4, FIG. 9 is cross-section 2-2 on FIG. 5, FIG. 11 is fragment of longitudinal section of the weapon 1C on the multifunction switch 43, FIG. 12 is fragment of longitudinal section of the weapon 1C on the slide stop 50, and FIG. 13 is cross-section 3-3 on FIG. 4 of the weapon 1C. Weapon 1C comprising: the magazine 6, the receiver cover 7, the cocking lever 8, the cocking lever axis 9, the lock washer of the cocking lever axis 10, the spring of the cocking lever 11, the bolt carrier 12B, the guide rod of a returnable spring 15, the returnable spring 16, the percussion piston 17, the conical bushing of the bolt 18, the shutter housing 19, the safety catch of the firing percussion 20, the spring of the firing percussion 21, the balancing gear 22, the spring washer of balancing gear 23, the barrel 24 with smooth channel, the barrel latch 25, the multifunctional cartridge 26, the conical bushing of receiver 27, the extractor 28, the lock washer of the extractor 29, the receiver 30, the trigger housing 31C, the big front nut 32, the front swivel 33, the magazine latch 34, the magazine latch pusher 35, the safety latch spring 36, the safety latch 37, the safety catch 38, the trigger bar for the semi-automatic shot 39B, sear 40, the trigger bar spring 41, the multifunction switch 43, the multifunction switch axis 44, the trigger bar spring 45, the bracket of the percussion mechanism 46, the axis of the cocking piece 47, the spiral mainspring 48, the cocking piece 49B, the slide stop 50, the slide stop spring 51, the multifunction latch lever 52, the stop of the multifunction latch 53, the lock pin splint 54, the spring of the lock pin splint 55, the latch of ramrod 56, the spring of the latch of ramrod 57, the ramrod 58, the caseless ammunition 59.

Figure 14:
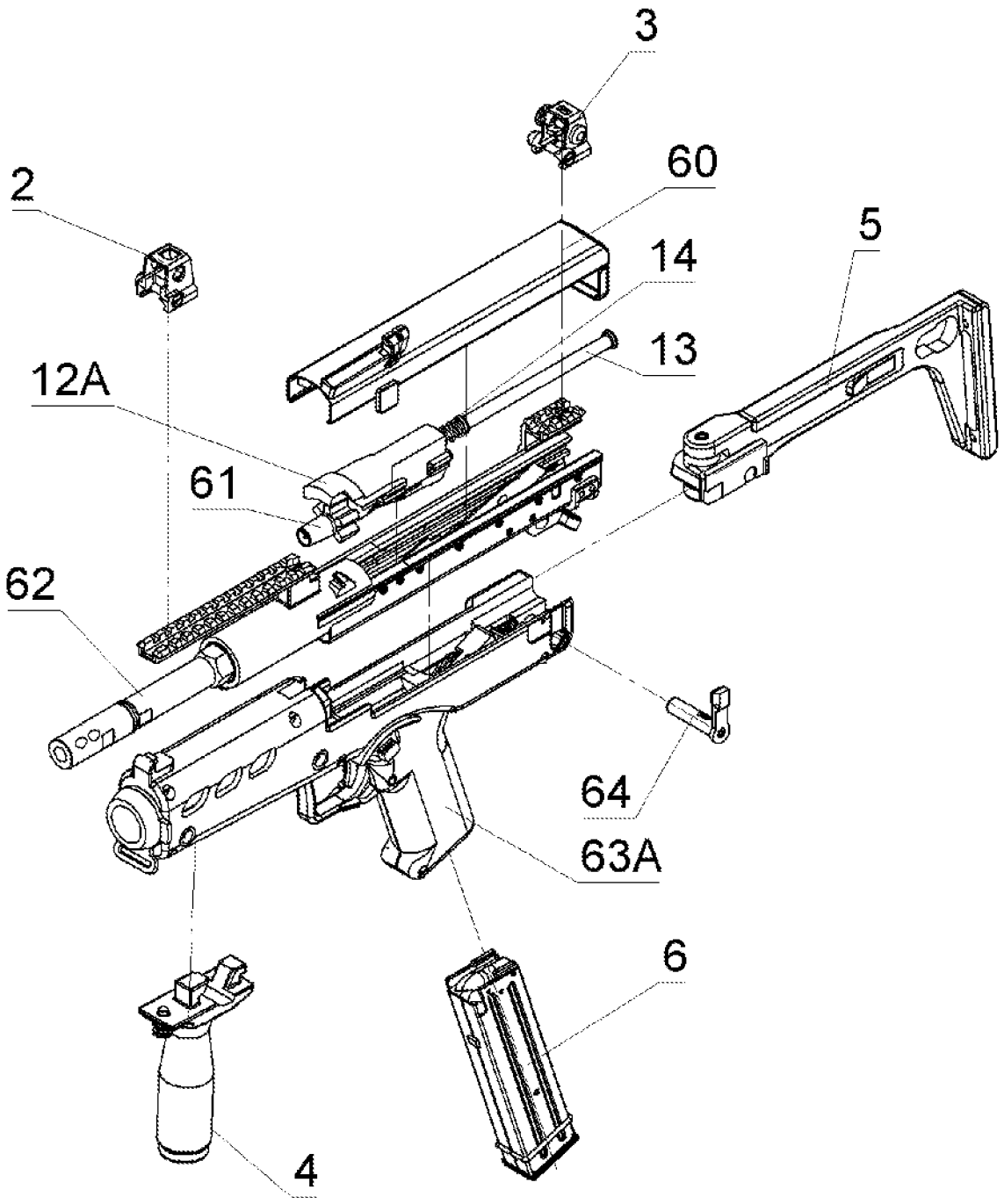
FIG. 14 is a disassembly of the magazine weapon 1A on units (side view).

FIG. 14 is a disassembly of the magazine weapon 1A on units (side view). Units comprising: the removable front sight 2, the removable dioptrical sight 3, the forward grip 4, the gunstock 5, the magazine 6, the cover of the receiver with mechanisms 60, the bolt carrier 12A with the bolt 61, the rod 13, the spring of the rod 14, the receiver with barrel and mechanisms 62, the trigger housing with mechanisms 63A, the multifunction latch 64.

Figure 15:
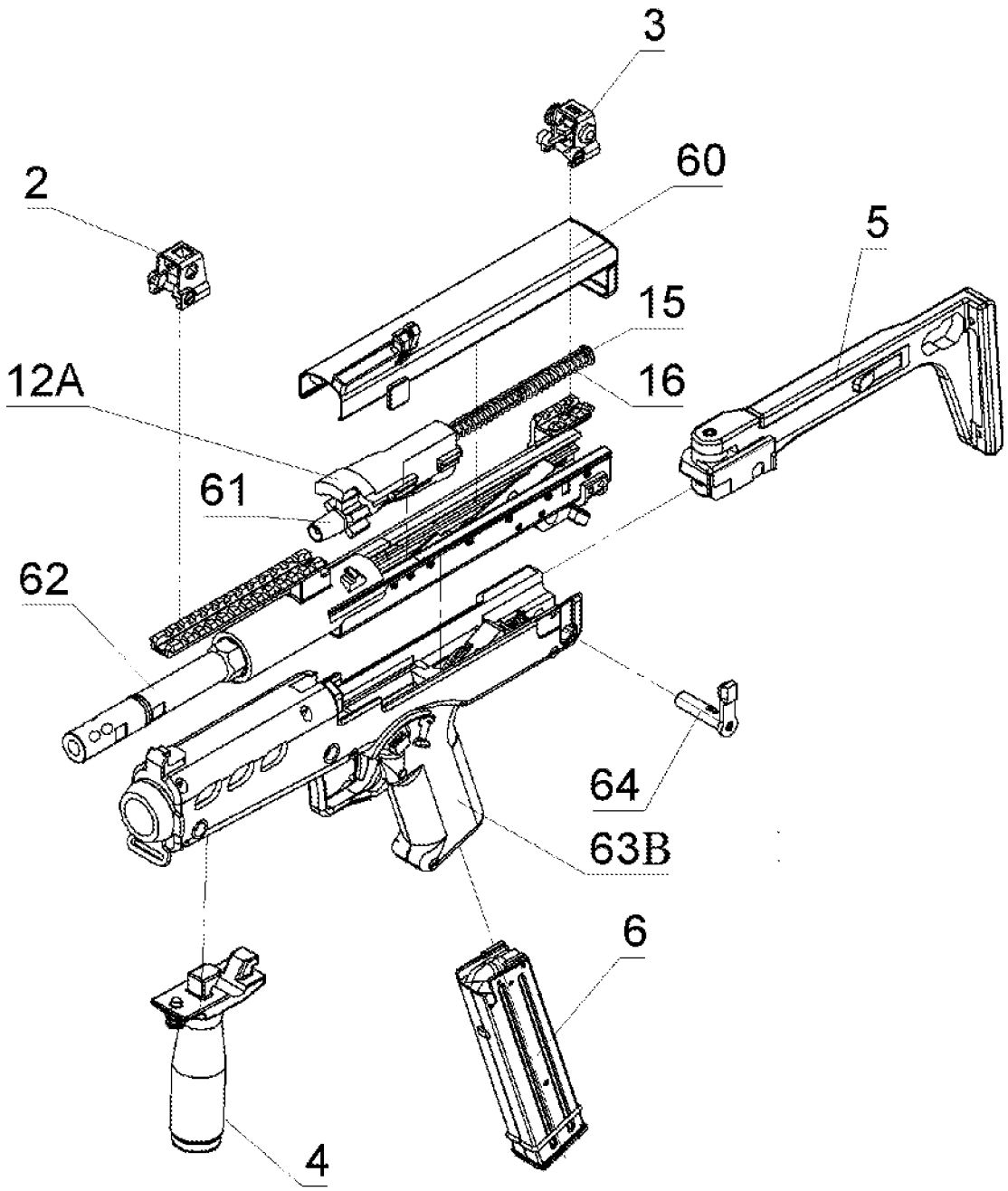
FIG. 15 is a disassembly of the semi-automatic weapon 1B on units (side view).

FIG. 15 is a disassembly of the semi-automatic weapon 1B on units (side view). Units comprising: the removable front sight 2, the removable dioptrical sight 3, the forward grip 4, the gunstock 5, the magazine 6, the cover of the receiver with mechanisms 60, the bolt carrier 12A with the bolt 61, the guide rod of a returnable spring 15, the returnable spring 16, the receiver with barrel and mechanisms 62, the trigger housing with mechanisms 63B, the multifunction latch 64.

Figure 16:
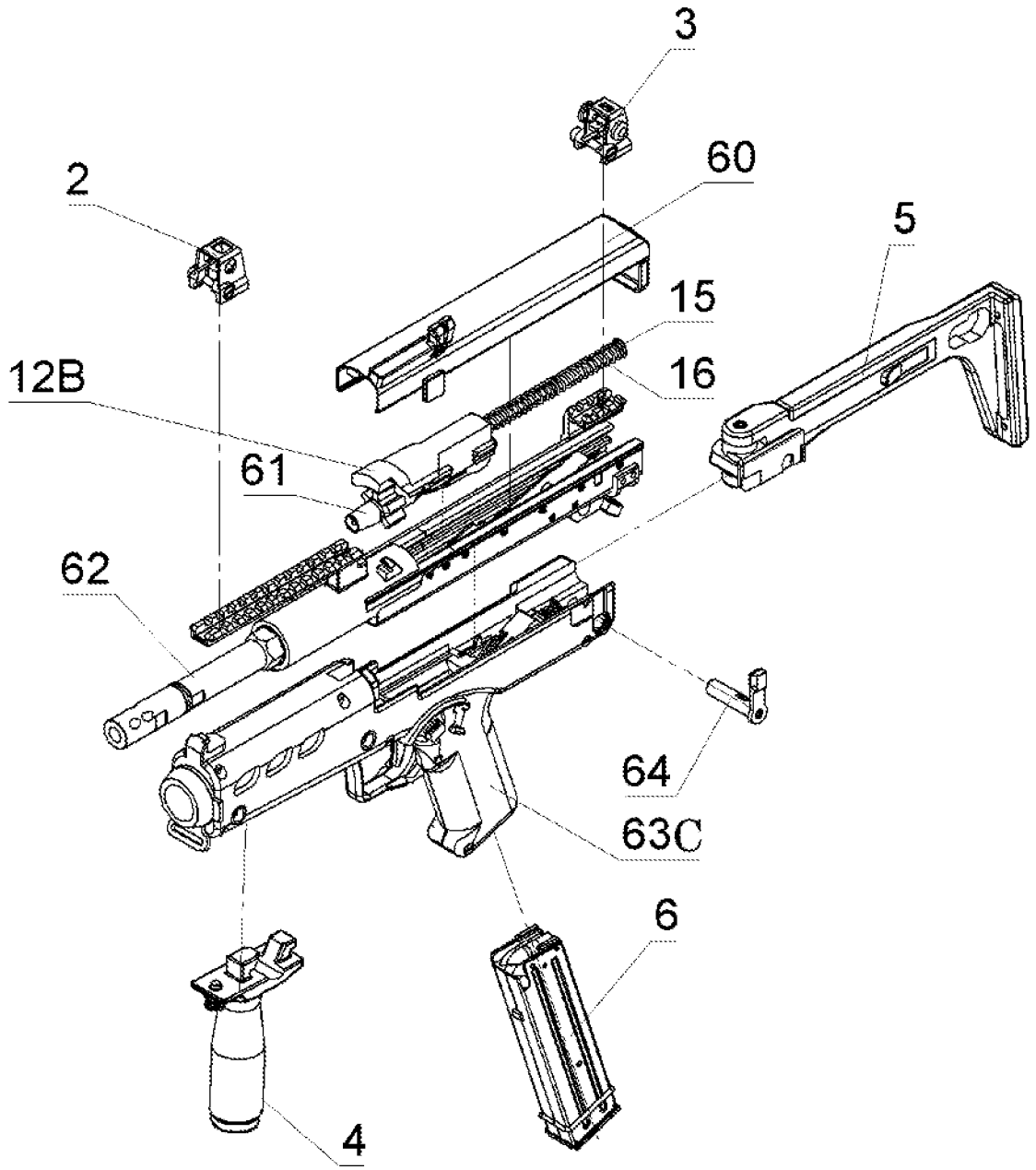
FIG. 16 is a disassembly of the automatic weapon 1C on units (side view).

FIG. 16 is a disassembly of the automatic weapon 1C on units (side view). Units comprising: the removable front sight 2, the removable dioptrical sight 3, the forward grip 4, the gunstock 5, the magazine 6, the cover of the receiver with mechanisms 60, the bolt carrier 12B with the bolt 61, the guide rod of a returnable spring 15, the returnable spring 16, the receiver with barrel and mechanisms 62, the trigger housing with mechanisms 63C, the multifunction latch 64.

Figure 17:
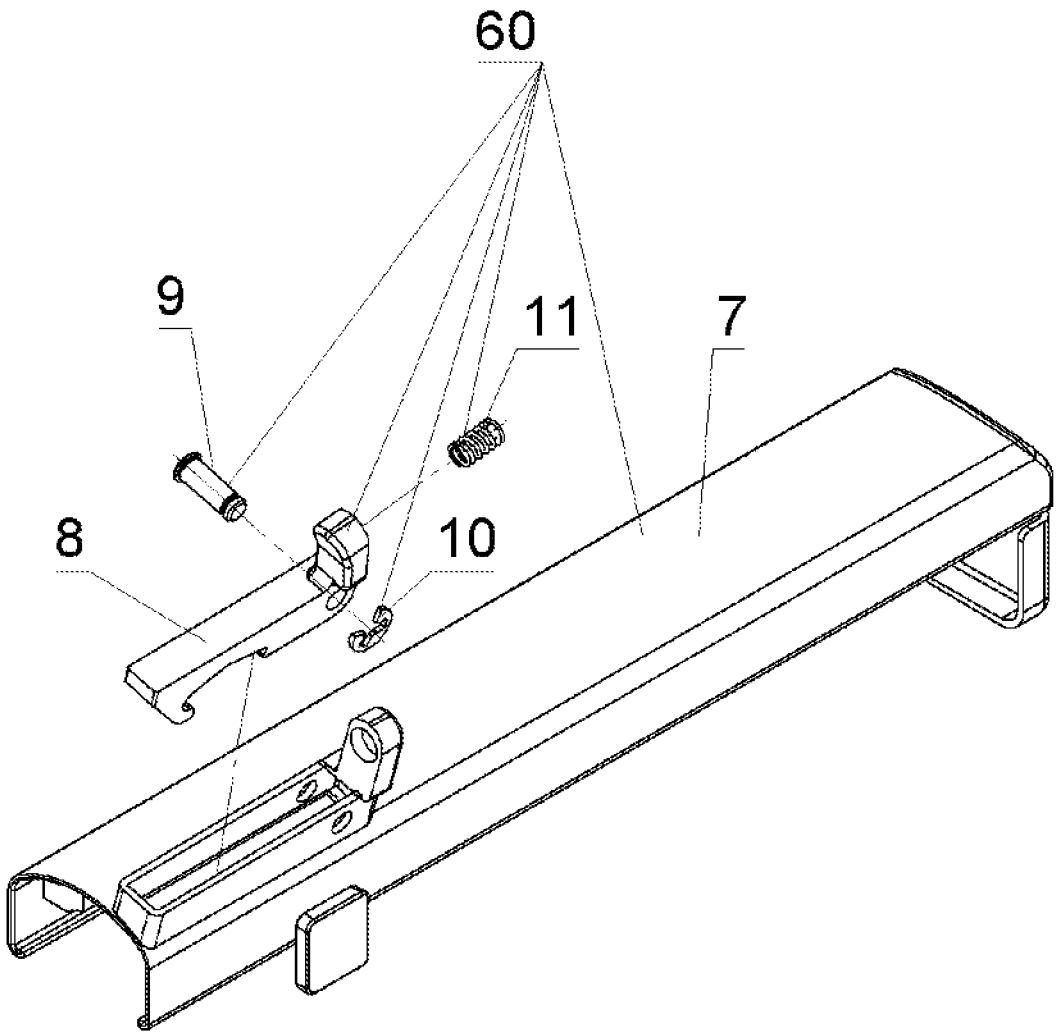
FIG. 17 is a detailing of the receiver cover 7 with mechanisms 60 (side view).

FIG. 17 is a detailing of the cover of the receiver with mechanisms 60 (side view). The cover of the receiver with mechanisms 60 comprising: the receiver cover 7, the cocking lever 8, the cocking lever axis 9, the lock washer of the cocking lever axis 10, the spring of cocking lever 11.

Figure 18:
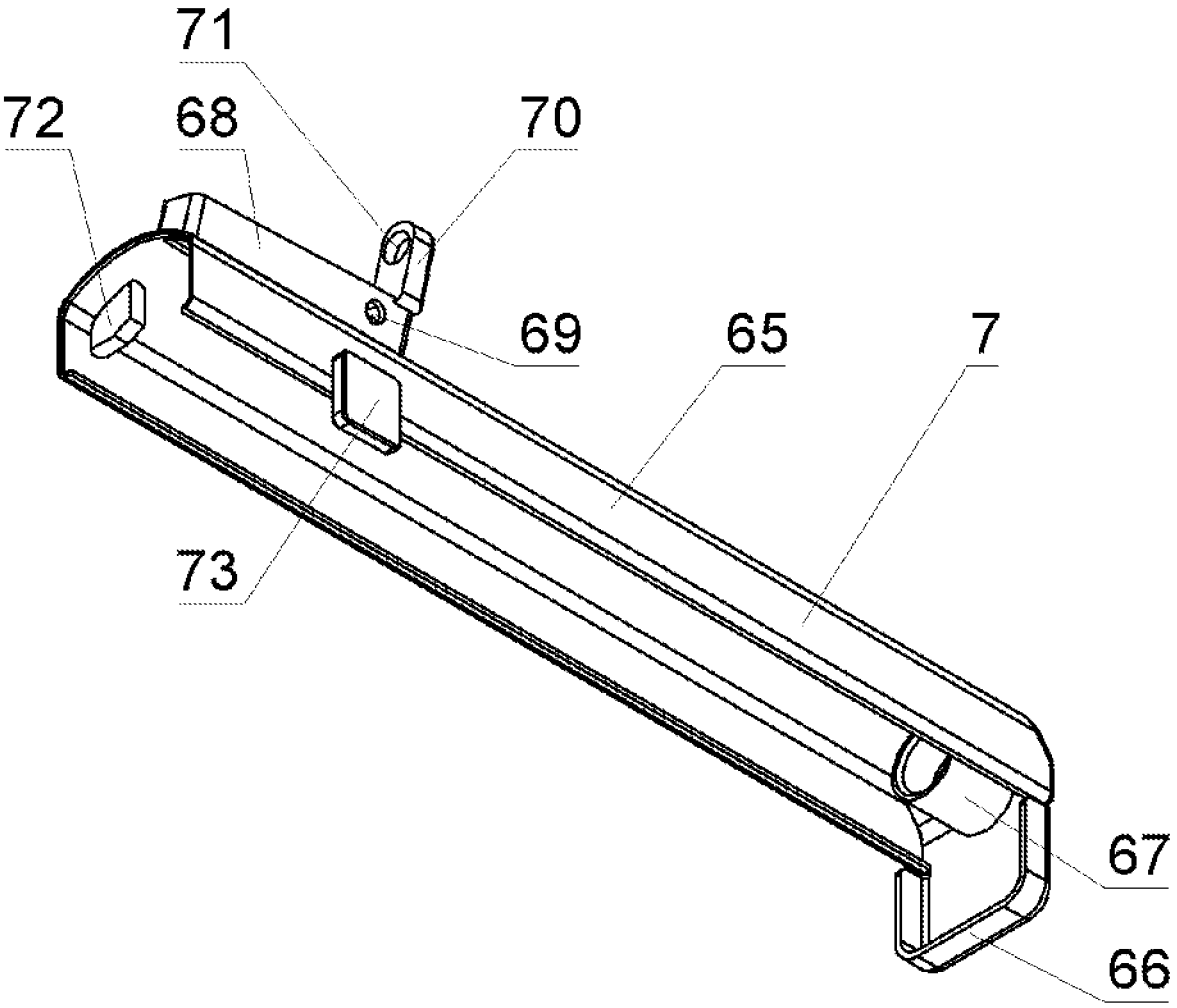
FIG. 18 is a side view of the receiver cover 7.

FIG. 18 is a side view of the receiver cover 7. The receiver cover 7 has a box-section body 65, which contains a rear plate 66. The bushing 67 is disposed in the middle of the internal side of rear plate 66. The bracket 68 for the cocking lever 8 is disposed on the external side in the front part of body 65. The bracket 68 has the through hole 69 for the axis of the cocking lever 9. The button 70 is disposed in the rear part of the bracket 68. The button 70 configured in the form of the washer with the blind hole 71 for the cocking lever spring 11. The front stop 72 disposed within the top of the body 65. Inside of the body 65 ledge with an interior chamfer 73 disposed outside. FIG. 18 showing all elements of the receiver cover 7, their forms and interactions between them.

Figure 19:
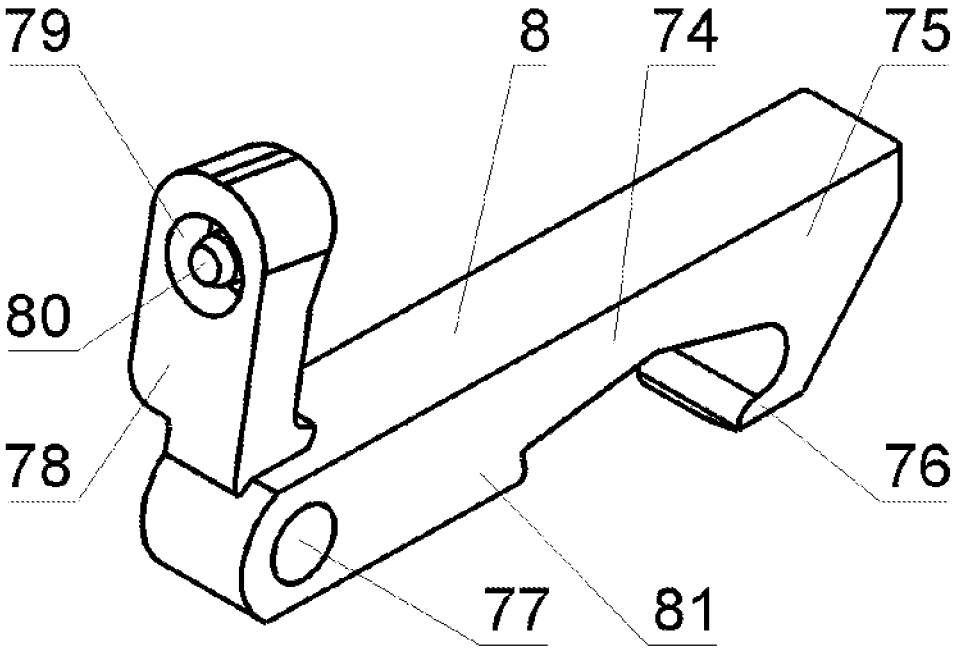
FIG. 19 is a side view of the cocking lever 8.

FIG. 19 is a side view of the cocking lever 8. The cocking lever 8 contains the lever 74, which has the hook 75 in the rear part, wherein the hook has rounded end 76. The through hole 77 for the axis of the cocking lever 9 disposed in the front lower part. The ledge in form of a button 78 with a blind hole 79 and a cylindrical ledge 80 for the cocking lever spring 11 disposed in the front part of lever 74. Wherein outer coil of the cocking lever spring 11 is pressed on the cylindrical ledge 80 and because of it, outer coil of the cocking lever spring 11 is not flying away during disassembly the cocking lever 8. Between the hook 75 and through hole 77 inclined ledge 81 with incline to the hook side 75 disposed therein. The inclined ledge 81 configured to interact with the ledge 88 of the bolt carrier 12A or 12B. FIG. 19 showing all elements of the cocking lever 11, their forms and interactions between them.

Figure 20A:
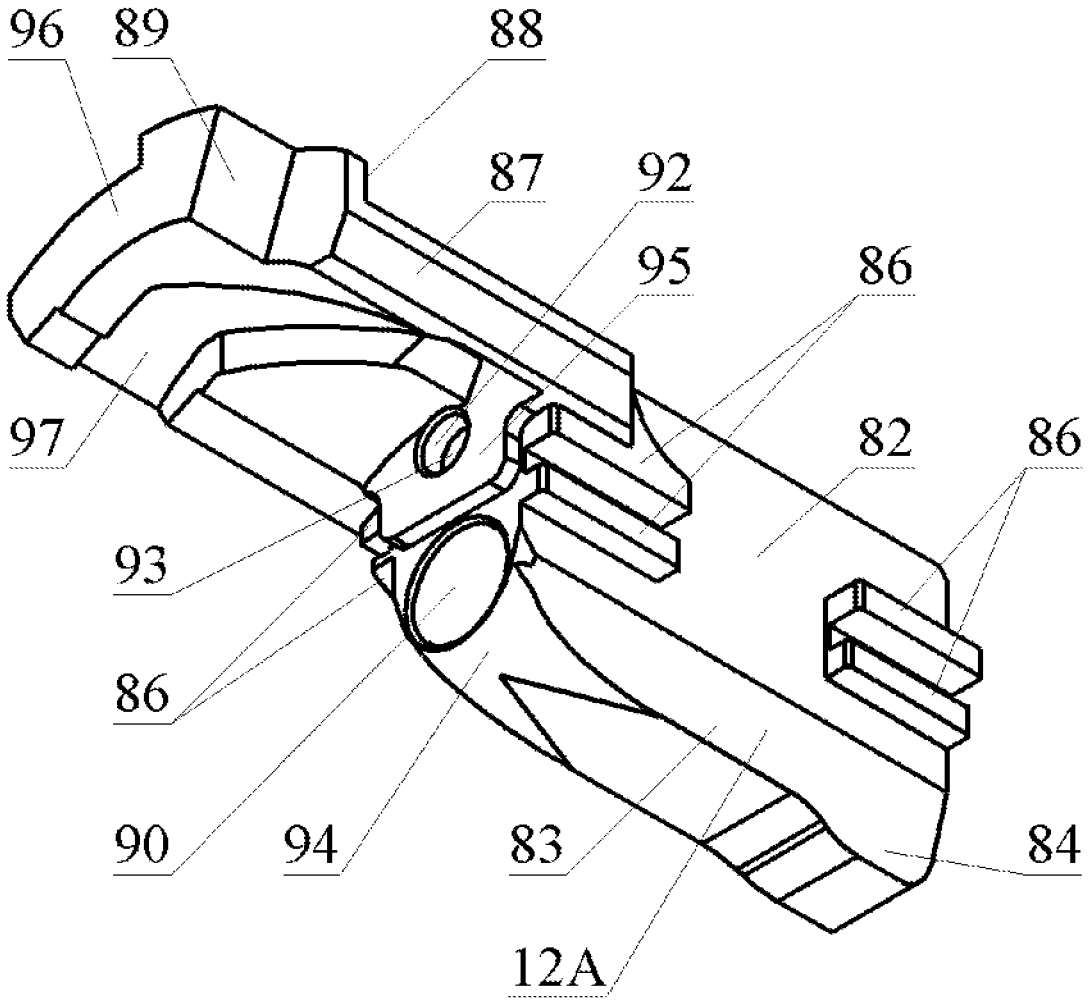
FIG. 20A is a front view of the bolt carrier 12A.
Figure 21A:
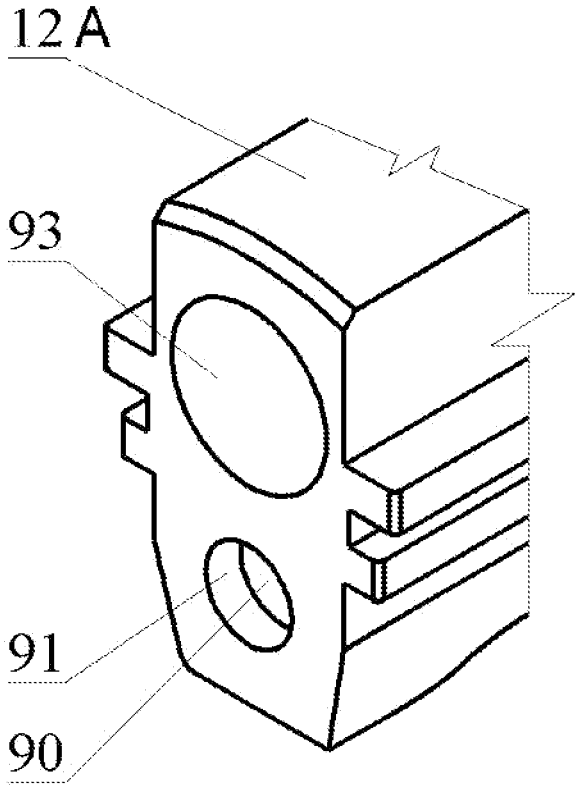
FIG. 21A is a fragment of the rear part of the bolt carrier 12A.
Figure 22:
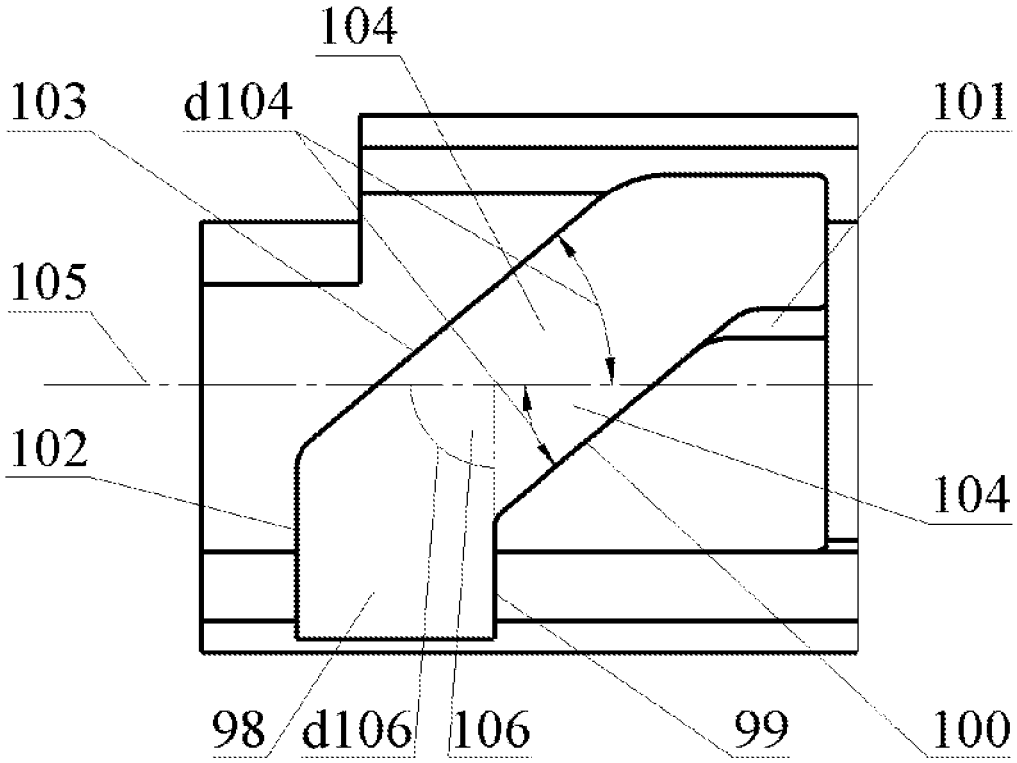
FIG. 22 is a bottom view on the cam slot 97 of the bolt carrier 12A, 12B.

FIG. 20A is a front view of the bolt carrier 12A, FIG. 21A is a fragment of the rear part of the bolt carrier 12A, FIG. 22 is a bottom view on the cam slot 96 of the bolt carrier 12A or 12B. The bolt carrier 12A comprises the bar 82, the lower part of which has the form of the trapezoidal section 83. Enlargement 84 disposed in the rear part of the trapezoidal section 83. The guided ledges 86 disposed on the side surface of the bar 82, wherein said guided ledges 86 are configured to interact with the channel guide 178 of the receiver 30. The front upper part of the bar 82 shaped in the form of console 87. The ledge 88 disposed at the top in front of said console 87 and configured to interact with an inclined ledge 81 of the cocking lever 8. The slot 89 disposed on the edge in the front part of said console 87. The blind hole 90 disposed inside of the lower part of the bar 82 and configured to reciprocate the shutter housing 19. The through hole 91 disposed on the bottom of the blind hole 90 and configured to reciprocate the percussion piston 17. The through hole 92 for the guide rod of the returnable spring 15 and the blind hole 93 for the returnable spring 16 are disposed within the upper part of the bar 82. The inlet chamfer 94 disposed in front of the trapezoidal section 83 and configured to interact with the caseless ammunition 59. The support platform 95 disposed at the beginning of the console 87 near with the through hole 92. The support platform 96 disposed in the front part of the console 87 and the cam slot 97 for the leading ledge 132 of the shutter housing 19 is disposed on the lower surface of console 87. The cam slot 97 configured in form of the screwed groove, which has the inlet slot 98, the leading edge 99, edge 100 for rotation of the shutter housing 19, the free running internal edge 101, the support platform 102 and external leading edge 103. The edge 100 and external leading edge 103 form an acute angle 104 to the axis of the bolt 105. A measure of an acute angle d104 correlates to 30-45 degrees, which is optimal for the correct opening and closing of the shutter housing 19. The leading edge 99 and the axis of bolt 105 form a straight angle 106. Measure d106 correlates to 90 degrees. FIG. 20A, FIG. 21A, FIG. 22 showing all elements of the bolt carrier 12A, their forms and interactions.

Figure 20B:
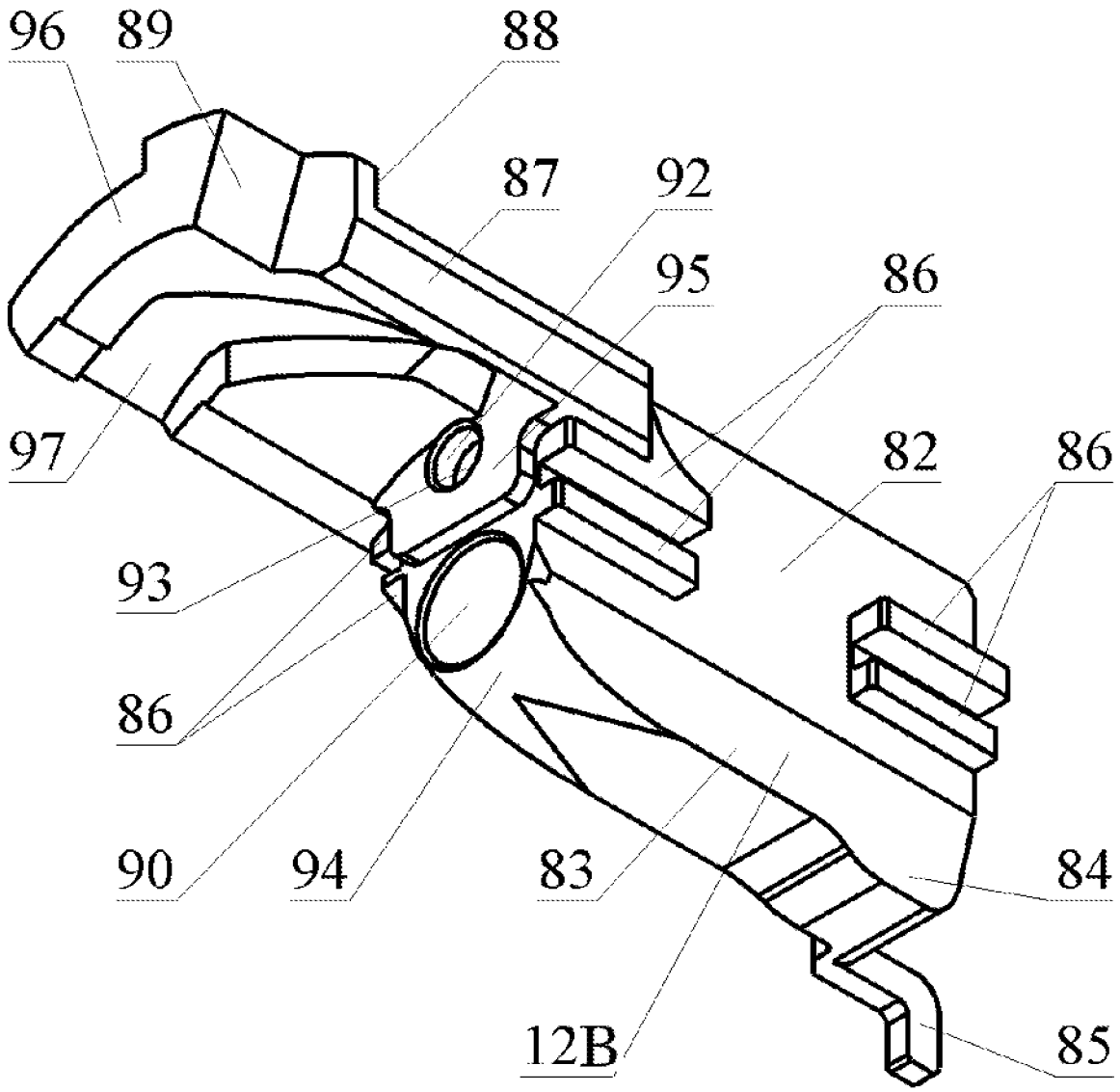
FIG. 20B is a front view of the bolt carrier 12B.
Figure 21B:
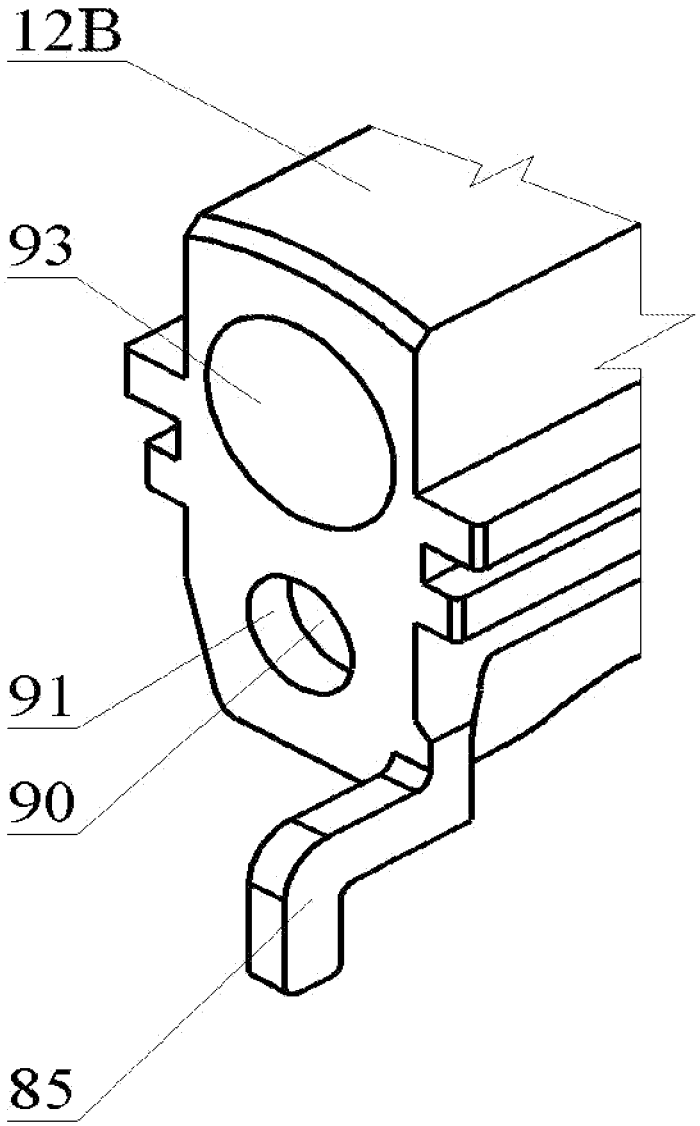
FIG. 21B is a fragment of the rear part of the bolt carrier 12B.

FIG. 20B is a front view of the bolt carrier 12B, FIG. 21B is a fragment of the rear part of the bolt carrier 12B, FIG. 22 is a bottom view on the cam slot 96 of the bolt carrier 12A or 12B. The bolt carrier 12A comprises the bar 82, the lower part of which has the form of a trapezoidal section 83. The enlargement 84 and the hook-shaped ledge 85, which interacts with the multifunction switch 43 in the "automatic fire" mode are disposed in the rear part of a trapezoidal section 83. The guided ledges 86 disposed on the side surface of the bar 82 and configured to interact with the channel guide 178 of the receiver 30. The front upper part of the bar 82 shaped in the form of console 87. The ledge 88 disposed at the top in front of said console 87 and configured to interact with the inclined ledge 81 of the cocking lever 8. The slot 89 disposed on the edge in the front part of said console 87. The blind hole 90 disposed inside of the lower part of the bar 82 and configured to reciprocate the shutter housing 19. The through hole 91 disposed on the bottom of the blind hole 90 and configured to reciprocate the percussion piston 17. The through hole 92 for guide rod of the returnable spring 15 and blind hole 93 for returnable spring 16 are disposed within upper part of the bar 82. The inlet chamfer 94 disposed in front of the trapezoidal section 83 and configured to interact with the caseless ammunition 59. The support platform 95 disposed at the beginning of the console 87 near with the through hole 92. The support platform 96 disposed in the front part of console 87 and the cam slot 97 for the leading ledge 132 of the shutter housing 19 is disposed on the lower surface of the console 87. The cam slot 97 configured in form of the screwed groove, which has the inlet slot 98, the leading edge 99, the edge 100 for rotation of the shutter housing 19, the free running internal edge 101, the support platform 102 and the external leading edge 103. The edge 100 and the external leading edge 103 form an acute angle 104 to the axis of the bolt 105. A measure of an acute angle d104 correlates to 30-45 degrees, which is optimal for the correct opening and closing of the shutter housing 19. The leading edge 99 and the axis of bolt 105 form a straight angle 106. Measure d106 correlates to 90 degrees. FIG. 20B, FIG. 21B, FIG. 22 showing all elements of the bolt carrier 12B, their forms and interactions.

Figure 23:
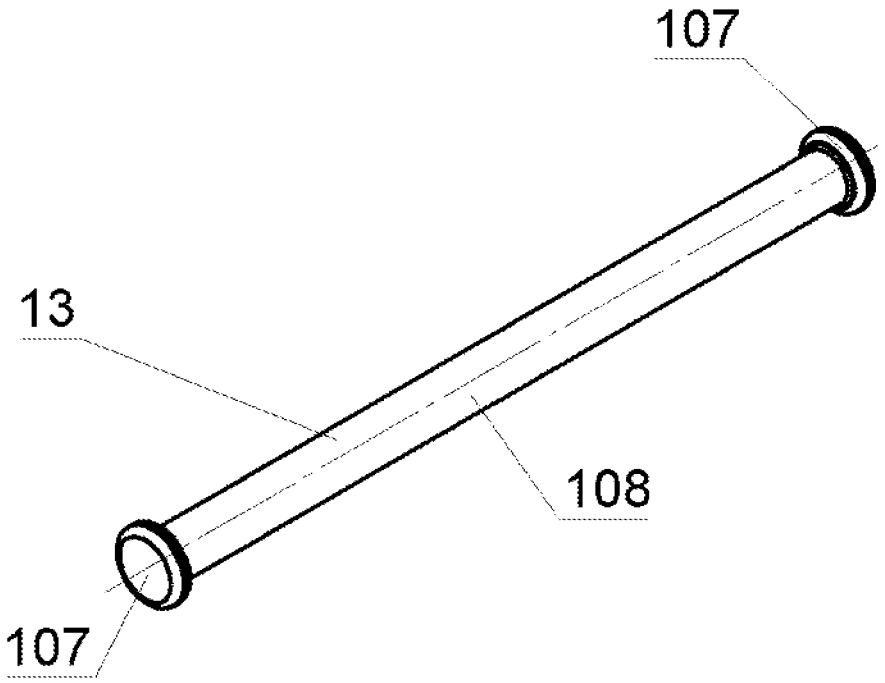
FIG. 23 is a side view of the rod 13.

FIG. 23 is a side view of the rod 13. The rod 13 has the washer with the radial chamfer 107, which passes into the cylindrical part 108, which passes into the washer with the radial chamfer 107. Said rod is element of the weapon 1A. FIG. 23 showing all elements of the rod 13, their forms and interactions.

Figure 24:
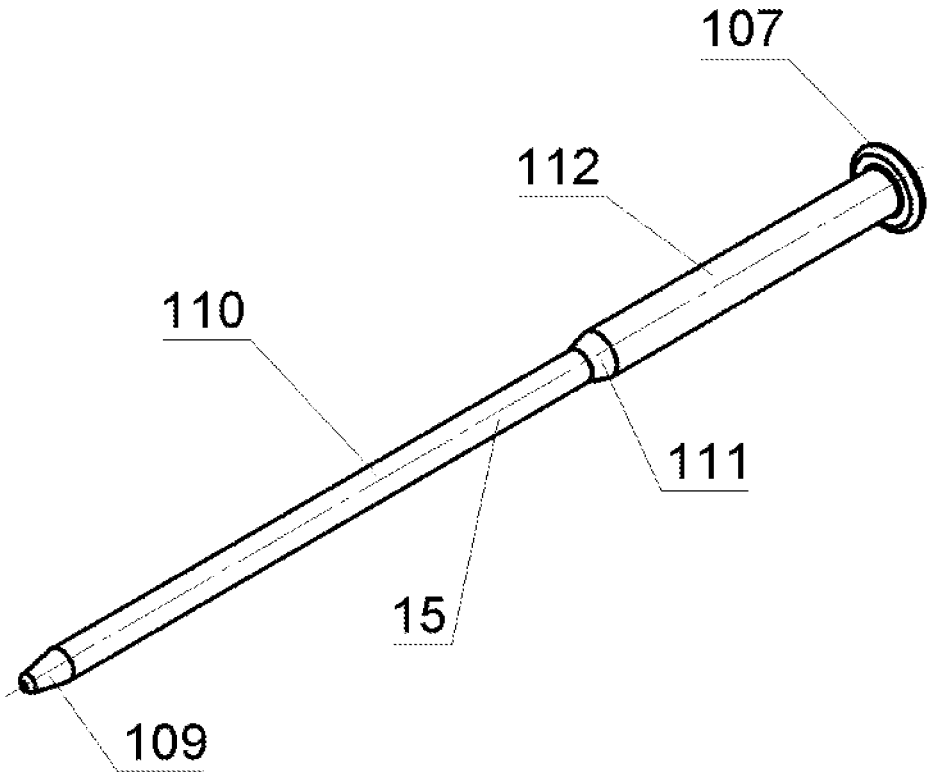
FIG. 24 is a side view of the guide rod 15.

FIG. 24 is a side view of the guide rod 15. The guide rod 15 configured in the form of the spherical head 109, which passes into the cylindrical part 110, which via the conical transition 111 passes into the cylindrical part 112 with bigger diameter, which passes into the washer with the radial chamfer 107. Said guide rod is an element of the weapon 1B and 1C. FIG. 24 showing all elements of the guide rod 15, their forms and interactions.

Figure 25:
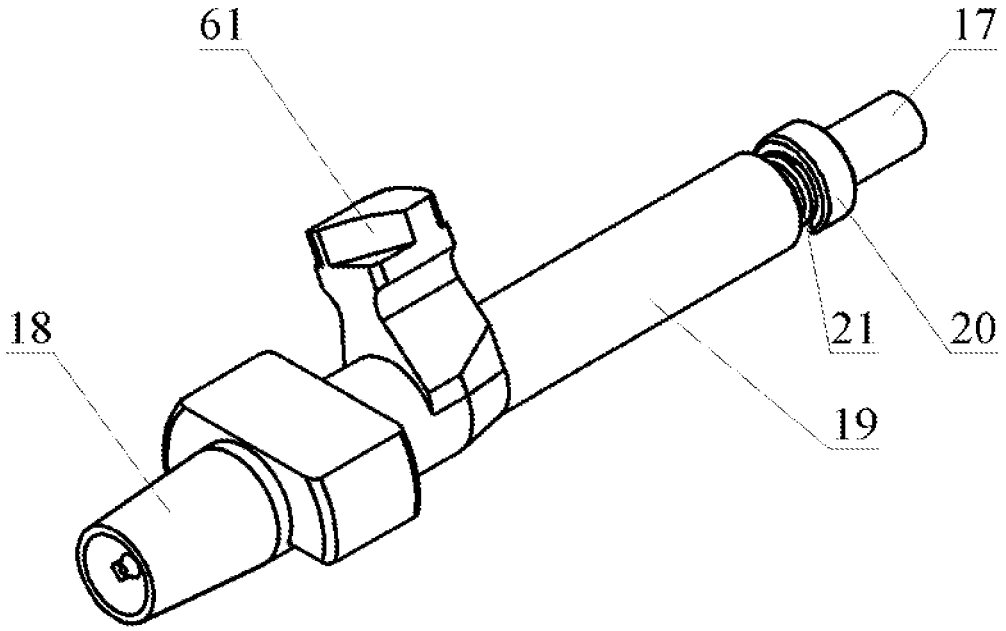
FIG. 25 is a side view of the bolt 61.
Figure 26:
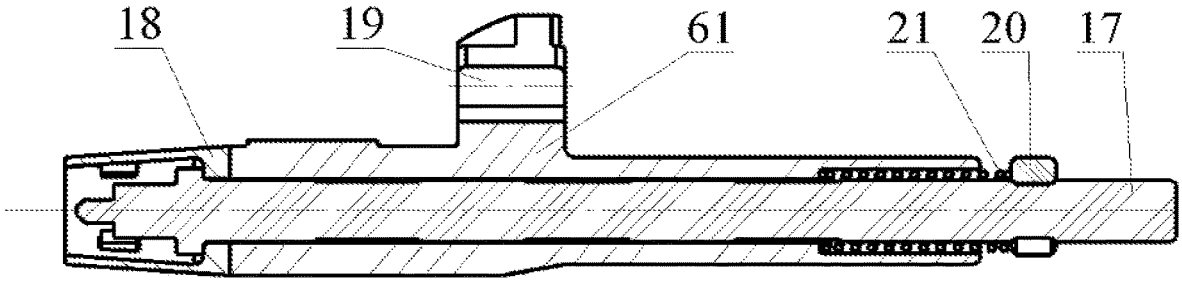
FIG. 26 is a longitudinal section of the bolt 61.

FIG. 25 is a side view of the bolt 61 and FIG. 26 is a longitudinal section of the bolt 61. The bolt 61 comprising: the percussion piston 17, the conical bushing of the bolt 18, shutter housing 19, the safety catch of the firing percussion 20, the spring of the firing percussion 21.

Figure 27:
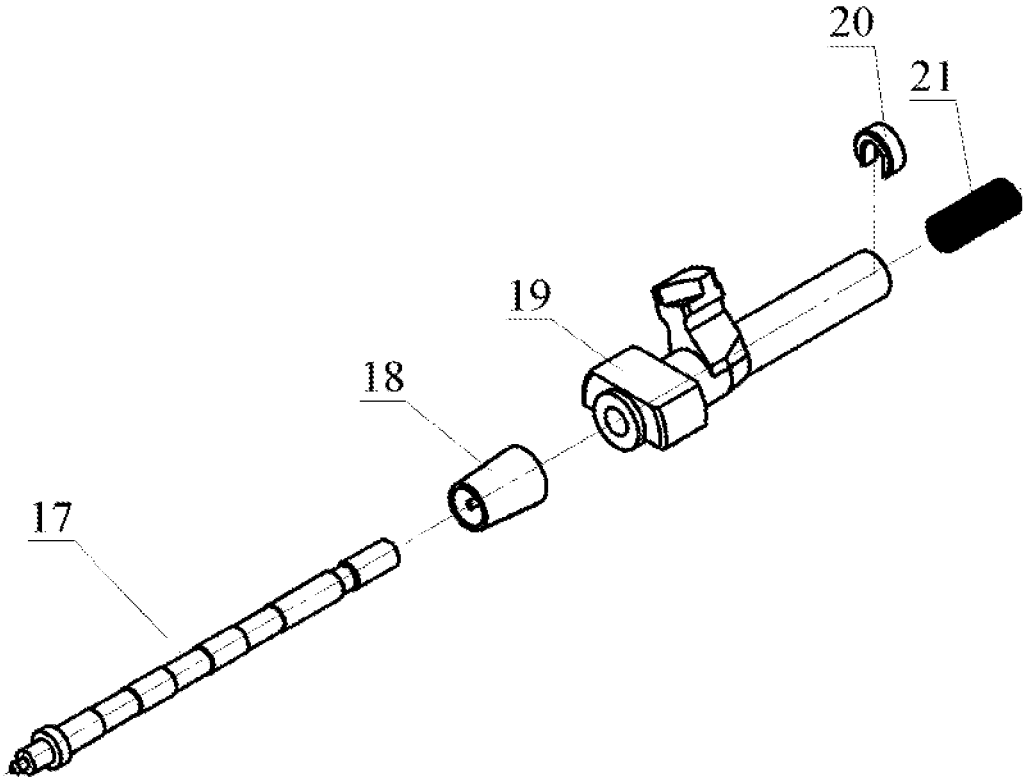
FIG. 27 is a detailing of the bolt 61 (side view).

FIG. 27 is a detailing of the bolt 61 (side view). This configuration comprising: the percussion piston 17, the conical bushing of the bolt 18, shutter housing 19, the safety catch of the firing percussion 20, the spring of the firing percussion 21.

Figure 28:
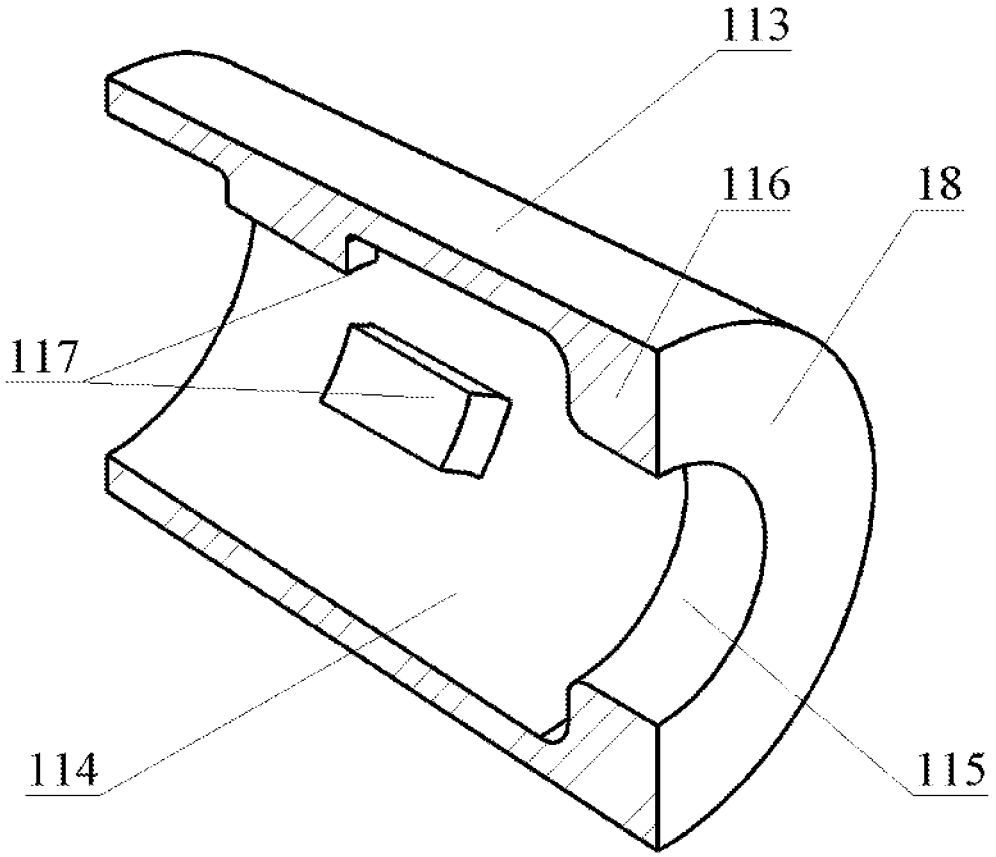
FIG. 28 is a longitudinal section of the conical bushing of the bolt 18.

FIG. 28 is a longitudinal section of the conical bushing of the bolt 18. The conical bushing of the bolt 18 configured to rotate on the percussion piston 17 and pressed by the spring of the firing percussion 21 to the glazed area 140 at the end of the cylindrical head 127 of the shutter housing 19. FIG. 28 shows that the conical bushing on the bolt 18 configured as the truncated cone 113 with the blind conical hole 114, which comes into the through hole 115, which is formed the stout wall 116 at the outlet of the big base of the truncated cone 113. Not less than three ledges 117 are configured at the inlet in the blind conical hole 114. Said ledges 117 fixed the caseless ammunition 59 and protecting it from the inertial accumulation by the percussion piston 17 in case the weapon dropping. FIG. 28 showing all elements of the conical bushing of the bolt 18, their forms and interactions.

Figure 29:
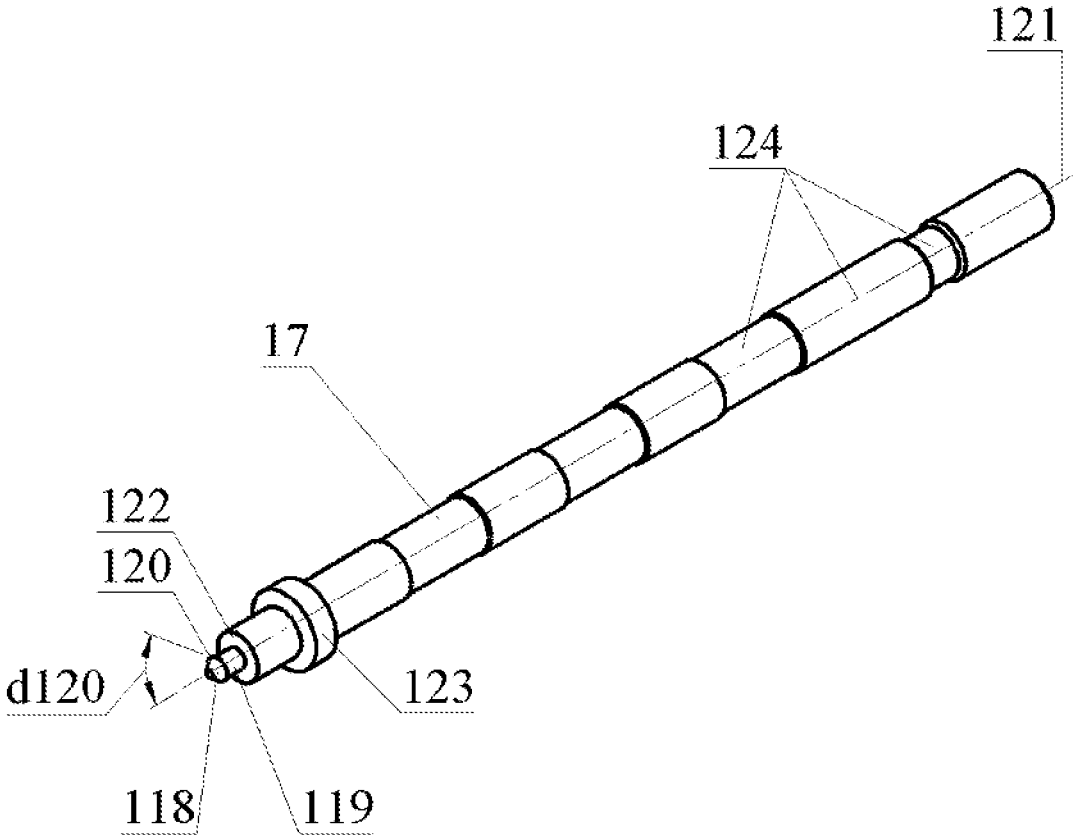
FIG. 29 is a side view of the percussion piston 17.

FIG. 29 is a side view of the percussion piston 17. The percussion piston 17 configured in stepped shaft form. The conical section 118 which passes into the cylindrical section with smaller diameter 119 disposed forepart, wherein the inclined ledge 120 disposed at the joint of the conical section 118 and the cylindrical section with smaller diameter 119. An angle of the ledge incline d120 to axis of the firing percussion 121 correlates to 30-45 degrees, which is optimal value to ensure peeling force of the ammunition 59 with the threaded bushing 166 of the multifunctional cartridge 26. The cylindrical section with smaller diameter 119 passes into the cylindrical section with bigger diameter 122, which passes into the cylindrical piston 123. The cylindrical piston 123 passes into the rod section with the grooves 124, wherein the rear groove configured for the safety catch of the firing percussion 20. FIG. 29 showing all elements of the firing percussion 17, their forms and interactions.

Figure 30:
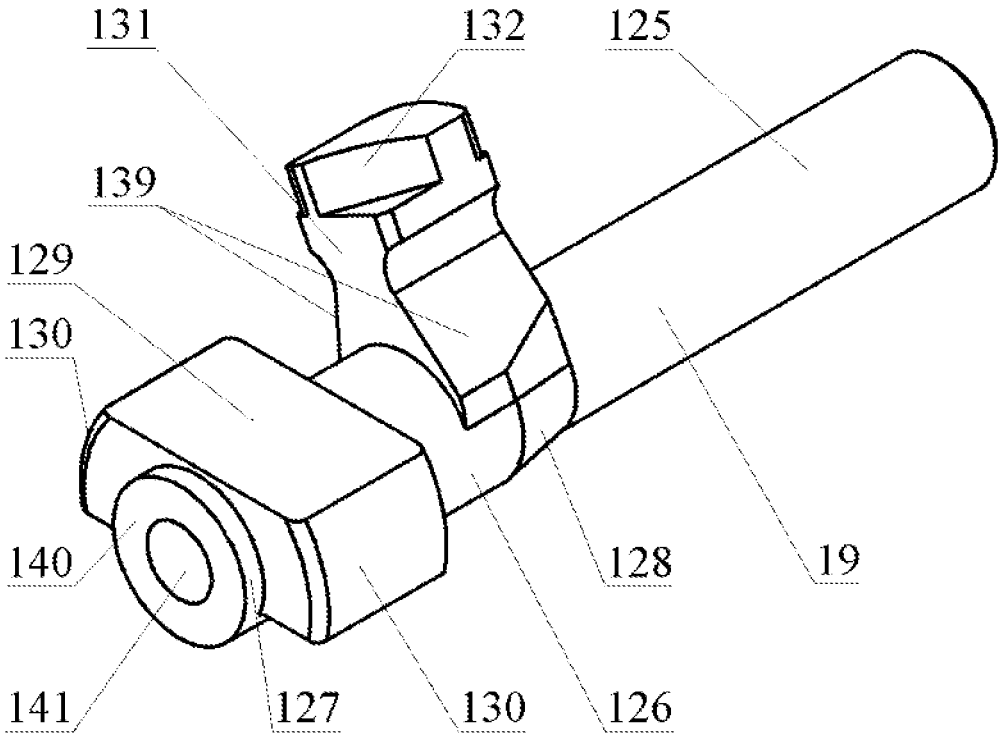
FIG. 30 is a side view of the shutter housing 19.
Figure 31:
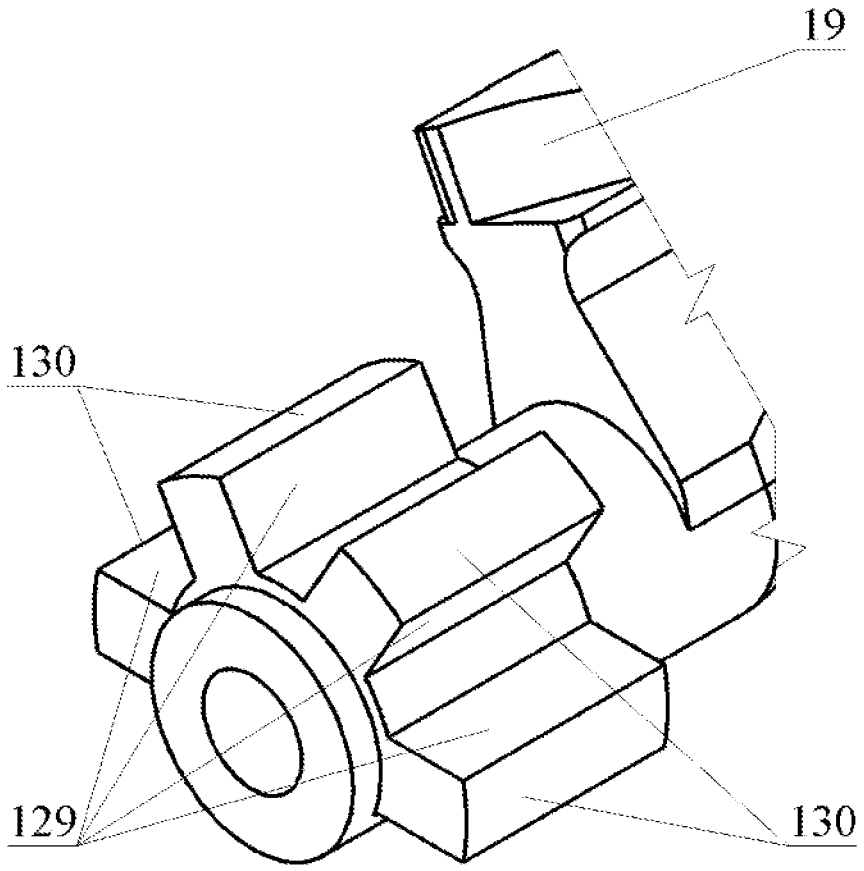
FIG. 31 is a fragment of the shutter housing 19.
Figure 32:
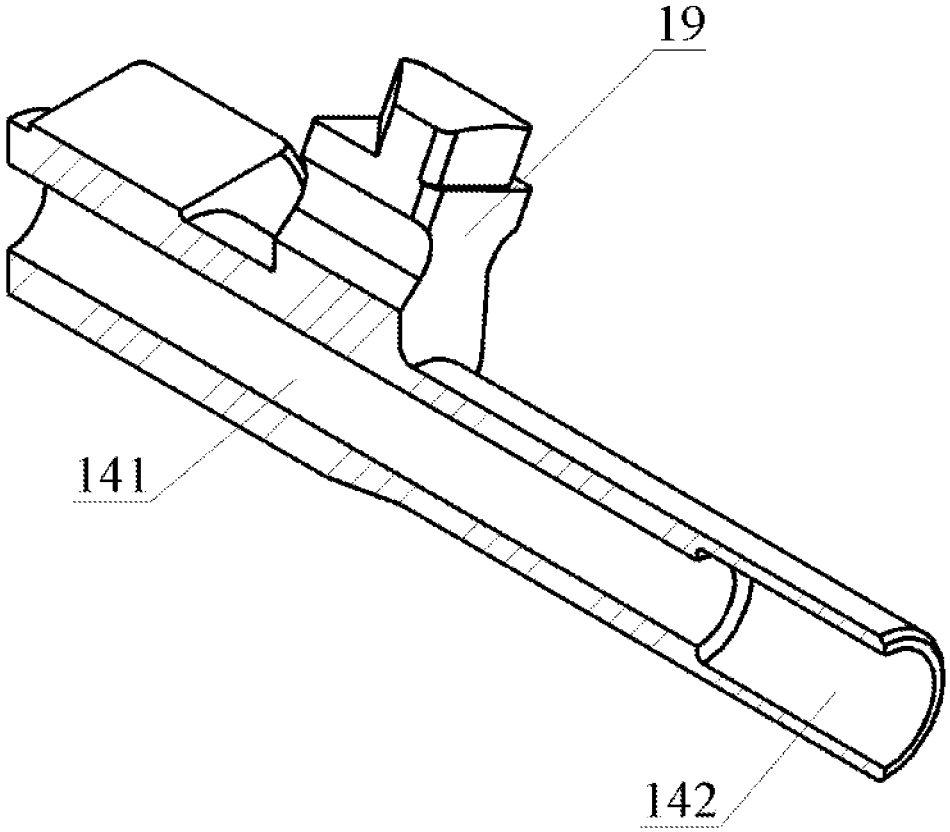
FIG. 32 is a longitudinal section of the shutter housing 19.
Figure 33:
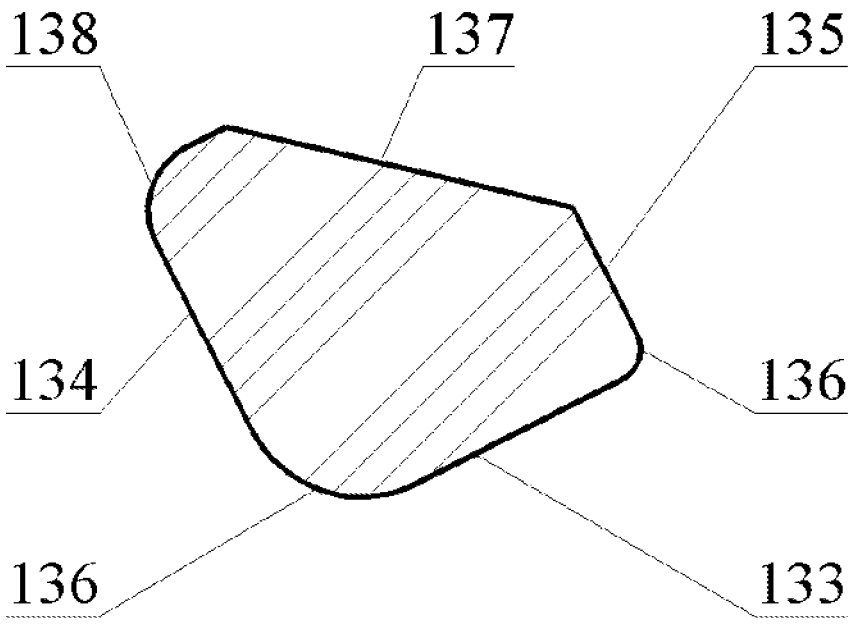
FIG. 33 is a longitudinal section of the leading ledge 132 of the shutter housing 19.

FIG. 30 is a side view of the shutter housing 19, FIG. 31 is a fragment of the shutter housing 19, FIG. 32 is a longitudinal section of the shutter housing 19, FIG. 33 is a longitudinal section of the leading ledge 132 of the shutter housing 19. The shutter housing 19 has the cylindrical section 125, which passes into the thickened cylindrical section 126, which passes into the cylindrical head 127. Through passage from the cylindrical section 125 to the thickened cylindrical section 126, the chamfer 128 is disposed therein. In the junction point between the thickened cylindrical section 126 and the cylindrical head 127 the locking lug 129 is disposed therein in the form of not less than two ledges, ends of which configured as the radius surfaces 130. Through passage from the cylindrical section 125 to the thickened cylindrical section 126 the stepped ledge is disposed therein, which comprising the base 131 and the leading ledge 132, configured to interact with the cam slot 97 of the bolt carrier 12A or 12B. The leading ledge 132 has rear leading edge 133, side edge of the free running 134 and 135, rear radius chamfers 136, the external sideway forepart scarf 137 and the external radius section 138. Two cylindrical grooves with inclined sides 139 disposed on the base 131. The base 131 is disposed at angle to the locking lug 129. The glazed area 140 for the conical bushing on the bolt 18 disposed at the end of the cylindrical head 127. The central cylindrical channel 141 for the percussion piston 17 disposed within the shutter housing 19. The rear part of the central cylindrical channel 141 has the blind cylindrical hole 142 with bigger diameter, which configured to interact with the firing percussion spring 21 and the safety catch of the firing percussion 20. FIG. 30, FIG. 31, FIG. 32, FIG. 33 showing all elements of the shutter housing 19, their forms and interactions.

Figure 34:
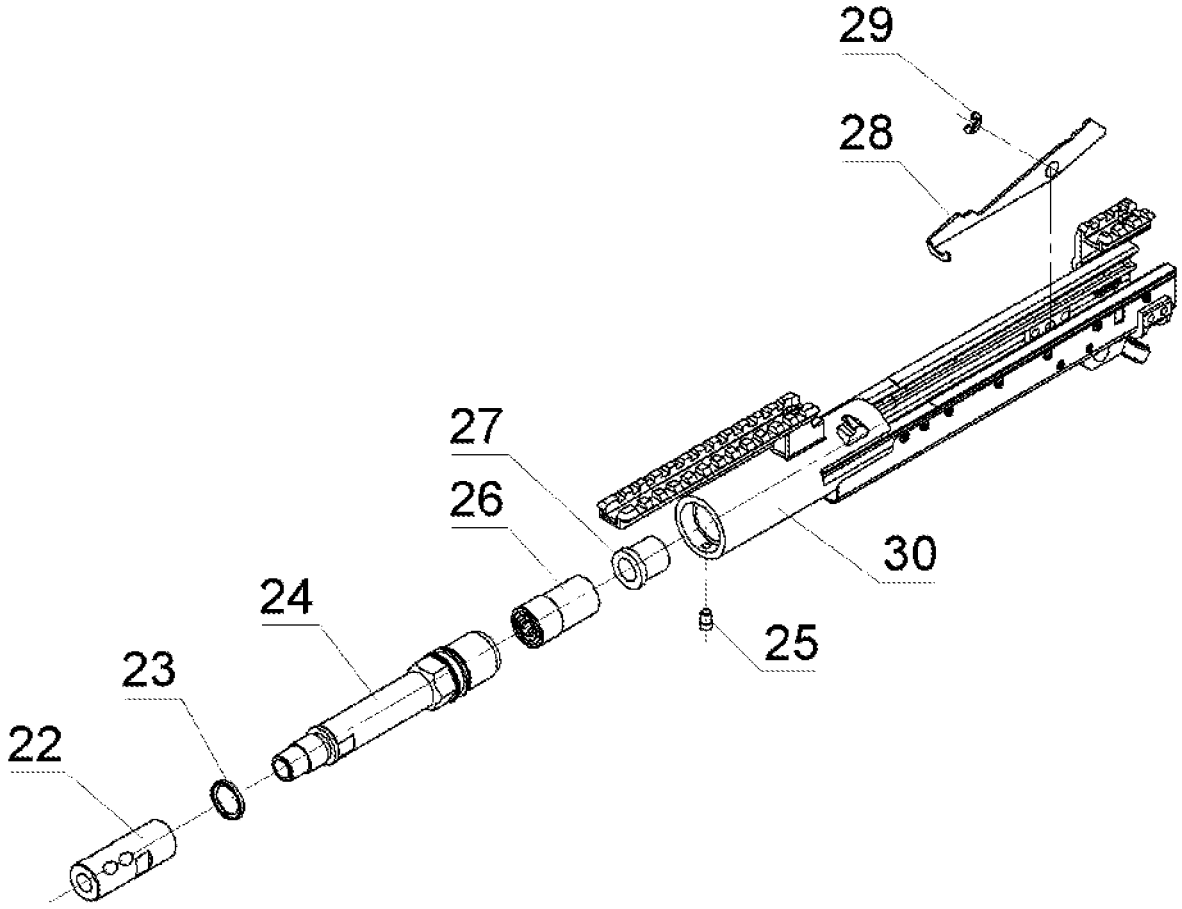
FIG. 34 is a detailing of the receiver with the barrel and mechanisms 62 (side view).

FIG. 34 is a detailing of the receiver with the barrel and mechanisms 62 (side view). This configuration comprising: the balancing gear 22, the spring washer of the balancing gear 23, the barrel 24 with smooth channel, the barrel latch 25, multifunctional cartridge 26, the conical bushing of the receiver 27, the extractor 28, the lock washer of the extractor 29, the receiver 30.

Figure 35:
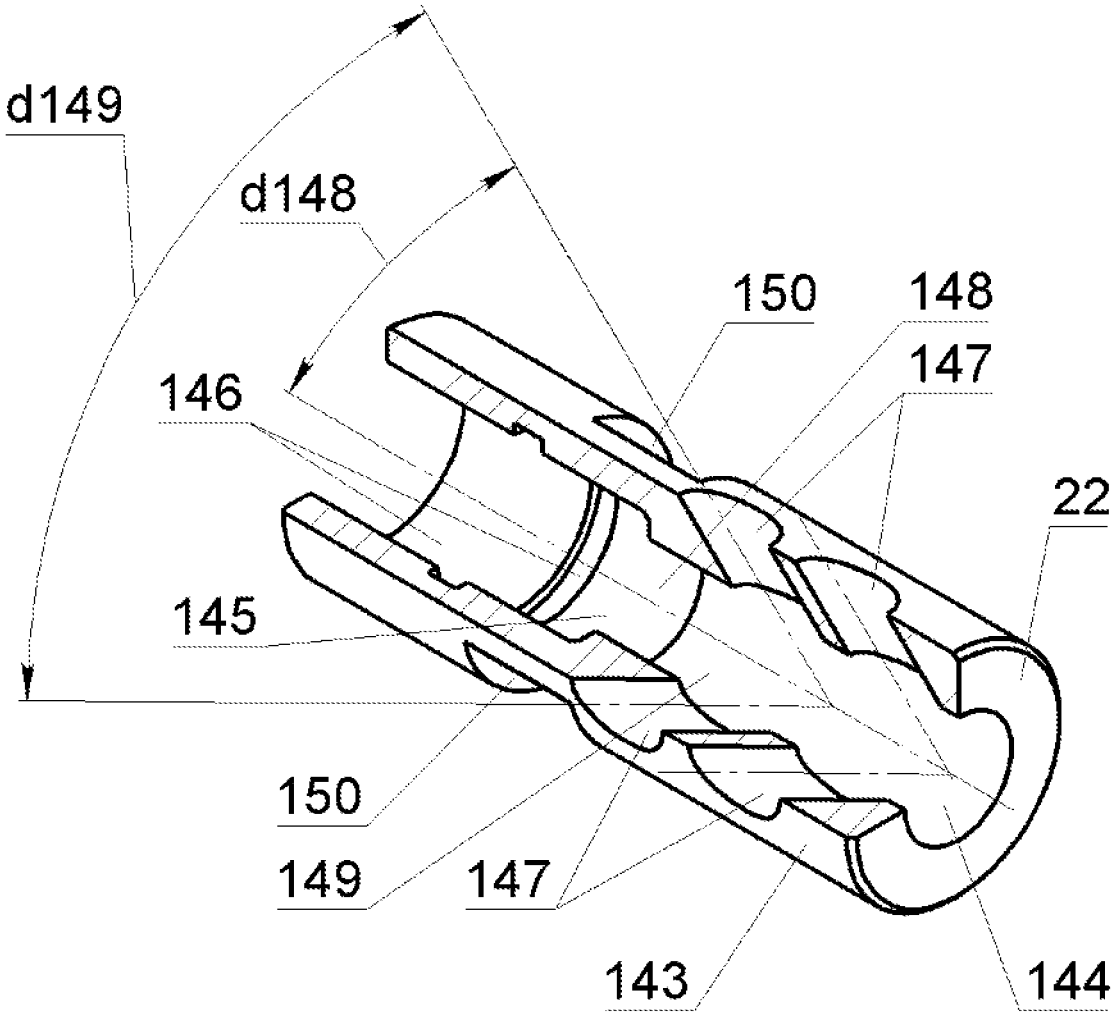
FIG. 35 is a side view of the balancing gear 22.

FIG. 35 is a side view of the balancing gear 22. The balancing gear 22 configured in the form of a cylinder 143, inside of which the smooth cylindrical section 144 is disposed, which passes into the conical section 145, which passes into the cylindrical groove with the threaded section 146. The inclined holes 147 with the acute angle 148 to the longitudinal axis disposed in the front part of the cylinder 143. The inclined holes 147 in the cross-section between them formed an angle 149. The slots 150 are made behind the inclined holes 147 on the outer part of the cylinder 143. FIG. 35 showing all elements of the balancing gear 22, their forms and interactions.

Figure 36:
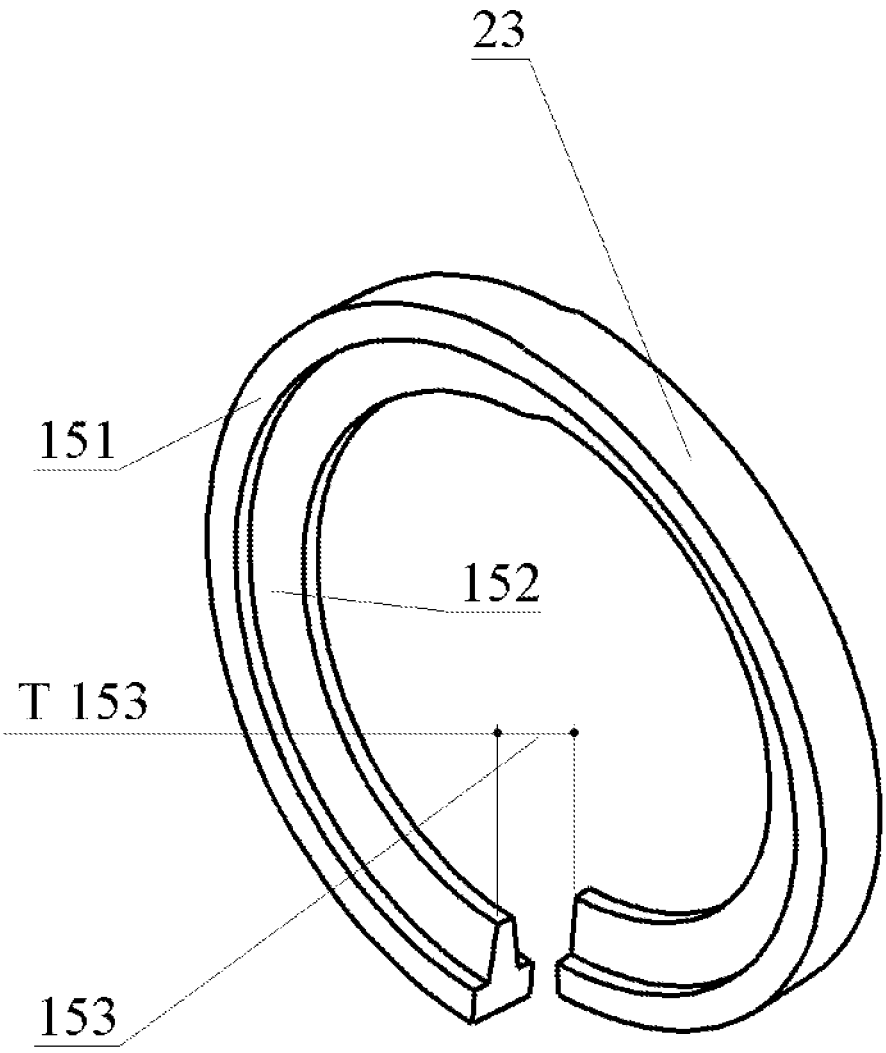
FIG. 36 is a front view of the spring washer of the balancing gear 23.

FIG. 36 is a front view of the spring washer of the balancing gear 23. The spring washer of the balancing gear 23 configured as the split ring 151 and the three-sided flange 152 on the internal side. The spring washer of the balancing gear 23 with their three-sided flange 152 abuts against threaded section 155 for balancing gear 23 when the balancing gear 23 is removed from barrel 24, which allows the balancing gear 23 to not be lost. The ends of the split ring 151 have a bias 153. The measure of bias T153 correlates 0.2D23, where D23—is the outer diameter of the spring washer of the balancing gear 23. Said measure is optimal for performing a spring clamp function. FIG. 36 showing all elements of the spring washer of the balancing gear 23, their forms and interactions.

Figure 37:
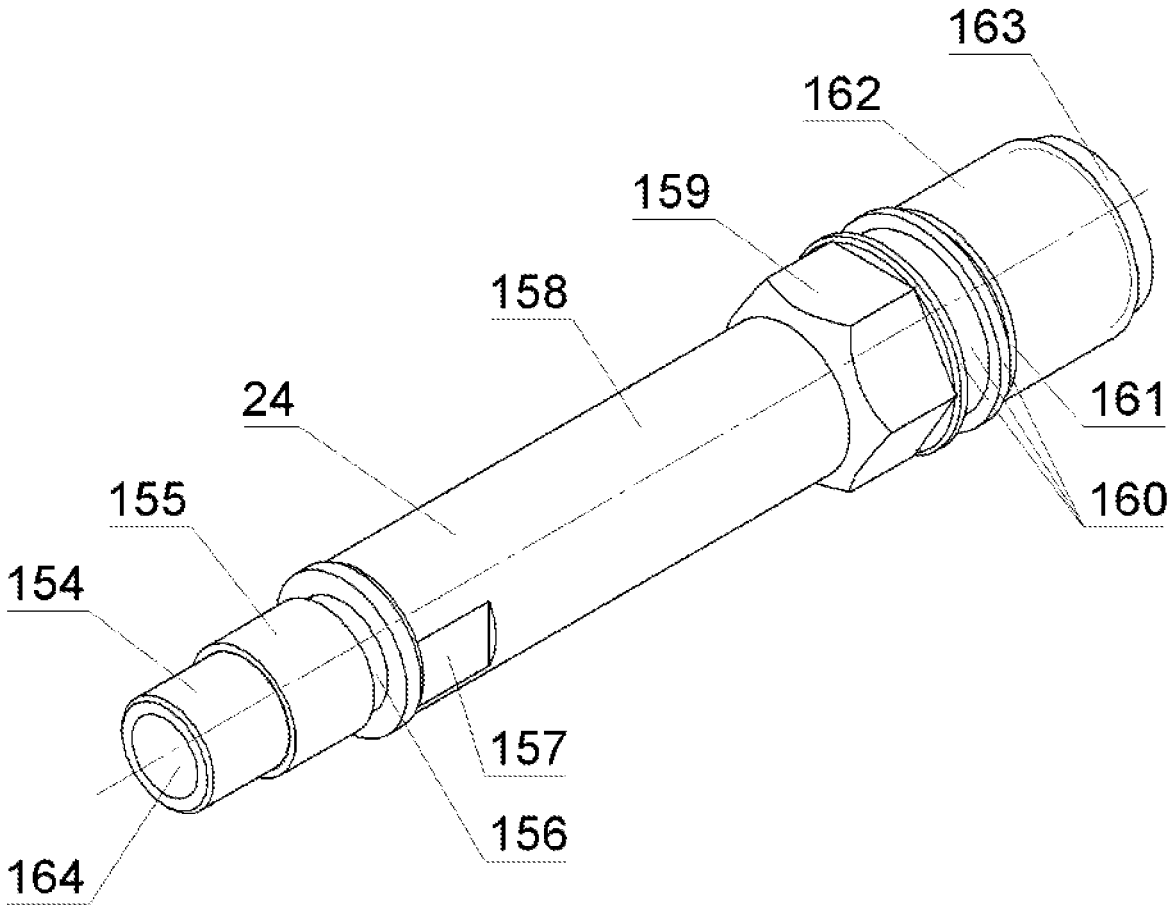
FIG. 37 is a side view of the barrel 24.

FIG. 37 is a side view of the barrel 24. The barrel 24 has the smooth conical section 154, which passes into the threaded section 155, which passes into the slot 156, which passes into the cylindrical section with the splineway 157 for a wrench, which passes into the cylindrical section 158 which passes into the multifaceted area 159 for a wrench, which passes into the smooth cylindrical section with the groove 160 for the barrel latch 25. The smooth cylindrical section with the groove 160 passes into the circular groove 161, which passes into the threaded section with the buttress thread 162, which passes into the smooth cylindrical section 163. The internal channel 164 is smooth without rifling. Said barrel sections 24 have different thickness, which are shown on FIG. 36, FIG. 37.

Figure 38:
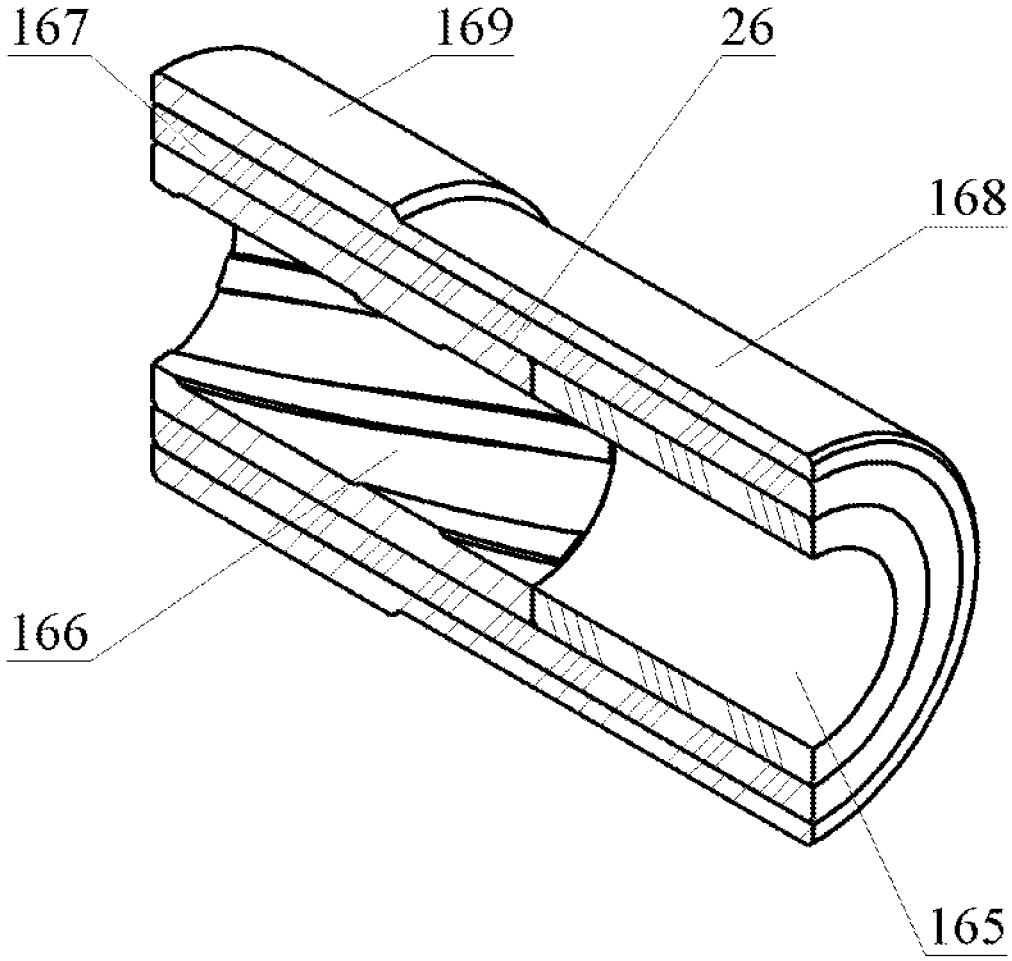
FIG. 38 is a longitudinal section of the multifunctional cartridge 26.

FIG. 38 is a longitudinal section of the multifunctional cartridge 26. The multifunctional cartridge 26 comprising the threaded bushing 165, the internal smooth bushing 166, at least one middle bushing 167 and the external bushing with variable diameter 168, which has bigger diameter 169. The threaded bushing 165 and the inner smooth bushing 166 are made of carbide and refractory material. The threaded bushing 165 made of carbide and refractory material and has two or more threaded grooves. The pitchs and forms of grooves depends on applying ammunition. The bushings 165, 166, 167 and 168 are inserted into each other with tension and created the multifunctional cartridge 26. Outer surface of the bushings 165, 166, 167 and 168 are highly polished. The multifunctional cartridge 26 provide high pressure during firing, and high polishing ensures minimal heat loss in the hottest part. The polished surface reflecting the heat flux as a thermos. The carbide and refractory threaded groove 165, the inner smooth bushing 166 provide high reliability of the weapon during the high temperature of gases produced when the propellant is burnt. FIG. 38 showing all elements of the spring washer of the multifunctional cartridge 26, their forms and interactions.

Figure 39:
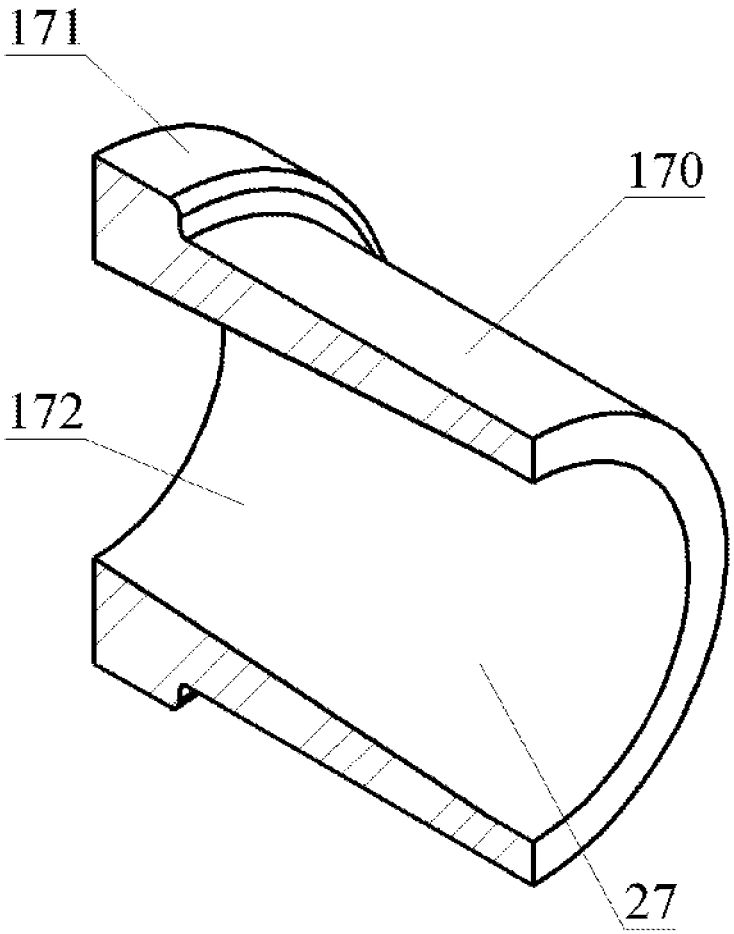
FIG. 39 is a longitudinal section of the conical bushing of receiver 27.

FIG. 39 is a longitudinal section of the conical bushing of the receiver 27. The conical bushing of the receiver 27 has the cylindrical section 170 which passes into the smaller cylindrical section 171. The conical hole 172 disposed inside of the conical bushing of the receiver 27 the small base of which is located at the end of the cylindrical section 170. FIG. 39 showing all elements of the conical bushing of receiver 27, their forms and interactions.

Figure 40:
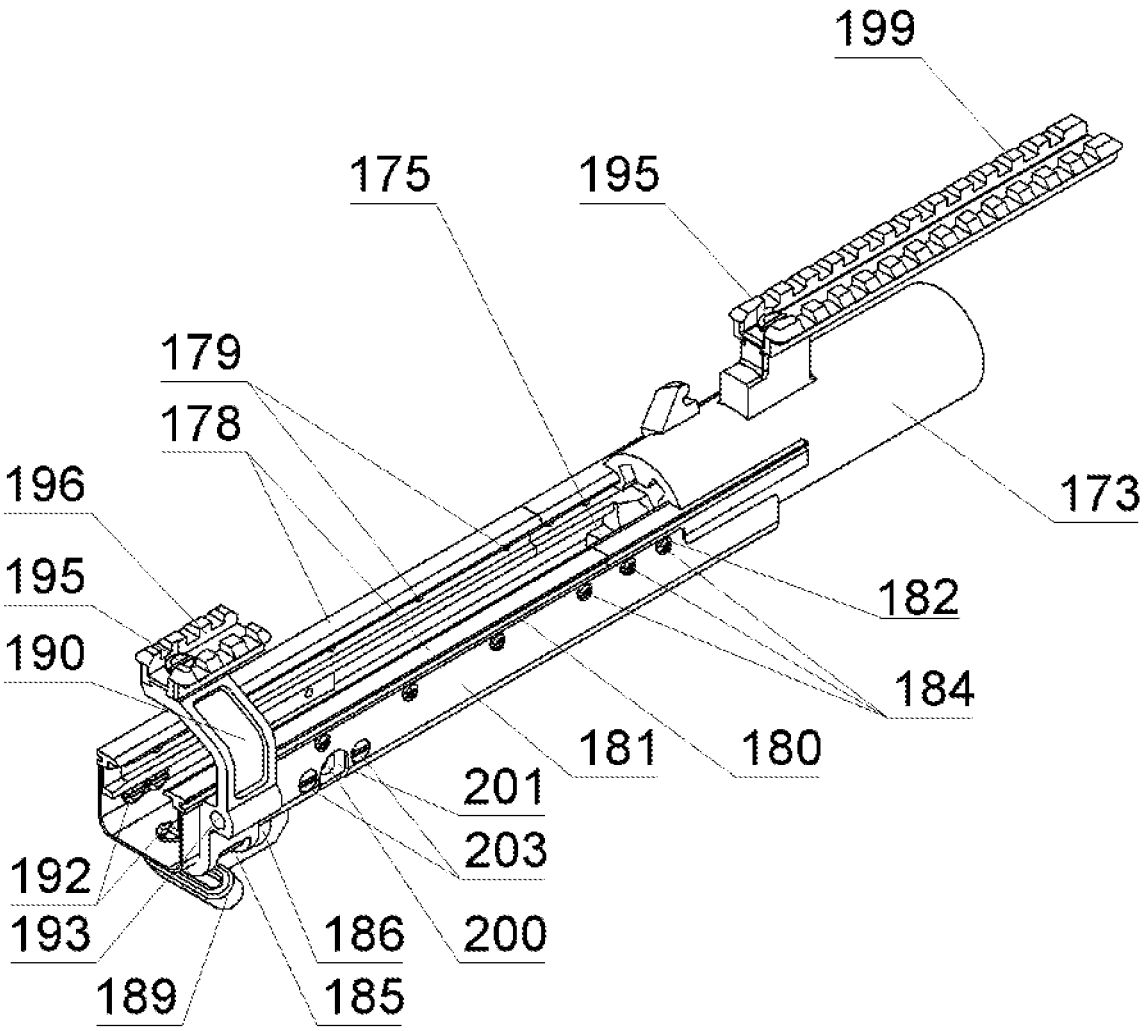
FIG. 40 is a side view of the receiver 30.
Figure 41:
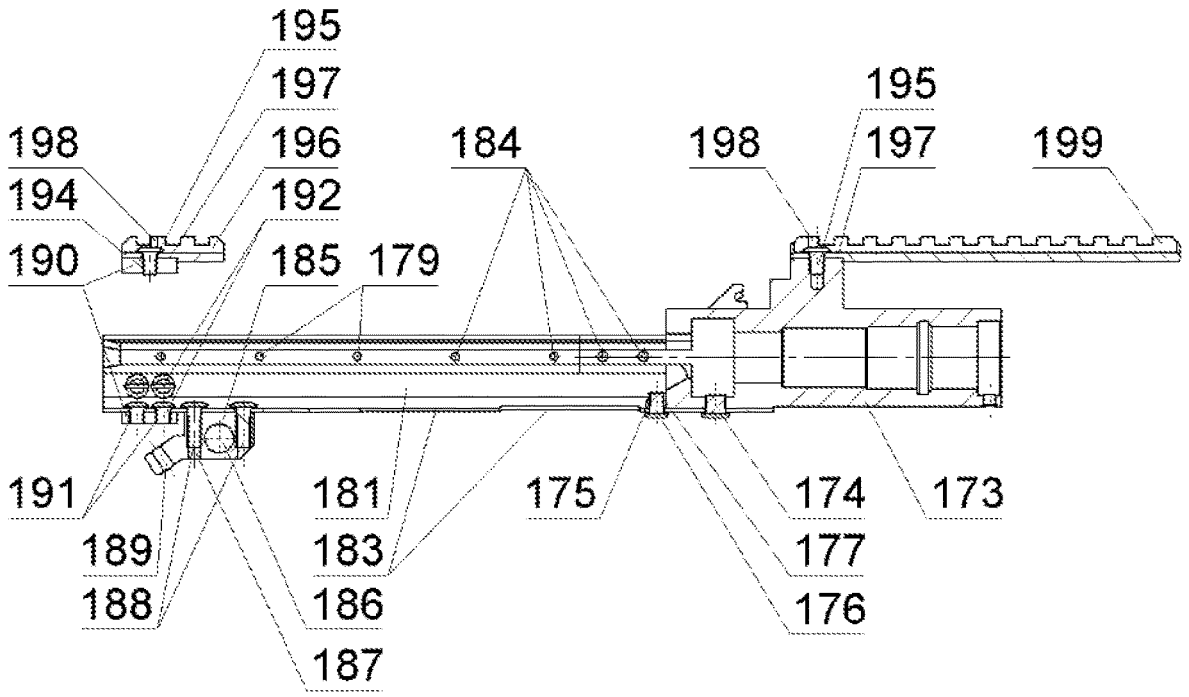
FIG. 41 is a longitudinal section of the receiver 30.

FIG. 40 is a side view of the receiver 30 and FIG. 41 is a longitudinal section of the receiver 30. The receiver 30 comprising:

the barrel chamber 173 which is screwed in with the locking screw of the barrel chamber 174 to the lower part of the receiver 181;

the feed ramp 175 configured in the form of the plate with the threaded hole 176 in the middle, and screwed in with the fastening screw of the guide of the projectile 177 to the lower part of the receiver 181;

the channel guides 178 with threaded holes 179 for the passage of the bolt carrier 12A or 12B and the shutter housing 19;

the upper grooves 180, which are disposed on the external surface of the channel guides 178, and configured for the receiver cover 7.

The holes disposed on the side walls 182 in the lower part of the receiver 181, and configured to be fixed with the screws 184 of the barrel chamber 173 and the channel guides 178. The lower part of the receiver 181 configured in the form of a box-section figure, wherein the cam hole 183 for passage the cocking piece 49A or 49B and the magazine 6 is disposed on the bottom of lower part of the receiver 181. The channel guides 178 are fastened to the lower part of the receiver 181 and the barrel chamber 173 via the cap screws 184. The stop 185 for the trigger box 31A or 31B or 31C disposed on the rear part of lower part of the receiver 181. The stop 185 has the cross through hole 186, which configured to interact with the multifunction latch 64 and two vertical threaded holes 187, wherein said stop is mounted on the rear part of the receiver 181 below via screws 188. The rear swivel 189 is disposed on the stop 185. The receiver 30 also comprising the bracket 190 having the threaded holes 191 in the lower part for fastening the bracket 190 to the lower part of the receiver 181 and a longitudinal hole 193, which configured to interact with a ramrod 58. The threaded hole disposed 194 on top of the bracket 190, for connection the rear sight rail 196 with the screw 195.

On the rear sight Picatinny-type rail 196 with the dovetail type slot 197, the hole 198 for screws 195 disposed in the middle of the slot 197. On the front sight Picatinny-type rail 196 with the dovetail type slot 197, the hole 198 disposed in the middle of the slot 197. On the plate 200 on which the hole 201 is disposed in the middle, which configured to interact with the extractor 28, and two threaded holes 202 disposed thereon at the edges, which configured for fastening the plate 200 to the lower part of the receiver 181 with the screws 203. FIG. 40, FIG. 41 showing all elements of the spring washer of the receiver 30, their forms and interactions.

Figure 42:
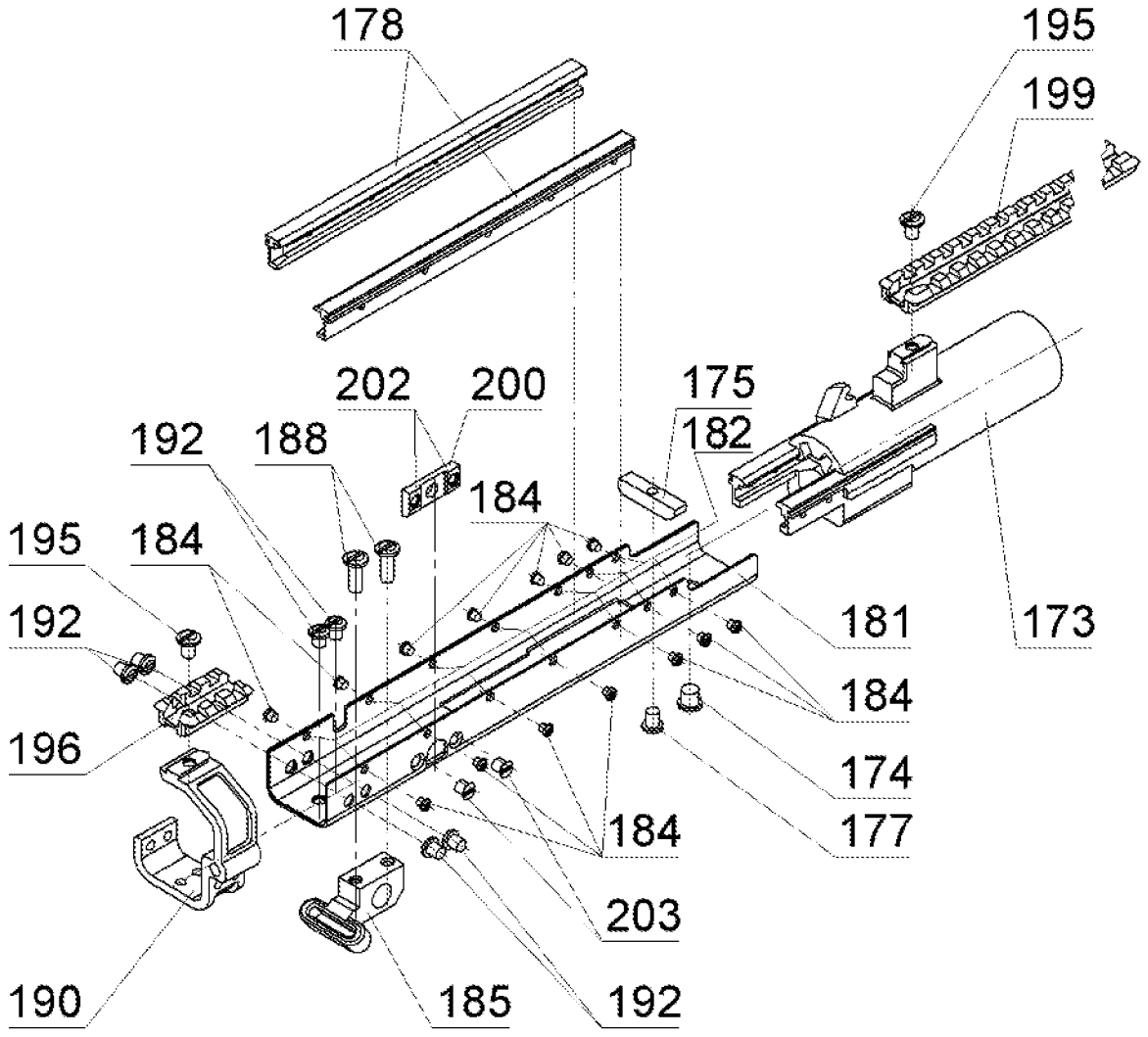
FIG. 42 is a detailing of the receiver 30 (side view).

FIG. 42 is a detailing of the receiver 30 (side view). This configuration comprising: the barrel chamber 173, the locking screw of the gun chamber 174, the feed ramp 175, the cap screw 177, the channel guide 178, the lower part of receiver 181, the cap screw 184, the stop 185, the screws 188, the bracket 190, the screws 192, the screws 195, the rear sight rail 196, the front sight rail 199, the plate 200, the screws 203.

Figure 43:
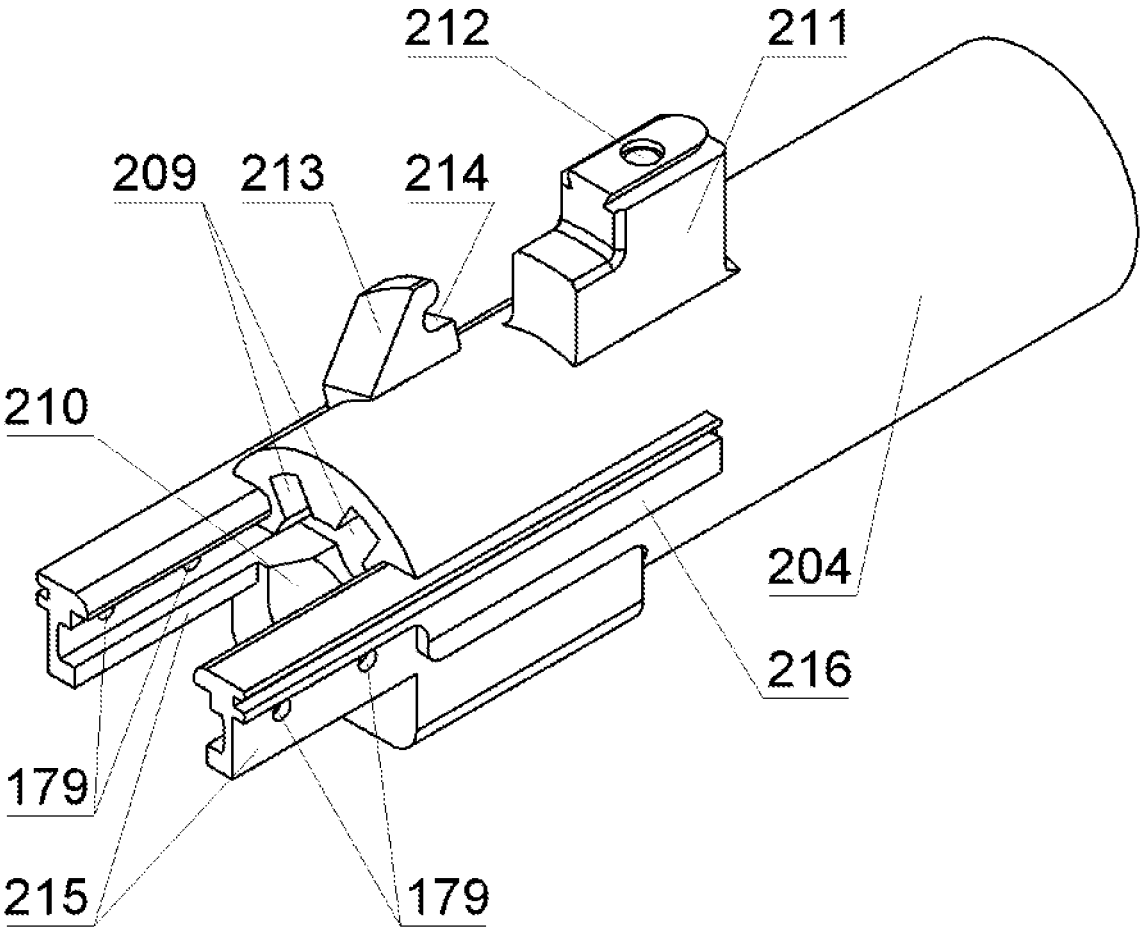
FIG. 43 is a side view of the barrel chamber 173.
Figure 44:
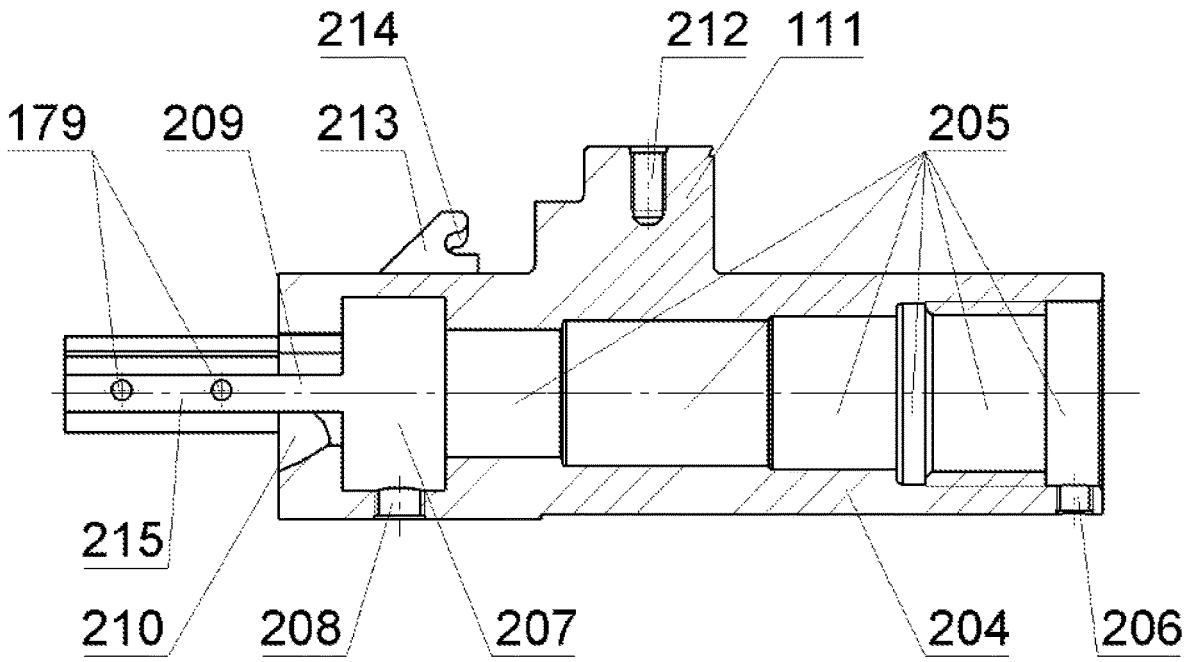
FIG. 44 is a longitudinal section of the barrel chamber 173.

FIG. 43 is a side view of the barrel chamber 173 and FIG. 44 is a longitudinal section of the barrel chamber 173. The barrel chamber 173 has a cylindrical part 204. At the end of cylindrical part 204 within which a multistage cylindrical hole with a threaded section 205 is disposed, which configured to mounting the conical bushing of the receiver 27, to mounting the multifunctional cartridge 26 and to mounting the barrel 24. At the inlet of the multistage cylindrical hole 205 with threaded section is the cross threaded hole 206 in the lower part for mounting the barrel latch 25. The multistage cylindrical hole with threaded section 205 passes into the cylindrical groove 207, the lower part of which has a threaded hole 208 for the locking screw of the barrel chamber 174. The cylindrical groove 207 passes into a complex-shaped section 209, which follows the shape of the front part of the shutter housing 19. On the inlet of the complex-shaped section 209 is two leading cylindrical guiding chamfers 210 disposed therein. In the middle at the top of the cylindrical section 204 the base with a dovetail-type ledge 211 disposed therein, in which the threaded hole 212 for a screw 195 is disposed for fastening the front sight rail 199. At the end of the cylindrical part 204 the inclined ledge 213 disposed therein, for interaction with the cocking lever 8. The cylindrical groove 214 disposed on inclined ledge 213. The rear end of the cylindrical part 204 has consoles 215 in the form of channel guides, which is configured to interact with the bolt carrier 12A or 12B (depending on the choice of an embodiment of the weapon) and the shutter housing 19. The cross threaded holes 179 for cap screws 184 to connecting with the barrel chamber 173 with the lower part of the receiver 181 disposed in the consoles 215. The upper grooves 216 are disposed on the external surface of the cylindrical part 204, configured to interact with the receiver cover 7. FIG. 43, FIG. 44 showing all elements of the spring washer of the barrel chamber 173, their forms and interactions.

Figure 45:
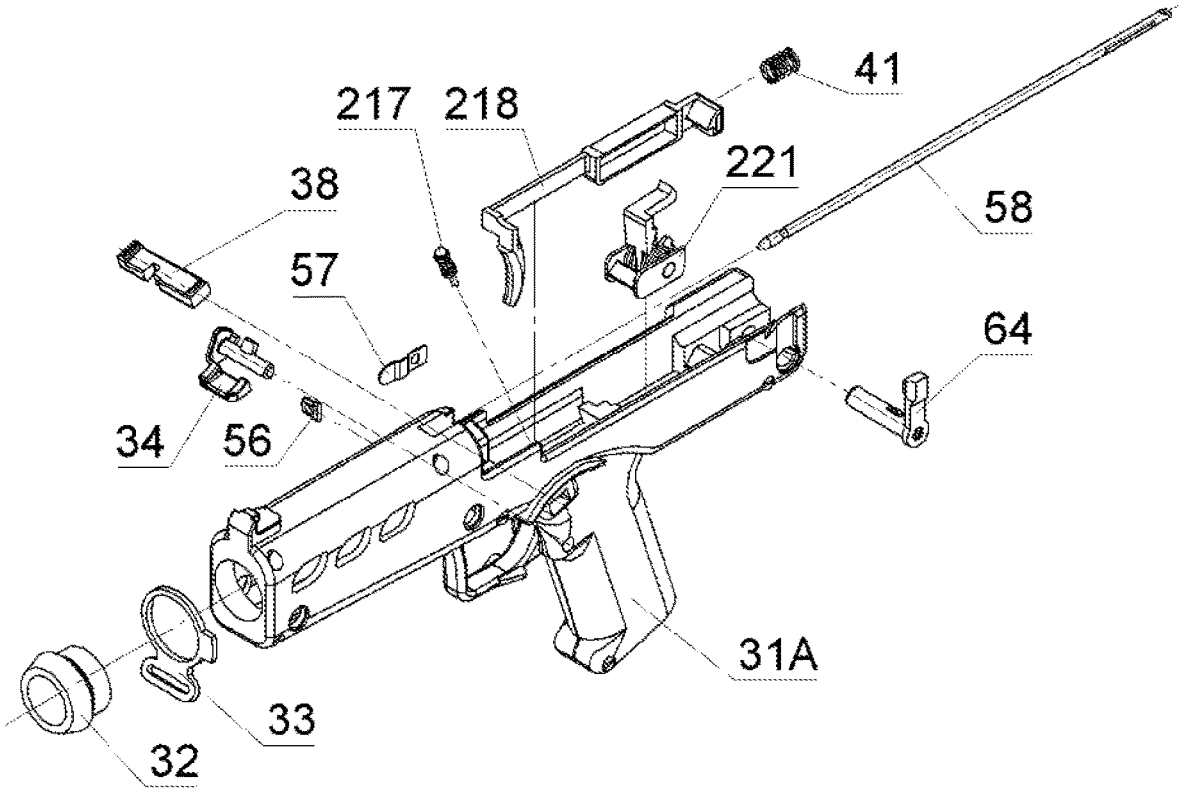
FIG. 45 is a detailing of the trigger housing with mechanisms 63A for automatic weapon.

FIG. 45 is a detailing of the trigger housing with mechanisms 63A for automatic weapon 1A. The trigger housing with mechanisms 63A comprising: the trigger housing 31A, the big front screw 32, the front swivel 33, the magazine latch 34, the safety catch 38, the trigger bar spring 41, the latch of ramrod 56, the spring of the latch of ramrod 57, the ramrod 58, the multifunction latch 64, the retainer mechanism 217, the firing mechanism for magazine shot 218, the percussion mechanism 221 for the magazine shot.

Figure 46:
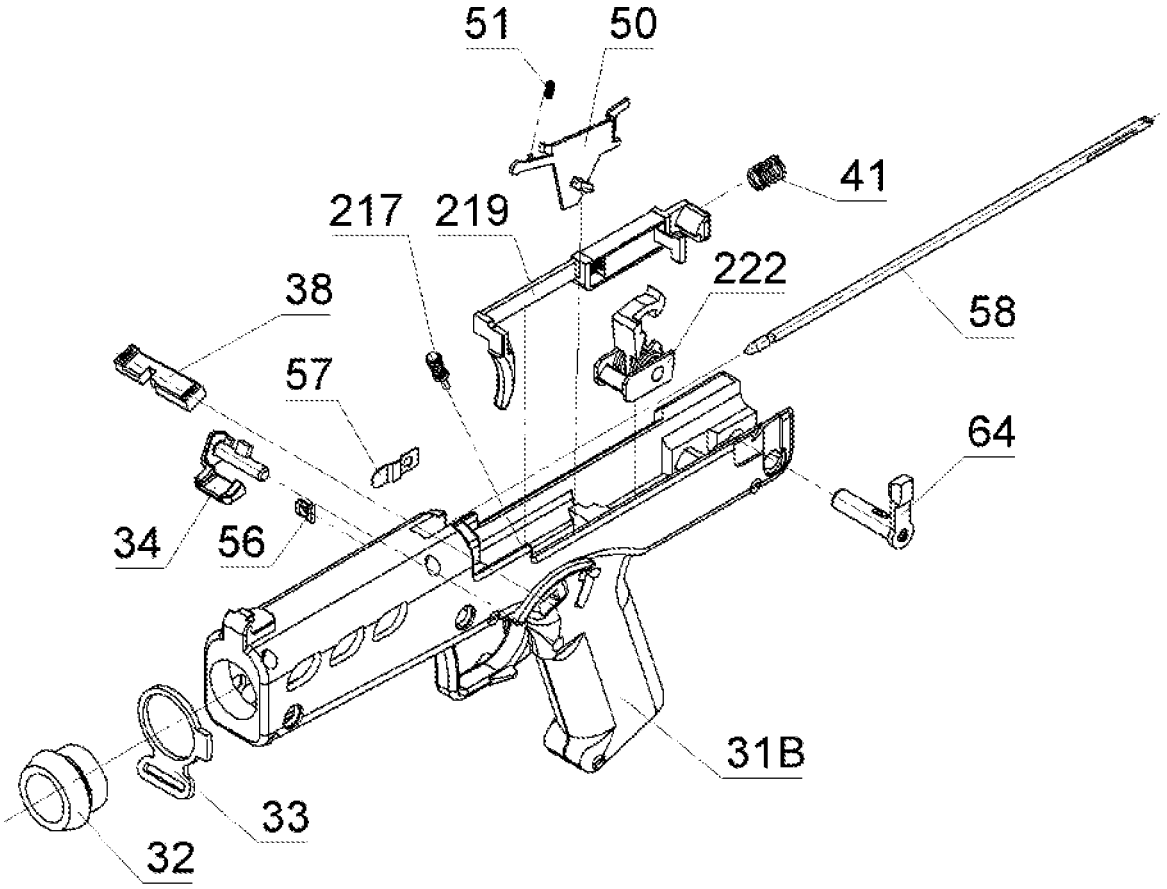
FIG. 46 is a detailing of the trigger housing with mechanisms 63B for semi-automatic weapon.

FIG. 46 is a detailing of the trigger housing with mechanisms 63B for semi-automatic weapon 1B. The trigger housing with mechanisms 63B comprising: the trigger housing 31B, the big front screw 32, the front swivel 33, the magazine latch 34, the safety catch 38, the trigger bar spring 41, the slide stop 50, the slide stop spring 51, the latch of ramrod 56, the spring of the latch of ramrod 57, the ramrod 58, the multifunction latch 64, the retainer mechanism 217, the firing mechanism for semi-automatic shot 219, the percussion mechanism 222 for semi-automatic shot and automatic shot.

Figure 47:
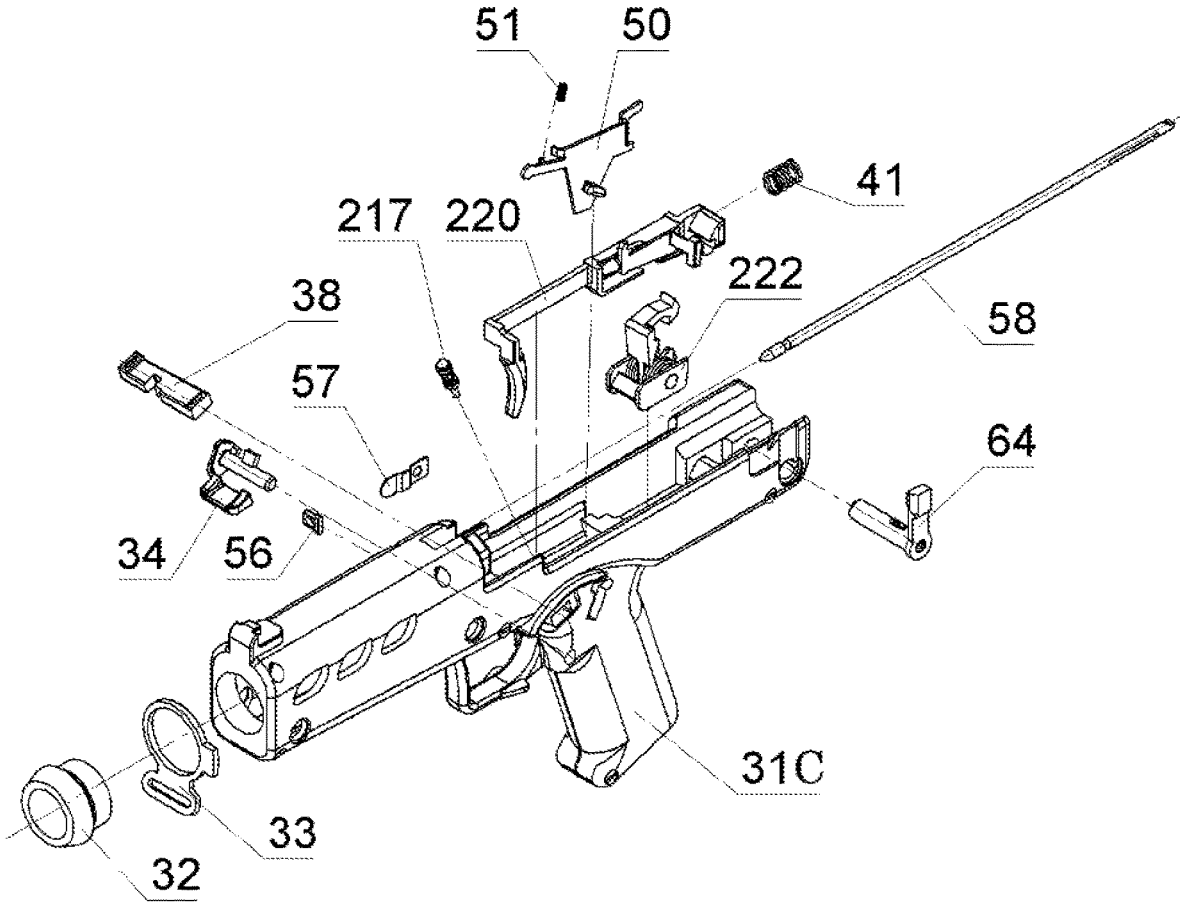
FIG. 47 is a detailing of the trigger housing with mechanisms 63C for automatic weapon.

FIG. 47 is a detailing of the trigger housing with mechanisms 63C for automatic weapon 1C. The trigger housing with mechanisms 63C comprising: the trigger housing 31C, the big front screw 32, the front swivel 33, the magazine the latch 34, the safety catch 38, the trigger bar spring 41, the slide stop 50, the slide stop spring 51, the latch of ramrod 56, the spring of the latch of ramrod 57, the ramrod 58, the multifunction latch 64, the retainer mechanism 217, the firing mechanism for automatic shot 220, the percussion mechanism 222 for semi-automatic and automatic shot.

Figure 48:
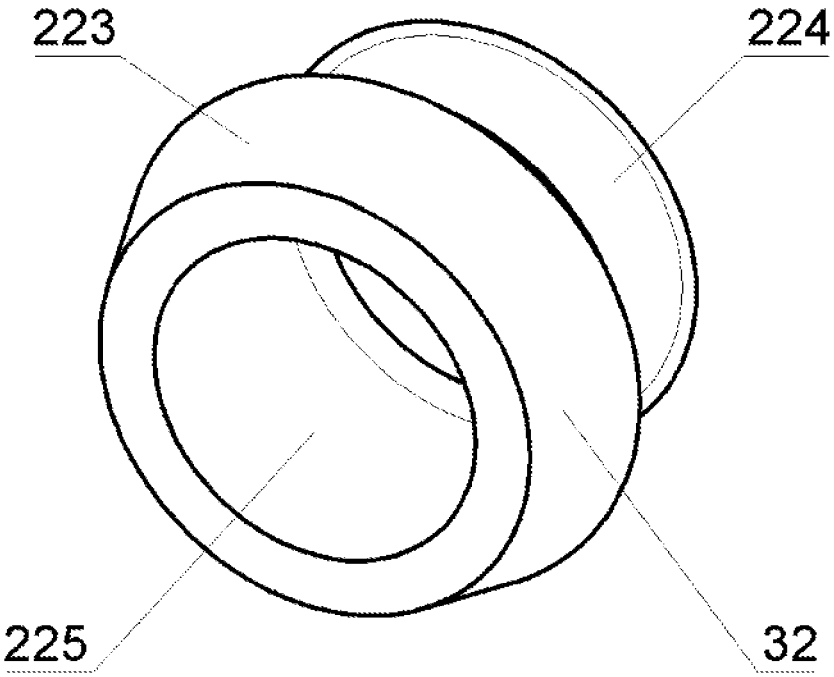
FIG. 48 is a side view of the big front nut 32.

FIG. 48 is a side view of the big front nut 32. The big front nut 32 is configured in the form of a truncated cone 223, which passes into the cylindrical section with the external thread 224. The through hole 225 disposed in said nut. FIG. 48 showing all elements of the big front nut 32, their forms and interactions.

Figure 49:
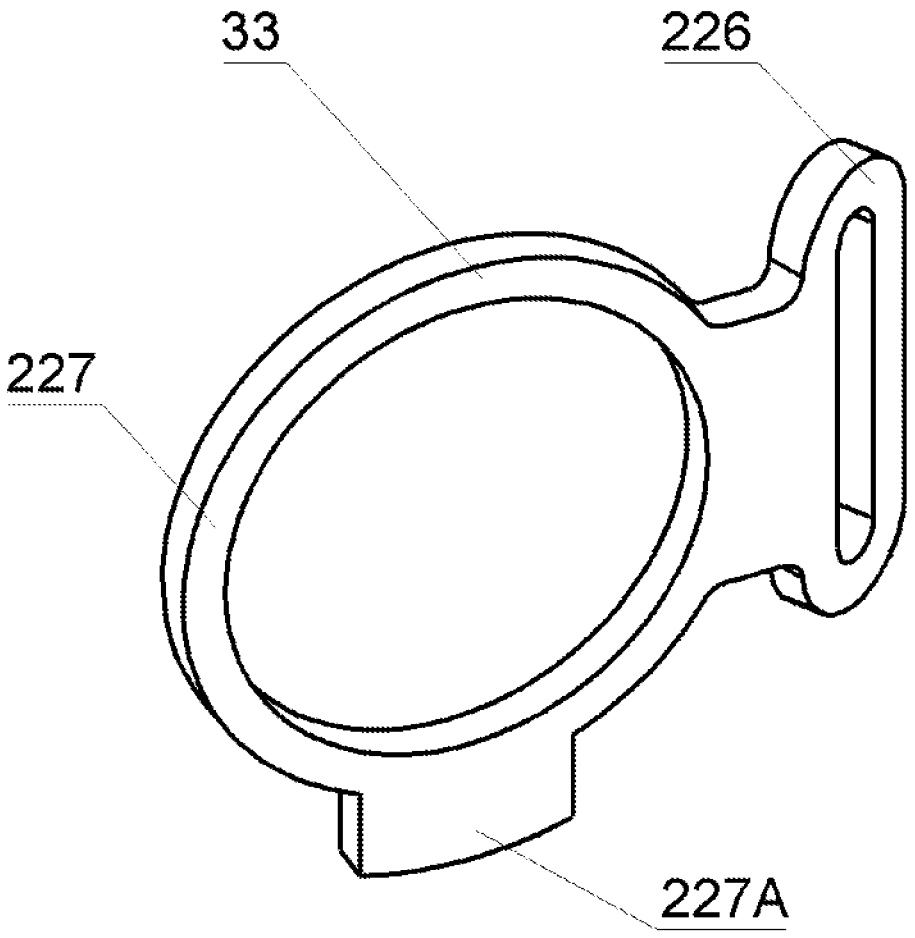
FIG. 49 is a side view of the front big swivel 33.

FIG. 49 is a side view of the front swivel 33. The front swivel 33 is configured in the form of a ring 226, on the side of which the ledge 226A and the sling swivel 227 are disposed in the form of an oval ring. FIG. 49 showing all elements of the front swivel 33, their forms and interactions.

Figure 50:
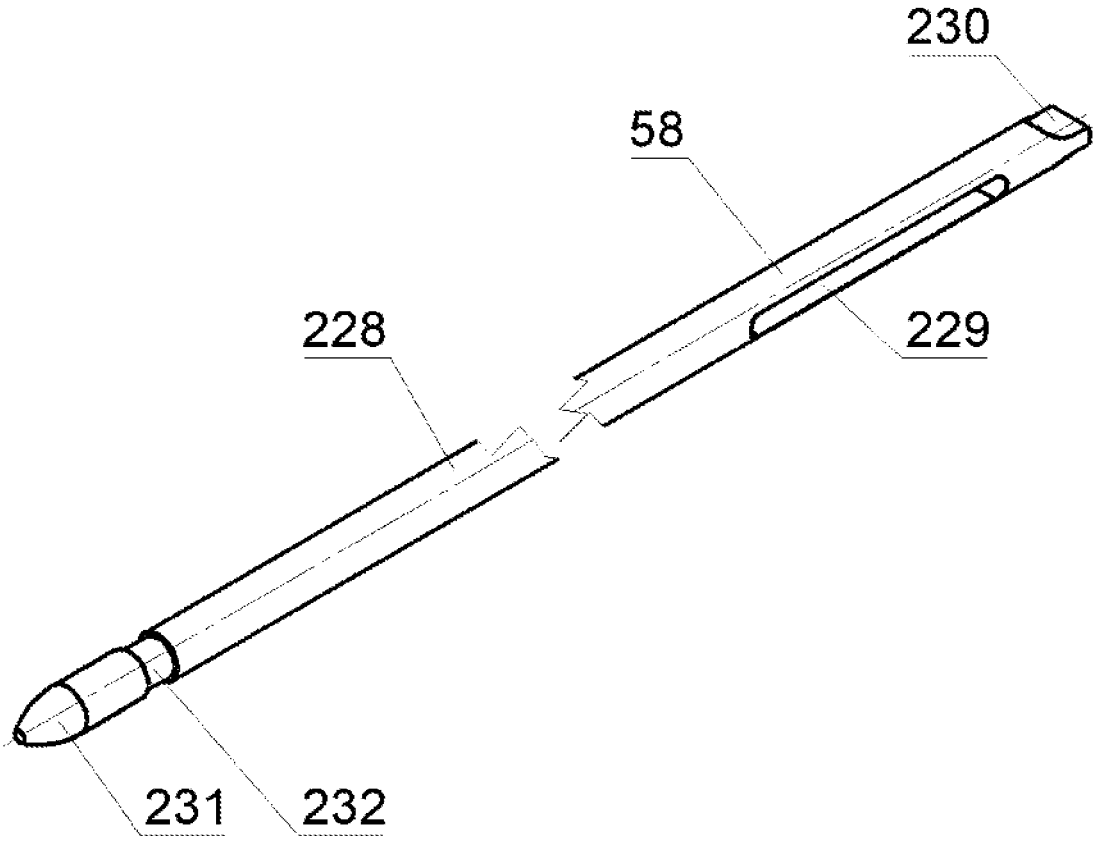
FIG. 50 is a side view of the ramrod 58.

FIG. 50 is a side view of the ramrod 58. The ramrod 58 configured in the form of a rod 228, at the front end of which a slotted slot 229 is disposed, which passes into the flat end 230 in the form of a screwdriver. The rear end of the rod 228 is configured in the form of a conical head 231, in front of which a groove 232 for retention of the latch of ramrod 56 is disposed. FIG. 50 showing all elements of the ramrod 58, their forms and interactions.

Figure 51:
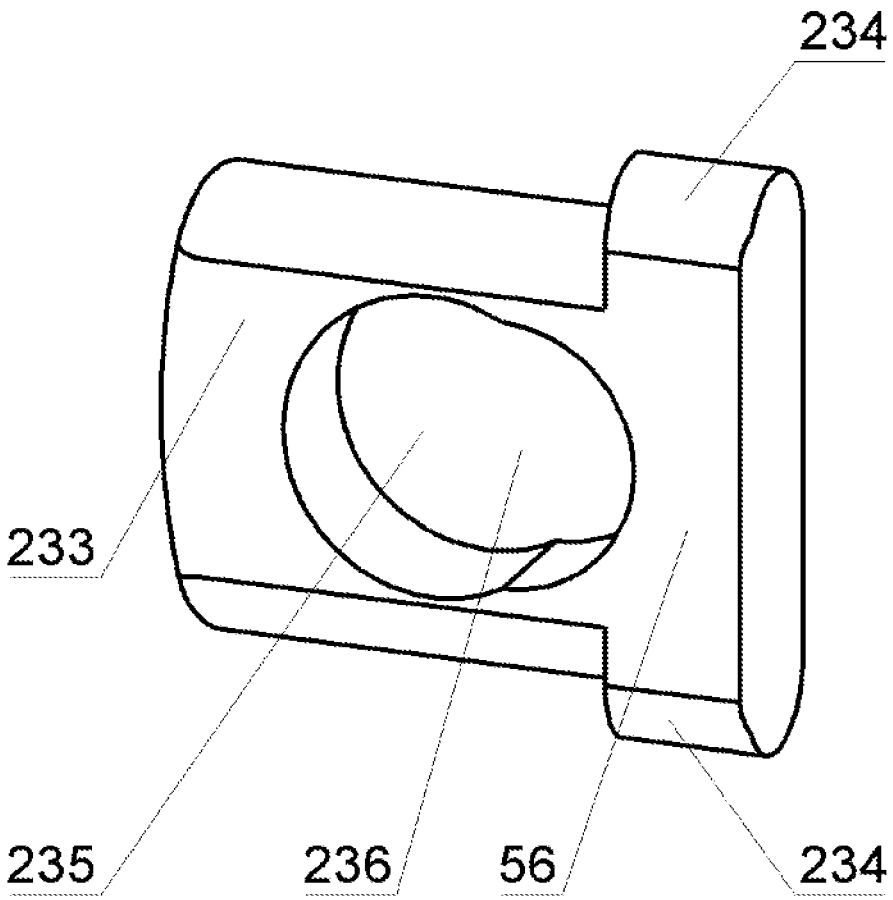
FIG. 51 is a side view of the latch of the ramrod 56.

FIG. 51 is a side view of the latch of ramrod 56. The latch of ramrod 56 is configured in the form of a plate 233 with rounded ledges 234 on the lower part. The through semi-circular hole 235 is disposed in the center of the plate 233. The semicircular slot 236 is disposed in the lower part of the through hole 235. FIG. 51 showing all elements of the latch of ramrod 56, their forms and interactions.

Figure 52:
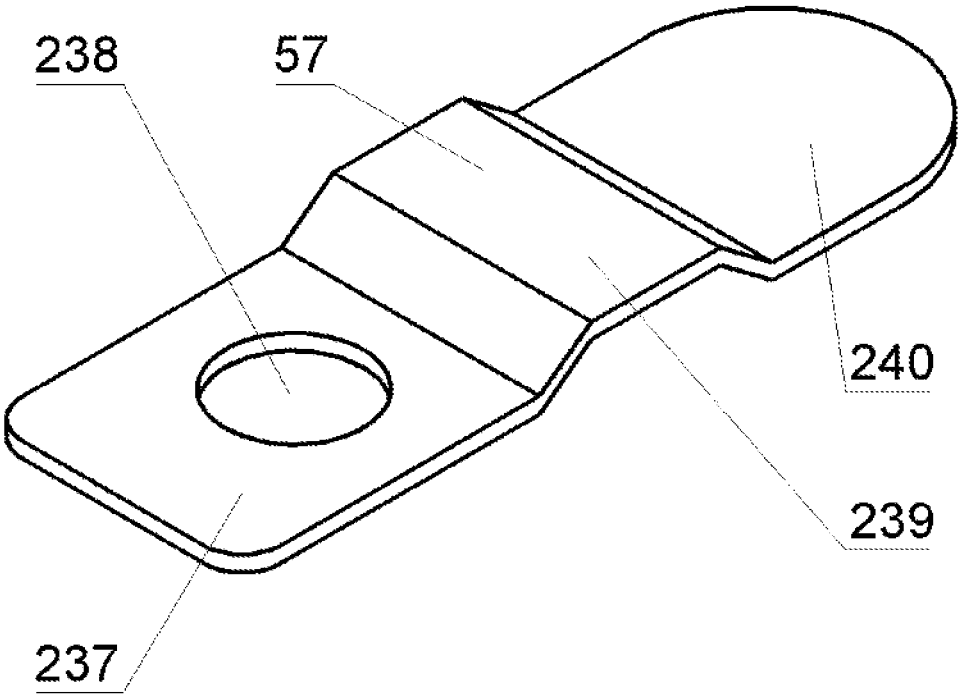
FIG. 52 is a side view of the spring of the lock ramrod latch 57.

FIG. 52 is a side view of the spring of the latch of ramrod 57. The spring of the latch of ramrod 57 is configured in the form of the flat spring 237, which has through hole 238 at the front end. The bulge 239 is disposed in the middle of the flat spring. The rear part 240 of the flat spring is rounded. FIG. 52 showing all elements of the spring of the latch of ramrod 57, their forms and interactions.

Figure 53:
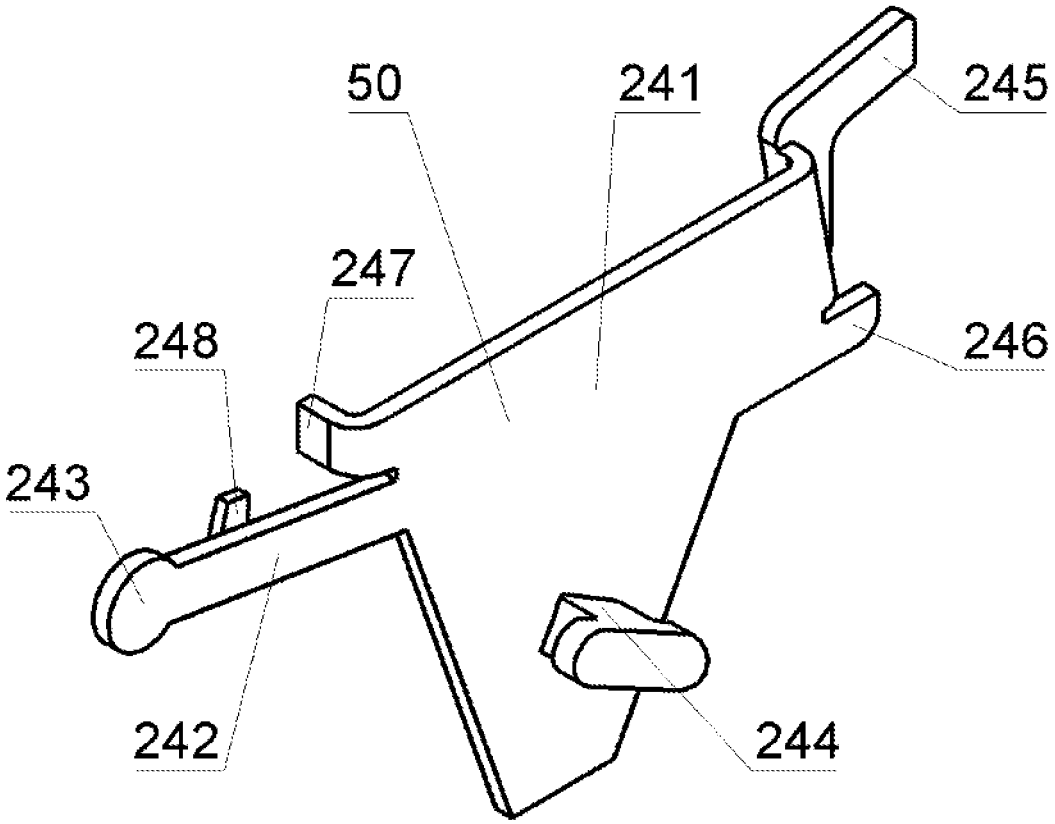
FIG. 53 is a side view of the slide stop 50.

FIG. 53 is a side view of the slide stop 50. The slide stop 50 configured in the form of a plate 241, in front upper part of which ledge 242 with a hinge 243 in the form of the washer is disposed therein. The "T" shaped ledge 244 is disposed on the external side of plate 241. Two ledges are disposed at the end of said plate 241, upper ledge 245 for retention the locking lug 129 of the bolt body 19 and lower ledge 246 for stop it into the receiver 30, because of this, the upper ledge 245 in upper position installed on the trajectory of the locking lug 129 of the bolt body 19. The ledge for ledge 424 of magazine 6 platform 423 is disposed 247 on the internal side of plate 241. The hook 248 disposed on the internal side of the lever 242 for the spring of the slide stop 51. FIG. 53 showing all elements of the slide stop 50, their forms and interactions.

Figure 54:
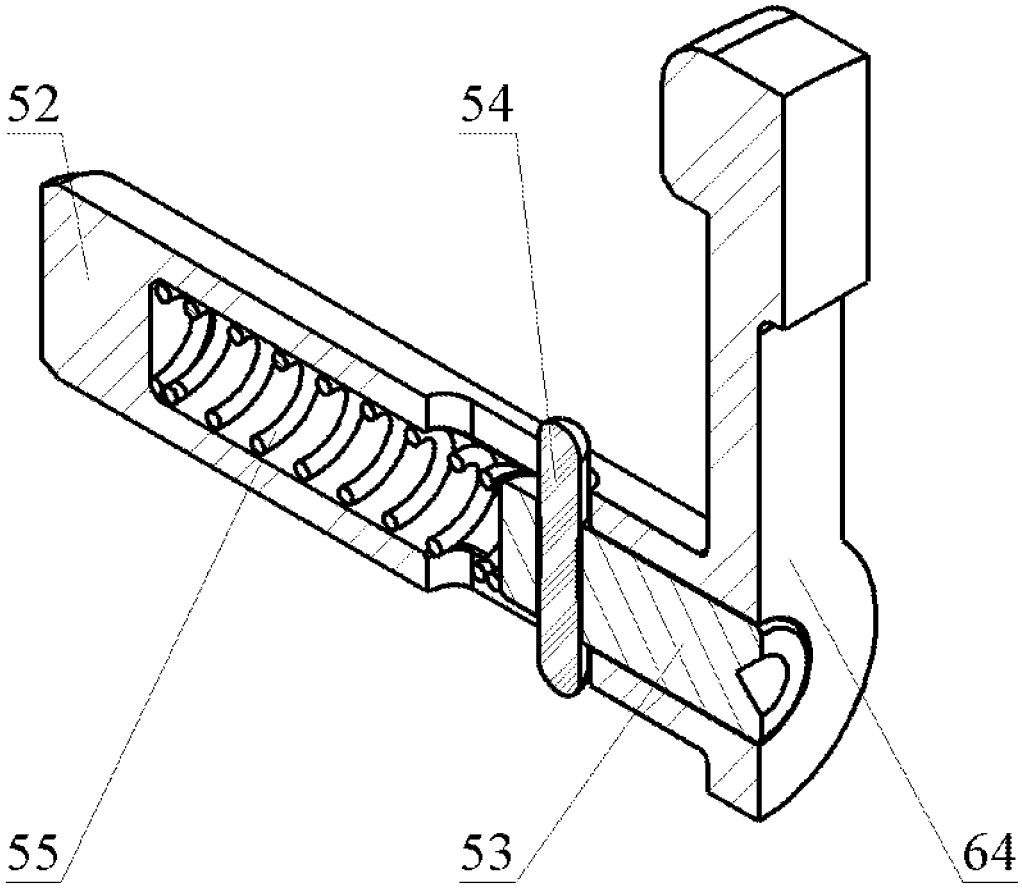
FIG. 54 is a longitudinal section of the multifunction latch 64.

FIG. 54 is a longitudinal section of the multifunction latch 64. The multifunction latch 64 comprising: the multifunction latch lever 52, the multifunctional latch stop 53 the lock pin splint 54, the spring of the lock pin splint 55.

Figure 55:
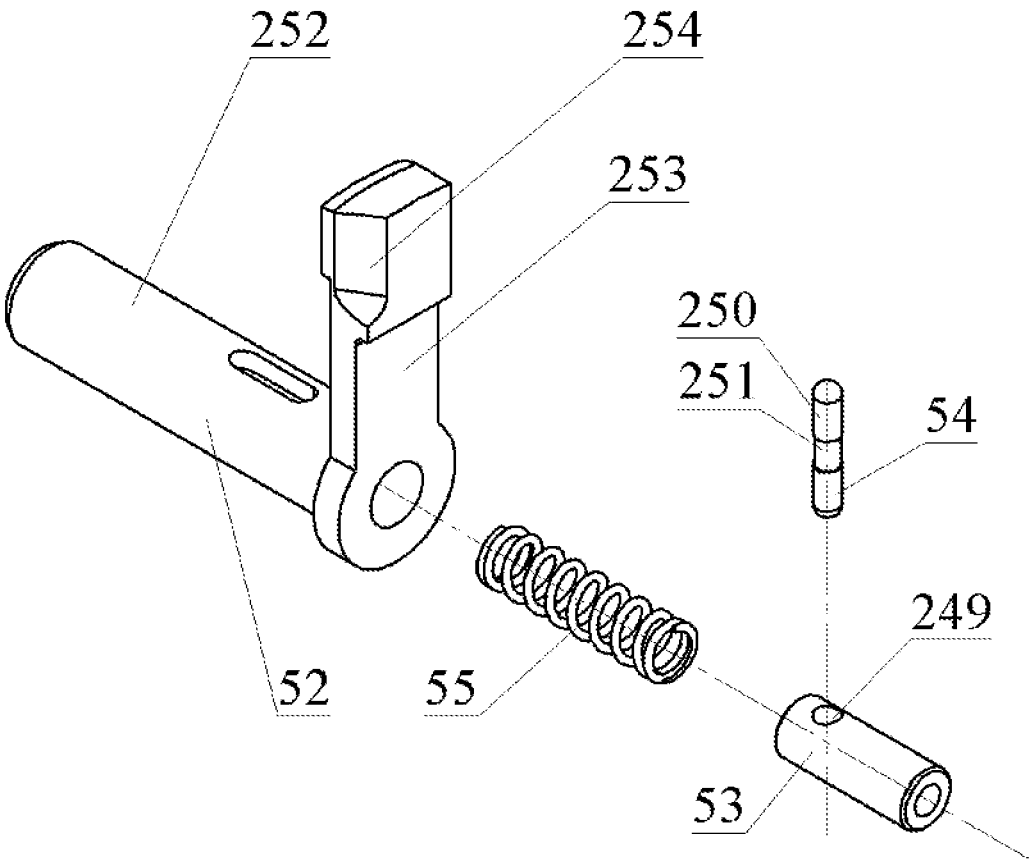
FIG. 55 is a detailing of the multifunction latch 64 (side view).

FIG. 55 is a detailing of the multifunction latch 64 (side view). The multifunction latch 64 comprising: multifunction latch lever 52, the multifunction latch lever 52 is configured in the form of the rod 252, in front of which the lever 253 disposed therein with inclined area 254, multifunctional latch stop 53 within which a through cross hole 249 is disposed for the lock pin 54, which has spherical ends 250 and the groove in the middle 251, the spring of the lock pin splint 55.

Figure 56:
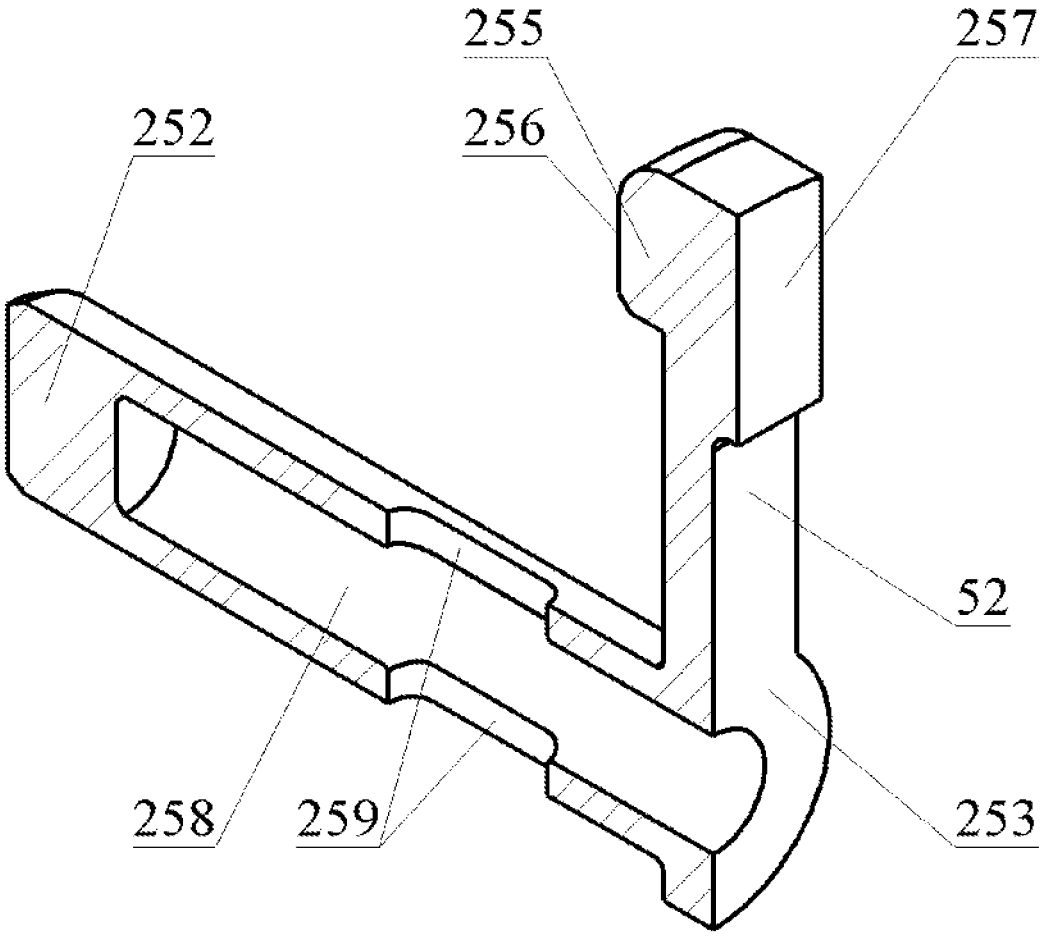
FIG. 56 is a longitudinal section of the multifunction latch lever 52.

FIG. 56 is a longitudinal section of the multifunction latch lever 52. The multifunction latch lever 52 comprises the rod 252 with the lever 253 in front part. The protrusions, rear 256 and front 257 are disposed on the enlargement 255, which is disposed at the end of the lever 253. The rear protrusion 256 is configured for retention the multifunction latch lever 52 in the trigger housing 31A, or 31B, or 31C. The front protrusion 257 functions as a button for the multifunction latch lever 52. The blind hole 258 is disposed in the rod 252 from the side of the lever 253 against the lock pin spring 55 and the multifunction latch stop 53. Besides, in the rod 252 the through slot 259 for lock pin splint 54 is disposed. Wherein, the multifunction latch stop 53 and the lock pin 54 are configured to reciprocate in the multifunction latch lever 52. FIG. 56 showing all elements of the multi-function latch lever 52, their forms and interactions.

Figure 57A:
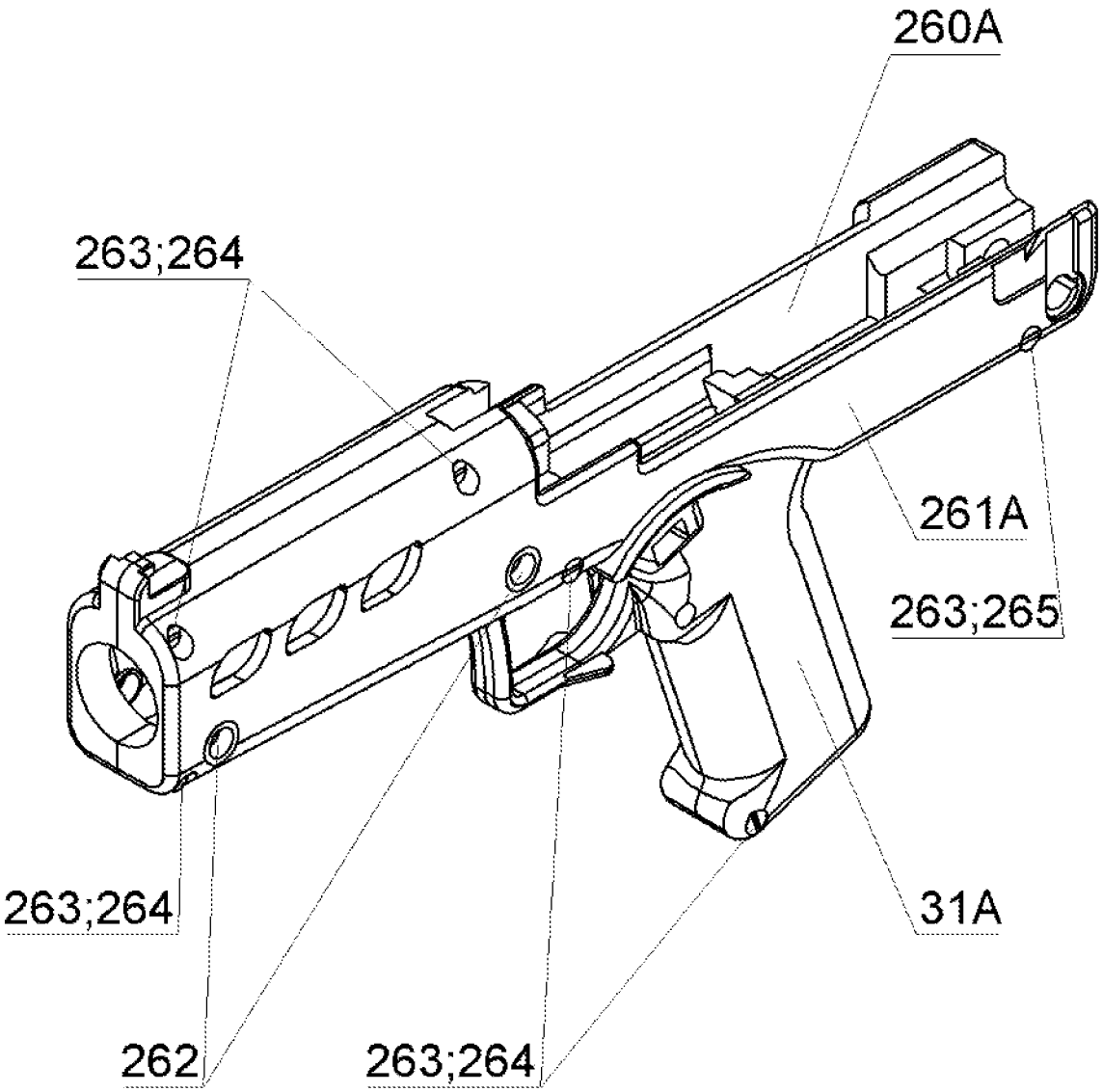
FIG. 57A is a side view of the trigger housing 31A.

FIG. 57A is a side view of the trigger housing 31A. The trigger housing 31A comprising: the right half of the trigger housing 260A and left half of the trigger housing 261A, lower ventilation bushings 262, which additionally function as the hinge for installation a trunnion for a tripod, that provid a precision shoot from a fixed position, cap screws 263, threaded bushings 264 for cap screws 263, threaded bushing with the splineway 265 for cap screw 263 in the gunstock 5 installation place.

Figure 57B:
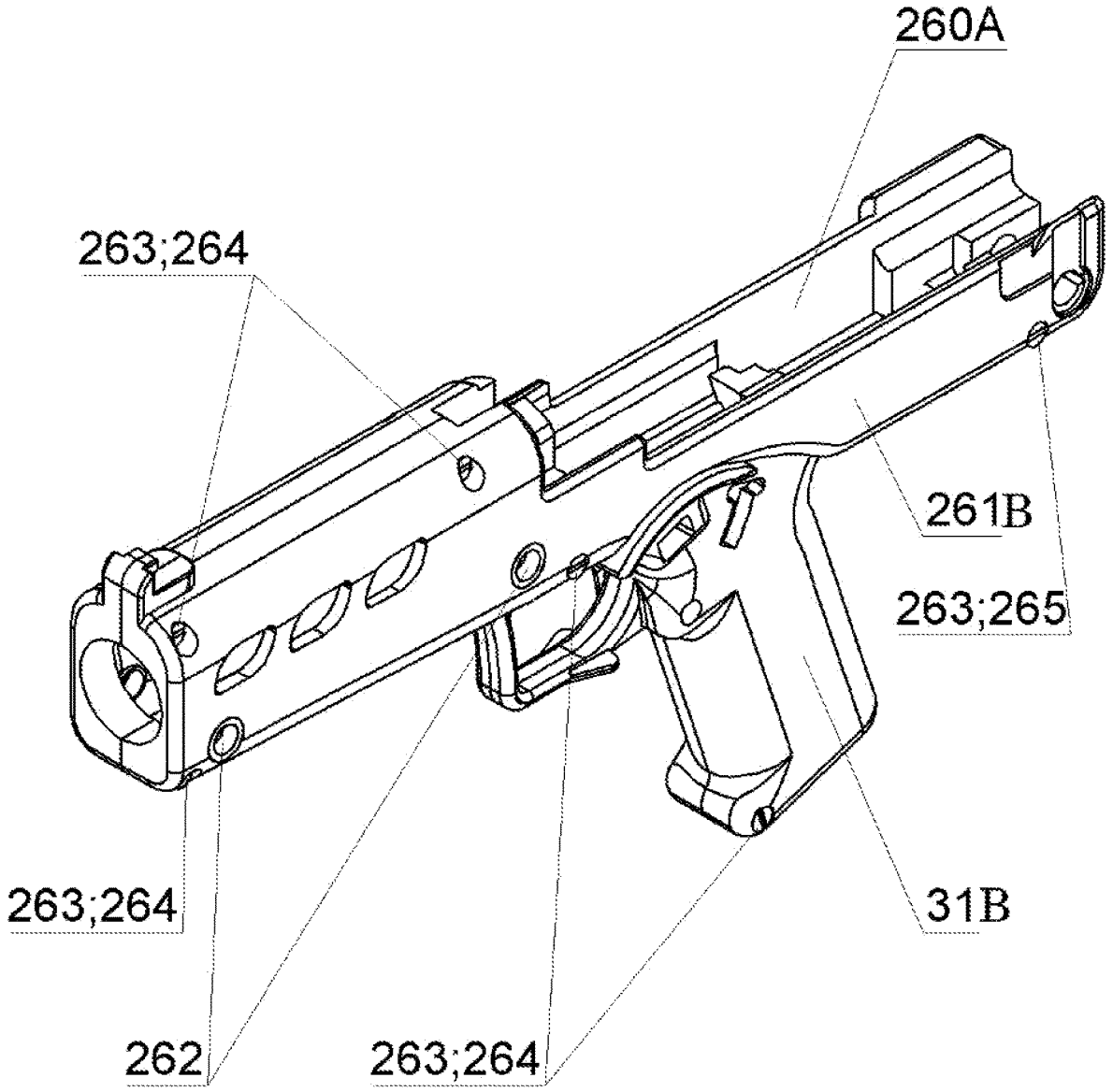
FIG. 57B is a side view of the trigger housing 31B.

FIG. 57B is a side view of the trigger housing 31B. The trigger housing 31B comprising: the right half of the trigger housing 260A and left half of the trigger housing 261B, lower ventilation bushings 262, which additionally function as the hinge for installation a trunnion for a tripod, that provid a precision shoot from a fixed position, cap screws 263, threaded bushings 264 for cap screws 263, threaded bushing with the splineway 265 for cap screw 263 in the gunstock 5 installation place.

Figure 57C:
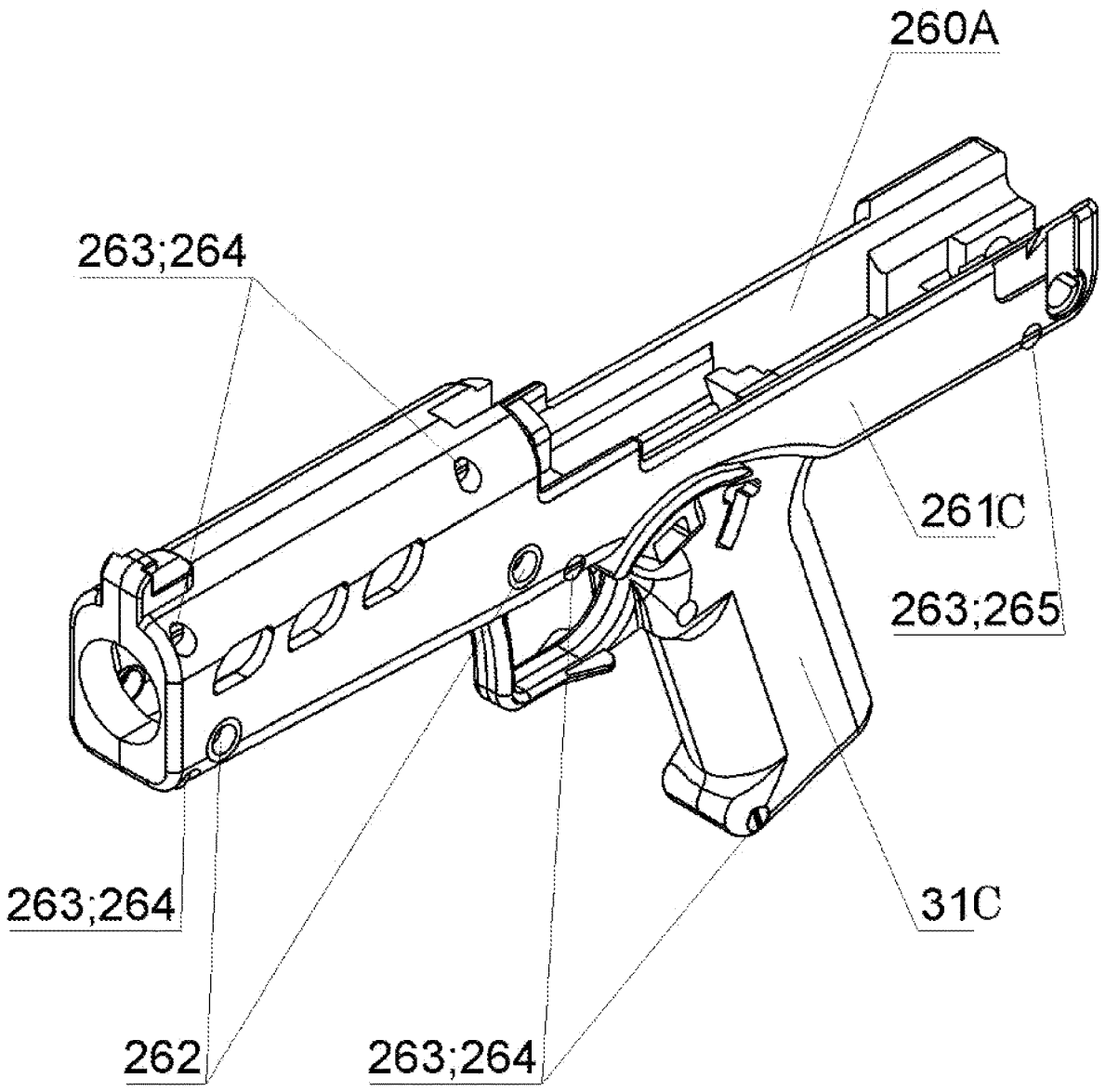
FIG. 57C is a side view of the trigger housing 31C.

FIG. 57C is a side view of the trigger housing 31C. The trigger housing 31C comprising: the right half of the trigger housing 260C and left half of the trigger housing 261B, lower ventilation bushings 262, which additionally function as the hinge for installation a trunnion for a tripod, that provid a precision shoot from a fixed position, cap screws 263, threaded bushings 264 for cap screws 263, threaded bushing with a splineway 265 for cap screw 263 in gunstock 5 installation place.

Figure 58A:
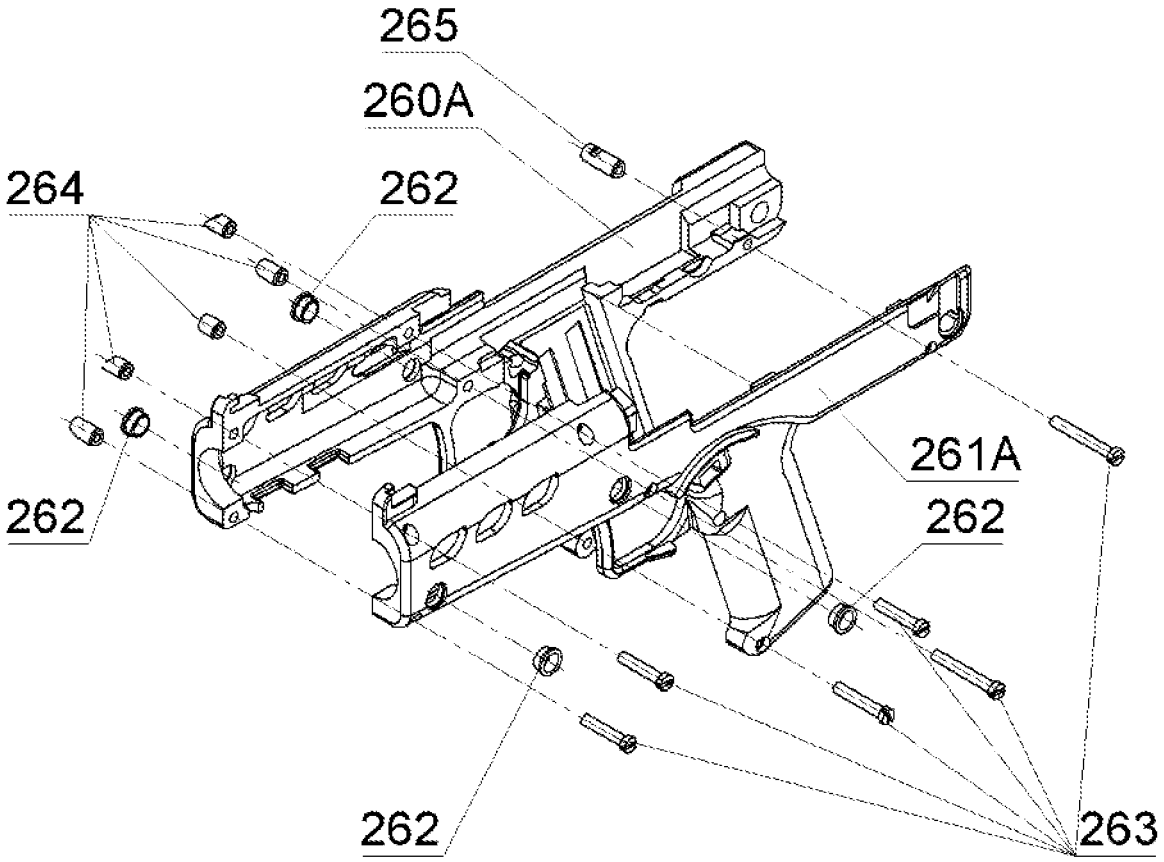
FIG. 58A is a side view. Detailing of the trigger housing 31A.

FIG. 58A is a detailing of the trigger housing 31A (side view). This configuration comprising: the right half of the trigger housing 260A and left half of the trigger housing 261A, lower ventilation bushings 262, cap screws 263, threaded bushings 264, threaded bushing with the splineway 265.

Figure 58B:
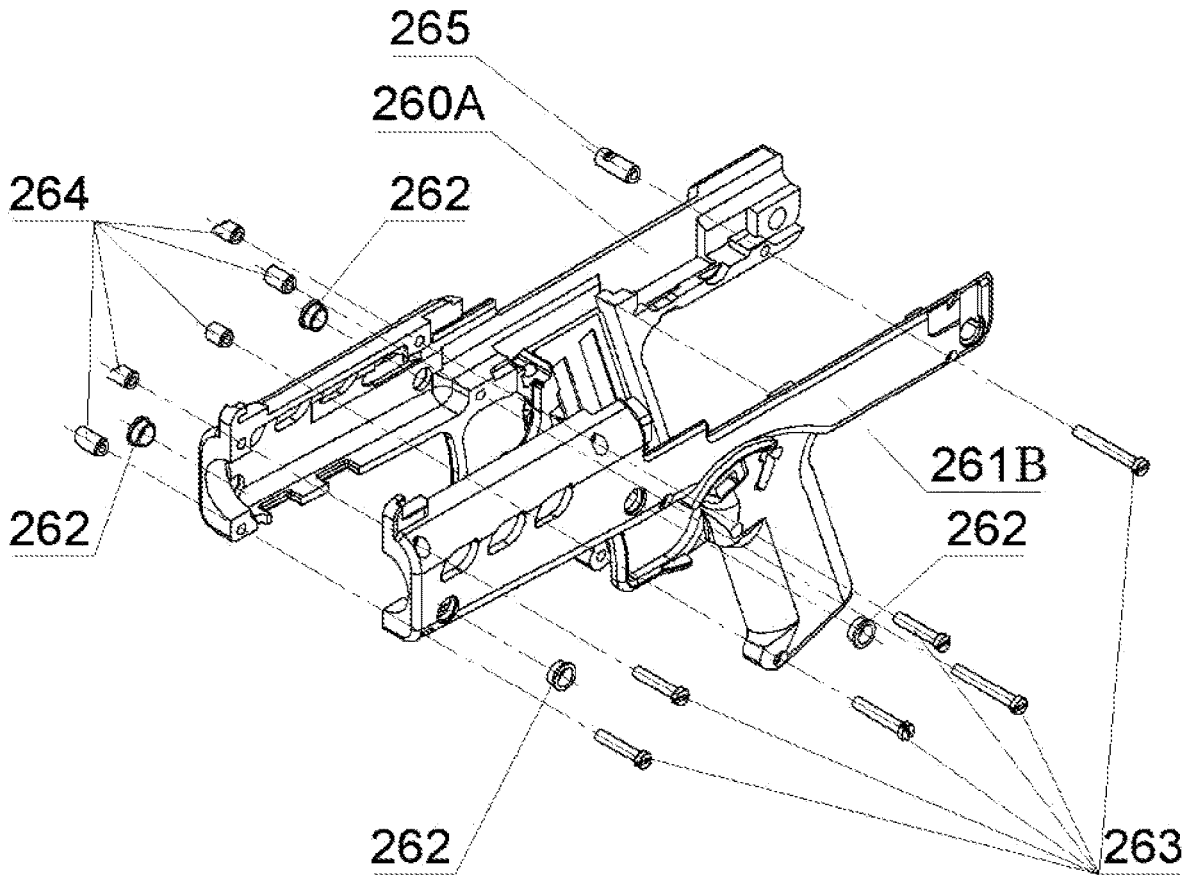
FIG. 58B is a side view. Detailing of the trigger housing 31B.

FIG. 58B is a detailing of the trigger housing 31B (side view). This configuration comprising: the right half of the trigger housing 260A and left half of the trigger housing 261B, lower ventilation bushings 262, cap screws 263, threaded bushings 264, threaded bushing with the splineway 265.

Figure 58C:
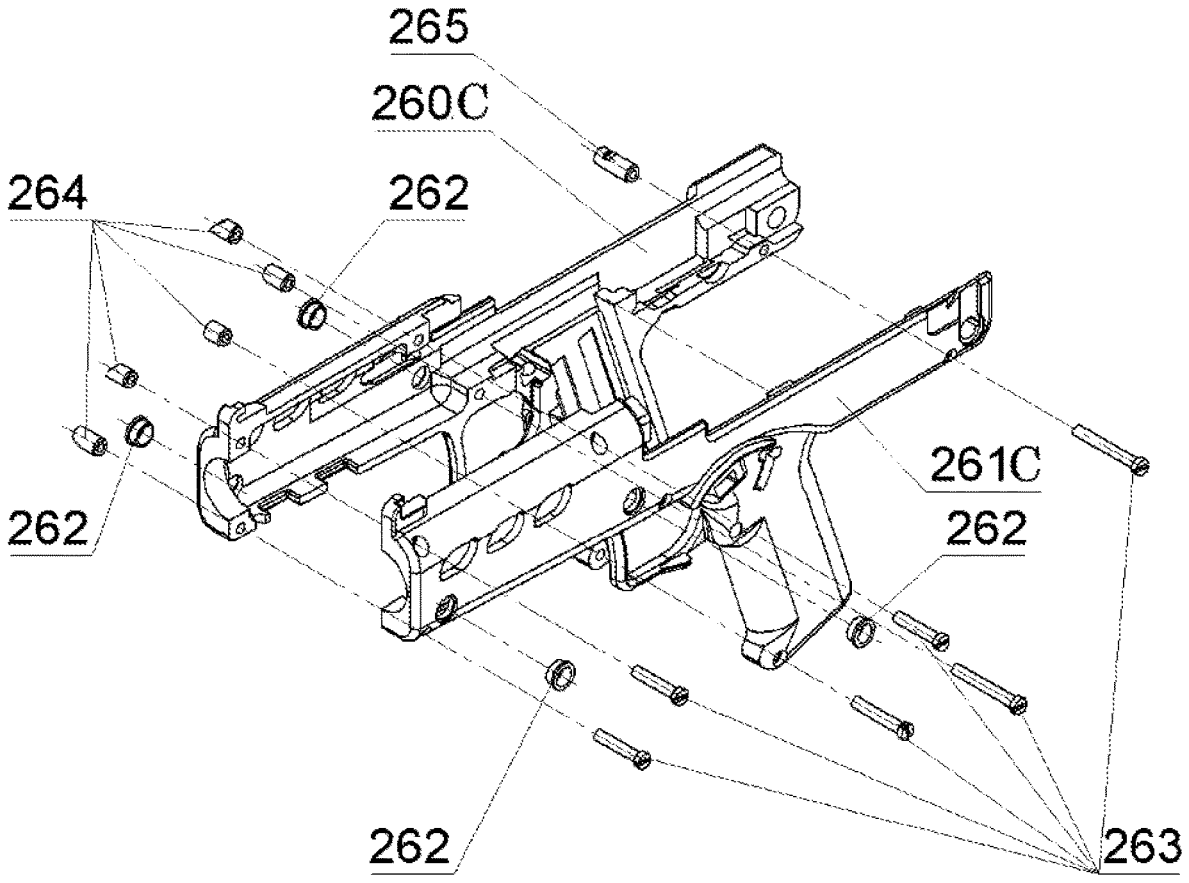
FIG. 58C is a side view. Detailing of the trigger housing 31C.

FIG. 58C is a detailing of the trigger housing 31C side view). This configuration comprising: the right half of the trigger housing 260C and left half of the trigger housing 261B, lower ventilation bushings 262, cap screws 263, threaded bushings 264, threaded bushing with the splineway 265.

Figure 59:
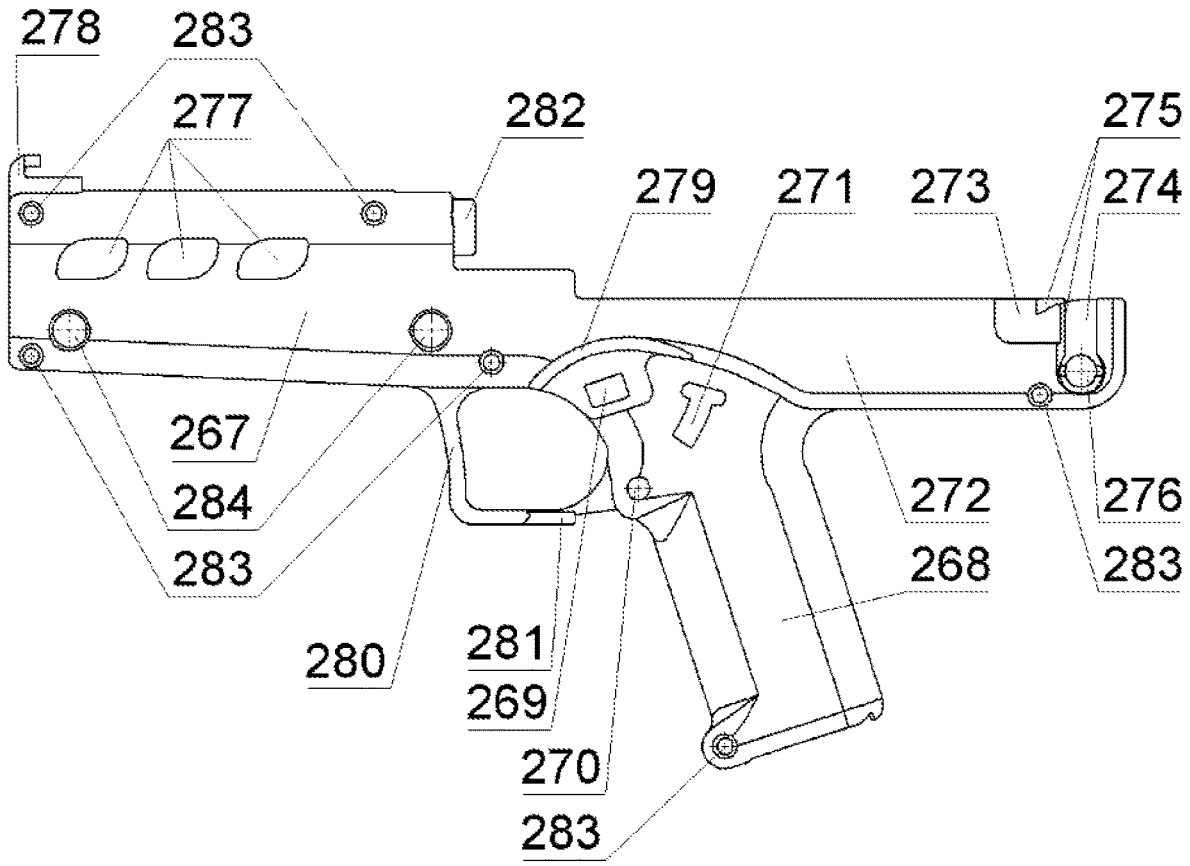
FIG. 59 is a side view outside of the left half of the trigger housing 261A or 261B.
Figure 60:
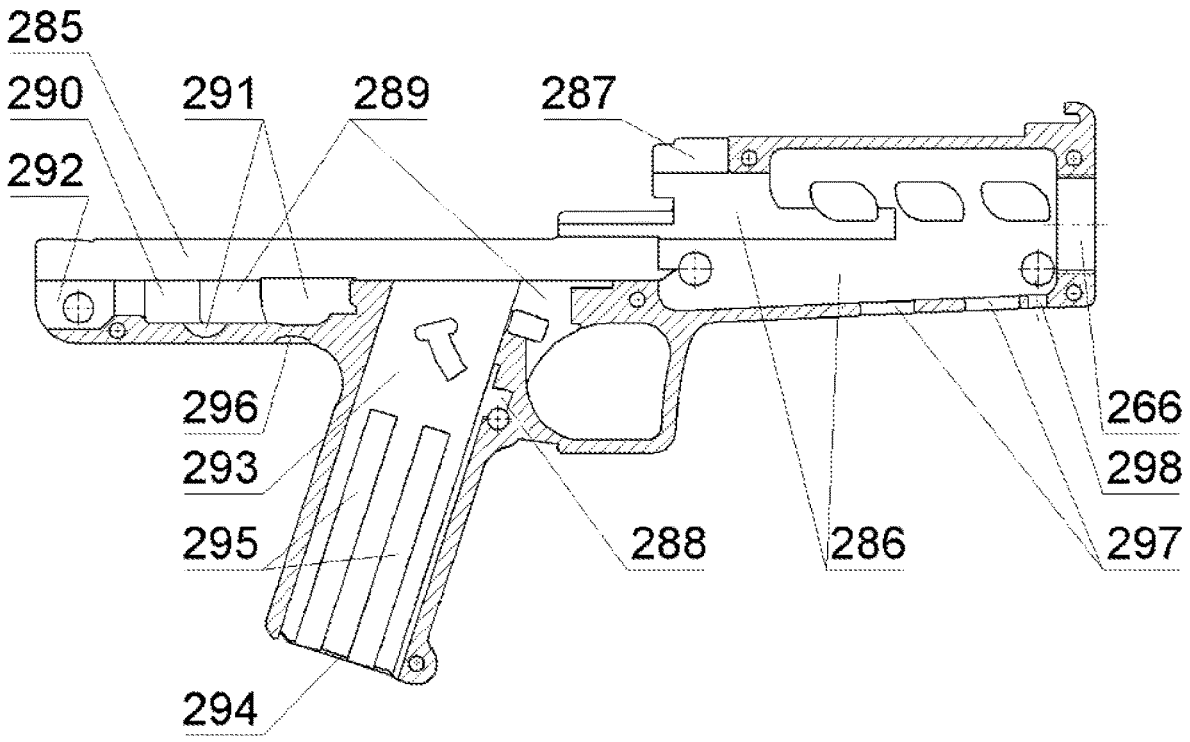
FIG. 60 is a side view inside of the left half of the trigger housing 261A or 261B.

FIG. 59 is a side view of the outside of the left half of the trigger housing 261A or 261B, and FIG. 60 is a side view of the inside of the left half of the trigger housing 261A or 261B. The threaded hole 266 for the big front nut 32 and the handguard 267 are disposed in the front part of the left half of the trigger housing 261A or 261B. The left half of the trigger housing 261A or 261B having the pistol grip 268 below in the middle. The rectangular hole 269 for the safety catch 38 and hole 270 for the magazine latch 34 are disposed in the pistol grip 268. The "T" shaped hole 271 for the slide stop 50 (only for the left half of the trigger housing 261B) is disposed on the pistol grip 268. Slots 273, 274, which biasing with the inclined area 275 and complex-shaped hole 276 for the multifunction latch 64 are disposed in the rear part of the left half of the trigger housing 261A or 261B. Ventilative holes 277 and hook 278 for retention the front sight Picatinny-type rail 199 are disposed on the upper front part of the left half of the trigger housing 261A or 261B. The trigger guard 279 is disposed above the pistol grip 268 for the safety catch 38 protection, for the case of the weapon dropping. The pistol grip 268 and handguard 267 are fastened via the trigger guard 280, on which protrusions are mounted for magazine latch 34 for protection from accidental press. The protrusion 282 is disposed in the upper part of the handguard 267 behind the ventilative holes 277 to provide the hermetization of the receiver cover 7 in off position. Cross holes 283 for the cap screws 263 are disposed on the left half of the trigger housing 261A or 261B. The holes 284 for the lower ventilation grooves 262 are disposed in the side walls of the handguard 267. The left half of the trigger housing 261A or 261B having within the channel 285, cavity 286 and slot 287 for mounting the receiver with the barrel and mechanisms 62. Besides, the cavity 288 is configured for the magazine latch 34. Besides, the cavity 289 is configured for hauling with the hook 39A or 39B and the cavity 290 for the trigger bar spring 41. The cavity 291 for the cocking piece 49A or 49B is disposed at the beginning of the cavity 290. Besides, the cavity 292 configured for the stop 185. Besides, the rectangular hole 293, inlet conical hole 294, and slots for collecting dirt 295 are configured for the magazine 6. Besides, the hole 296 is configured for the cocking indicator, trigger 49A or 49B. Besides, the lower rectangular holes 297 and cylindrical hole 298 are configured for mounting the forward grip 4. FIG. 59, FIG. 60 showing all elements of the left half of the trigger housing 261A or 261B, their forms and interactions.

Figure 61:
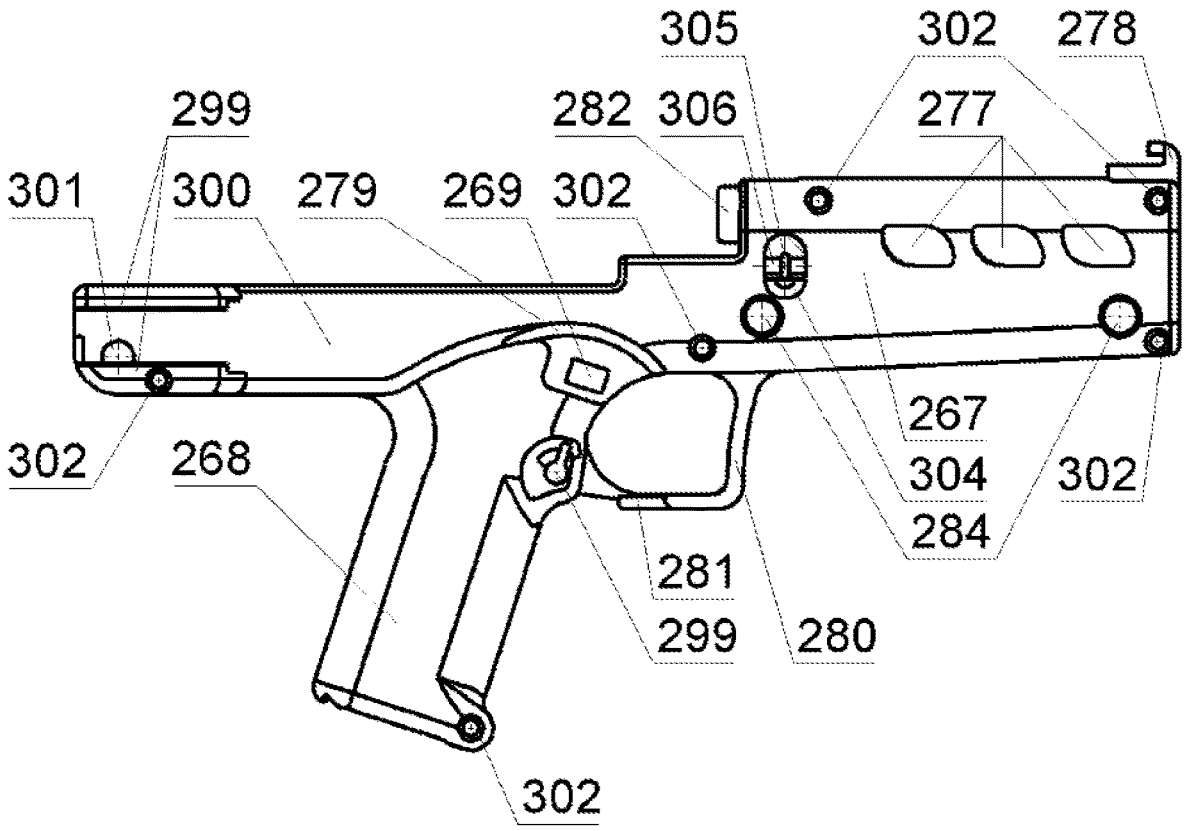
FIG. 61 is an exterior side view of the right half of the trigger housing 260A or 260C.
Figure 62:
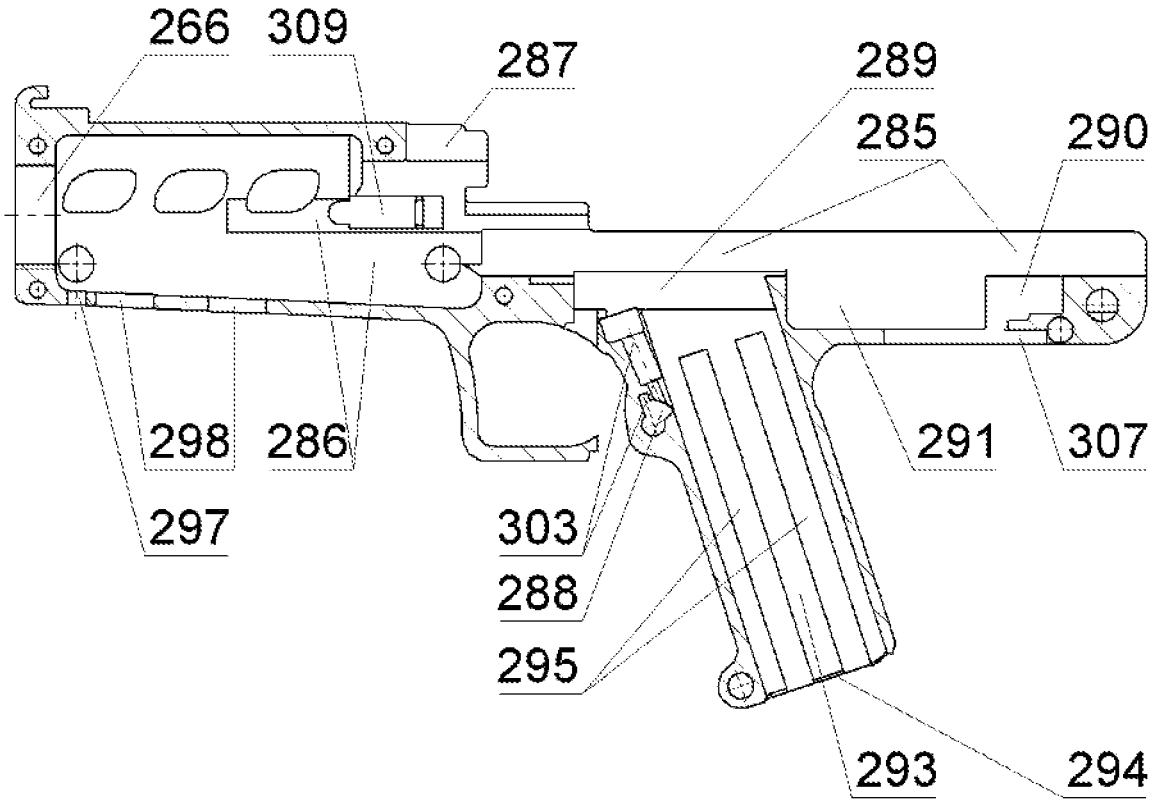
FIG. 62 is an interior side view inside of the right half of the trigger housing 260A or 260C.

FIG. 61 is an exterior side view of the right half of the trigger housing 260A or 260C and FIG. 62 is an interior side view inside of the right half of the trigger housing 260A or 260C. The right half of the trigger housing 260A or 260C having threaded hole 266 for the big front nut 32 and handguard 267 in the front part. The left half of the trigger housing 261A or 261B having the pistol grip 268 below in the middle. The pistol grip 268 having the rectangular hole 269 for safety catch 38 and the complex-shaped hole 299 for the magazine latch 34. The hole 301 for the multifunction latch 64 is disposed in the rear part 300 of the right half of the trigger housing 260A or 260C. The upper front part of the right half of the trigger housing 260A or 260C having the ventilative holes 277 and the hook 278 for retention the front sight Picatinny-type rail 199. The trigger guard 279 is disposed above the pistol grip 268 for the safety catch 38 protection, for the case of the weapon dropping. The pistol grip 268 and handguard 267 are fastened via the trigger guard 280, on which the protrusions are mounted for the magazine latch 34 for protection from accidental press. The protrusion 282 is disposed in the upper part of the handguard 267 behind the ventilative holes 277 to provide the hermetization of the receiver cover 7 in off position. Cross threaded holes 302 for the threaded bushings 264 and threaded bushing with the splineway 265 are disposed on the right half of the trigger housing 260A or 260C. The holes 284 for the lower ventilation grooves 262 disposed in the side walls of the handguard 267. The channel 285, cavity 286 and slot 287 for installation the receiver with the barrel and mechanisms 62 are disposed within the right half of the trigger housing 260A or 260C. The assembly holes 303 for the safety latch 37, safety spring retaining pin 36, magazine latch pusher 35 are disposed upper the pistol grip 268. Besides, the cavity 288 is configured for the magazine latch 34 as well. Besides, the cavity 289 is configured for hauling with the hook 39A or 39B and the cavity 290 is configured for the trigger bar spring 41. The cavity 291 for the cocking piece 49A or 49B is disposed at the beginning of the cavity 290. Besides, the rectangular hole 293, inlet conical hole 294, and slots for collecting dirt 295 are configured for the magazine 6. The protrusion 304 with the cross hole 305 for the latch of the ramrod 56 and the longitudinal hole 306 for the ramrod 58 are disposed outside on the handguard 267 near the trigger guard 280. Besides, the through groove 307 is configured for the multifunction latch 43 (only for the right half of the trigger housing 260C). Also, the lower rectangular holes 297 and the cylindrical hole 298 are configured for fastening the front handle 4. The "T" shaped slot 308 for mounting the gunstock 5 is disposed in the rear part 300 of the right half of the trigger housing 260A or 260C. The slot 309 for the spring of the ramrod latch 57 is disposed at the beginning of the cavity 286. FIG. 61, FIG. 62 showing all elements of the right half of the trigger housing 260A or 260C, their forms and interactions.

Figure 63:
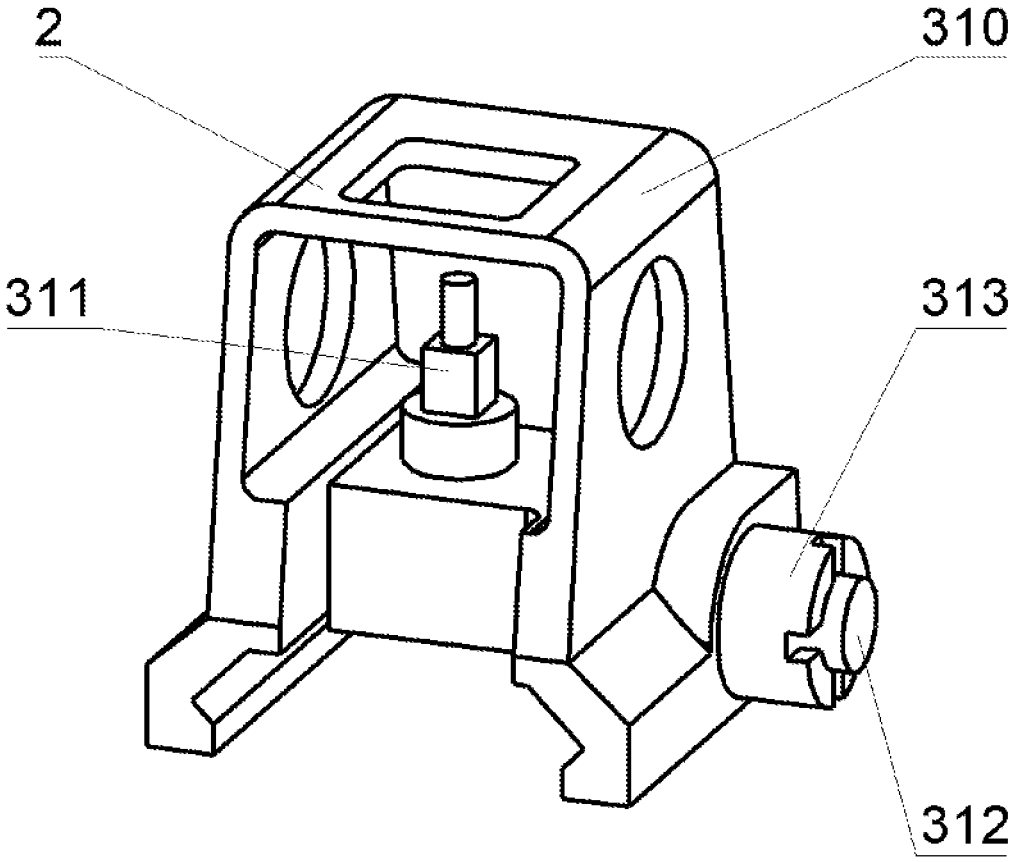
FIG. 63 is a side view of the adjustable front sight 2.

FIG. 63 is a side view of the adjustable front sight 2. The adjustable front sight 2 comprises the front sight bracket 310 into which the front sight 311 is screwed in, wherein the front sight bracket 310 is mounted on the front sight Picatinny-type rail 199 via the cap screw 312 and cylindrical nut 313.

Figure 64:
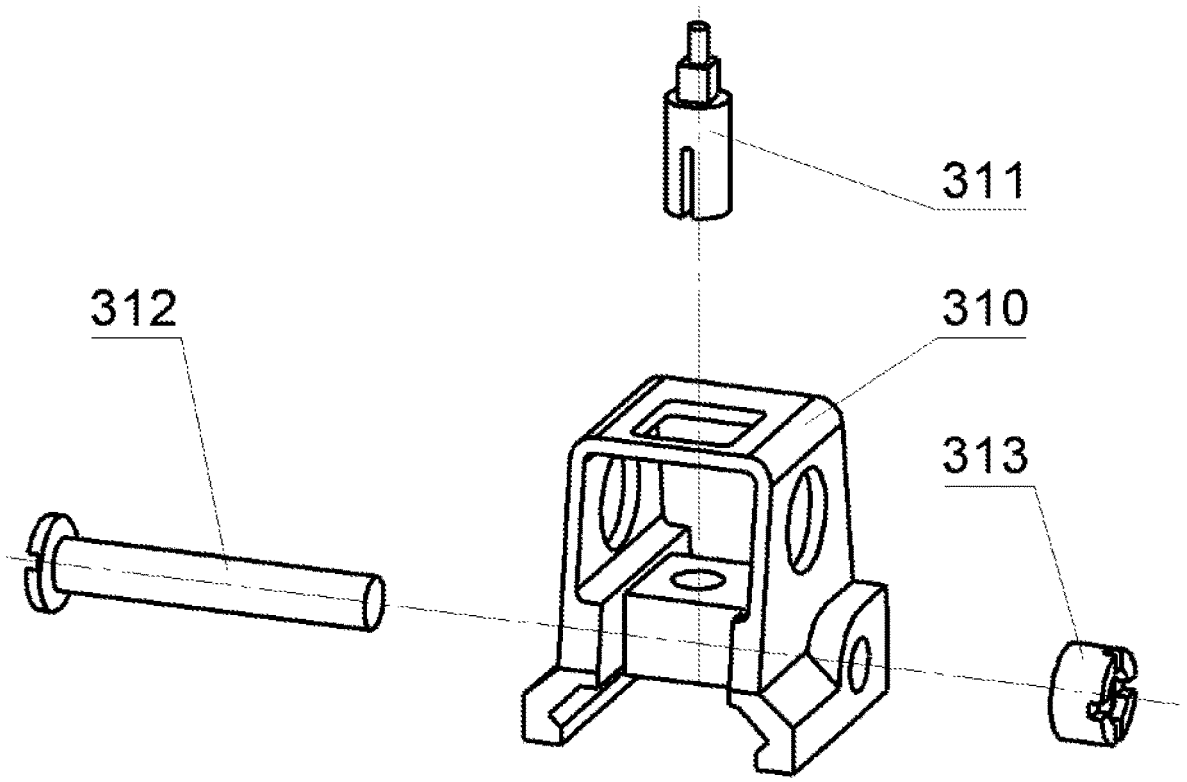
FIG. 64 is a detailing of the adjustable front sight 2 (side view).

FIG. 64 is a detailing of the adjustable front sight 2 (side view). This configuration comprising: the front sight bracket 310, front sight 311, cap screw 312 and cylindrical nut 313 with the splineway for a screwdriver.

Figure 65:
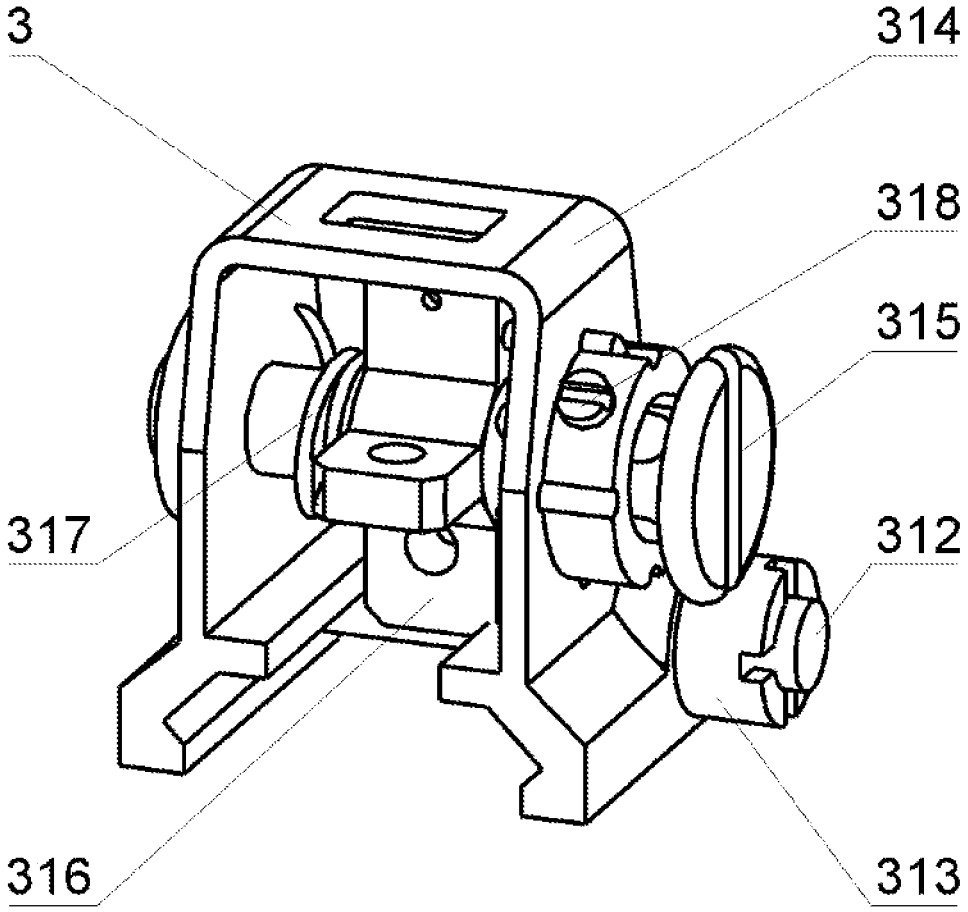
FIG. 65 is a side view of the adjustable dioptrical sight 3.

FIG. 65 is a side view of the adjustable dioptrical sight 3. The adjustable dioptrical sight 3 comprising: the bracket 314 within the adjustment screw 315 and the impeller with diopter holes 316 is put on the bracket 314 and said impeller has the possibility to rotate on the adjustment screw 315 and constantly compressed by the conical spring 317. The retainer screw 318 is mounted in the bracket 314 is fixing the adjustment screw 315 against rotation, wherein the bracket 314 is mounted on the rear sight Picatinny-type rail 196 via the adjustment screw 312 and cylindrical nut 313.

Figure 66:
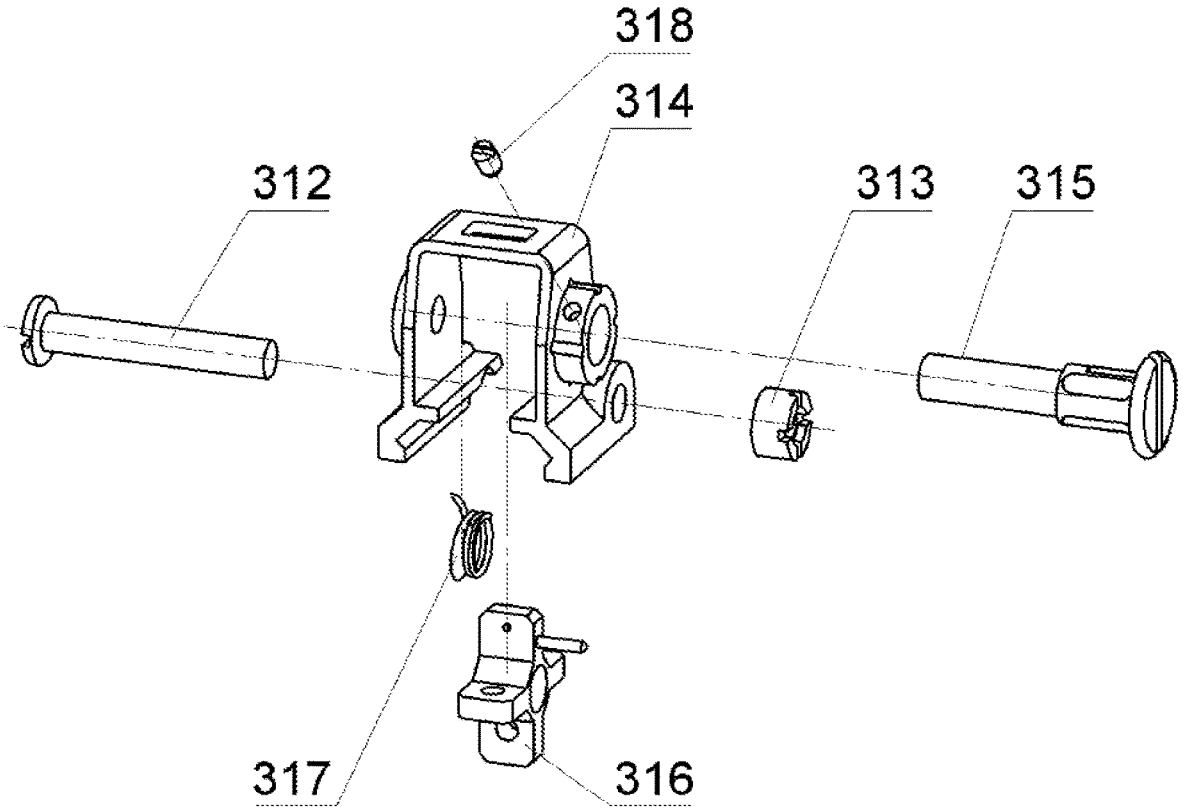
FIG. 66 is a detailing of the adjustable dioptrical sight 3 (side view).

FIG. 66 is a detailing of the adjustable dioptrical sight 3 (side view). This configuration comprising: the bracket 314, adjustment screw 315, impeller with the diopter holes 316, conical spring 317, adjustment screw 312, cylindrical nut 313, retainer screw 318 with the splineway for a screwdriver.

Figure 67:
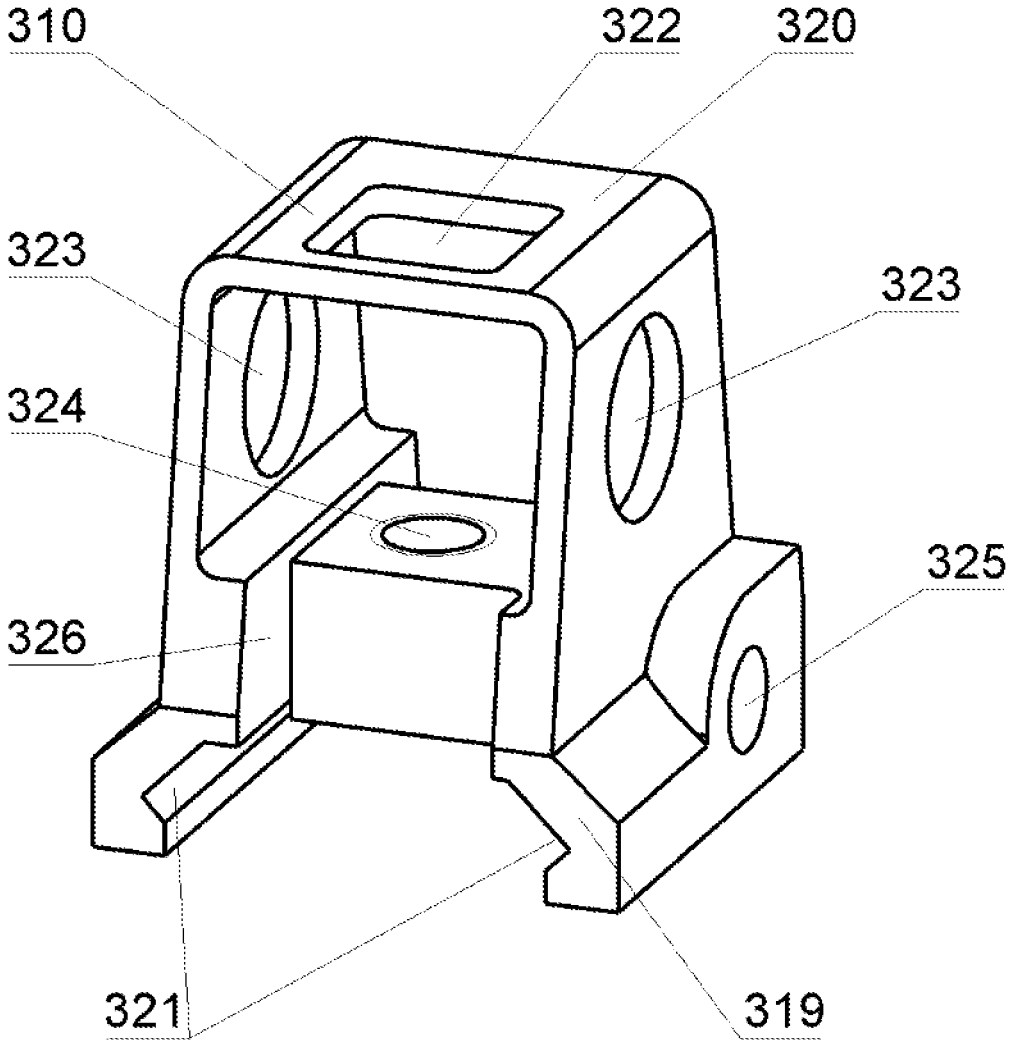
FIG. 67 is a side view of the front sight bracket 310.

FIG. 67 is a side view of the front sight bracket 310. The front sight bracket 310 contains the plate 319, which passes into the clamp 320. Clamp 320 is configured in the form of the curved plate of trapezoidal shape. The plate 319 having the complex-shaped through slot 321 which follows the shape of the sight Picatinny-type rail. The hole 322 disposed on top in the middle of the clamp 320 and configured for the thickness of the clamp wall 320. The light holes 323 are disposed on the side walls of the clamp 320 at the junction with the plate 319. The threaded hole 324 for the front sight 311 is disposed on top in the middle of the plate 319. The cross hole 325 for the adjustment screw 312 is disposed at the back on the side surface of the plate 319. Through longitudinal slot 326 is disposed behind the threaded hole 324 in front of the wall of the clamp 320 for the entire thickness of the wall plate 319. Because of the through longitudinal slot 326, the front sight bracket 310 works as a spring clip that ensures reliable retention of the front sight bracket 310 to the rear sight rail 196. FIG. 67 showing all elements of the front sight bracket 310, their forms and interactions.

Figure 68:
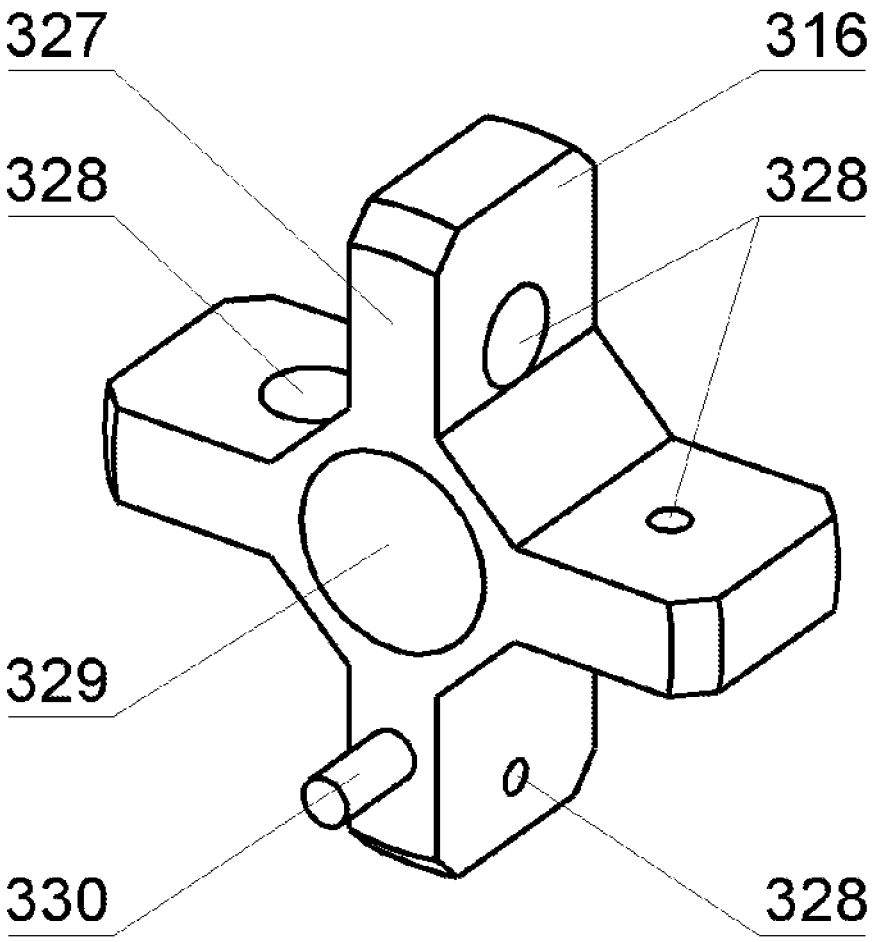
FIG. 68 is a side view of the impeller with diopter holes 316.

FIG. 68 is side view of the impeller with the diopter holes 316. The impeller with the diopter holes 316 having the blades 327 with the diopter holes 328 with the through axial hole 329. The retainer pin 330 is disposed on one of the impeller blades 327. FIG. 68 showing all elements of the impeller with the diopter holes 316, their forms and interactions.

Figure 69:
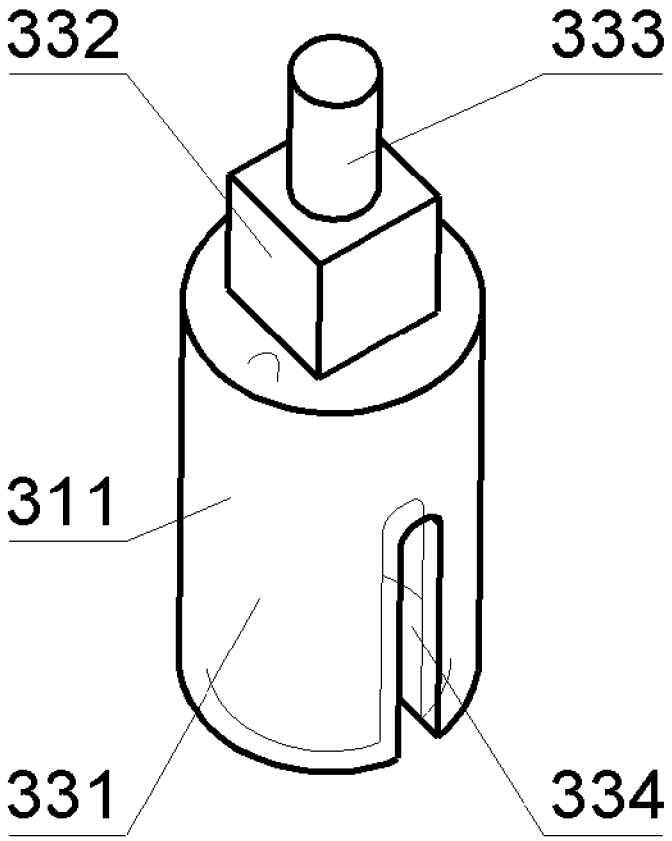
FIG. 69 is a side view of the front sight 311.

FIG. 69 is a side view of the front sight 311. The front sight 311 having the cylindrical section with the thread 331, which passes into a prismatic section 332, which passes into the cylindrical section 333. The through slot 334 is disposed in the cylindrical section with the thread 331. FIG. 69 showing all elements of the front sight 311, their forms and interactions.

Figure 70:
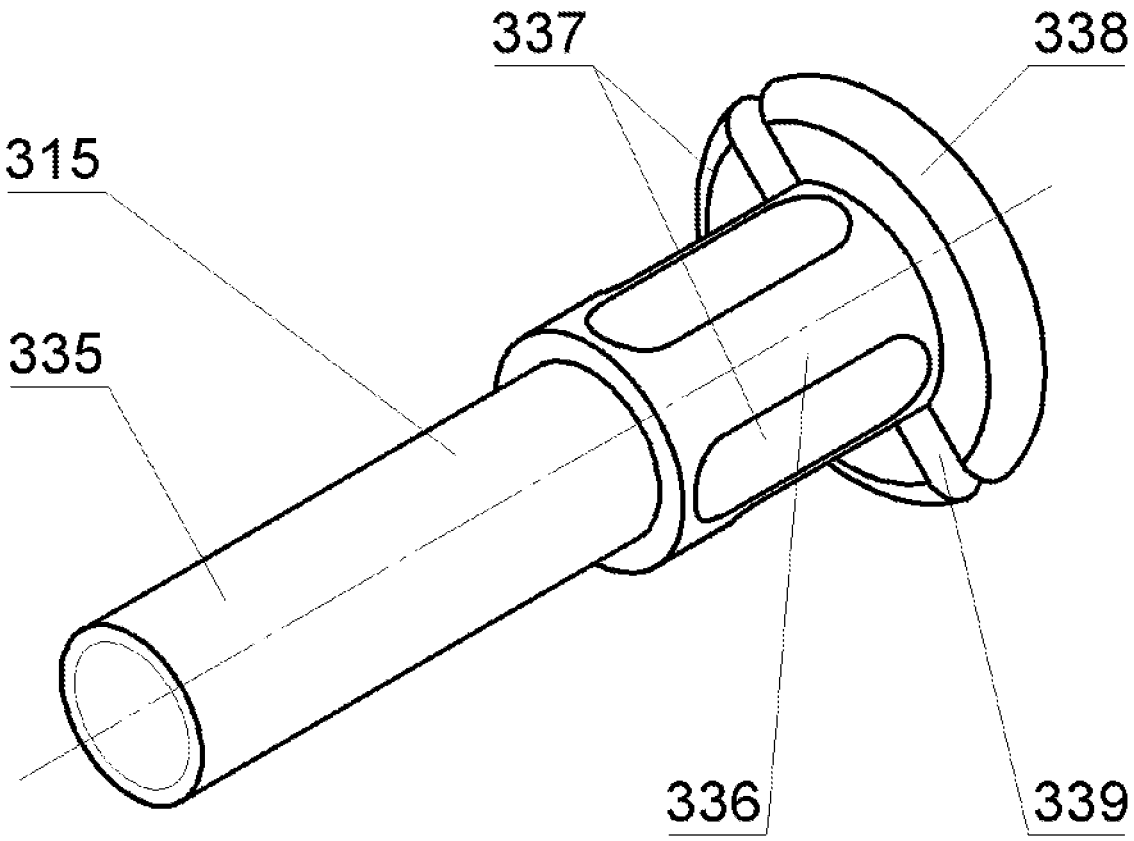
FIG. 70 is a side view of the adjustment screw 315.

FIG. 70 is a side view of the adjustment screw 315. The adjustment screw 315 having the cylindrical section with the thread 335, which passes into the cylindrical section 336 along the perimeter of which the slots 337 are disposed, which configured for retention of the adjustment screw 315 via retainer screw 318 in the bracket 314 of the dioptrical sight 3. The cylindrical section 336 passes into the washer 338. Through slot 339 is slotted in the washer 338 and in the cylindrical section 336. The cylindrical section 336 and washer 338 on section with the slot 339 are spring-loaded, which provides retention of the adjustment screw 315 in the set position. FIG. 70 showing all elements of the adjustment screw 315, their forms and interactions.

Figure 71:
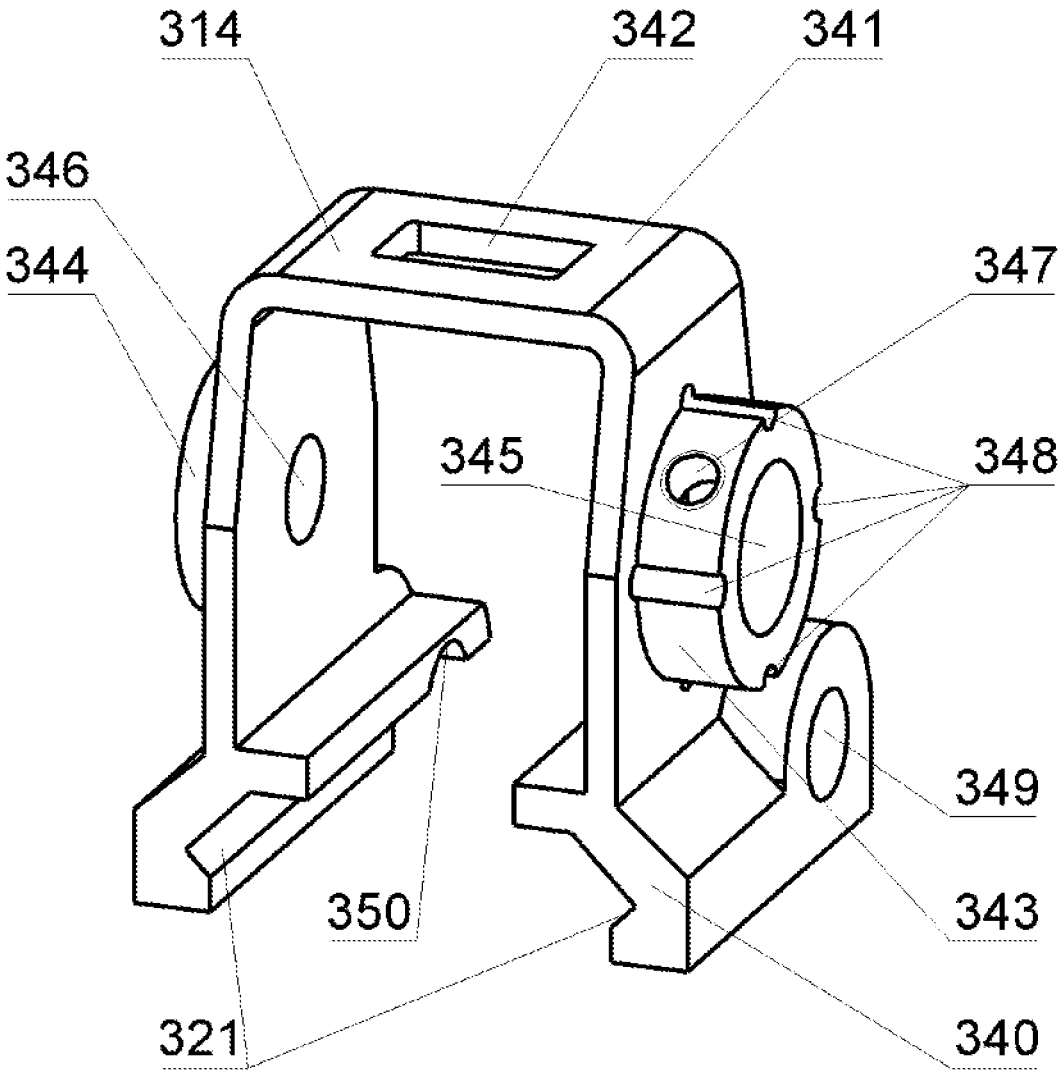
FIG. 71 is a side view of the bracket 314.

FIG. 71 is a side view of the bracket 314. The bracket 314 is configured in the form of the plate 340, which passes into the clamp 341. The clamp 341 is configured in a form of a curved plate of trapezoidal shape. The complex-shaped through slot 321 is disposed in plate 340 and follows the form of the sight Picatinny-type rail. The hole 342 disposed in the center of the top of the clamp 341 for the thickness of the clamp wall. The clamp 341 having the cylindrical protrusions 343 and 344 on the side walls of the clamp, wherein the cylindrical protrusion 343 having the smooth hole 345, and the other protrusion 344 having the threaded hole 346. The holes 345 and 346 configured for the adjustment screw 315. Threaded hole 347 for the retainer screw 318 is disposed in the cylindrical protrusion 343 on the side surface of the protrusion for the thickness of the wall. In the side wall of the clamp 341 from the smooth hole side 345 four holes 348 disposed therein, which located at an angle of ninety degrees to each other for the retainer pin 330, which provides retention of the impeller to the diopter holes 316. Cross hole 349 for the adjustment screw 312 disposed in front on the side surface of the plate 340. The through longitudinal slot 350 is disposed in front of the wall of the clamp 341 on the entire wall thickness of the plate 340. Because of the through longitudinal slot 350 the front sight bracket 314 works as a spring clip that ensures reliable retention of the front sight bracket 314 to the front sight rail 199. FIG. 71 showing all elements of the bracket 314, their forms and interactions.

Figure 72:
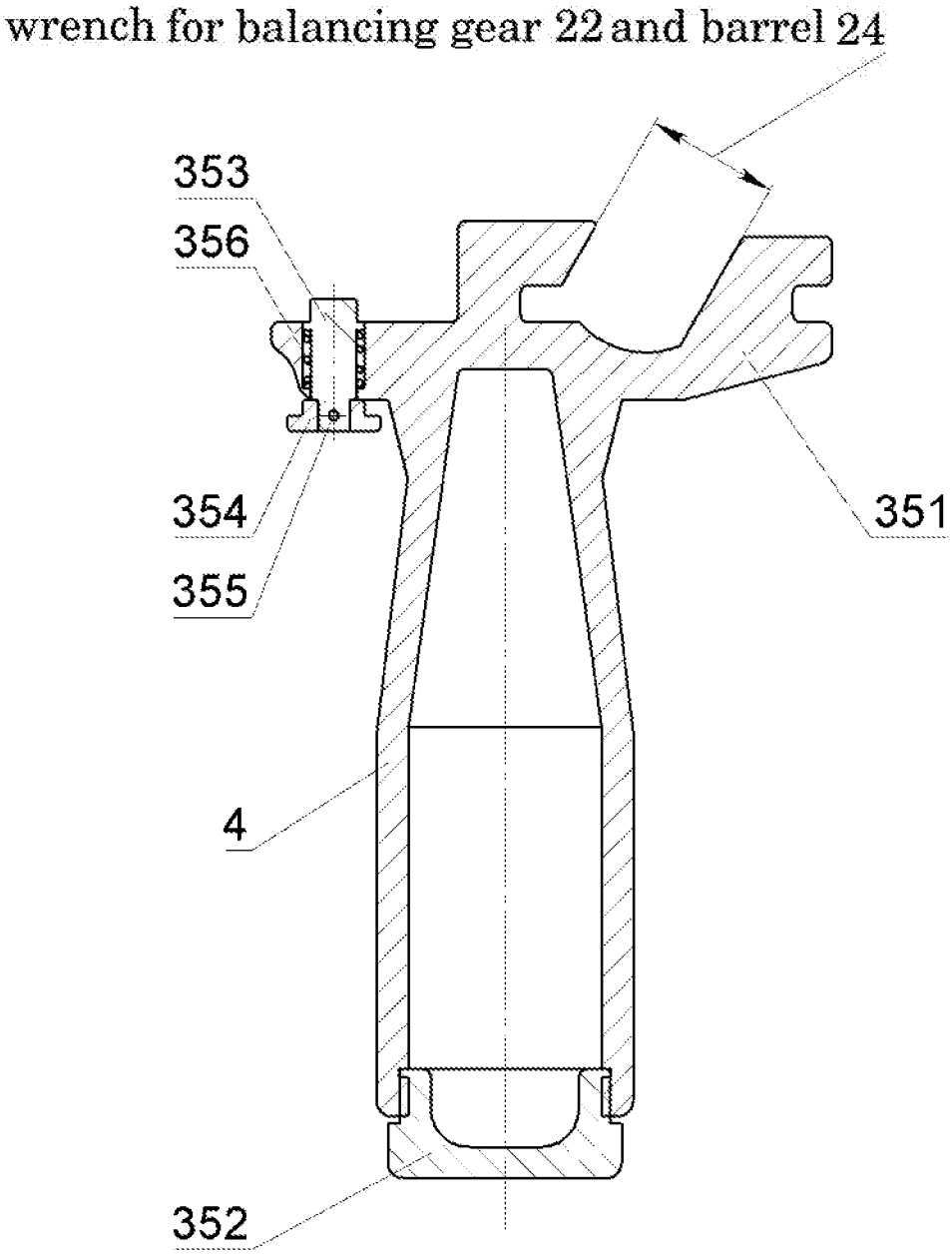
FIG. 72 is a side view of the forward grip 4.

FIG. 72 is a side view of the forward grip 4. The forward grip 4 comprising: the body 351 with mounted threaded cover 352 and the retainer spring-loaded by the spring of the locking pin 356 and configured in the form of the locking pin 353, which is mounted in the body 351, the locking pin head 354 is fixed via splint pin of the locking pin 355 is mounted at the end of the locking pin 353 that comes out of the body 351.

Figure 73:
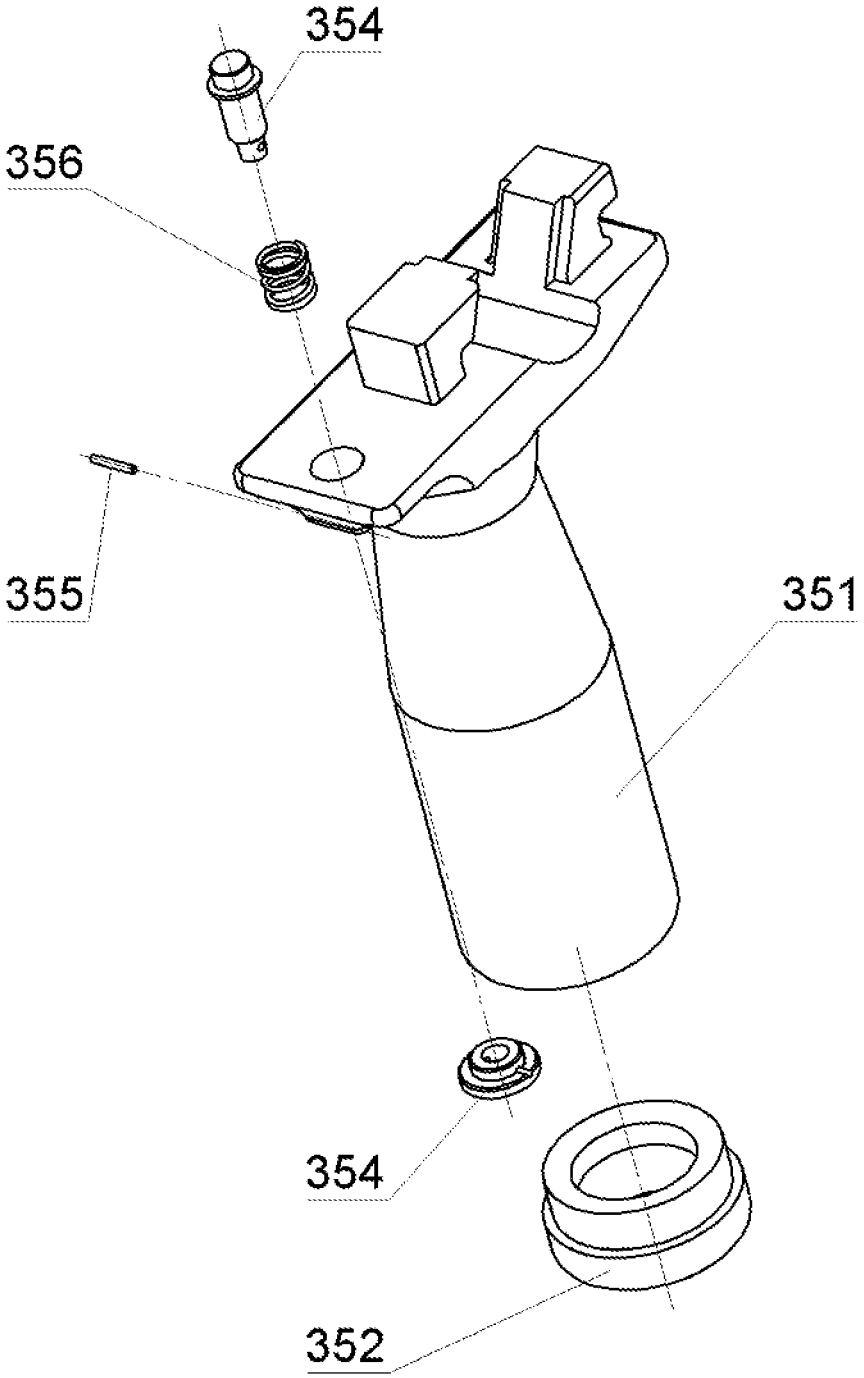
FIG. 73 is a side view. Detailing of the forward grip 4.

FIG. 73 is a detailing of the forward grip 4 (side view). This configuration comprising: the body 351, threaded cover 352, locking pin 353, locking pin head 354, splint pin of locking pin 355, spring of the locking pin 356.

Figure 74:
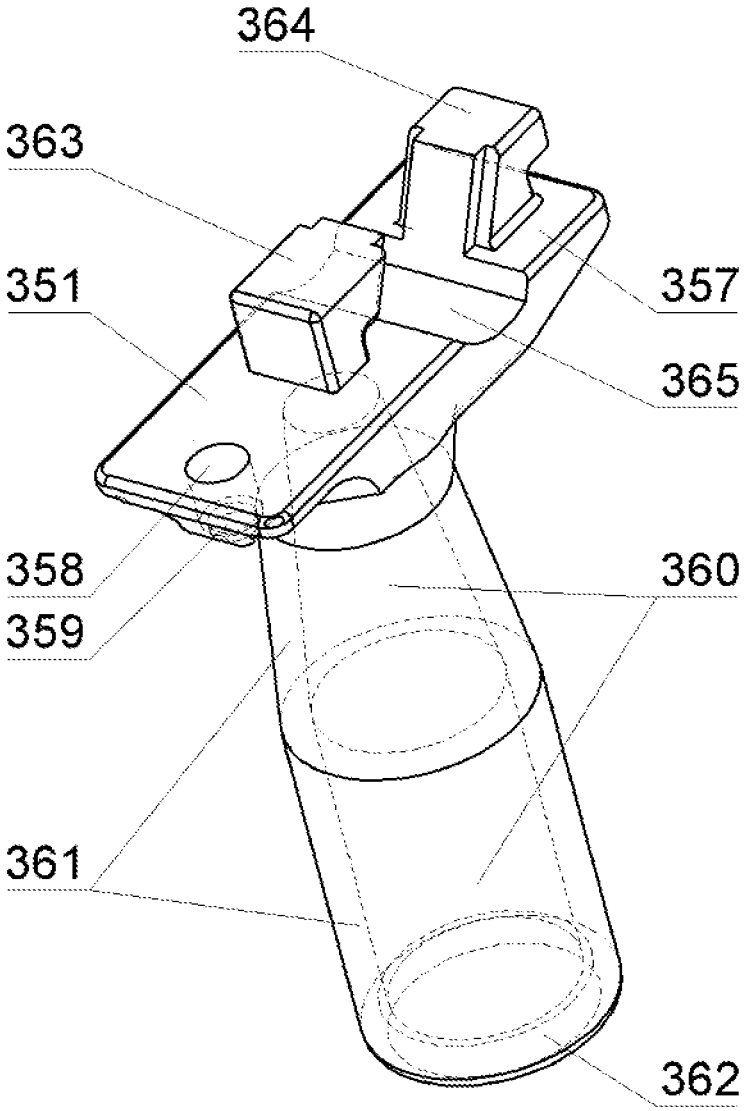
FIG. 74 is a side view of the body 351.
Figure 75:
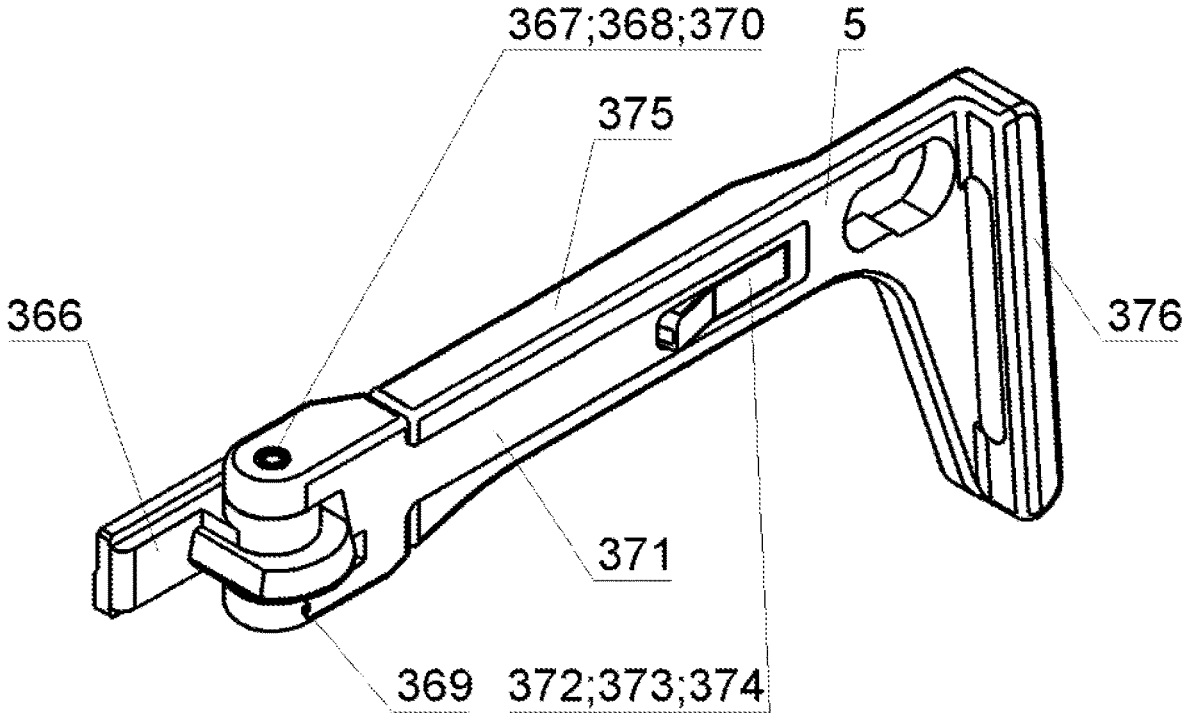
FIG. 75 is a side view of the gunstock 5.

FIG. 74 is a side view of the body 351. The body 351 having the plate 357. The holes 358, 359 for locking pin 353 and for spring of the locking pin 356 are disposed in front of the plate 357. The rear end of the plate 357 connected to the conical cylindrical part 360, inside of which the cavity 361 with thread 362 at the output for the threaded cover 352 is disposed thereon. Two "L" shaped protrusions 363, 364 with the slot 365 disposed on the upper surface in the middle of the plate 357. The body used as a wrench for the balancing gear 22 and barrel 24. FIG. 75 showing all elements of the forward grip body 351 their forms and interactions.

FIG. 75 is a side view of the gunstock 5. The gunstock 5 comprising: the bracket of the gunstock 366 having the bushing of the gunstock axis 367, in which the gunstock of the axis 368 spring-loaded with the spring of the gunstock axis 370 and fixed via pin of the gunstock axis 369 in the gunstock base 371 is mounted, the adjustment lever 372 is configured to swing on the axis of the adjustment lever 373 and interact with the gunstock body 375, the smooth recoil pad 376.

Figure 76:
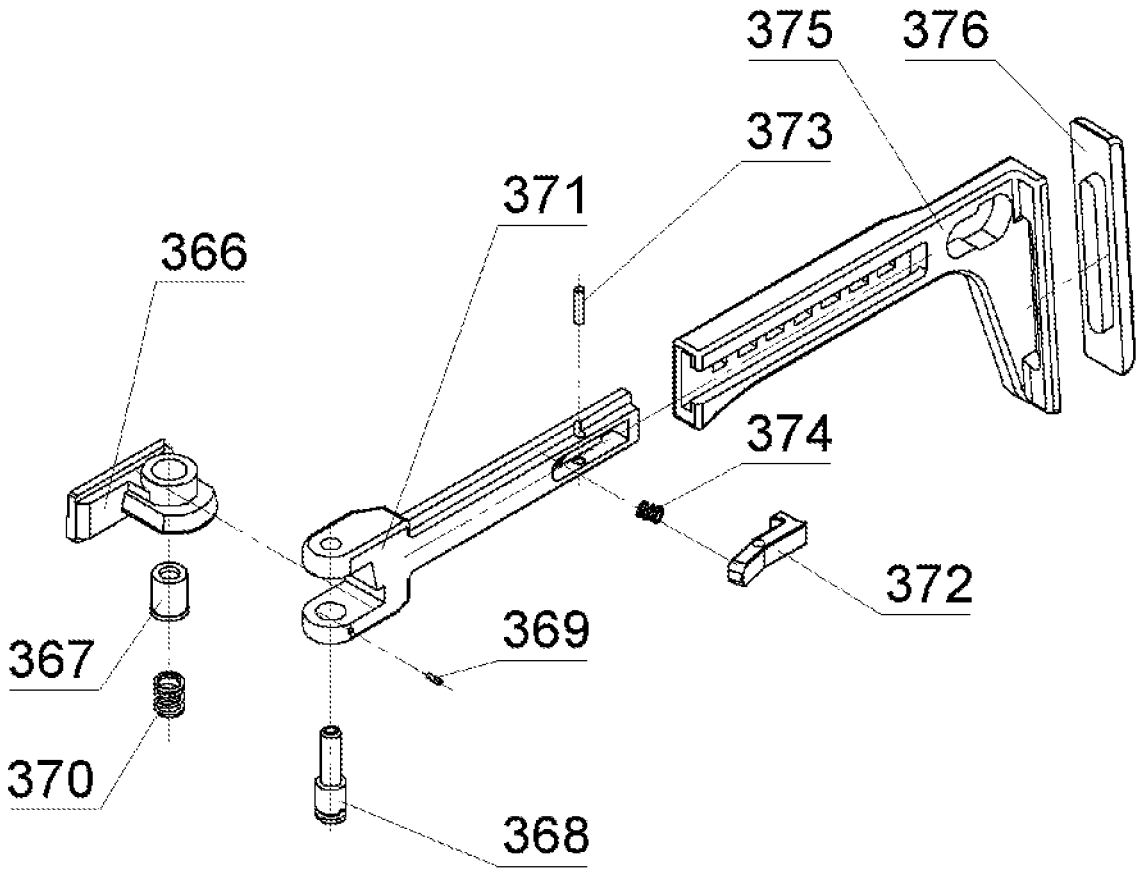
FIG. 76 is a detailing of the gunstock 5 (side view).

FIG. 76 is a detailing of the gunstock 5 (side view). This configuration comprising: the bracket of the gunstock 366, the bushing of the gunstock axis 367, the gunstock of the axis 368, the pin of the gunstock axis 369, the spring of the gunstock axis 370, the gunstock base 371, the adjustment lever 372, the axis of the adjustment lever 373, the spring of the adjustment lever 374, the gunstock body 375, the smooth recoil pad 376. The gunstock body 375 is put on the base of the gunstock 371 and configured to reciprocate along the base of the gunstock 371 and the smooth recoil pad 376 disposed in the gunstock body 375.

Figure 77:
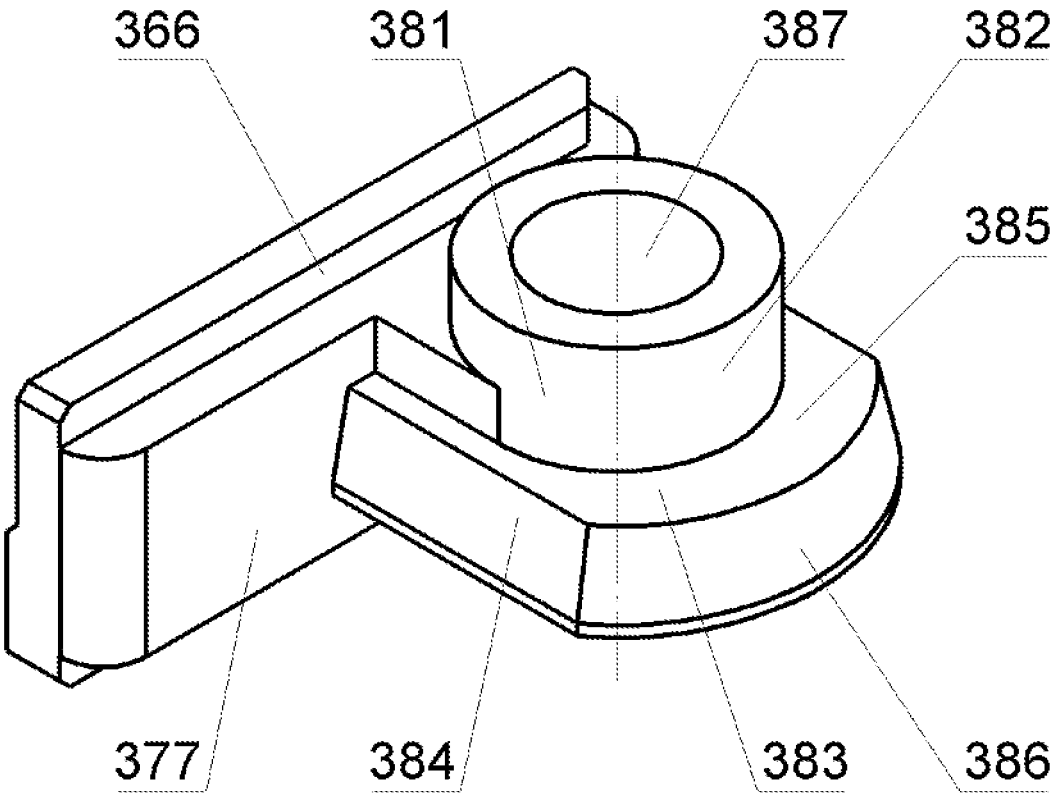
FIG. 77 is a front view of the bracket of the gunstock 366.
Figure 78:
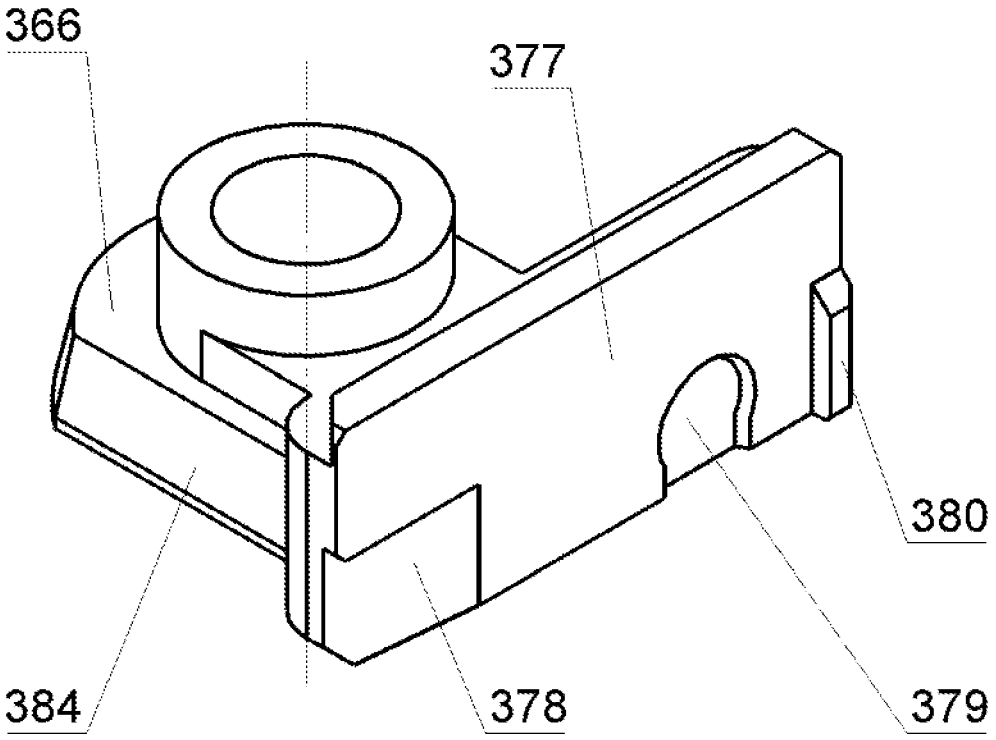
FIG. 78 is a rear view of the bracket of the gunstock 366.

FIG. 77 is a front view of the bracket of the gunstock 366 and FIG. 78 is a rear view of the bracket of the gunstock 366. The gunstock bracket 366 is configured in the form of "T" shaped section 377 with inclined slot 378, blind hole 379 for the multifunction latch 64 and with the locking protrusion 380. The complex-shaped protrusion 381 is disposed in the upper part on the other side of the "T" shaped section 377 in the form of the cylinder 382 and in the lower part in the form of the protrusion 383 with inclined sides 384, horizontal platform 385 and radius side 386. The through hole 387 for the gunstock of the axis 368 is disposed in the protrusion 381. FIG. 77, FIG. 78 showing all elements of the bracket of the gunstock 366, their forms and interactions.

Figure 79:
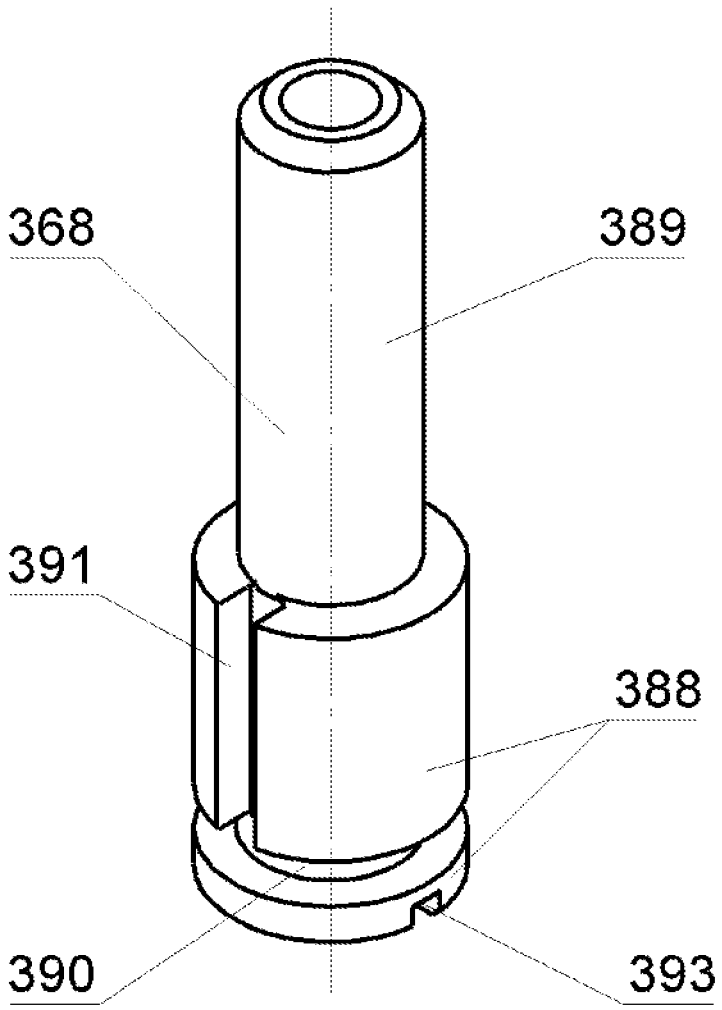
FIG. 79 is a front view of the gunstock axis 368.
Figure 80:
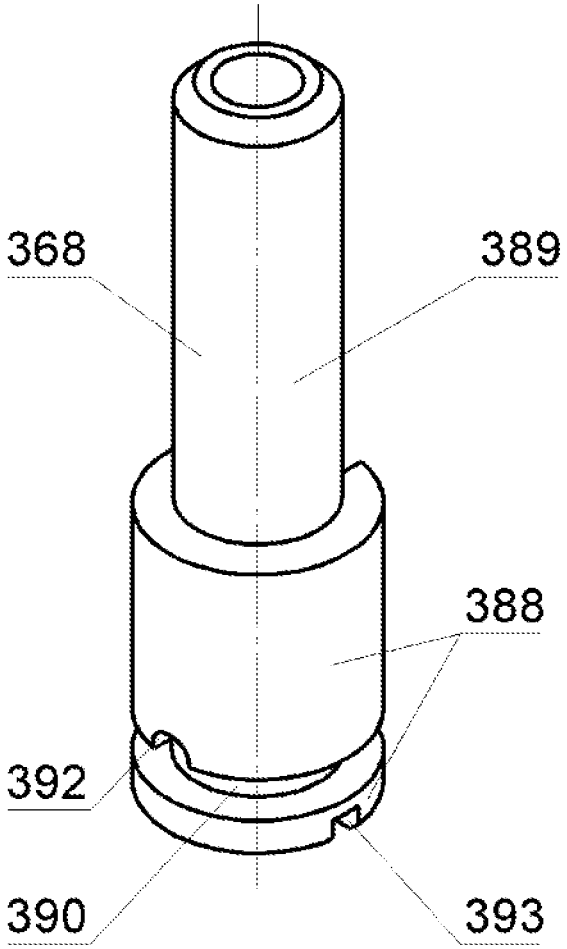
FIG. 80 is a rear view of the gunstock axis 368.

FIG. 79 is a front view of the gunstock axis 368 and FIG. 80 is a rear view of the gunstock axis 368. The gunstock axis 368 is configured in the form of the rod 388, which passes into the rod with the smaller diameter 389. The circular groove 390 is disposed in the rod 388. Two slots located at 180 degrees along the rod 388, the longitudinal slot 391 and the blind slot 392 are disposed after the circular groove 390. These slots are configured for the pin of the gunstock axis 369. The splineway 393 for a screwdriver is disposed at the beginning of the rod 388. FIG. 79, FIG. 80 showing all elements of the gunstock axis 368, their forms and interactions.

Figure 81:
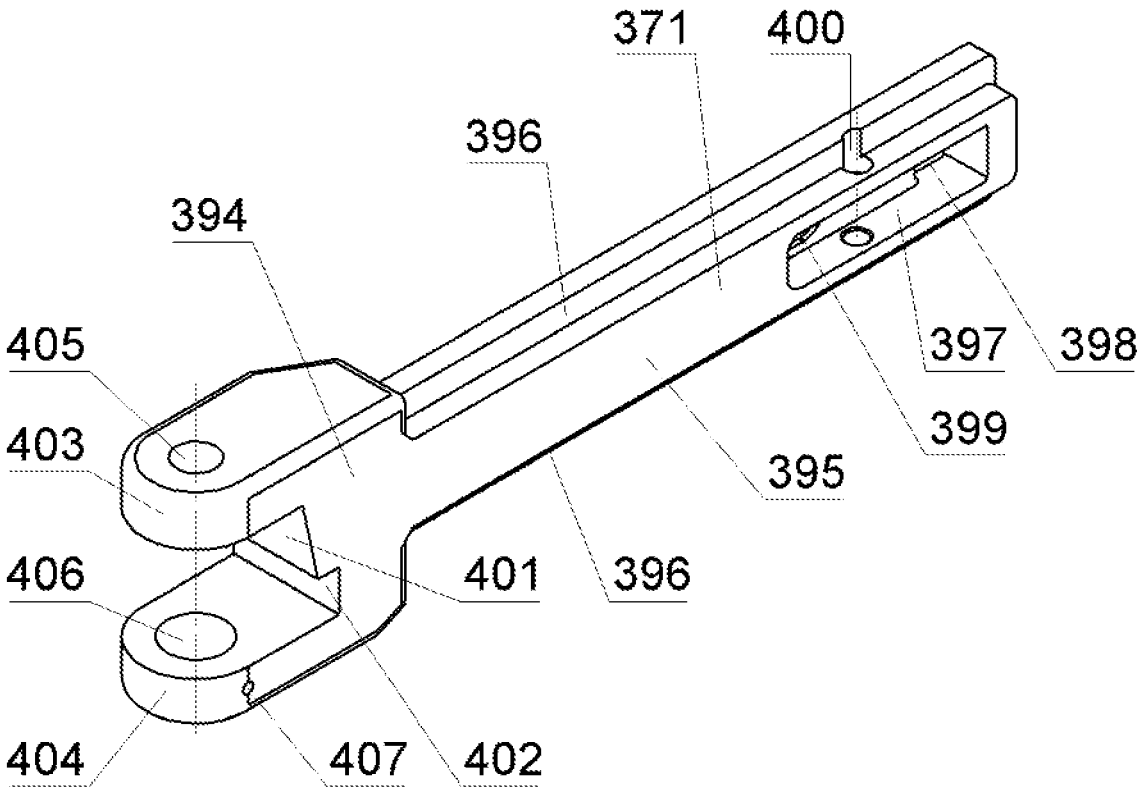
FIG. 81 is a side view of the gunstock base 371.

FIG. 81 is a side view of the gunstock base 371. The gunstock base 371 is configured in the form of the complex-shaped bracket 394 with the "T" shaped protrusion 395. The "T" shaped protrusion 395 having slots 396 for collecting dirt configured to provide reliable operation of the gunstock body 375. Behind the "T" shaped protrusion 395 the rectangular slot is disposed therein 397 with the through hole 398 for passage of the protrusion 410, adjustment lever 372 and the blind hole 399 for the spring of the adjustment lever 374. The cross through hole 400 for mounting the axis of the adjustment lever 373 is disposed in the middle of the rectangular slot 397. At the beginning of the bracket 394 within which an inclined platform 401 and the rectangular slot 402 are disposed therein and the upper protrusion 403 and the lower protrusion 404 are located therein. The through holes 405 and 406 for the gunstock axis 368 are disposed in the upper protrusion 403 and lower protrusion 404. The through hole 407 for the pin of the gunstock axis 369 is disposed on the side of the lower protrusion 404. FIG. 81 showing all elements of the gunstock base 371, their forms and interactions.

Figure 82:
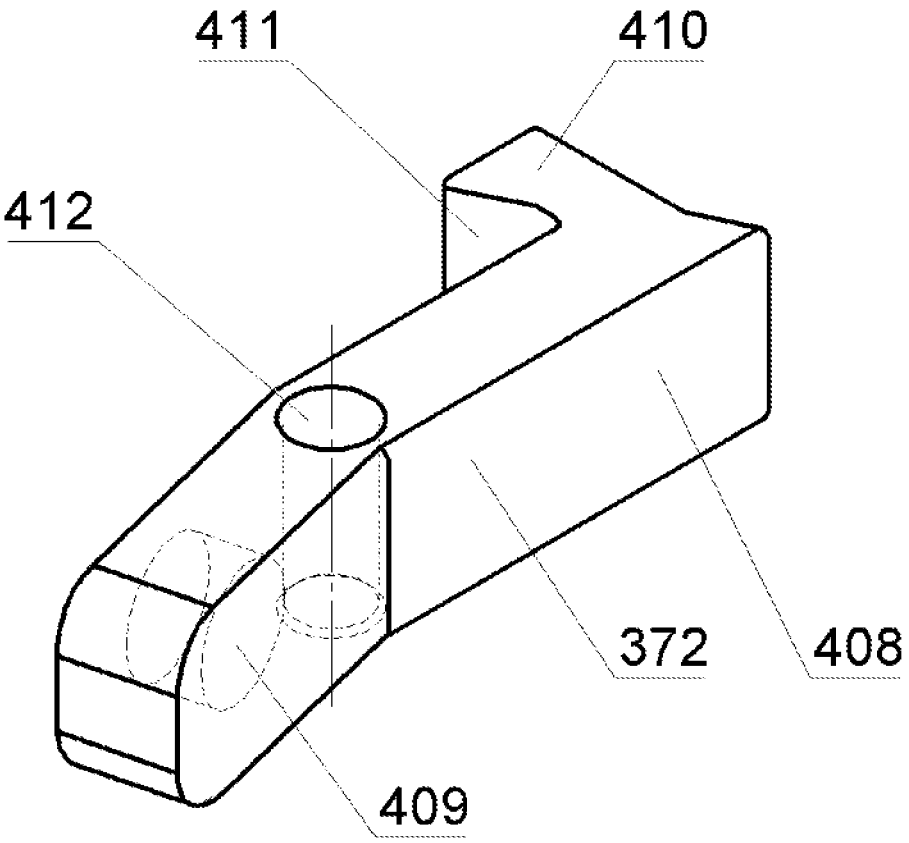
FIG. 82 is a side view of the adjustment lever 372.

FIG. 82 is a side view of the adjustment lever 372. The gunstock adjustment lever 372 is configured in the form of the lever 408 with blind hole 409 on one side for the spring of adjustment lever 374. The protrusion 410 with the inclined surface 411 disposed on the other side of the lever 408. Through hole 412 for the axis of the adjustment lever 373 is disposed in the middle of the lever 408. FIG. 82 showing all elements of the adjustment lever 372, their forms and interactions.

Figure 83:
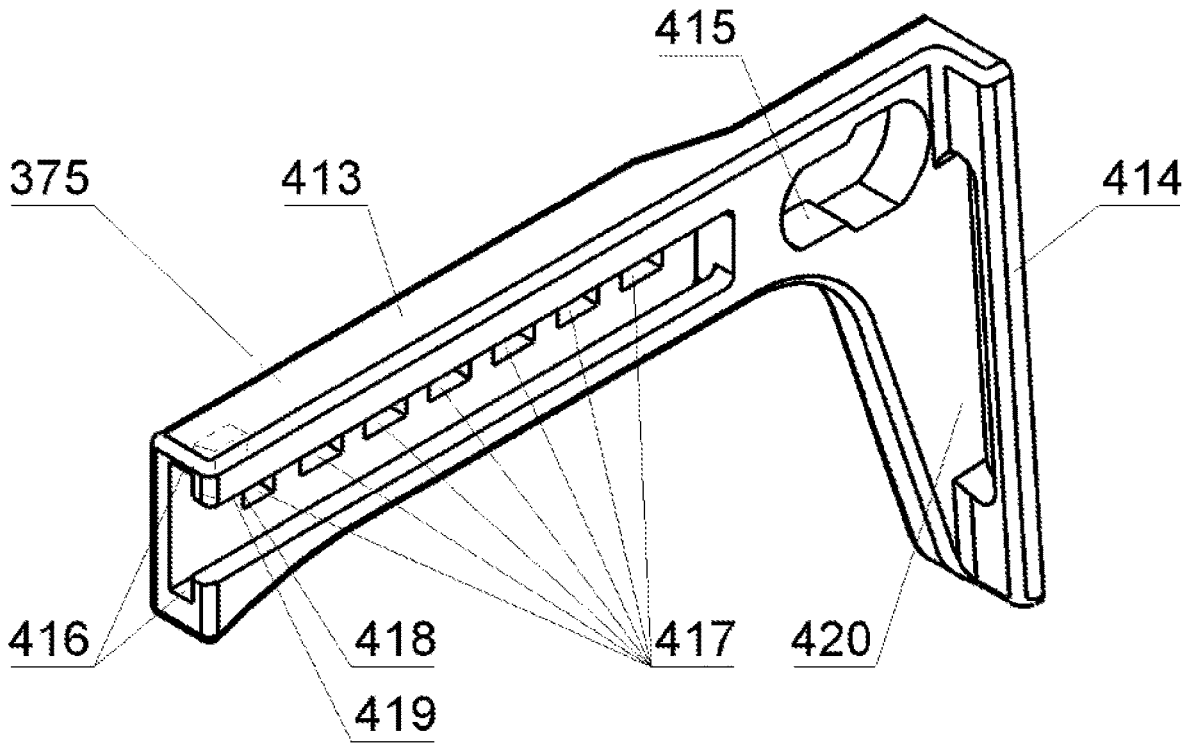
FIG. 83 is a side view of the gunstock body 375.

FIG. 83 is a side view of the gunstock body 375. The body of the gunstock 375 is configured in the form of the plate 413 with protrusion 414 in the form of a plate, which corresponds with the form of the smooth recoil pad 376. The complex-shaped hole 415 for the multifaceted area 159 of the barrel 24, disposed in front of the protrusion 414 in the rear part of said plate 413. The guide "T" shaped blind slot 416 disposed in front of said plate 413 and configured to connect the gunstock body 375 with the gunstock base 371. Cross grooves 417 for the adjustment lever 372 are disposed in the guide "T" shaped blind slot 416. The first cross groove 417 configured with the chamfer 418 having negative incline 419. The rectangular hole 420 disposed in the protrusion 414 for the smooth recoil pad 376. FIG. 83 showing all elements of the gunstock body 375, their forms and interactions.

FIG. 84 is a fragment of a cross section of the latch of the ramrod 56, and FIG. 85 is a fragment of a longitudinal section of the latch of the ramrod 56. Said figures are showing operation of the latch of the ramrod 56 in the off position. The flat spring 237 of the ramrod latch 56 is in the loaded position due to the bulge 239, which is pressed to the receiver with the barrel and mechanisms 62, and the rear part 240 of the flat spring 237 is clamped in the cavity 309 of the trigger housing 31A or 31B or 31C. The front end of the flat spring 237 pushes the ramrod latch 56 while the semicircular slot 236 of the ramrod 56 enters the groove 232 of the ramrod 58 and latches it in a place.

FIG. 86 is a fragment of a cross section of the latch of the ramrod 56 and FIG. 87 is a fragment of a longitudinal section of the latch of the ramrod 56. Said figures are showing operation of the latch of the ramrod 56 in the on position. If the ramrod 58 is to be removed, press the latch of the ramrod 56. The front end of the flat spring 237 presses against the receiver with the barrel and mechanisms 62, and the semi-circular slot 236 comes out of the groove 232 of the ramrod 58, while the groove 232 will be located opposite the through semi-circular hole 235, which allows to remove the ramrod 58. The conical head 231 of the ramrod 58 allows to insert the ramrod 58 into the latch of the ramrod 56 by direct pressing of the conical head 231 on the through semi-circular hole 235, which speeds up the whole process. The latch of the ramrod 56 is held in the trigger housing 31A or 31B or 31C by the rounded protrusions 234, while the ramrod 58 is being removed. All above mentioned provides reliable retention, convenience, simplicity and speed of the installation and removal of the ramrod 58 on weapons 1A or 1B or 1C respectively.

FIG. 88 is disassembly and assembly of the latch of the ramrod 56. If the the latch of the ramrod 56 is to be disassembled, press and hold the latch of the ramrod 56, which will press on the front end of the flat spring 237 and brings it out of the cavity 309 of the trigger housing 31A or 31B or 31C. At the same time, the ramrod 58 is inserted into the through hole 238 of the flat spring 237 and pushes the rear part 240 of the flat spring 237 out of the cavity 309 of the trigger housing 31A or 31B or 31C. At this point, the latch of the ramrod 56 is being disassembled without special tools. If the latch of the ramrod 56 is to be assembled, follow these steps in the reverse order.

FIG. 89 is showing operation of the slide stop 50 in the off position (side view). When magazine 6 is loaded with the caseless ammunition 59, the slide stop spring 51 pushes against the lever 242 of the slide stop 50. At this point, the slide stop 50 rotates relative to the hinge 243 and rests against the lower protrusion 246 on section 421, which is located in the cavity 422 of the trigger housing 31B or 31C. The plate 241 of the slide stop 50 tightly closes the cavity 422 in the trigger housing 31B or 31C and the cam through hole 271 of the trigger housing 31B or 31C and prevents the water, dirt, dust and sand entering weapons 1A or 1B. All the above mentioned provides reliable operation of the slide stop 50 and weapon 1A or 1B in general.

FIG. 90 showing an operation of the slide stop 50 in the on position (side view). When the magazine 6 has run out of the caseless ammunition 59, the magazine platform 423 will reach the top. The protrusion of the magazine platform 424 hits the protrusion 247 of the slide stop 50 and raises the slide stop 50 up to the stop of the lower protrusion 246 in the receiver 30. At the same time, the upper protrusion 245 gets in the way of the locking lug 129 of the shutter housing 19, as a result of which, the shutter housing 19 is fixed in the rear position, and the spring of the slide stop 51 is compressed. When you press the "T" shaped lever 244 of the slide stop 50 the upper protrusion 245 releases from engagement with the locking lug 129 of the shutter housing 19 and releases it. Wherein, the slide stop 50 rotates relative to the hinge 243 and goes lower.

FIG. 91 is a disassembly of the slide stop 50 (side view). When the receiver 30 is removed, the slide stop 50 rotates upwards relative to the hinge 243 up to the stop in the cam through hole 271, and the spring of the slide stop 51 opens. Then, the "T" shaped lever 244 of the slide stop 50 is pressed and the slide stop 50 is removed through the cam through hole 271 from the cavity 422 of the trigger housing 31B or 31C. At the moment, the slide stop 50 is disassembled without special tools in any conditions. If the slide stop 50 is to be disassembled follow these steps in the reverse order.

FIG. 92 showing an operation of the receiver cover 7 for the manual rearward movement. When the cover of the receiver 7 manually moved rearward, the bolt carrier 12A or 12B with the bolt 61, the returnable spring 16 and the guide rod of the recoil spring 15 are moved rearward, while the front stop 72 of the receiver cover 7 presses against the support platform 96 of the bolt 12A or 12B. Additionally, enlargement 84 of the bolt carrier 12A or 12B cocks the cocking piece 49C. The returnable spring 16 is not involved in the reloading weapons 1B or 1C, thereby reducing the cocking force of weapons and allows to stop the cover of the receiver 7 in any position. This provides convenient access and elimination of light delays when using weapons 1B or 1C in combat conditions.

FIG. 93 showing an operation of the cocking lever 8 in the off position. The hook 75 of the cocking lever 8 extends beyond the inclined protrusion 213 of the barrel chamber 173 and forms a contact pad in the cylindrical slot 214. At the same time, the inclined protrusion 81 of the cocking lever 8 creates the gap 425 with the bolt carrier of 12A or 12B. The cocking lever 8 rotates on the axis of the cocking lever 9 and being pressed by the spring of the cocking lever 11. The gap 426 is made between the support platform 96 of the bolt carrier 12A or 12B and the front stop 72 of the receiver cover 7. During automatic shoot, the receiver cover 7 remains stationary and does not have holes. The only hole in the receiver cover 7 located under the cocking lever 8, which tightly overlaps it. This increases the reliability of the weapon 1A or 1B or 1C in difficult conditions, such as water, dirt, dust, and sand, preventing them from getting inside.

FIG. 94 showing an operation of the cocking lever 8 in the on position. The button 70 of the bracket 68 of the receiver cover 7 and the button 78 of the cocking lever 8 are pressed together. The cocking lever 8 rotates on the axis of the cocking lever 9 and the spring of the cocking lever 11 contracts, and the cocking lever 8 is fixed in the on position. The hook 75 of the cocking lever 8 extends from the cylindrical slot 214 of the inclined protrusion 213 of the barrel chamber 173. The gap 425 between the inclined protrusion 81 of the cocking lever 8 and the bolt carrier 12A or 12B increases. Additionally, the support platform 96 of the slide frame 12A or 12B rests against the front stop 72 of the receiver cover 7.

FIG. 95 showing an operation of the cocking lever 8 for the forward movement. The button 70 of the bracket 68 of the receiver cover 7 is pushed forward without using button 78 of the cocking lever 8. As the cocking lever 8 is pushed down by the action of the spring 11, the inclined protrusion 81 presses against the protrusion 88 of the bolt carrier 12A or 12B, which forces the bolt 61 to forcibly deliver the caseless ammunition 59, including contaminated, from the magazine 6 to the multifunctional cartridge 26. This increases the reliability of weapons 1A or 1B or 1C in combat conditions. After the receiver cover 7 is closed, the gap 426 is formed between the front stop 72 of the cover of the receiver 7 and the stop plate 96 of the slide frame 12A or 12B.

FIG. 96, FIG. 97 showing assembly and disassembly of the forward grip 4 for the weapon 1A or 1B or 1C. To install the forward grip 4, the "L" shaped protrusions 363, 364 of the forward grip 4 are set against the lower rectangular holes 297 of the trigger housing 31A or 31B or 31C and press the front handle 4 up to the stop into the trigger housing 31A or 31B or 31C. Then the front handle 4 moves in the direction of the trigger guard 280, while the locking pin 353 of the forward grip 4 engaging with the cylindrical hole 298 of the trigger housing 31A or 31B or 31C. If the forward grip 4 is to be disassemble it is needed to pull on the head of the locking pin 354, wherein said locking pin 353 of the forward grip 4 releases from the engagement with the cylindrical bore 298 of the trigger housing 31A or 31B or 31C, and then to perform the steps reverse to the installation. Easy assembly and disassembly of the forward grip 4 allow to change the configuration of the weapon 1A or 1B or 1C without special tools in any conditions.

FIG. 98, FIG. 99 showing a folding and unfolding of the gunstock 5 for the weapon 1A or 1B or 1C. To unfold the gunstock 5, push up the gunstock base 371 and the rectangular slot 402 of the gunstock base 371 coincide with the protrusion 383 of the gunstock bracket 366 and, without releasing it, rotate it at 180 degrees. During this process, the axis of the gunstock 368 in the gunstock bracket 366 compresses the spring of the gunstock axis 370. After the gunstock 5 is folded down, the gunstock base 371 should be released. At that moment, the inclined platform 401 of the gunstock base 371 engages the gunstock side 384 of the gunstock bracket 366 and fixes the gunstock 5 in this position. If the latch of the gunstock 5 is to be folded follow these steps in the reverse order. The inclined platform 401 of the gunstock base 371 and the inclined side 384 of the gunstock bracket 366 are always spring-loaded with the spring of the gunstock axis 370. Due to this, the select of the gap between these sections occurs without assistance and during long-term operation the reliability of the gunstock 5 increases. Fast folding and unfolding of the gunstock 5 allow to change the length of weapons at any time.

FIG. 100, FIG. 101 showing an alteration to the length of the gunstock 5 for the weapon 1A or 1B or 1C. The spring of the adjustment lever 374 of the gunstock base 371 presses the adjustment lever 372 of the gunstock base 371 and the protrusion 410 with inclined plane 411 of the adjustment lever 372 and said spring 374 enters the transverse grooves 417 of the gunstock body 375. To extend the gunstock 5, press and hold the adjustment lever 372 of the gunstock base 371 and extend the body of the gunstock 375 to the required length, then release the adjustment lever 372. The protrusion 410 of the adjustment lever 372 is fixed in the corresponding new transverse groove 417 of the gunstock body 375. To extend the gunstock 5 in a different way, simply pull the gunstock body 375, and extension will happen automatically. Wherein the gunstock body 375 is not descended from the gunstock base 371, but locks in the first transverse groove 417. It occurs because the inclined plane 411 on the protrusion 410 of the adjustment lever 372 and the chamfer 418 in the transverse groove 417 create a self-locking lock. If the gunstock 5 is to be shortened follow these steps in the reverse order. This additional functionality allows shooters with different anthropological characteristics to use weapon 1A or 1B or 1C in a sitting, lying, or knee position.

FIG. 102, FIG. 103 showing assembly and disassembly of the gunstock 5 for the weapon 1A or 1B or 1C. To assembly the gunstock 5, insert the gunstock bracket 366 into the "T" shaped slot 308 of the trigger housing 31A or 31B or 31C and move the gunstock 5 up to the stop of the locking lug 380 on the gunstock bracket 366 into the trigger housing 31A or 31B or 31C, wherein the inclined slot 378 release the multifunction latch lever 52 automatically. To remove the gunstock 5, turn the multifunctional latch lever 52 by 45 degrees counterclockwise, while the rear protrusion 256 at the enlargement 255 of the multifunctional latch lever 52 slides on the slot 274 through the inclined surface 275 into the slot 273 and removes the rod 252 of the multifunctional latch lever 52 from the blind hole of the gunstock bracket 366, and then to remove the gunstock 5 from weapon 1A or 1B or 1C.

FIG. 104, FIG. 105 showing a mounting unit of the knife-bayonet 427 on the weapon 1A or 1B or 1C (upper side view). The front stop with the ring 428 is placed on the balancing gear 22. The rear stop with the hook-shaped protrusion 429 is inserted into the ventilative holes 277 of the trigger housing 31A or 31B or 31C. The ring with the protrusion 226 on the front swivel 33 via its protrusion is inserted into the slot 430 of the handle 431, thereby fixing the knife-bayonet 427. Screwing the front big nut 32 into the trigger housing 31A or 31B or 31C, clamping of the front swivel 33, thereby ensuring reliable retention of the knife-bayonet 427 on weapon 1A or 1B or 1C.

FIG. 106 showing an operation of the weapon 1A in the lock time for the magazine firing. The lock time 432 lasts from the beginning of an ignition of the propellant 433 (solid, liquid, gaseous) to the beginning of the piercing of the projectile 434 into the notches of the multifunctional cartridge 26. During this period the following processes occur:

after striking the cocking piece 49A on the percussion piston 17, the percussion piston 17 breaks the primer with anvil 435 inside the igniter block 436 and the force flame 437 ignites the propellant 433 (solid, liquid, gaseous). Gases 438 begin to be exhausted with high temperature and pressure. The whole process takes place in the closed space of the projectile chamber 439 for the propellant. The cylindrical piston 123 of the percussion piston 17 under the action of gases 438 will press down the conical bushing of the bolt 18 to the glazed area 140 of the shutter housing 19, thereby blocking the leakage of gases 438 into the receiver 30. When the gas pressure P0 reaches the forcing pressure, the projectile 434 by its leading cylindrical part 440 starts to gripping into the notches of the multifunctional cartridge 26. At this moment, the gap 441 between the rear cylindrical part 442 of the projectile 434 and the inner surface of the multifunctional cartridge 26 begins to decrease and the projectile 434 begins to move forward. The thickness T441 of the gap 441 depends on many dimensions and is established by calculation in each particular ammunition.

FIG. 107 showing an operation of the weapon 1B and 1C in the lock time for the semi-automatic shot and automatic shot. The lock time 432 lasts from the beginning of the ignition of the propellant 433 (solid, liquid, gaseous) to a beginning of the gripping of the projectile 434 into the notches of the multifunctional cartridge 26. During this period the following processes occur:

after striking the cocking piece 49B on the percussion piston 17, the percussion piston 17 breaks the primer with anvil 435 inside the igniter block 436 and the force flame 437 ignites the propellant 433 (solid, liquid, gaseous). Gases 438 begin to be exhausted with high temperature and pressure. Wherein said igniter block 436 under the action of gases 438 presses on the percussion piston 17. The percussion piston 17 moves and selects the gap 443 formed between the cylindrical piston 123 of the percussion piston 17 and the internal surface of the stout wall 116 of the conical bushing of the bolt 18. The thickness T443 of the gap 443 depends on many quantities and is set by calculation in each specific case, while the next condition, that the received impulse I should be sufficient for the operation of the weapon's automation is followed. After the gap 443 is selected, the cylindrical piston 123 of the percussion piston 17 under the action of gases 438 will press the conical bushing of the bolt 18 to the glazed area 140 of the shutter housing 19, thereby blocking the leakage of gases 438 into the receiver 30. The impulse caused by moves of the percussion piston 17 through the safety catch 20 is transmitted to the bolt carrier 12A, which will operate a weapon automation. When the gas pressure P0 reaches the forcing pressure, the projectile 434 by its leading cylindrical part 440 starts to gripping into the notches of the multifunctional cartridge 26. At this point, the gap 441 between the rear cylindrical part 442 of the projectile 434 and the internal surface of the multifunction cartridge 26 begins to decrease and the projectile 434 begins to move forward. The thickness T441 of the gap 441 depends on many dimensions and is established by calculation in each particular ammunition.

FIG. 108 showing an operation of the weapon 1A and 1B or 1C in the ignition time 444. The ignition time 444 lasts from the beginning of the gripping of the leading cylindrical part 440 of the projectile 434 in the multifunctional cartridge 26 to full output of the projectile 434 from the multifunctional cartridge 26. During this period following processes occur:

1. Obturation. With a sharp increase of the pressure in the projectile chamber 439 for propellant in the space of the multifunctional cartridge 26 the gases 438 under the high pressure press the igniter block 436 to the cylindrical piston 123. Thus, blocking gases 438 from breaking into the central cylindrical channel 141 of the shutter housing 19. The gases 438 bypass the igniter block 436 and enter the space formed by the blind conical hole 114 of the conical bushing 18 and the cylindrical piston 123. Since the gases 438 act in all directions, one part of the gases 438 presses the stout wall 116 of the conical bushing of the bolt 18 which is pressed against the glazed area 140 of the shutter housing 19. This prevents the breakthrough of the gases 438 in the weapon. Another part of the gases 438 presses against the walls in the blind conical hole 114 of the conical bushing of the bolt 18 and on the conical bushing of the receiver 27. Gases 438 press on the cylindrical piston 123, which with its end blocks gas leak 438 between the percussion piston 17 and the through hole 115 of the conical bushing of the bolt 18.

2. Cutting. The projectile 434 passes through the notches of the multifunctional cartridge 26, wherein the screw channels 445 are gripping on the projectile 434. The projectile 434 receives the required speed rotation for stable flight. At the moment of the projectile 434 release beyond the threaded part of the multifunctional cartridge 26, the pressure P of the gas 438 has a maximum value, a maximum temperature T and 70% of the muzzle velocity V0 of the projectile. The burning process of the propellant 433 (solid, liquid, gaseous) will be completed. Under the action of the gas pressure 438, the walls of the projectile 434 deform and the gap 441 between the rear cylindrical part 442 of the projectile 434 and the internal surface of the multifunctional cartridge 26 is closed. Gases 438 in the projectile chamber 439 for the propellant forge the walls of the projectile 434. The chips formed from the creation of screw channels 445 on projectile 434, blown by gases 438 through screw channels 445 of projectile 434 and partially removed by gases 438 behind projectile 434. If gas pressure 438 exceeds the allowable, the conical bushing of the bolt 18 cracks, allowing the gasses 438 to exhausted. This safety measure protects a weapon and a shooter. For further use of the weapon, it is necessary to replace the conical bushing of the bolt 18. The cracks are also possible in the multifunctional cartridge 26 when the gas pressure 438 is increased. For further use of the weapon, it is necessary to replace the multifunctional cartridge 26.

FIG. 20, FIG. 109, FIG. 110 (where unit A is shown in FIG. 109) showing the operation of the weapon in the barrel time 446. The barrel time 446 lasts from the exit of the projectile 434 from the threaded part of the multifunctional cartridge 26 to the rear part of the projectile 434 reached the inclined holes 147 of the balancing gear 22. During this period, the following process occurs:

1. For the magazine weapon 1A, when the projectile 434 passes through the smooth channel of the barrel 24, the gases 438 partially blow out the chips formed by gripping the screw channels 445 of the projectile 434. Additionally, the gases 434 create the gas blanket 447 because of the gap 448 formed by notches on the projectile 445, reducing the friction of the projectile 434 on the smooth surface of the channel of the barrel 24. The thickness T448 of the gap 448 is equal to the height of the notches on the projectile 434. In the barrel time 446, the highly compressed and heated gases 438 expand and put the pressure on the projectile 434, increasing its velocity V446 up to 98% of the initial velocity V0 of the projectile 434. The decrease in gas pressure 438 in the barrel time 446 occurs sharply with a curvilinear dependence.

2. For the semi-automatic weapon 1B, an impulse I received in the lock time 432 rolls back the bolt carrier 12A. The opening of the shutter housing 19 will occur only after the gas pressure 438 reaches a safe level by selecting the free running gap 449 formed between the outer leading edge 103 of the cam slot 97 of the bolt carrier 12A and the outer sideway front scarf 137 on the leading protrusion 132 of the shutter housing 19. Wherein this bolt carrier 12A unlocks the shutter housing 19, cocks the cocking piece 49B and fixes it on the sear of the single-shot sear 42, compresses the returnable spring 16 on the guide rod 15 and locks in the rear position of the receiver cover 7. Then returnable spring 16 expands and pushes the bolt carrier 12A. The bolt carrier 12A by leading edge 99 presses against the leading protrusion 132 of the shutter housing 19 and the bolt 61 entrains forward. Rolling occurs. At the same time, the conical bushing of the bolt 18 when passing through the magazine 6 captures the next caseless ammunition 59 and sends it to the multifunctional cartridge 26. The bolt 61 stops in the extreme forward position, firstly left the leading edge 99 of the bolt carrier 12A and falls on the edge 100 of the cam slot 97 of the bolt carrier 12A. The bolt carrier 12A, with the edge 100 turns the bolt 61, while the locking lugs 129 of the shutter housing 19 enter the cylindrical groove 207 of the barrel chamber 173 and lock the bolt 61. Wherein, the bolt carrier 12A continues to move forward, increasing the free running gap 449, at the same time the cocking piece 49B is held on the sear of a single-shot sear 42 and the next shot will not occur. For the next shot, release and press the trigger bar for semi-automatic fire 39A, then another shot will occur. The thickness T449 of the gap 449 depends on many dimensions and is established by calculation in each specific case.

3. For automatic weapon 1C in the mode of semi-automatic fire, an impulse I received in the lock time 432, rolls back the bolt carrier 12B. The opening of the shutter housing 19 will occur only after the gas pressure 438 reaches a safe level by selecting the free running gap 449 formed between the outer leading edge 103 of the cam slot 97 of the bolt carrier 12B and the outer sideway front scarf 137 on the leading protrusion 132 of the shutter housing 19. When this bolt carrier 12B unlocks the shutter housing 19, cocks the cocking piece 49B and fixes it on the multifunction switch 43, compresses the returnable spring 16 on the guide rod 15 and locks in the rear position of the receiver cover 7. Then, the returnable spring 16 expands and pushes the bolt carrier 12B. The bolt carrier 12B with leading edge 99 presses against the leading protrusion of the slide of the bolt 132 and entrains the shutter housing 19 forward. Rolling occurs. Wherein, the conical bushing of the bolt 18, passing through the magazine 6, captures the next caseless ammunition 59 and delivers it to the multifunctional cartridge 26. The bolt 61 stops in the extreme forward position, first moving from the leading edge 99 of the slide frame 12B, and falls on the edge 100 of the cam slot 97 of the bolt 12B. The bolt carrier 12B with the edge 100 rotates the shutter housing 19, while the locking lugs 129 of the shutter housing 19 enter in the cylindrical groove 207 of the barrel chamber 173 and lock the bolt 61. Wherein, the bolt carrier 12B continues to move forward and increasing the free running gap 449. Wherein, the hook-shaped protrusion 85 of the bolt carrier 12B passes on the top of the multifunction switch 43. Wherein the cocking piece 49B is held on the multifunction switch 43 and the next shot will not occur. For the next shot, release and press the trigger bar for automatic fire 39B and then another shot will occur. The thickness T449 of the gap 449 depends on many quantities and is established by calculation in each specific case, 4. For the automatic weapon 1C the impulse I, received in the lock time 432, rolls back the bolt carrier 12B. The opening of the shutter housing 19 will occur only after the gas pressure 438 reaches a safe level by selecting the free running gap 449 formed between the outer leading edge 103 of the cam slot 97 of the bolt carrier 12B and the outer sideway front scarf 137 on the leading protrusion 132 of the shutter housing 19. Wherein, the bolt carrier 12B unlocks the shutter housing 19, cocks the cocking piece 49B and fixes it on the multifunction switch 43, compresses the returnable spring 16 on the guide rod 15 and locks in the rear position of the receiver cover 7. Then, the returnable spring 16 expands and pushes the bolt carrier 12B. The bolt carrier 12B with leading edge 99 presses against the leading protrusion of the slide of the bolt 132 and entrains the shutter housing 19 forward. Rolling occurs. Wherein, the conical bushing of the bolt 18 when passing through the magazine 6 captures the next caseless ammunition 59 and delivers it to the multifunctional cartridge 26. The bolt 61 stops in the extreme forward position, first moving from the leading edge 99 of the slide frame 12B, and falls on the edge 100 of the cam slot 97 of the bolt 12B. The bolt carrier 12B with the edge 100 rotates the bolt 61, while the locking lugs 129 of the shutter housing 19 enter in the cylindrical groove 207 of the barrel chamber 173 and lock the bolt 61. Wherein, the bolt carrier 12B continues to move forward and increasing the free running gap 449. Wherein, the hook-shaped protrusion 85 of the bolt carrier 12B removes the multifunction switch 43 from the cocking piece 49B and the cocking piece 49B strikes the percussion piston 17 making another shot. The thickness T449 of the gap 449 depends on many dimensions and is established by calculation in each specific case.

FIG. 111, FIG. 112, FIG. 113 showing an operation of the weapon in the transitional period 450. The transitional period 450 lasts from the moment when the projectile 434 reached the inclined holes 147 of the balancing gear 22 until the gases 438 stop to exert force on the projectile 434. During this period, the following process occurs:

The gases 438 passes through the inclined holes 147 of the balancing gear 22 to the outside. The projectile 434 reaches a higher initial velocity Vmax near twenty centimeters from the face of the muzzle of the balancing gear 22. The transitional period 450 ends when the gas pressure 438 on the projectile 434 is balanced with atmospheric pressure. After the ejection of the projectile 434 from the barrel 24, the incoming airflow 451 enters the screw channels 445 on the projectile 434, and passing through them at high speed and creates the reaction 452, which gives an additional rotation of the projectile 434 around its longitudinal axis. Thus, the stability of the projectile 434 is improved throughout the entire flight path. When the gases 438 exhausted from the barrel 24, some of the gases 438 remaining in the space formed by the blind conical hole 114 on conical bushing of the bolt 18 and the cylindrical piston 123 will tear the igniter block 436 from the percussion piston 17 and throw it out of the barrel 24 after the projectile 434.

FIG. 20A, FIG. 20B, FIG. 106, FIG. 107, FIG. 108, FIG. 109, FIG. 110, FIG. 111, FIG. 112, FIG. 113 showing an operation of the caseless weapon when firing, which allows in weapon:

1. Completely remove recoil during magazine shooting. This is achieved due to the curvilinear nature of the gases 438 operation in the barrel time 446 and the operation of the balancing gear 22 during the transitional period 450.

2. To increase efficiency, reduce heat losses and reduce the heating of the barrel 24. This is achieved since the notches force corresponds to the level of the forcing pressure P0, at which the complete burning of the propellant 433 (solid, liquid, gaseous) occurs, as well as the gas pressure Pmax 438 and the maximum discharge temperature T, occurring in the ignition time 444 in a thick-walled, multilayer, multifunctional cartridge 26. In the barrel 24 with the smooth channel 438, the gases expand and cool abruptly, the projectile 434 moves in the smooth channel of the barrel 24 in the gas blanket 447 through the gap 448 with minimal friction and with necessary axial rotation of the projectile 434.

3. To reduce the length of the barrel 24. This is achieved because of the release of all thermal energy occurs in the multifunctional cartridge 26 of the receiver 30 and building up of the basic velocity V0 of the projectile 434 occurs when passing the carbide and refractory threaded groove 165 of the multifunctional cartridge 26. Therefore, the maximum velocity Vmax of the projectile 434 is achieved on the barrel 24 in length twice shorter as with a traditional shot.

4. To reduce the weight and dimensions of the weapon. This is achieved by increasing the operating temperature and operating pressures. This allows creating weapon 1A or 1B or 1C with small dimensions, weight, and high muzzle energy of the shot.

Below are examples of the process of assembling the proposed caseless weapon.

The process of assembling caseless weapons for magazine firing:

01. To assemble the trigger housing 31A by using the right half of the trigger housing 260A, the left half of the trigger housing 261A, lower ventilation bushings 262 via cap screws 263, threaded bushings 264 and threaded bushing with the splineway 265.

02. To install the latch ramrod 56 and the spring of the latch ramrod 57 into the trigger housing 31A.

03. To install the front big nut 32 and the front swivel 33 on the trigger housing 31A.

04. To install the magazine latch 34 into the trigger housing 31A.

05. To assemble the locking mechanism 217 by using the magazine latch pusher 35, the safety spring of the safety catch 36 and the safety catch 37.

06. To install the retainer mechanism 217 in the trigger housing 31A.

07. To install the safety catch 38 in the trigger housing 31A.

08. To assemble the firing mechanism for magazine shot 218 by using the trigger bar for semi-automatic shot 39A and the sear 40, 09. To install the firing mechanism for the magazine firing 218 with the spring of the trigger bar 41 in the trigger housing 31A (for magazine firing).

10. To assemble the percussion mechanism 221 (for magazine firing) by using the bracket of the percussion mechanism 46, the axis of the cocking piece 47, the spiral mainsprings 48 and the cocking piece 49A.

11. To install the percussion mechanism 221 (for magazine firing) in the trigger housing 31A (for magazine firing).

12. To install the spring washer of the balancing gear 23 and the balancing gear 22 on the barrel 24.

13. To install the conical bushing of the receiver 27 in the receiver 30.

14. To install the multifunctional cartridge 26 into the receiver 30.

15. To install the barrel 24 in the receiver 30 and fix it with the barrel latch 25.

16. To install the extractor 28 in the receiver 30 fixing it with the lock washer of the extractor 29.

17. To assemble the multifunction latch 64 by using the multifunction latch lever 52, the multifunction latch stop 53, the lock pin splint 54 and the spring of the lock pin splint 55.

18. To install receiver with mechanisms 62 in the trigger housing with mechanisms 63A and fix it with multifunction latch 64.

19. To assemble the cover of the receiver with the mechanisms 60 by using the cover of the receiver 7, cocking lever 8, axis of the cocking lever 9, lock washer of the cocking lever axis 10, spring of the cocking lever 11.

20. To assemble the bolt 61 by using the percussion piston 17, the conical bushing of the bolt 18, the shutter housing 19, the safety catch of the firing percussion 20 and the spring of the firing percussion 21.

21. To install the bolt 61 in the bolt carrier 12A (for magazine firing).

22. To assemble the bolt carrier 12A (for magazine firing) with the bolt 61, the spring of the rod 14, the rod 13.

23. To install the spring of the rod 14, the rod 13 and the bolt carrier 12A (for magazine shot) with the bolt 61 into the receiver cover with mechanisms 60.

24. To assemble the weapon 1A (for magazine firing), install the receiver cover with mechanisms 60 with the bolt carrier 12A (for magazine firing) with the bolt 61, the spring of the rod 14 and the rod 13 into the receiver housing with the mechanisms 62.

25. To install the ramrod 58 on the weapon 1A.

26. Using the front sight bracket 310, the front sight 311 to assemble the removable front-sight 2 and mount on the weapon 1A via the fastening screw 312 and cylindrical nut 313.

27. Using the bracket 314, the adjusting screw 315, the impeller with the diopter holes 316, the conical spring 317, the retainer screw 318 to assemble the removable diopter sight 3 and mount on the weapon 1A via the fastening screw 312 and cylindrical nut 313.

28. Using the body 351, the front handle cover with the thread 352, the locking pin 353, the locking pin head 354, the splint pin of the locking pin 355, and the locking pin spring 356 to assemble the front handle 4 and attach said front handle 4 to the weapon 1A.

29. Using the bracket of the gunstock 366, the bushing of the gunstock axis 367, the axis of the gunstock 368, the pin of the gunstock axis 369, the spring of the gunstock axis 370, the gunstock base 371, adjustment lever 372, the axis of the adjustment lever 373, the spring of the adjustment lever 374, the body of the gunstock 375 and the smooth gunstock plate 376 to assemble the gunstock 5 and install the said gunstock 5 on the weapon 1A.

30. To equip the magazine 6 with the ammunition 59 and insert it into the weapon 1A.

31. To transfer the safety latch 38 to the "fire" mode.

32. To distort the receiver cover 7 and the caseless weapon 1A for magazine shot is ready to fire.

The assembling process of the caseless weapons for the semi-automatic firing 1B:

01. To assemble the trigger housing 31B by using the right half of the trigger housing 260A, the left half of the trigger housing 261B, lower ventilation bushings 262 via the cap screws 263, threaded bushings 264 and threaded bushing with the splineway 265.

02. To install the latch ramrod 56 and the spring of the latch ramrod 57 into the trigger housing 31B.

03. To install the front big nut 32 and the front swivel 33 on the trigger housing 31B.

04. To install the magazine latch 34 into the trigger housing 31B.

05. To assemble the retainer mechanism 217 by using the magazine latch pusher 35, the safety spring of the safety catch 36 and the safety catch 37.

06. To install the retainer mechanism 217 in the trigger housing 31B.

07. To install the safety catch 38 in the trigger housing 31B.

08. To install the slide stop 50 with the spring of the slide stop 51 in the trigger housing 31B.

09. Using the trigger bar for semi-automatic shot 39A, sear 40, single-shot sear 42 and trigger bar spring 45 to assemble the firing mechanism for semi-automatic firing 219.

10. To install the firing mechanism for semi-automatic firing 219 with the spring of the trigger bar 41 in the trigger housing 31B (for semi-automatic firing).

11. To assemble the percussion mechanism 222 (for semi-automatic and automatic firing) by using the bracket of the percussion mechanism 46, the axis of the cocking piece 47, the spiral mainsprings 48 and the cocking piece 49B.

12. To install the percussion mechanism 222 (for semi-automatic and automatic firing) in the trigger housing 31B (for semi-automatic firing).

13. To install the spring washer of the balancing gear 23 and the balancing gear 22 on the barrel 24.

14. To install the conical bushing of the receiver 27 in the receiver 30.

15. To install the multifunctional cartridge 26 into the receiver 30.

16. To install the barrel 24 in the receiver 30, and fixing it with the barrel latch 25.

17. To install the extractor 28 in the receiver 30, fixing it with the lock washer of the extractor 29.

18. To assemble the multifunction latch 64 by using the multifunction latch lever 52, the multifunction latch stop 53, the lock pin splint 54 and the spring of the lock pin splint 55.

19. To install the receiver with mechanisms 62 in the trigger housing with mechanisms 63B and fixing with the multifunction latch 64.

20. To assemble the cover of the receiver with the mechanisms 60 by using the cover of the receiver 7, cocking lever 8, the axis of the cocking lever 9, the lock washer of the cocking lever axis 10, the spring of the cocking lever 11.

21. To assemble the bolt 61 by using the percussion piston 17, the conical bushing of the bolt 18, the shutter housing 19, the safety catch of the firing percussion 20 and the spring of the firing percussion 21.

22. To install the bolt 61 in the bolt carrier 12A (for semi-automatic firing).

23. To assemble the bolt carrier 12A (for semi-automatic firing) with the bolt 61, returnable spring 16 and guide rod of the returnable spring 15.

24. To install the bolt carrier 12A with the bolt 61, the returnable spring 16 and guide rod of the returnable spring 15 into the receiver cover with mechanisms 60.

25. To assemble the weapon 1B (for semi-automatic firing), install the receiver cover with mechanisms 60 with the bolt carrier 12A with the bolt 61, the returnable spring 16 and the guide rod of the returnable spring 15 into the receiver housing with the mechanisms 62.

26. To install the ramrod 58 on the weapon 1B.

27. Using the front sight bracket 310, the front sight 311 to assemble the removable front-sight 2 and mount on the weapon 1B via the fastening screw 312 and cylindrical nut 313.

28. Using the bracket 314, the adjusting screw 315, the impeller with the diopter holes 316, the conical spring 317, the retainer screw 318 to assemble the removable diopter sight 3 and mount it on the weapon 1B via the fastening screw 312 and cylindrical nut 313.

29. Using the body 351, the front handle cover with the thread 352, the locking pin 353, the locking pin head 354, the splint pin of the locking pin 355 and the locking pin spring 356 to assemble the front handle 4 and attach said front handle 4 to the weapon 1B.

30. Using the bracket of the gunstock 366, the bushing of the gunstock axis 367, the axis of the gunstock 368, the pin of the gunstock axis 369, the spring of the gunstock axis 370, the gunstock base 371, adjustment lever 372, the axis of the adjustment lever 373, the spring of the adjustment lever 374, the body of the gunstock 375 and the smooth gunstock plate 376 to assemble the gunstock 5 and install the gunstock 5 on the weapon 1B.

31. To equip the magazine 6 with the caseless ammunition 59 and insert it into the caseless weapon 1B.

32. To transfer the safety latch 38 to the "fire" mode.

33. To distort the receiver cover 7 and the caseless weapon 1B for semi-automatic firing is ready to fire.

The process of assembling caseless weapons for automatic firing:

01. To assemble the trigger housing 31C by using the right half of the trigger housing 260C, the left half of the trigger housing 261B, lower ventilation bushings 262 via the cap screws 263, threaded bushings 264 and threaded bushing with the splineway 265.

02. To install the latch ramrod 56 and the spring of the latch ramrod 57 into the trigger housing 31C.

03. To install the front big nut 32 and the front swivel 33 on the trigger housing 31C.

04. To install the magazine latch 34 into the trigger housing 31C.

05. To assemble the retainer mechanism 217 by using the magazine latch pusher 35, the safety spring of the safety catch 36 and the safety catch 37.

06. To install the retainer mechanism 217 in the trigger housing 31C.

07. To install the safety catch 38 in the trigger housing 31C.

08. To install the slide stop 50 with the spring of the slide stop 51 in the trigger housing 31C.

09. Using the trigger bar for automatic shot 39B, sear 40, multifunction switch 43, axis of the multifunction switch 44 and trigger bar spring 45 to assemble the firing mechanism for automatic firing 220.

10. To install the firing mechanism for automatic shot 220 with the spring of the trigger bar 41 in the trigger housing 31C (for automatic firing).

11. To assemble the percussion mechanism 222 (for semi-automatic and automatic firing) by using the bracket of the percussion mechanism 46, the axis of the cocking piece 47, the spiral mainsprings 48 and the cocking piece 49B.

12. To install the percussion mechanism 222 (for semi-automatic and automatic firing) in the trigger housing 31C (for automatic firing).

13. To install the spring washer of the balancing gear 23 and the balancing gear 22 on the barrel 24.

14. To install the conical bushing of the receiver 27 in the receiver 30.

15. To install the multifunctional cartridge 26 in the receiver 30.

16. To install the barrel 24 in the receiver 30 and fixing it with the barrel latch 25.

17. To install the extractor 28 in the receiver 30, fixing it with the lock washer of the extractor 29.

18. To assemble the multifunction latch 64 by using the multifunction latch lever 52, the multifunction latch stop 53, the lock pin splint 54 and the spring of the lock pin splint 55.

19. To install the receiver with mechanisms 62 in the trigger housing with mechanisms 63C and fixing it with multifunction latch 64.

20. To assemble the cover of the receiver with the mechanisms 60 by using the cover of the receiver 7, the cocking lever 8, the axis of the cocking lever 9, the lock washer of the cocking lever axis 10, the spring of the cocking lever.

21. To assemble the bolt 61 by using the percussion piston 17, the conical bushing of the bolt 18, the shutter housing 19, the safety catch of the firing percussion 20 and the spring of the firing percussion 21.

22. To install the bolt 61 in the bolt carrier 12B (for automatic firing).

23. To assemble the bolt carrier 12B (for automatic firing) with the bolt 61, returnable spring 16 and guide rod of the returnable spring 15.

24. To install the bolt carrier 12B with the bolt 61, the returnable spring 16 and the guide rod of the returnable spring 15 into the receiver cover with mechanisms 60.

25. To assemble the weapon 1C (for automatic firing), install the receiver cover with mechanisms 60 with the bolt carrier 12B with the bolt 61, the returnable spring 16 and the guide rod of the returnable spring 15 into the receiver housing with the mechanisms 62C.

26. To install the ramrod 58 on the weapon 1C.

27. Using the front sight bracket 310 and the front sight 311 to assemble the removable front-sight 2 and mount it on the weapon 1C via the fastening screw 312 and the cylindrical nut 313.

28. Using the bracket 314, the adjusting screw 315, the impeller with the diopter holes 316, the conical spring 317, the retainer screw 318 to assemble the removable dioptrical sight 3 and mount on the weapon 1C via the fastening screw 312 and cylindrical nut 313.

29. Using the body 351, the front handle cover with the thread 352, the locking pin 353, the locking pin head 354, the splint pin of the locking pin 355 and the locking pin spring 356 to assemble the front handle 4 and attach said front handle to the weapon 1C.

30. Using the bracket of the gunstock 366, the bushing of the gunstock axis 367, the axis of the gunstock 368, the pin of the gunstock axis 369, the spring of the gunstock axis 370, the gunstock base 371, the adjustment lever 372, the axis of the adjustment lever 373, the spring of the adjustment lever 374, the body of the gunstock 375 and the smooth gunstock plate 376 to assemble the gunstock 5 and install the gunstock 5 on the weapon 1C.

31. To equip the magazine 6 with the caseless ammunition 59 and insert it into the caseless weapon 1C.

32. To transfer the safety latch 38 to the "fire" mode.

33. To distort the receiver cover 7 and the caseless weapon 1C for automatic shot is ready to fire.

Below are examples of the process of shot by the claimed caseless weapon.

The process of the shot by the caseless weapon 1A for magazine firing:

01. Transfer the safety latch 38 to the "fire" mode.

02. Press the trigger bar 39A and then the cocking piece 49A will fall off the cocked position.

03. Spiral mainsprings 48 rotate the cocking piece 49A, which strikes the percussion piston 17.

04. The percussion piston 17 punctures and breaks the primer with the anvil 435, which ignites the propellant 433 (solid, liquid, gaseous).

05. The propellant 433 (solid, liquid, gaseous) burns with the release of gases 438, high temperature and pressure.

06. The projectile 434 is rifling acquiring axial rotation, and picks up the speed.

07. The projectile 434 under the action of gases 438 presses on the percussion piston 17. The percussion piston 17 moves, wherein not transmitting an impulse to the bolt carrier 12A.

08. The projectile 434 flies out of the barrel 24 and the gas pressure 438 on the projectile 434 are balanced with atmospheric pressure. The shot is completed (magazine firing).

09. To continue firing, distort the cover of the receiver 7, while the bolt 61 with the bolt carrier 12A when it is moved rearward will roll up the cocking piece 49A and put it in a cocked position. When the bolt 61 is moving forward and passing through the magazine 6 it picks up the next caseless ammunition 59, sends it to the multifunctional cartridge 26 and locks on the locking lugs 129. The weapon 1A is ready for the next shot.

The process of the shot by the caseless weapon 1B for semi-automatic firing:

01. Transfer the safety latch 38 to the "fire" mode.

02. Press the trigger bar 39B and then the cocking piece 49B will fall off the cocked position.

03. Spiral mainsprings 48 rotate the cocking piece 49B, which strikes the percussion piston 17.

04. The percussion piston 17 punctures and breaks the primer with the anvil 435, which ignites the propellant 433 (solid, liquid, gaseous).

05. The propellant 433 (solid, liquid, gaseous) burns with the exhaust of the gases 438, high temperature and pressure.

06. The projectile 434 is rifling acquiring axial rotation, and picks up the speed.

07. The projectile 434 under the action of gases 438 presses on the percussion piston 17. The percussion piston 17 moves, wherein not transmitting an impulse to the bolt carrier 12A.

08. The projectile 434 flies out of the barrel 24 and the gas pressure 438 on the projectile 434 are balanced with the atmospheric pressure.

09. The bolt carrier 12A with the shutter 61 is moved rearward.

10. The bolt carrier 12A compressing the returnable spring 16 and hits the bushing 67 of the receiver cover 7. When the returnable spring 16 is released, the bolt carrier 12A starts to move forward.

11. The bolt 61 with the bolt carrier 12A, passing through the magazine 6, picks up the next caseless ammunition 59, sends it to the multifunctional cartridge 26 and locks the bolt 61 with the locking lugs 129. The shot is completed (semi-automatic shot). To continue the semi-automatic shot, release and press on the trigger housing 31A.

12. After using all the caseless ammunition 59 in the magazine 6, the bolt 61 becomes on the slide stop 50. To continue the firing, change the magazine 6, remove it from the slide stop 50 by clicking on slide stop.

The process of the shot by the caseless weapon 1C for automatic shot:

01. Transfer the safety latch 38 to the "fire" mode.

02. Press the trigger bar 39B and then the cocking piece 49B will fall off the cocked position 03. Spiral mainsprings 48 rotate the cocking piece 49B, which strikes the percussion piston 17.

04. The percussion piston 17 punctures and breaks the primer with the anvil 435, which ignites the propellant 433 (solid, liquid, gaseous).

05. The propellant 433 (solid, liquid, gaseous) burns with the release of the gases 438, high temperature and pressure.

06. The projectile 434 is rifling, acquiring axial rotation, and picks up the speed.

07. The projectile 434 under the action of gases 438 presses on the percussion piston 17. The percussion piston 17 moves, wherein it is not transmitting an impulse to the bolt carrier 12B.

08. The projectile 434 flies out of the barrel 24 and the gas pressure 438 on the projectile 434 are balanced with the atmospheric pressure.

09. The bolt carrier 12B with the shutter 61 is moved rearward.

10. The bolt carrier 12B compressing the returnable spring 16 and hits the bushing 67 of the receiver cover 7. When the returnable spring 16 is released, the bolt carrier 12B starts to move forward.

11. The bolt 61 with the bolt carrier 12B, passing through the magazine 6, picks up the next caseless ammunition 59, sends it to the multifunctional cartridge 26 and locks the bolt 61 with the locking lugs 129. At this time, the bolt carrier 12B with hook-shaped protrusion 85 shifts the multifunction switch 43 and releasing the cocking piece 49B. The spiral mainsprings 48 rotate the cocking piece 49B, which strikes the percussion piston 17. Another shot occurs.

12. After using all the caseless ammunition 59 in the magazine 6, the bolt 61 becomes on the slide stop 50. To continue the firing, change the magazine 6, remove from the slide stop 50 by clicking on it.

The claimed new weapon easily adapts to the various types of weapons (pistol, submachine gun, assault rifle, light machine gun, medium machine gun), can be applied for the army, police, hunting, sport and works with maximum efficiency.

The invention claimed is:

1. A caseless magazine weapon (1A), which contains a receiver cover (7), and interacts with a receiver (30), and a bolt carrier (12A) which is configured to reciprocate in a channel guide (178), in which a bolt is mounted (61), which is configured to reciprocate and rotate about an axis, wherein said receiver (30) mounted in a trigger housing (31A) and fixed by multifunction latch (64), a magazine (6) is mounted in the trigger housing (31A) and interacting with the magazine latch (34), and a conical bushing of the receiver (27) is mounted in the receiver (30) and a multifunctional cartridge (26) is mounted on said conical bushing of the receiver (27);

a barrel (24), at the front end of which spring-loaded washer of the balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacting with the bolt carrier (12A);

fixed forepart in the trigger housing (31A) a big front nut (32), with the front swivel (33) mounted on it, a ramrod (58), fixed in the trigger housing (31A) and in the receiver (30), and interacting with the latch of the ramrod (56), which is spring-loaded by spring of the latch of the ramrod (57) and mounted in the trigger housing (31A);

a safety catch (38), spring-loaded through safety latch (37) by the safety latch spring (36), which is located in the trigger housing (31A), and configured to reciprocate;

a trigger bar for a semi-automatic weapon (39A), configured together with a sear (40) and affected by the spring of the trigger bar (41) has the possibility to reciprocate in the trigger housing (31A), wherein said spring of the trigger bar (41) is configured to compress and expand in the trigger housing (31A);

a percussion mechanism (221) for magazine shot is fixed in the trigger housing (31A), and comprising a bracket of the percussion mechanism (46), a cocking piece (49A) with a cocking indicator mounted on the axis of the cocking piece (47), and a spiral mainspring (48), wherein said cocking piece (49A) is spring-loaded with the spiral mainspring (48), and interacting with enlargement (84) of the bolt carrier (12A) and the sear (40);

a removable adjustable front sight (2), a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with a stock (13), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12A) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12A), mounted on the axis of the cocking lever (9), which is fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12A);

magazine latch (34) configured to rotate and spring-loaded through magazine latch pusher (35) by safety spring retaining pin (36);

the bolt carrier (12A) comprises the bar, the lower part of which has the form of a trapezoidal section (83), and enlargement (84), which configured to interact with the cocking piece (49A) and disposed in the rear part of a trapezoidal section (83);

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) and blind hole (93) disposed within upper part of the bar (82), and said blind hole (93) configured to interaction between the operating rod spring (14) and the rod (13);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12A) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102), and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (d120) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) has a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in junction point between the cylindrical section (125) and the thickened cylindrical section (126) the stepped protrusion is disposed therein, which comprising the base (131) and the leading protrusion (132), configured to interact with cam slot (97) of the bolt carrier (12A), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7), and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of the lower part of the receiver (181);

a stop (185) with a rear swivel (189) and the cross through hole (186), which configured to interact with the multifunction latch (64) and two vertical threaded holes, wherein said stop is mounted on the rear part of the receiver (181) below via screws (188);

the lower part of the bracket (190) containing threaded holes (191) for fastening the bracket (190) to the lower part of the receiver (181) with the screws (192) and a longitudinal hole (193), which configured to interact with a ramrod (58);

a threaded hole disposed (194) on top of the bracket (190), for fastening the rear sight rail (196) with the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) with screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12A) and the shutter housing (19), and in said consoles (215) in which the cross threaded holes (179) for cap screws (184) to connecting with the barrel chamber (173) with the lower part of the receiver (181), wherein the upper grooves (216) disposed on the external surface of the cylindrical part (204), configured to interact with the receiver cover (7);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31A) to press the front swivel (33) to the trigger box (31A), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31A) comprising the right half of the trigger box (260A) and left half of the trigger box (261A), which are connected to each other by the cap screws (263) with threaded bushings (264) and a threaded bushing with a splineway (265), and lower ventilation bushings (262) disposed on the sides of said trigger box (31A) in the lower part, wherein the right half of the trigger box (260A) and the left half of the trigger box (261A) form the pistol grip (268) of the trigger box (31A), and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) by cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allow the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on another side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

2. A caseless magazine weapon (1B), which contains a receiver cover (7), and interacts with a receiver (30), and a bolt carrier (12A) which is configured to reciprocate in a channel guide (178) of the receiver (30), in which a bolt is mounted (61), which is configured to reciprocate and rotate about an axis, wherein said receiver (30) mounted in a trigger housing (31B) and fixed by multifunction latch (64), a magazine (6) is mounted in the trigger housing (31B) and interacting with the magazine latch (34), and a conical bushing of the receiver (27) is mounted in the receiver (30) and a multifunctional cartridge (26) is mounted on said conical bushing of the receiver (27);

a barrel (24), at the front end of it spring-loaded washer of a balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacts with the bolt carrier (12A);

fixed forepart in the trigger housing (31A) a big front screw (32), with the front swivel (33) mounted on it, a ramrod (58), fixed in the trigger housing (31B) and in the receiver (30), and interacting with the latch of the ramrod (56), which is spring-loaded by spring of the latch of the ramrod (57) and mounted in the trigger housing (31B);

a safety catch (38), spring-loaded through safety latch (37) by the safety latch spring (36), which is located in the trigger housing (31B), and configured to reciprocate;

a trigger bar for a semi-automatic weapon (39A), configured together with a sear (40) and affected by the spring of the trigger bar (41) has the possibility to reciprocate in the trigger housing (31B), in which a single-shot sear (42) is disposed within, which is spring-loaded by trigger bar spring (45);

wherein said spring of the trigger bar (41) is configured to compress and expand in the trigger housing (31B);

a percussion mechanism (222) for semi-automatic and automatic shot is fixed in the trigger housing (31B), and comprising a bracket of the percussion mechanism (46), a cocking piece (49B) with a cocking indicator mounted on the axis of the cocking piece (47), and a spiral mainspring (48), wherein said cocking piece (49B) is spring-loaded with the spiral mainspring (48), and interacts with enlargement (84) of the bolt carrier (12A) the sear (40) and single-shot sear (42);

spring-loaded with spring of a slide stop (51), a slide stop (50), which is mounted in the trigger housing (31B), and has the possibility of angular bias, and interacting with locking lug (129) and the shutter housing (19);

a removable adjustable front sight (2), a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with the guide rod of a returnable spring (15), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12A) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12A), mounted on the axis of the cocking lever (9), which fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12A);

magazine latch (34) configured to rotate and spring-loaded through magazine latch pusher (35) by safety spring retaining pin (36);

the bolt carrier (12A) comprises the bar, the lower part of which has the form of a trapezoidal section (83), and enlargement (84), which configured to interact with the cocking piece (49B) and disposed in the rear part of a trapezoidal section (83);

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) configured for the guide rod of a returnable spring (15) reciprocation and blind hole (93) disposed within upper part of the bar (82), and said blind hole (93) configured to interaction between the returnable spring (16) and guide rod of a returnable spring (15);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12A) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102) and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (d120) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the percussion piston (17) is configured with a gap (443), which is made between cylindrical piston (123) of the percussion piston (17) and internal surface of stout wall (116) and conical bushing of the bolt (18);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) configured with a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in the junction point between the cylindrical section (125) and the thickened cylindrical section (126) the stepped protrusion is disposed therein, which comprising the base (131) and the leading protrusion (132), configured to interact with cam slot (97) of the bolt carrier (12A), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7);

and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of lower part of the receiver (181);

a stop (185) with a rear swivel (189) and the cross through hole (186), which configured to interact with the multifunction latch (64) and with two vertical threaded holes, wherein said stop is mounted on the rear part of the receiver (181) below via screws (188);

the lower part of the bracket (190) containing threaded holes (191) for fastening the bracket (190) to the lower part of the receiver (181) via the screws (192) and a longitudinal hole (193), which configured to interact with a ramrod (58);

a threaded hole disposed (194) on top of the bracket (190), for fastening the rear sight rail (196) via the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) via screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12A) and the shutter housing (19), and in said consoles (215) in which the cross threaded holes (179) for cap screws (184) to connecting the barrel chamber (173) with the lower part of the receiver (181), wherein the upper grooves (216) disposed on the external surface of the cylindrical part (204), configured to interact with the receiver cover (7);

the slide stop (50) configured in the form of a plate (241), in front upper part of which protrusion (242) with a hinge (243) in the form of the washer, is disposed therein, a "T" shaped protrusion (244) disposed on the external side of said plate (241), two protrusions upper protrusion (245) and lower protrusion (246) disposed at the end of said plate (241), and protrusion is disposed (247) on the internal side of said plate (241), wherein a hook (248) disposed on the internal side of lever (242);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) is disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31B) to press the front swivel (33) to the trigger box (31B), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31B) comprising the right half of the trigger box (260A) and left half of the trigger box (261B), which are connected to each other by the cap screws (263) with threaded bushings (264) and a threaded bushing with a splineway (265), and lower ventilation bushings (262) disposed on the sides of said trigger box (31B) in the lower part, wherein the right half of the trigger box (260A) and the left half of the trigger box (261B) form the pistol grip (268) of the trigger box (31B), in which a "T" shaped hole is made (271) for interaction with the slide stop (50) and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) via the cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allows the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots disposed at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on another side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

3. A caseless magazine weapon (1C), which contains a receiver cover (7), and interacts with a receiver (30), and a bolt carrier (12B) which is configured to reciprocate in a channel guide (178) of the receiver (30), in which a bolt is mounted (61), which is configured to reciprocate and rotate about an axis, wherein said receiver (30) mounted in a trigger housing (31C) and fixed by multifunction latch (64), a magazine (6) is mounted in the trigger housing (31C) and interacting with the magazine latch (34), and a conical bushing of the receiver (27) is mounted in the receiver (30) and a multifunctional cartridge (26) is mounted on said conical bushing of the receiver (27);

a barrel (24), at the front end of it spring-loaded washer of the balancing gear (23) is put on and the balancing gear (22) is screwed on, and the rear end is screwed in the receiver (30) and fixed with a barrel latch (25);

an extractor (28), fixed in the receiver (30) via lock washer of the extractor (29) and which has the possibility to swing in the receiver (30) about its axis and interacts with the bolt carrier (12B);

fixed forepart in the trigger housing (31C) a big front nut (32), with the front swivel (33) mounted on it, a ramrod (58), fixed in the trigger housing (31C) and in the receiver (30), and interacting with the latch of the ramrod (56), which is spring-loaded by spring of the latch of the ramrod (57) and mounted in the trigger housing (31C);

a safety catch (38), spring-loaded through safety latch (37) by the safety latch spring (36), which is located in the trigger housing (31C), and configured to reciprocate;

a trigger bar for a semi-automatic weapon (39B), configured together with a sear (40) and affected by the spring of the trigger bar (41) has the possibility to reciprocate in the trigger housing (31C), in which the multifunction switch (43) is disposed within, which is spring-loaded through the multifunction switch axis (44) by the trigger spring (45);

wherein said spring of the trigger bar (41) is configured to compress and expand in the trigger housing (31C);

a percussion mechanism (222) for semi-automatic and automatic shot is fixed in the trigger housing (31C), and comprising a bracket of the percussion mechanism (46), a cocking piece (49B) with a cocking indicator mounted on the axis of the cocking piece (47), and a spiral mainspring (48), wherein said cocking piece (49B) is spring-loaded with the spiral mainspring (48), and interacts with enlargement (84) of the bolt carrier (12B), the sear (40) and the multifunction switch (43);

spring-loaded with spring of a slide stop (51), a slide stop (50), which is mounted in the trigger housing (31C), and has the possibility of angular bias and interacting with locking lug (129) and the shutter housing (19);

a removable adjustable front sight (2) a removable adjustable dioptrical sight (3), a forward grip (4), a gunstock (5), wherein, the receiver cover (7) has a box-section body (65), which contains a rear plate (66), and a bushing (67) is disposed inside of the internal side of said rear plate (66), the bushing configured to interact with the guide rod of a returnable spring (15), and a bracket (68) for the cocking lever (8) is disposed on the external side in the front part of body (65), wherein the bracket (68) has the through hole (69) for the axis of the cocking lever (9), and a button (70) in the form of washer with blind hole (71) for the cocking lever spring (11) is disposed in the rear part of bracket (68), wherein a front stop (72) configured to interact with a support platform (96) of the bolt carrier (12B) and disposed within the top of the body (65), and inside of the body (65) protrusion with an interior chamfer (73) disposed outside and configured to interact with an inclined area (254) of multifunction latch (64), wherein the cocking lever (8), which is configured to interact with the receiver (30) and the bolt carrier (12B), mounted on the axis of the cocking lever (9), which fixed by lock washer of the axis of the cocking lever (10);

the cocking lever (8) contains the lever (74), which has a hook (75) in the rear part, wherein hook has rounded end (76) and configured to interact with an inclined protrusion (213) and its cylindrical slot (214) of a barrel chamber (173), and a through hole (77) for the axis of the cocking lever (9) disposed in front lower part of said cocking lever (8), the protrusion in form of a button (78) with a blind hole (79) and a cylindrical protrusion (80) for the cocking lever spring (11) disposed in the front part of lever (74), wherein outer coil of the cocking lever spring (11) is pressed on the cylindrical protrusion (80), and between the hook (75) and through hole (77) inclined protrusion (81) with incline to the hook side (75) disposed therein and configured to interact with the protrusion (88) of the bolt carrier (12B);

magazine latch (34) configured to rotate and spring-loaded through magazine latch pusher (35) by safety spring retaining pin (36);

the bolt carrier (12B) comprises the bar, the lower part of which has the form of a trapezoidal section (83), and in the rear part of a trapezoidal section (83), in which the enlargement (84), which configured to interact with the cocking piece (49B) and a hook-shaped protrusion (85), which interacts with the multifunction switch (43) in the "automatic fire" mode are disposed therein;

the guided protrusions (86) disposed on the side surface of a bar (82), wherein said guided protrusions (86) are configured to interact with a channel guide (178) of the receiver (30), wherein front upper part of the bar (82) shaped in the form of console (87), a protrusion (88) disposed at the top in front of said console (87) and configured to interact with an inclined protrusion (81) of the cocking lever (8), and a slot (89) disposed on the edge in front part of said console (87), wherein a blind hole (90) disposed inside of the lower part of the bar (82) and configured to reciprocate the shutter housing (19), a through hole (91) disposed on the bottom of the blind hole (90) and configured to reciprocate a percussion piston (17), wherein through hole (92) configured for the guide rod of a returnable spring (15) reciprocation and blind hole (93) disposed within upper part of the bar (82), and said blind hole (93) configured to interaction between the returnable spring (16) and guide rod of a returnable spring (15);

an inlet chamfer (94) disposed in front of the trapezoidal section (83) and configured to interact with caseless ammunition (59), the support platform (95) disposed at the beginning of the console (87) near with through hole (92), wherein a support platform (96) disposed on the front part of console (87) and configured to interact with the front stop (72) of receiver cover (7), wherein gap (426) disposed between the support platform (96) of the bolt carrier (12B) and the front stop (72) of receiver cover (7), and cam slot (97) disposed on the lower surface of console (87) and configured to interact with a leading protrusion (132) of the shutter housing (19), wherein said cam slot configured in form of a screwed groove, which has inlet slot (98), leading edge (99), edge (100) for rotation of the shutter housing (19), free running internal edge (101), the support platform (102) and external leading edge (103), wherein edge (100) and external leading edge (103) form an acute angle (104) to the axis of the bolt (105) and measure of an acute angle (d104) is equal to 30-45 degrees, and leading edge (99) and the axis of bolt (105) form a straight angle (106);

the bolt (61) comprises the percussion piston (17) mounted in a conical bushing (18) and put in the central cylinder channel (141) of the shutter housing (19) configured to reciprocate and spring-loaded by spring of the firing percussion (21) and fixed with the safety catch of the firing percussion (20);

the percussion piston (17) configured in stepped shaft form, which has the conical section (118) forepart, which passes into a cylindrical section with smaller diameter (119), wherein an inclined protrusion (120) disposed at the joint of the conical section (118) and the cylindrical section with smaller diameter (119), wherein angle of the protrusion incline (d120) to axis of the firing percussion (121) is equal to 30-45 degrees, and the cylindrical section with smaller diameter (119) passes into the cylindrical section with bigger diameter (122), which passes into the cylindrical piston (123), wherein said piston (123) passes into the rod section with grooves (124);

the percussion piston (17) is configured with a gap (443), which is made between cylindrical piston (123) of the percussion piston (17) and internal surface of stout wall (116) and conical bushing of the bolt (18);

the conical bushing of the bolt (18) configured to rotate on the percussion piston (17) and pressed by the spring of the firing percussion (21) to a glazed area (140) at the end of a cylindrical head (127) of the shutter housing (19), wherein said conical bushing on the bolt (18) configured as a truncated cone (113) with a blind conical hole (114), which comes into a through hole (115), which forms the stout wall (116) at the outlet of big base of the truncated cone (113), and at inlet in the blind conical hole (114) figured not less than three protrusions (117), which are interacting with the caseless ammunition (59);

the shutter housing (19) has a cylindrical section (125), which passes into a thickened cylindrical section (126), which passes into a cylindrical head (127), and through passage from the cylindrical section (125) to the thickened cylindrical section (126), a chamfer (128) is disposed therein, wherein in junction point between the thickened cylindrical section (126) and the cylindrical head (127) a locking lug (129) is disposed thereon in the form of not less than two protrusions, ends of which configured as the radius surfaces (130), wherein in the junction point between the cylindrical section (125) and the thickened cylindrical section (126) the stepped protrusion is disposed therein, which comprising the base (131) and the leading protrusion (132), configured to interact with cam slot (97) of the bolt carrier (12B), and the leading protrusion (132) has a rear leading edge (133), side edge of free running (134) and (135), rear radius chamfers (136), external sideway forepart scarf (137) and external radius section (138), wherein base (131) is at angle to the locking lug (129) and two cylindrical grooves with inclined sides (139) disposed on said base (131), and the glazed area (140) disposed at the end of cylindrical head (127);

a central cylindrical channel (141) disposed within the shutter housing (19) and configured to interact with percussion piston (17), and rear part of the central cylindrical channel (141) has a blind cylindrical hole (142) with bigger diameter, which configured to interact with the firing percussion spring (21) and the safety catch of the firing percussion (20);

a spring washer of the balancing gear (23) configured as a split ring (151) and a three-sided flange (152) on the internal side, and ends of the split ring (151) have bias (153), wherein the measure of bias (T153) is 0.2D23, where D23—is the outer diameter of the spring washer of the balancing gear (23);

the barrel (24) has a smooth conical section (154), which passes into a threaded section (155), which passes into a slot (156), which passes into a cylindrical section with a splineway (157), which passes into the cylindrical section (158) which passes into a multifaceted area (159), which passes into a smooth cylindrical section with a groove (160), wherein the smooth cylindrical section with the groove (160) passes into a circular groove (161), which passes into a threaded section with a buttress thread (162), which passes into a smooth cylindrical section (163), and the internal channel (164) is smooth without rifling, wherein said barrel sections (24) have different thickness;

the multifunctional cartridge (26) comprising a threaded bushing (165), an internal smooth bushing (166), at least one middle bushing (167) and an external bushing with variable diameter (168), which has bigger diameter (169), wherein the threaded bushing (165) configured with two or more undercut grooves and bushings (165), (166), (167) and (168) are inserted into each other with tension;

the conical bushing of the receiver (27) has a cylindrical section (170) which passes into the smaller cylindrical section (171), and a conical hole (172) disposed inside of said conical bushing of the receiver (27) and configured to interact with the conical bushing of the bolt (18), the small base of which is located at the end of the cylindrical section (170);

wherein the receiver (30) comprising:

the barrel chamber (173) which is screwed in with a locking screw of barrel chamber (174) to the lower part of the receiver (181);

a feed ramp (175) configured in the form of a plate with a threaded hole (176) in the middle, and screwed in with a fastening screw of the guide of the projectile (177) to the lower part of the receiver (181);

channel guides (178) with threaded holes (179);

the upper grooves (180), which are disposed on the external surface of the channel guides (178), and configured to interact with the receiver cover (7);

and in the lower part of the receiver (181) holes disposed on the side walls (182), which configured to be fixed with the screws (184) of the barrel chamber (173) and the channel guides (178);

the lower part of the receiver (181) configured in the form of a box-section figure, wherein cam hole (183) disposed on the bottom of lower part of the receiver (181);

a stop (185) with a rear swivel (189) and the cross through hole (186), which configured to interact with the multifunction latch (64) and with two vertical threaded holes, wherein said stop is mounted on the rear part of the receiver (181) below via screws (188);

the lower part of the bracket (190) containing threaded holes (191) for fastening the bracket (190) to the lower part of the receiver (181) via the screws (192) and a longitudinal hole (193), which configured to interact with a ramrod (58);

a threaded hole disposed (194) on top of the bracket (190), for fastening the rear sight rail (196) via the screw (195);

on a rear sight Picatinny-type rail (196) with a dovetail type slot (197), a hole (198) disposed in the middle of the slot (197);

on a front sight Picatinny-type rail (196) with the dovetail type slot (197), the hole (198) disposed in the middle of the slot (197);

a plate (200) on which a hole is disposed in the middle (201), which configured to interact with the extractor (28), and two threaded holes (202) disposed thereon at the edges, which configured for fastening the plate (200) to the lower part of the receiver (181) via screws (203);

the barrel chamber (173) has a cylindrical part (204), and at the end of said cylindrical part (204) within which a multistage cylindrical hole with a threaded section (205) is disposed, which configured to mounting the conical bushing of the receiver (27), the multifunctional cartridge (26) and the barrel (24), wherein at the inlet of said multistage cylindrical hole (205) is a cross threaded hole (206) in the lower part, which is configured to mounting the barrel latch (25), wherein said multistage cylindrical hole (205) passes into the cylindrical groove (207), the lower part of which has a threaded hole (208) for the locking screw of the barrel chamber (174), and the cylindrical groove (207) passes into a complex-shaped section (209), which follows the shape of the front part of shutter housing (19), wherein on the inlet of the complex-shaped section (209) have two leading cylindrical guiding chamfers (210) disposed thereon, and in the middle at the top of the cylindrical section (204) the base with a dovetail-type protrusion (211) disposed therein, in which is disposed the threaded hole (212) for a screw (195) for fastening the front sight rail (199), wherein at the end of the cylindrical part (204) the inclined protrusion (213) disposed thereon, for interaction with the cocking lever (8), and a cylindrical groove (214) disposed on said inclined protrusion (213), wherein the rear end of the cylindrical part (204) has consoles (215) in the form of channel guides, which is configured to interact with the bolt carrier (12B) and the shutter housing (19), and in said consoles (215) in which the cross threaded holes (179) for cap screws (184) to connecting the barrel chamber (173) with the lower part of the receiver (181), wherein the upper grooves (216) disposed on the external surface of the cylindrical part (204), configured to interact with the receiver cover (7);

the slide stop (50) configured in the form of a plate (241), in front upper part of which protrusion (242) with a hinge (243) in the form of the washer, is disposed therein, a "T" shaped protrusion (244) disposed on the external side of said plate (241), two protrusions upper protrusion (245) and lower protrusion (246) disposed at the end of said plate (241), and protrusion is disposed (247) on the internal side of said plate (241), wherein a hook (248) disposed on the internal side of lever (242);

a multifunction latch (64) contains a multifunction latch lever (52), within which a blind hole (258) is disposed, in which a spring of the lock pin splint (55) and a multifunctional latch stop (53) are mounted in series, wherein the lever of the multifunctional latch (52) within which a through cross hole (249) is disposed and the lock pin (54) is mounted, which has spherical ends (250) and a groove in the middle (251), and said lock pin (54) is disposed within the multifunction latch lever (52) and fixed in the through slot (259), the lock pin spring (55) and the multifunction latch stop (53), wherein the multifunction latch stop (53) and a lock pin (54) are configured to reciprocate in the multifunction latch lever (52), wherein the multifunction latch lever (52) is configured in the form of a rod (252), in front of which a lever (253) is disposed therein, and protrusions, rear (256) and front (257) are disposed on the enlargement (255), which disposed at the end of the lever (253), wherein a blind hole (258) disposed in the rod (252) from the side of the lever (253) wherein the through slot (259) disposed in the rod (252);

a big front nut (32) on which the front swivel (33) is mounted thereon, has the possibility of rotation by 360 degrees relative to the axis of the big front nut (32) and is screwed in into the front of the trigger box (31C) to press the front swivel (33) to the trigger box (31C), wherein the big front nut (32) is configured in the form of a truncated cone (223), which passes into a cylindrical section with an external thread (224), and the through hole (225) disposed in said nut;

a front swivel (33) is configured in the form of a ring (226), on the side of which the protrusion (226A) and a sling swivel (227) are disposed in the form of an oval ring;

the latch of the ramrod (56) is configured in the form of a plate (233) with rounded protrusions (234) on the lower part, wherein a through semi-circular hole (235) disposed in the center of the plate (233), and a semi-circular slot (236) is disposed in the lower part of the through hole (235);

the spring of the latch of the ramrod (57) is configured in the form of a flat spring (237), which has through hole (238) at the front end, wherein a bulge (239) is disposed in the middle of the flat spring, and the rear part (240) of the flat spring is rounded;

the trigger box (31C) comprising the right half of the trigger box (260C) and left half of the trigger box (261B), which are connected to each other via the cap screws (263) with threaded bushings (264) and a threaded bushing with a splineway (265), and lower ventilation bushings (262) disposed on the sides of said trigger box (31C) in the lower part, wherein the right half of the trigger box (260B) and the left half of the trigger box (261C) form the pistol grip (268) of the trigger box (31C), in which a "T" shaped hole is made (271) for interaction with the slide stop (50) and a through slot (307), which is made for interaction with the multifunction switch (43), and in the front part they form a threaded hole (266) for interaction with the big front nut (32) and a handguard (267);

the removable adjustable front sight (2) contains a front sight bracket (310) into which the front sight is screwed in (311), wherein the front sight bracket (310) is mounted on the front sight Picatinny-type rail (199) via the cap screw (312) and a cylindrical nut (313);

the front sight bracket (310) contains a plate (319), which passes into a clamp (320), which is configured in the form of a curved plate of a trapezoidal shape, and a complex-shaped through slot (321) follows the shape of the sight Picatinny-type rail is disposed within the plate (319), and a hole (322) disposed on top in the middle of said clamp (320) configured for the thickness of the clamp wall (320), wherein light holes (323) are disposed on the side walls of the clamp (320) at the junction with the plate (319), wherein a threaded hole (324) is disposed on top in the middle of the plate (319), and a cross hole (325) is disposed at the back on the side surface of the plate (319), wherein a through longitudinal slot (326) is disposed behind the threaded hole (324) in front of the wall of the clamp (320) for the entire thickness of the wall plate (319);

a removable adjustable diopter sight (3) contains a bracket (314) within which the adjustment screw (315) is mounted, on which an impeller with diopter holes (316) is put on, which has the possibility to rotate on the adjustment screw (315), and is constantly compressed by a conical spring (317), wherein the retainer screw (318), which is mounted in the bracket (314), fixes the adjustment screw (315) against rotation, wherein the bracket (314) is mounted on the rear sight Picatinny-type rail (196) via the adjustment screw (312) and the cylindrical nut (313);

the adjustment screw (315) has a cylindrical section with a thread (335), which passes into a cylindrical section (336), along the perimeter of which the slots (337) are disposed, wherein the cylindrical section (336) passes into a washer (338), and through slot (339) is slotted in the washer (338) and in the cylindrical section (336);

the impeller with diopter holes (316) is configured with the blades (327) with diopter holes (328) with a through axial hole (329), and a retainer pin (330) is disposed on one of the blades of the impeller (327);

the bracket (314) is configured in the form of a plate (340), which passes into a clamp (341), which is configured in the form of a curved plate of a trapezoidal shape, wherein the complex-shaped through slot (321) is disposed in said plate (340) and follow the form of the sight Picatinny-type rail, wherein a cross hole (349) disposed in front on the side surface of the plate (340), and the hole (342) disposed in the center of the top of the clamp (341) for the thickness of the clamp wall, and on the side walls of the clamp (341) within which a cylindrical protrusion (343), which has a smooth hole (345), and a cylindrical protrusion (344), which has a threaded hole (346) are disposed thereon, and a threaded hole (347) is disposed in the cylindrical protrusion (343) on the side surface of the protrusion for the thickness of the wall, wherein in the side wall of the clamp (341) from the smooth hole side (345) four holes (348) disposed therein, which are at an angle of ninety degrees to each other, and the through longitudinal slot (350) is disposed in front of the wall of the clamp (341) on the entire wall thickness of the plate (340);

wherein the gunstock (5) comprising:

a bracket of the gunstock (366), in which a bushing of the gunstock axis (367) is mounted, in which the spring-loaded with spring of the gunstock axis (370) the gunstock of the axis (368) is mounted, which is fixed via pin of the gunstock axis (369) in the gunstock base (371);

the gunstock axis (368), which combines the gunstock base (371) with the gunstock bracket (366) and allows the gunstock base (371) to fold, wherein the adjustment lever (372) spring-loaded with spring of adjustment lever (374) is mounted in the gunstock base (371) and configured to swing on the axis of the adjustment lever (373) and interacting with the gunstock body (375);

the gunstock bracket (366) is configured in the form of a "T" shaped section (377) with an inclined slot (378), the blind hole (379) and with a locking protrusion (380), and a complex-shaped protrusion (381) is disposed in the upper part on the other side of the "T" shaped section (377) in the form of a cylinder (382) and in the lower part in the form of a protrusion (383), wherein the protrusion (383) configured with inclined sides (384), a horizontal platform (385) and a radius side (386), wherein a through hole (387) is disposed in the protrusion (381);

the gunstock axis (368) is configured in the form of a rod (388), which passes into a rod with smaller diameter (389), while a circular groove (390) is disposed in the rod (388), and two slots disposed at 180 degrees along the rod (388), the longitudinal slot (391) and the blind slot (392) are disposed after the circular groove (390), wherein a splineway (393) is disposed at the beginning of the rod (388);

the gunstock base (371) is configured in the form of a complex-shaped bracket (394) with a "T" shaped protrusion (395), wherein said protrusion (395) has slots (396) for collecting dirt, and behind said protrusion (395) a rectangular slot is disposed therein (397) with the through hole (398) and the blind hole (399), wherein a cross through hole (400) is disposed in the middle of a rectangular slot (397), and at the beginning of the bracket (394) within which an inclined platform (401) and a rectangular slot (402) are disposed thereon, and the upper protrusion (403) and the lower protrusion (404) are mounted thereon, in which the through holes (405) and (406) are mounted, and a through hole (407) is disposed on the side of the lower protrusion (404);

the gunstock adjustment lever (372) is configured in the form of a lever (408), which has a blind hole (409) on one side, and a protrusion (410) with an inclined surface (411) on the other side of the lever (408), wherein a through hole (412) is disposed in the middle of the lever (408);

the gunstock body (375) is put on the base of the gunstock (371) and configured to reciprocate along the base of the gunstock (371) and a smooth recoil pad (376) disposed in the gunstock body (375);

the body of the gunstock (375) is configured in the form of an "L" plate (413) with a protrusion (414), in the rear part of the said plate (413), the complex-shaped hole (415) disposed in front of the protrusion (414), a guide "T" shaped blind slot (416) disposed in front of said plate (413) and has the cross grooves (417), wherein the first cross groove (417) configured with a chamfer (418), which has an negative incline (419), and a rectangular hole (420) disposed in the protrusion (414).

4. The weapon according to claim 1, wherein the rod (13) is configured with the washer with the radial chamfer (107), which passes into cylindrical part (108), which passes into the washer with the radial chamfer (107).

5. The weapon according to claim 2, wherein the guide rod (15) is configured with the spherical head (109), which passes into cylindrical part (110), which via a conical transition (111) passes into cylindrical part (112) with bigger diameter, which passes into the washer with radial chamfer (107).

6. The weapon according to claim 3, wherein the guide rod (15) is configured with the spherical head (109), which passes into cylindrical part (110), which via a conical transition (111) passes into cylindrical part (112) with bigger diameter, which passes into the washer with radial chamfer (107).

7. The weapon according to claim 1, wherein the balancing gear (22) is configured in the form of a cylinder (143), inside of which a smooth cylindrical section (144) is disposed, which passes into a conical section (145), which passes into a cylindrical groove with threaded section (146), and in the front of the cylinder (143) there inclined holes (147) are disposed with an acute angle (148) to the longitudinal axis, and slots (150) are disposed behind the inclined holes (147) on the outer part of the cylinder (143), wherein said inclined holes (147) in the cross-section between them formed an angle (149).

8. The weapon according to claim 2, wherein the balancing gear (22) is configured in the form of a cylinder (143), inside of which a smooth cylindrical section (144) is disposed, which passes into a conical section (145), which passes into a cylindrical groove with threaded section (146), and in the front of the cylinder (143) there inclined holes (147) are disposed with an acute angle (148) to the longitudinal axis, and slots (150) are disposed behind the inclined holes (147) on the outer part of the cylinder (143), wherein said inclined holes (147) in the cross-section between them formed an angle (149).

9. The weapon according to claim 3, wherein the balancing gear (22) is configured in the form of a cylinder (143), inside of which a smooth cylindrical section (144) is disposed, which passes into a conical section (145), which passes into a cylindrical groove with threaded section (146), and in the front of the cylinder (143) there inclined holes (147) are disposed with an acute angle (148) to the longitudinal axis, and slots (150) are disposed behind the inclined holes (147) on the outer part of the cylinder (143), wherein said inclined holes (147) in the cross-section between them formed an angle (149).

10. The weapon according to claim 1, wherein the ramrod (58) is configured in the form of a rod (228), at the front end of which a slotted groove (229) is disposed, which passes into the flat end (230), a groove (232) is disposed in front of the rear end of the rod (228) which is configured in the form of a conical head (231).

11. The weapon according to claim 2, wherein the ramrod (58) is configured in the form of a rod (228), at the front end of which a slotted groove (229) is disposed, which passes into the flat end (230), a groove (232) is disposed in front of the rear end of the rod (228) which is configured in the form of a conical head (231).

12. The weapon according to claim 3, wherein the ramrod (58) is configured in the form of a rod (228), at the front end of which a slotted groove (229) is disposed, which passes into the flat end (230), a groove (232) is disposed in front of the rear end of the rod (228) which is configured in the form of a conical head (231).

13. The weapon according to claim 1, wherein the front sight (311) has a cylindrical section with a thread (331), which passes into a prismatic section (332), which passes into a cylindrical section (333), and a through slot (334) is disposed in the cylindrical section with thread (331).

14. The weapon according to claim 2, wherein the front sight (311) has a cylindrical section with a thread (331), which passes into a prismatic section (332), which passes into a cylindrical section (333), and a through slot (334) is disposed in the cylindrical section with thread (331).

15. The weapon according to claim 3, wherein the front sight (311) has a cylindrical section with a thread (331), which passes into a prismatic section (332), which passes into a cylindrical section (333), and a through slot (334) is disposed in the cylindrical section with thread (331).

16. The weapon according to claim 1, wherein the forward grip (4) comprising a body (351) in which a threaded cover (352) and a retainer spring-loaded with a spring of a locking pin (356) are mounted, and configured in the form of a locking pin (353), which is mounted in the body (351), and at the end of the locking pin (353) coining out of the body (351), a locking pin head (354) is mounted, which is fixed with a splint pin of the locking pin (355).

17. The weapon according to claim 2, wherein the forward grip (4) comprising a body (351) in which a threaded cover (352) and a retainer spring-loaded with a spring of a locking pin (356) are mounted, and configured in the form of a locking pin (353), which is mounted in the body (351), and at the end of the locking pin (353) coming out of the body (351), a locking pin head (354) is mounted, which is fixed with a splint pin of the locking pin (355).

18. The weapon according to claim 3, wherein the forward grip (4) comprising a body (351) in which a threaded cover (352) and a retainer spring-loaded with a spring of a locking pin (356) are mounted, and configured in the form of a locking pin (353), which is mounted in the body (351), and at the end of the locking pin (353) coming out of the body (351), a locking pin head (354) is mounted, which is fixed with a splint pin of the locking pin (355).

19. The weapon according to claim 1, wherein the body (351) is configured with a plate (357), in front of which there are holes (358), (359), wherein the rear end of the plate (357) connected to the conical cylindrical part (360), in which a cavity (361) is formed with a thread (362) at the exit, and on the upper surface in the middle of the plate (357) there are two «L» protrusions (363) and (364) with a slot (365).

20. The weapon according to claim 2, wherein the body (351) is configured with a plate (357), in front of which there are holes (358), (359), wherein the rear end of the plate (357) connected to the conical cylindrical part (360), in which a cavity (361) is formed with a thread (362) at the exit, and on the upper surface in the middle of the plate (357) there are two «L» protrusions (363) and (364) with a slot (365).

21. The weapon according to claim 3, wherein the body (351) is configured with a plate (357), in front of which there are holes (358), (359), wherein the rear end of the plate (357) connected to the conical cylindrical part (360), in which a cavity (361) is formed with a thread (362) at the exit, and on the upper surface in the middle of the plate (357) there are two «L» protrusions (363) and (364) with a slot (365).

22. The weapon according to claim 1, wherein the threaded bushing (165) and the inner smooth bushing (166) are made of carbide and refractory material.

23. The weapon according to claim 2, wherein the threaded bushing (165) and the inner smooth bushing (166) are made of carbide and refractory material.

24. The weapon according to claim 1, wherein the caseless magazine weapon (1A) is additionally equipped with a knife-bayonet (427), which contains a front stop with a ring (428), a handle (431) with a slot (430) and a back stop with a hook-shaped protrusion (429).

25. The weapon according to claim 2, wherein the caseless semi-automatic weapon (1B) is additionally equipped with a bayonet-knife (427), which contains a front stop with a ring (428), a handle (431) with a slot (430) and a back stop with hook-shaped protrusion (429).

26. The weapon according to claim 3, wherein the caseless automatic weapon (1C) is additionally equipped with a bayonet-knife (427), which contains a front stop with a ring (428), a handle (431) with a slot (430) and a back stop with hook-shaped protrusion (429).

* * * * *